US012298096B2

(12) United States Patent
Bundy et al.

(10) Patent No.: US 12,298,096 B2
(45) Date of Patent: May 13, 2025

(54) FIREARM SUPPRESSOR ASSEMBLY, AND APPARATUS AND METHOD FOR AUDIBLE SIGNATURE REDUCTION OF A FIREARM

(71) Applicant: Maxim Defense Industries, LLC, St. Cloud, MN (US)

(72) Inventors: Travis Bundy, Ola, ID (US); Oddbjorn Eken, Meridian, ID (US); Jason Harper, Meridian, ID (US); Patrick Alfred Tamble, Richmond, MN (US)

(73) Assignee: Maxim Defense Industries, LLC, St. Cloud, MN (US)

( * ) Notice: Subject to any disclaimer, the term of this patent is extended or adjusted under 35 U.S.C. 154(b) by 0 days.

(21) Appl. No.: 18/154,821

(22) Filed: Jan. 14, 2023

(65) Prior Publication Data

US 2024/0328738 A1 Oct. 3, 2024

Related U.S. Application Data

(63) Continuation-in-part of application No. 29/823,249, filed on Jan. 14, 2022, now Pat. No. Des. 1,035,816, (Continued)

(51) Int. Cl.
*F41A 21/30* (2006.01)

(52) U.S. Cl.
CPC ..... *F41A 21/30* (2013.01)

(58) Field of Classification Search
CPC ..... F41A 21/30–38
See application file for complete search history.

(56) References Cited

U.S. PATENT DOCUMENTS 2,143,596 A 1/1939 Galliot et al.
2,351,037 A 6/1944 Green
(Continued)

FOREIGN PATENT DOCUMENTS

DE 1020110639 A1 9/2012
DE 202022100864 U1 * 4/2022
(Continued)

OTHER PUBLICATIONS

International Search Report, International Application No. PCT/US2023/060699; mailed Jan. 19, 2024; pp. 3.
(Continued)

*Primary Examiner* — Gabriel J. Klein
(74) *Attorney, Agent, or Firm* — Law Office of Arthur M. Antonelli, PLLC

(57) ABSTRACT

A suppressor for a firearm is disclosed. The suppressor may have a first longitudinal axis and include a mount body for receiving a muzzle of a firearm barrel. The mount body may include a first proximal end, a first distal end spaced from the first proximal end along the first longitudinal axis, a collar adjacent to the first proximal end, and an annular stem adjacent to the first distal end. The annular stem may include a first outer side wall surface which comprises a first screw thread, and a first interior side wall surface which comprises a second screw thread. The suppressor further may include a core connected to the mount body, and a tube disposed over the core and the annular stem. The mount body, core, and tube may form a plurality of chambers for sound signature reduction of a host firearm.

29 Claims, 92 Drawing Sheets

Related U.S. Application Data and a continuation-in-part of application No. 29/823,257, filed on Jan. 14, 2022, and a continuation-in-part of application No. 29/823,258, filed on Jan. 14, 2022, and a continuation-in-part of application No. 29/823,255, filed on Jan. 14, 2022, now Pat. No. Des. 1,036,611, and a continuation-in-part of application No. 29/823,273, filed on Jan. 14, 2022, now Pat. No. Des. 1,050,337, and a continuation-in-part of application No. 29/823,260, filed on Jan. 14, 2022, and a continuation-in-part of application No. 29/823,266, filed on Jan. 14, 2022, now abandoned, and a continuation-in-part of application No. 29/823,253, filed on Jan. 14, 2022.

(60) Provisional application No. 63/384,409, filed on Nov. 18, 2022, provisional application No. 63/299,850, filed on Jan. 14, 2022.

(56) References Cited

U.S. PATENT DOCUMENTS

| | | | | |
|---|---|---|---|---|
| 4,375,136 | A | 3/1983 | Pedgonay | |
| 4,530,417 | A * | 7/1985 | Daniel | F41A 21/30 181/252 |
| 4,813,333 | A | 3/1989 | Garris et al. | |
| 4,893,426 | A | 1/1990 | Bixler | |
| 5,305,677 | A | 4/1994 | Kleinguenther et al. | |
| 5,559,302 | A | 9/1996 | Latka | |
| RE35,381 | E | 11/1996 | Rose | |
| 5,596,161 | A | 1/1997 | Sommers | |
| 5,631,438 | A | 5/1997 | Martel | |
| D384,389 | S | 9/1997 | Cyktich | |
| 5,685,102 | A | 11/1997 | Latka | |
| D415,812 | S | 10/1999 | Andrews, Jr. et al. | |
| D415,813 | S | 10/1999 | O'Quinn et al. | |
| D425,184 | S | 5/2000 | Lidgett | |
| D435,623 | S | 12/2000 | Andrews, Jr. et al. | |
| 6,425,310 | B1 | 7/2002 | Champion | |
| 6,516,698 | B1 | 2/2003 | Poff, Jr. | |
| 6,722,254 | B1 | 4/2004 | Davies | |
| 6,820,530 | B2 | 11/2004 | Vais | |
| D507,619 | S | 7/2005 | Shiloni | |
| D594,082 | S | 6/2009 | O'Quinn | |
| 7,677,150 | B2 | 3/2010 | Dater et al. | |
| D632,751 | S | 2/2011 | Bowers et al. | |
| 7,891,282 | B1 | 2/2011 | DeGroat | |
| 7,905,171 | B1 | 3/2011 | Brittingham | |
| D641,450 | S | 7/2011 | Ding | |
| D642,650 | S | 8/2011 | Oliver | |
| D643,087 | S | 8/2011 | Oliver | |
| 7,987,944 | B1 | 8/2011 | Brittingham et al. | |
| 8,015,908 | B2 | 9/2011 | Kline et al. | |
| D651,680 | S | 1/2012 | DeGroat | |
| 8,087,338 | B1 | 1/2012 | Hines | |
| 8,096,222 | B2 | 1/2012 | Silvers | |
| D657,012 | S | 4/2012 | Woodell | |
| 8,156,855 | B2 | 4/2012 | Anderson | |
| 8,186,261 | B2 | 5/2012 | McNeill et al. | |
| 8,272,306 | B1 | 9/2012 | Smith | |
| 8,291,805 | B1 | 10/2012 | Quilligan | |
| 8,307,946 | B1 | 11/2012 | Johnston | |
| D677,357 | S | 3/2013 | Dueck et al. | |
| 8,387,299 | B1 | 3/2013 | Brittingham et al. | |
| 8,424,441 | B2 | 4/2013 | Brittingham et al. | |
| D682,384 | S | 5/2013 | Jaureguizar | |
| D682,974 | S | 5/2013 | Honigmann | |
| D685,874 | S | 7/2013 | Andrews et al. | |
| 8,474,361 | B2 | 7/2013 | Brittingham | |
| 8,505,431 | B2 | 8/2013 | Hines | |
| 8,505,680 | B2 | 8/2013 | Dueck | |
| D694,355 | S | 11/2013 | Hormann | |
| 8,714,300 | B2 | 5/2014 | Johansen | |
| D709,140 | S | 7/2014 | Coulter | |
| D712,997 | S | 9/2014 | Proske | |
| 8,820,473 | B1 | 9/2014 | White | |
| 8,881,862 | B1 | 11/2014 | Messer, Jr. | |
| D719,646 | S | 12/2014 | Melo | |
| 8,950,546 | B2 | 2/2015 | Shults et al. | |
| D723,647 | S | 3/2015 | Oliver | |
| 8,973,481 | B2 | 3/2015 | Dueck | |
| 8,978,818 | B2 | 3/2015 | Proske | |
| D728,058 | S | 4/2015 | Cheney | |
| 8,997,621 | B1 | 4/2015 | Dater et al. | |
| D741,443 | S | 10/2015 | Cheney | |
| D743,007 | S | 11/2015 | Kimura | |
| 9,175,919 | B2 | 11/2015 | Russell et al. | |
| 9,207,033 | B2 | 12/2015 | Vais | |
| 9,239,201 | B1 | 1/2016 | Reis Green | |
| D761,373 | S | 7/2016 | Lessard | |
| D764,621 | S | 8/2016 | Dueck et al. | |
| 9,410,761 | B2 | 8/2016 | Morris et al. | |
| D767,076 | S | 9/2016 | Bebee | |
| D767,706 | S | 9/2016 | Shults et al. | |
| D773,587 | S | 12/2016 | Underwood | |
| 9,513,078 | B1 | 12/2016 | Fulton et al. | |
| D776,226 | S | 1/2017 | Green | |
| D778,386 | S | 2/2017 | Farthing et al. | |
| D778,387 | S | 2/2017 | Farthing | |
| D779,618 | S | 2/2017 | Farthing | |
| D782,598 | S | 3/2017 | Faxon | |
| 9,658,019 | B2 | 5/2017 | Smith | |
| D788,873 | S | 6/2017 | Wiley | |
| D789,480 | S | 6/2017 | Olsen | |
| D790,647 | S | 6/2017 | Miller, III | |
| D790,648 | S | 6/2017 | Pezeshk | |
| D792,545 | S | 7/2017 | Green et al. | |
| 9,709,354 | B2 | 7/2017 | Larue | |
| 9,739,559 | B2 | 8/2017 | Bush | |
| 9,739,560 | B1 | 8/2017 | Salvador | |
| 9,746,267 | B2 | 8/2017 | Smith | |
| 9,791,247 | B2 | 10/2017 | Parker | |
| D802,699 | S | 11/2017 | Shults | |
| D802,700 | S | 11/2017 | Shults | |
| D807,461 | S | 1/2018 | Cheng et al. | |
| D808,490 | S | 1/2018 | Meinert | |
| D810,224 | S | 2/2018 | Lessard | |
| D811,513 | S | 2/2018 | Payton | |
| 9,933,224 | B2 | 4/2018 | Dorne et al. | |
| 9,958,227 | B2 | 5/2018 | Whitson | |
| 10,024,617 | B1 | 7/2018 | Moore et al. | |
| D825,845 | S | 8/2018 | Dittmer et al. | |
| 10,060,695 | B2 | 8/2018 | Slack | |
| 10,119,779 | B1 | 11/2018 | Miele | |
| 10,156,411 | B2 | 12/2018 | Thompson et al. | |
| D837,922 | S | 1/2019 | McDonald et al. | |
| 10,184,744 | B2 | 1/2019 | Young et al. | |
| 10,184,745 | B1 | 1/2019 | Fulton | |
| D842,419 | S | 3/2019 | Edminster et al. | |
| 10,228,210 | B2 | 3/2019 | Parker | |
| 10,281,228 | B1 | 5/2019 | Marfione | |
| 10,330,417 | B2 | 6/2019 | Reis Green et al. | |
| 10,330,419 | B1 * | 6/2019 | Holderby | F41A 21/30 |
| 10,345,070 | B1 | 7/2019 | Lepka | |
| 10,393,463 | B1 | 8/2019 | Sanders | |
| D860,372 | S | 9/2019 | Riley | |
| 10,480,884 | B2 | 11/2019 | Smith | |
| 10,480,888 | B2 | 11/2019 | Barrett | |
| 10,598,458 | B1 | 3/2020 | Cler | |
| 10,605,558 | B1 | 3/2020 | Marfione et al. | |
| 10,619,962 | B1 | 4/2020 | Hatfield | |
| 10,663,246 | B1 | 5/2020 | Gelernter | |
| D886,230 | S | 6/2020 | Green et al. | |
| 10,724,569 | B2 | 7/2020 | Windfeldt et al. | |
| 10,724,817 | B2 | 7/2020 | Miele | |
| 10,753,699 | B2 | 8/2020 | Klett et al. | |
| 10,801,796 | B2 | 10/2020 | Kras | |
| 10,809,032 | B1 | 10/2020 | Thomas et al. | |
| 10,969,187 | B2 | 4/2021 | DeJessa | |
| 10,996,015 | B2 | 5/2021 | Lee | |
| 11,035,637 | B2 * | 6/2021 | Barney | F41A 21/30 |
| 11,041,687 | B2 | 6/2021 | Wheeler et al. | |
| 11,085,725 | B2 | 8/2021 | Moore | |

(56) References Cited

U.S. PATENT DOCUMENTS

| | | | | |
|---|---|---|---|---|
| 11,092,399 | B2 | 8/2021 | Washburn, III et al. | |
| 11,156,423 | B2 * | 10/2021 | Winterseth | F41A 21/34 |
| 11,221,189 | B1 * | 1/2022 | Couvillion | F41A 21/30 |
| 11,243,040 | B2 | 2/2022 | Honigmann et al. | |
| 11,255,623 | B2 | 2/2022 | Kras | |
| 11,287,207 | B2 | 3/2022 | DeJessa | |
| D953,470 | S | 5/2022 | Windfeldt et al. | |
| 11,326,849 | B2 | 5/2022 | Edminster | |
| D955,524 | S | 6/2022 | Spector et al. | |
| D963,100 | S | 9/2022 | Green et al. | |
| D969,258 | S | 11/2022 | DeJessa | |
| D972,476 | S | 12/2022 | Gromova | |
| 11,530,890 | B2 | 12/2022 | Wheeler et al. | |
| 11,609,058 | B2 | 3/2023 | Petersen | |
| 11,614,297 | B2 | 3/2023 | Wheeler et al. | |
| 11,680,764 | B1 | 6/2023 | Bray | |
| 11,686,547 | B2 | 6/2023 | Kras | |
| 11,725,897 | B2 | 8/2023 | Washburn, III et al. | |
| 11,774,205 | B1 | 10/2023 | Kunsky | |
| D1,019,868 | S | 3/2024 | Grob | |
| D1,020,965 | S | 4/2024 | Bundy et al. | |
| 2008/0148928 | A1 | 6/2008 | McClellan | |
| 2009/0139795 | A1 | 6/2009 | Brittingham | |
| 2010/0294118 | A1 | 11/2010 | Hortobagyi | |
| 2010/0313743 | A1 | 12/2010 | Dueck et al. | |
| 2011/0072958 | A1 | 3/2011 | Brittingham et al. | |
| 2011/0186377 | A1 | 8/2011 | Kline et al. | |
| 2011/0271575 | A1 | 11/2011 | Overbeek et al. | |
| 2012/0048100 | A1 | 3/2012 | Davies | |
| 2012/0103176 | A1 * | 5/2012 | Latka | F41A 21/325 89/14.4 |
| 2012/0167749 | A1 | 7/2012 | Young | |
| 2012/0228052 | A1 | 9/2012 | Findlay | |
| 2012/0279381 | A1 | 11/2012 | Landolt | |
| 2013/0312592 | A1 * | 11/2013 | Storrs | F41A 21/30 89/14.4 |
| 2014/0237881 | A1 | 8/2014 | Mack | |
| 2014/0262604 | A1 | 9/2014 | Proske | |
| 2014/0262605 | A1 | 9/2014 | Washburn, III et al. | |
| 2015/0260473 | A1 * | 9/2015 | Barney | F41A 21/30 89/14.4 |
| 2016/0003570 | A1 | 1/2016 | Tonkin | |
| 2016/0054086 | A1 | 2/2016 | Westlake | |
| 2016/0109205 | A1 | 4/2016 | Coppinger | |
| 2016/0161203 | A1 | 6/2016 | Wilson | |
| 2016/0370157 | A1 | 12/2016 | Parker | |
| 2017/0067711 | A1 | 3/2017 | Slack | |
| 2017/0102201 | A1 * | 4/2017 | Bush | F41A 21/30 |
| 2017/0160034 | A1 | 6/2017 | Parker | |
| 2017/0205175 | A1 | 7/2017 | Garst et al. | |
| 2017/0261281 | A1 | 9/2017 | Salvador | |
| 2017/0321984 | A1 | 11/2017 | Palu et al. | |
| 2018/0058789 | A1 * | 3/2018 | Dorne | F41A 21/30 |
| 2018/0120045 | A1 | 5/2018 | Rost | |
| 2018/0128566 | A1 | 5/2018 | Reis Green | |
| 2018/0252489 | A1 | 9/2018 | Parker | |
| 2018/0299222 | A1 | 10/2018 | Albino | |
| 2018/0299223 | A1 | 10/2018 | Barrett | |
| 2018/0321008 | A1 | 11/2018 | Barney | |
| 2019/0063860 | A1 | 2/2019 | Walker | |
| 2019/0072353 | A1 | 3/2019 | Slack | |
| 2019/0072354 | A1 | 3/2019 | Lee | |
| 2019/0078852 | A1 | 3/2019 | Peknik | |
| 2019/0128632 | A1 | 5/2019 | Christanl et al. | |
| 2019/0226787 | A1 | 7/2019 | Orne | |
| 2019/0249942 | A1 | 8/2019 | Dunham | |
| 2019/0293376 | A1 | 9/2019 | Crown | |
| 2019/0353446 | A1 | 11/2019 | Kras | |
| 2020/0072571 | A1 | 3/2020 | Washburn et al. | |
| 2020/0232740 | A1 | 6/2020 | Honigmann | |
| 2020/0240736 | A1 | 6/2020 | Moore | |
| 2020/0224989 | A1 | 7/2020 | Bundy et al. | |
| 2020/0232741 | A1 | 7/2020 | Hood, II | |
| 2020/0248980 | A1 | 8/2020 | Bragais | |
| 2020/0284540 | A1 | 9/2020 | Doerr | |
| 2020/0284541 | A1 | 9/2020 | Poling | |
| 2021/0003360 | A1 | 1/2021 | Kras | |
| 2021/0018287 | A1 | 1/2021 | Kada et al. | |
| 2021/0254921 | A1 | 8/2021 | Spector et al. | |
| 2021/0310761 | A1 * | 10/2021 | Søgaard | F41A 21/30 |
| 2021/0381792 | A1 | 12/2021 | Young | |
| 2021/0389074 | A1 | 12/2021 | Reis Green et al. | |
| 2021/0389077 | A1 | 12/2021 | Turnblom | |
| 2022/0049920 | A1 | 2/2022 | Kras | |
| 2022/0057160 | A1 | 2/2022 | Johns | |
| 2022/0397361 | A1 | 12/2022 | DeJessa | |
| 2022/0397362 | A1 | 12/2022 | DeJessa | |
| 2022/0397363 | A1 | 12/2022 | DeJessa | |
| 2023/0175802 | A1 | 6/2023 | Bundy et al. | |

FOREIGN PATENT DOCUMENTS

| | | |
|---|---|---|
| EM | 009085772-001 | 7/2022 |
| EM | 009085772-002 | 7/2022 |
| WO | WO 2017/102012 A1 | 6/2017 |
| WO | WO 2017/102132 A1 | 6/2017 |
| WO | WO2023064649 A2 | 4/2023 |
| WO | WO2023220485 A2 | 11/2023 |

OTHER PUBLICATIONS

Written Opinion of the International Searching Authority, International Application No. PCT/US2023/060699; mailed Jan. 191, 2024; pp. 5.

* cited by examiner

FIG. 12
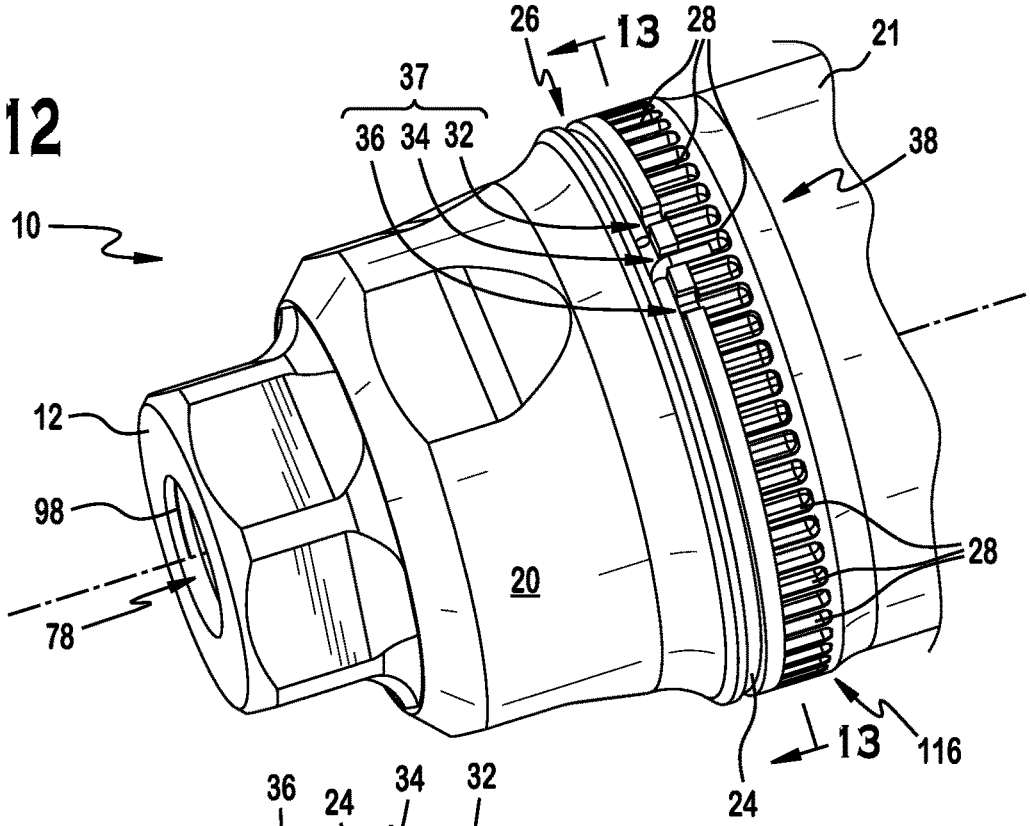
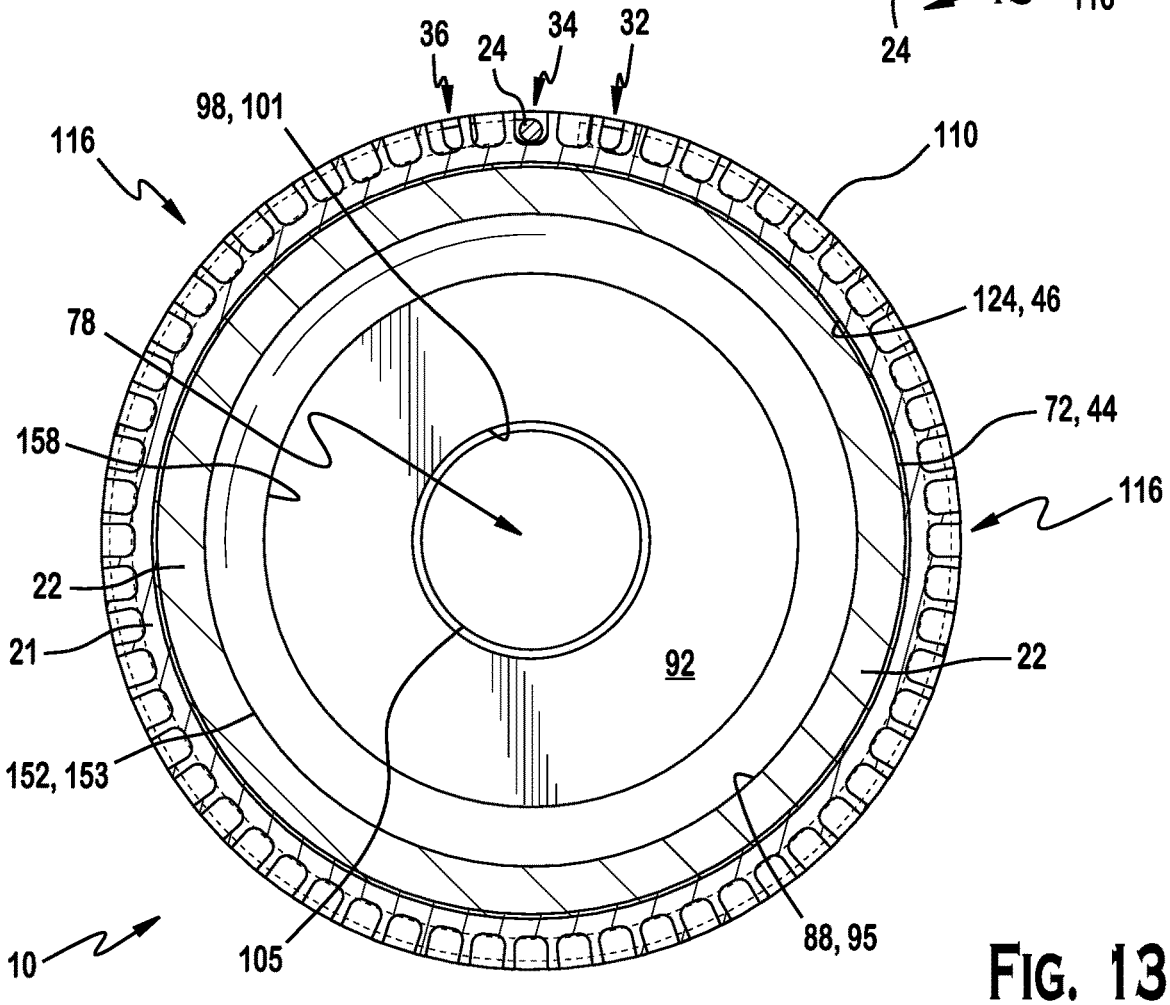
FIG. 13

FIG. 30
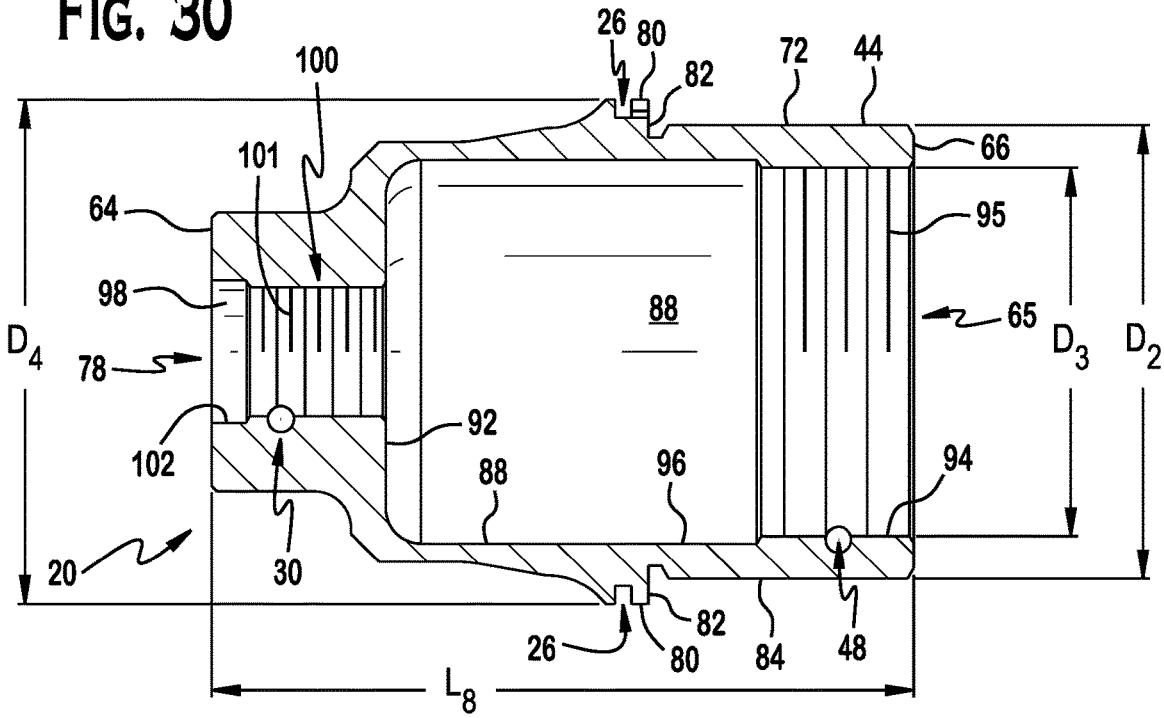
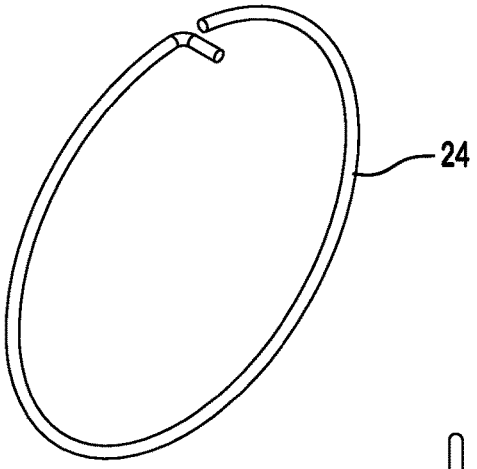
FIG. 31
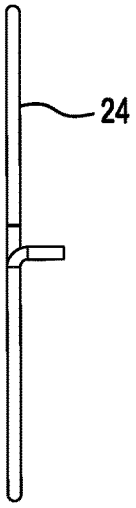
FIG. 33
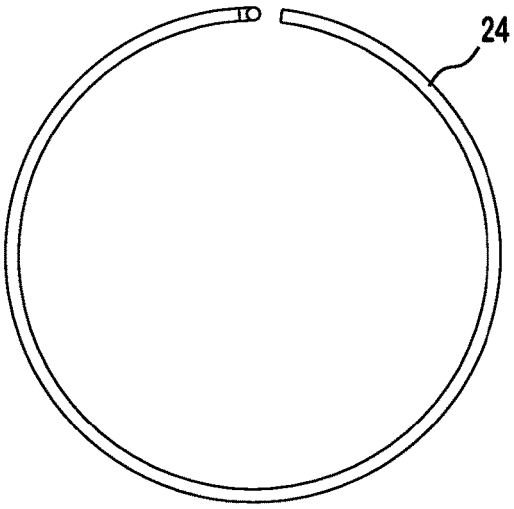
FIG. 32

FIG. 71
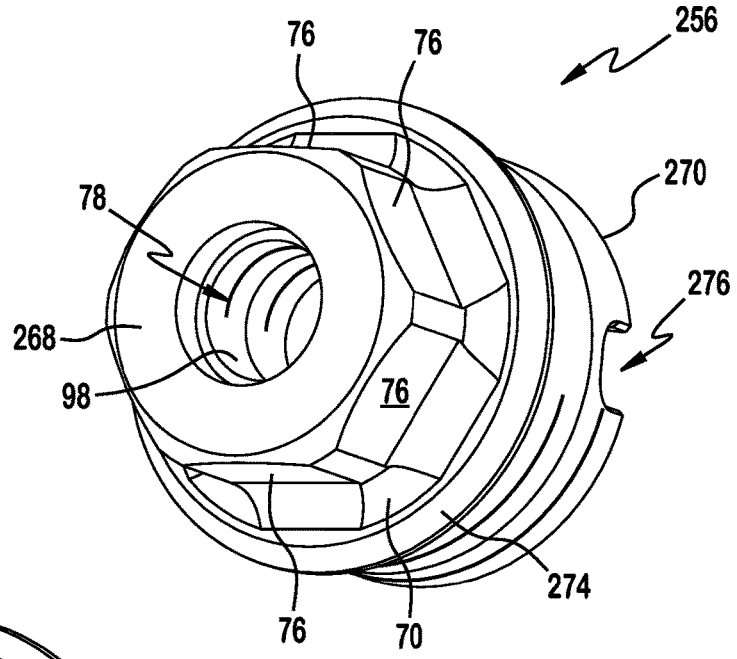
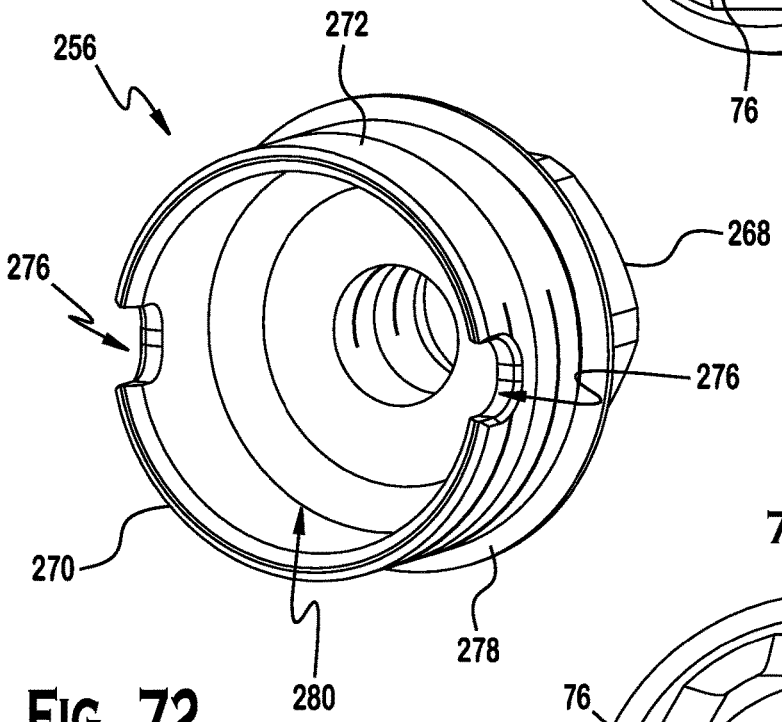
FIG. 72
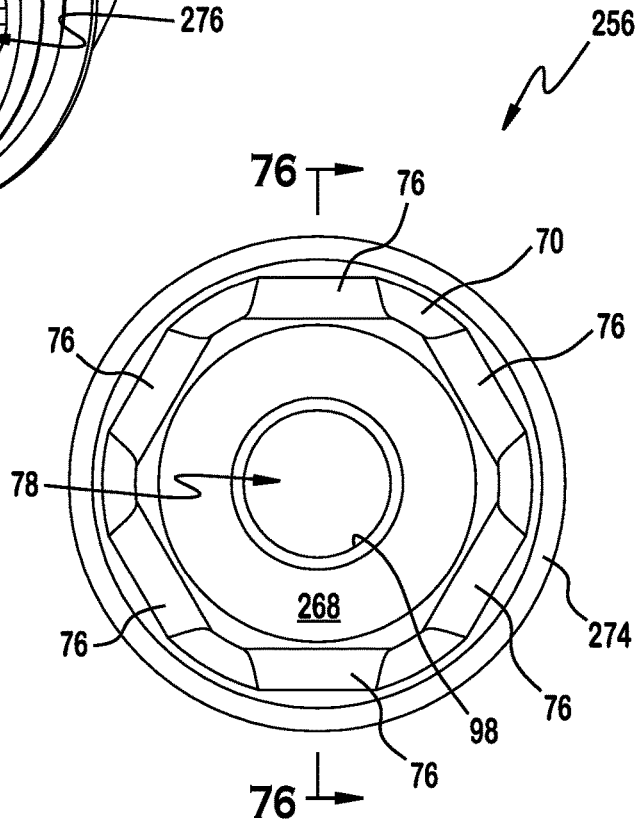
FIG. 73

FIREARM SUPPRESSOR ASSEMBLY, AND APPARATUS AND METHOD FOR AUDIBLE SIGNATURE REDUCTION OF A FIREARM

CROSS REFERENCE TO RELATED APPLICATIONS

This application claims the benefit of U.S. Provisional Application No. 63/299,850 filed Jan. 14, 2022. This application claims the benefit of U.S. Provisional Application No. 63/384,409 filed Nov. 18, 2022. This application is a continuation-in-part of U.S. patent application Ser. No. 29/823,249 filed Jan. 14, 2022. This application is a continuation-in-part of U.S. patent application Ser. No. 29/823,253 filed Jan. 14, 2022. This application is a continuation-in-part of U.S. patent application Ser. No. 29/823,255 filed Jan. 14, 2022. This application is a continuation-in-part of U.S. patent application Ser. No. 29/823,257 filed Jan. 14, 2022. This application is a continuation-in-part of U.S. patent application Ser. No. 29/823,258 filed Jan. 14, 2022. This application is a continuation-in-part of U.S. patent application Ser. No. 29/823,260 filed Jan. 14, 2022. This application is a continuation-in-part of U.S. patent application Ser. No. 29/823,266 filed Jan. 14, 2022. This application is a continuation-in-part of U.S. patent application Ser. No. 29/823,273 filed Jan. 14, 2022. The entire disclosure of each of the U.S. Patent applications mentioned in this paragraph is incorporated by reference herein.

FIELD OF THE INVENTION

The invention generally relates to firearm suppressors and to a method of decreasing the audible signature of a firearm. More particularly, the invention relates to a firearm suppressor assembly and components thereof which may be secured to a firearm to decrease the audible signature of the firearm.

BACKGROUND

Firearms may be operated by energy that is released from the firing of an ammunition cartridge. More particularly, detonation of a propellant within an ammunition cartridge may release energy that is transformed into mechanical work to induce a firearm's cycle of operation (feeding, chambering, locking, firing, unlocking, extracting, ejecting, cocking). Peak sound pressure level, spreading of pressure wave and other physical characteristics of the impulse noise from operating firearms may pose a hearing damage risk to an operator. Also, the audible signature of the firearm may enable detection of the presence and location of the operator. Accordingly, a need exists for new suppressors which may decrease the audible signature of a firearm.

SUMMARY

The present disclosure is generally directed toward firearm suppressors. More particularly, the present disclosure presents an exemplary embodiment of a suppressor for a firearm comprising a mount body, a core having a first longitudinal axis, and a tube. The core may include a first proximal end, a first distal end spaced from the first proximal end, and an array of baffles arranged between the first proximal end and the first distal end. The tube may include a second proximal end, a second distal end spaced from the second proximal end along the first longitudinal axis, and an interior sidewall extending from the second proximal end to the second distal end. The mount body, the core, and the tube may form a plurality of chambers for sound signature reduction of a host firearm. The suppressors may achieve a measured peak sound level measurement of less than 136.62 dB, the peak sound level measurement being conducted in accordance with MIL-STD-1474D. Also, the present disclosure is directed toward a suppressed firearm apparatus and methods of suppressing a firearm.

DESCRIPTION OF THE DRAWINGS

In the accompanying drawings, which form part of this specification and are to be read in conjunction therewith and in which like reference numerals are used to indicate like parts in the various views:

FIG. 12 is a partial perspective view of the proximal end of the suppressor of FIG. 1:

FIG. 13 is a cross-sectional view of FIG. 12 along line 13-13;

FIG. 30 is a cross-sectional view of the mount body of FIG. 28 along line 30-30;

FIG. 31 is a perspective view of the securing member of FIG. 4:

FIG. 32 is a front view of the securing member of FIG. 4:

FIG. 33 is a top view of the securing member of FIG. 4:

FIG. 71 is a perspective view of the modular mount of FIG. 64;

FIG. 72 is another perspective view of the modular mount of FIG. 64;

FIG. 73 is a rear view of the modular mount of FIG. 64;

FIG. 119 is a left side view of the core of FIG. 118:

FIG. 120 is a right side view of the core of FIG. 118:

FIG. 121 is a cross-sectional view of the core of FIG. 118, along line 121-121;

FIG. 122 is a cross-sectional view of the core of FIG. 119, along line 122-122:

FIG. 123 is an upper rear left side perspective view of the core of FIG. 118;

FIG. 124 is rear view of the core of FIG. 118:

FIG. 125 is an upper front right side perspective view of the core of FIG. 118:

FIG. 126 is front view of the core of FIG. 118:

FIG. 127 is a cross-sectional view of the core of FIG. 119, along line 127-127:

FIG. 128 is a cross-sectional view of the core of FIG. 119, along line 128-128:

FIG. 129 is a cross-sectional view of the core of FIG. 119, along line 129-129:

FIG. 130 is a cross-sectional view of the core of FIG. 105, along line 130-130:

Figure 105:
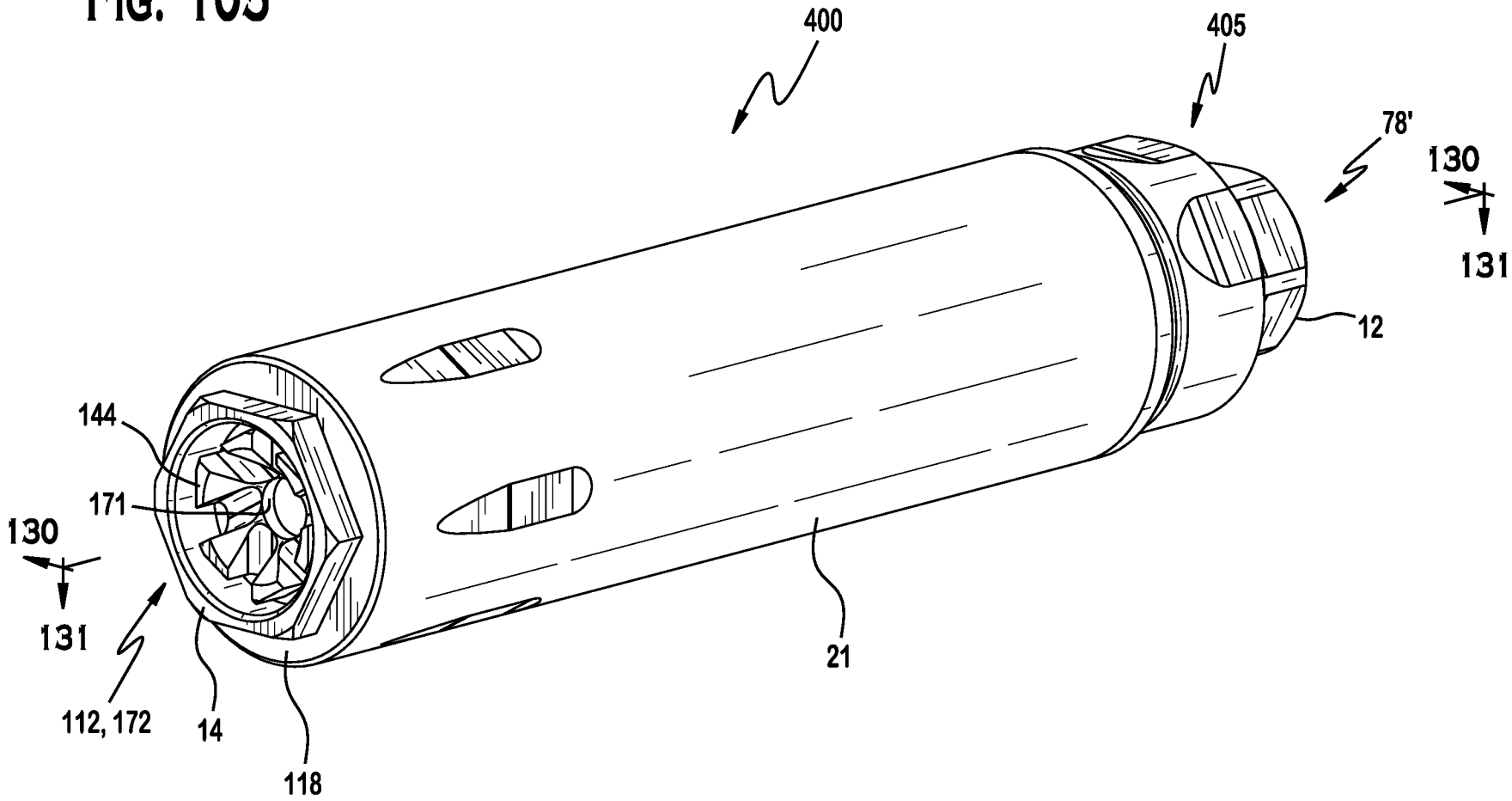
FIG. 105 is another exemplary embodiment of a suppressor.
Figure 131:
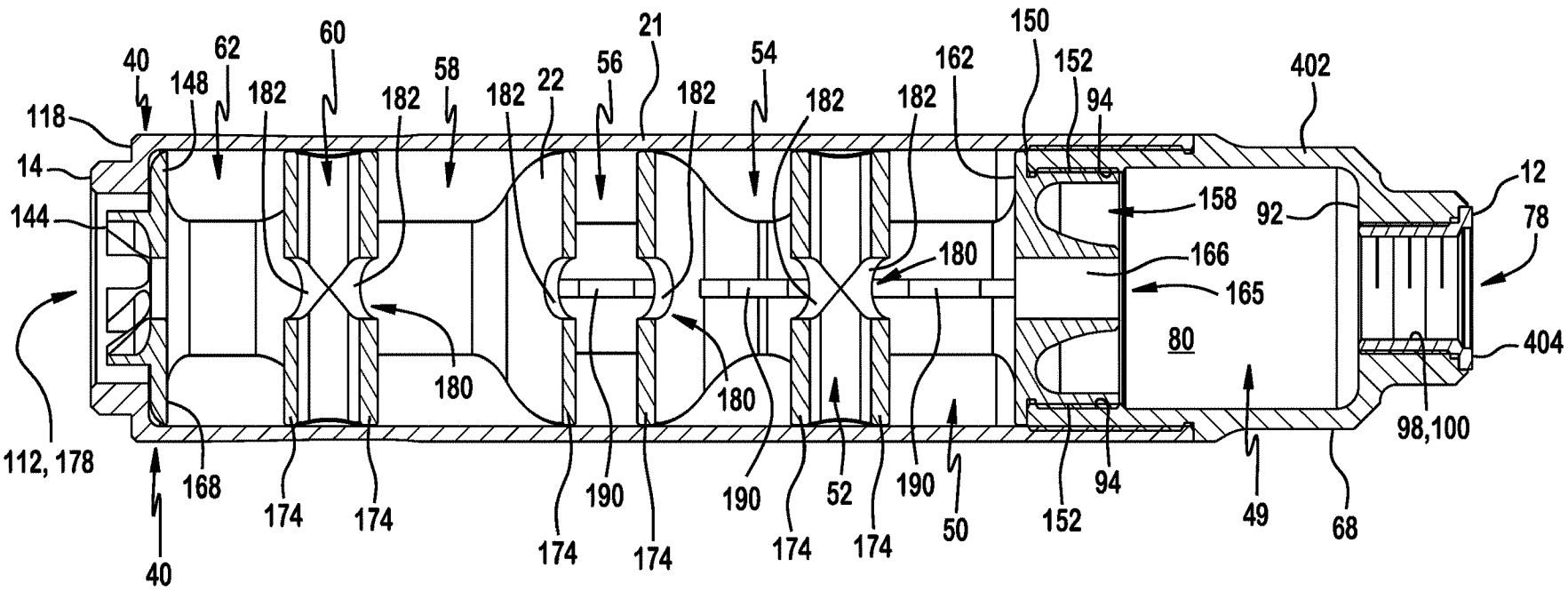
Figure 132:
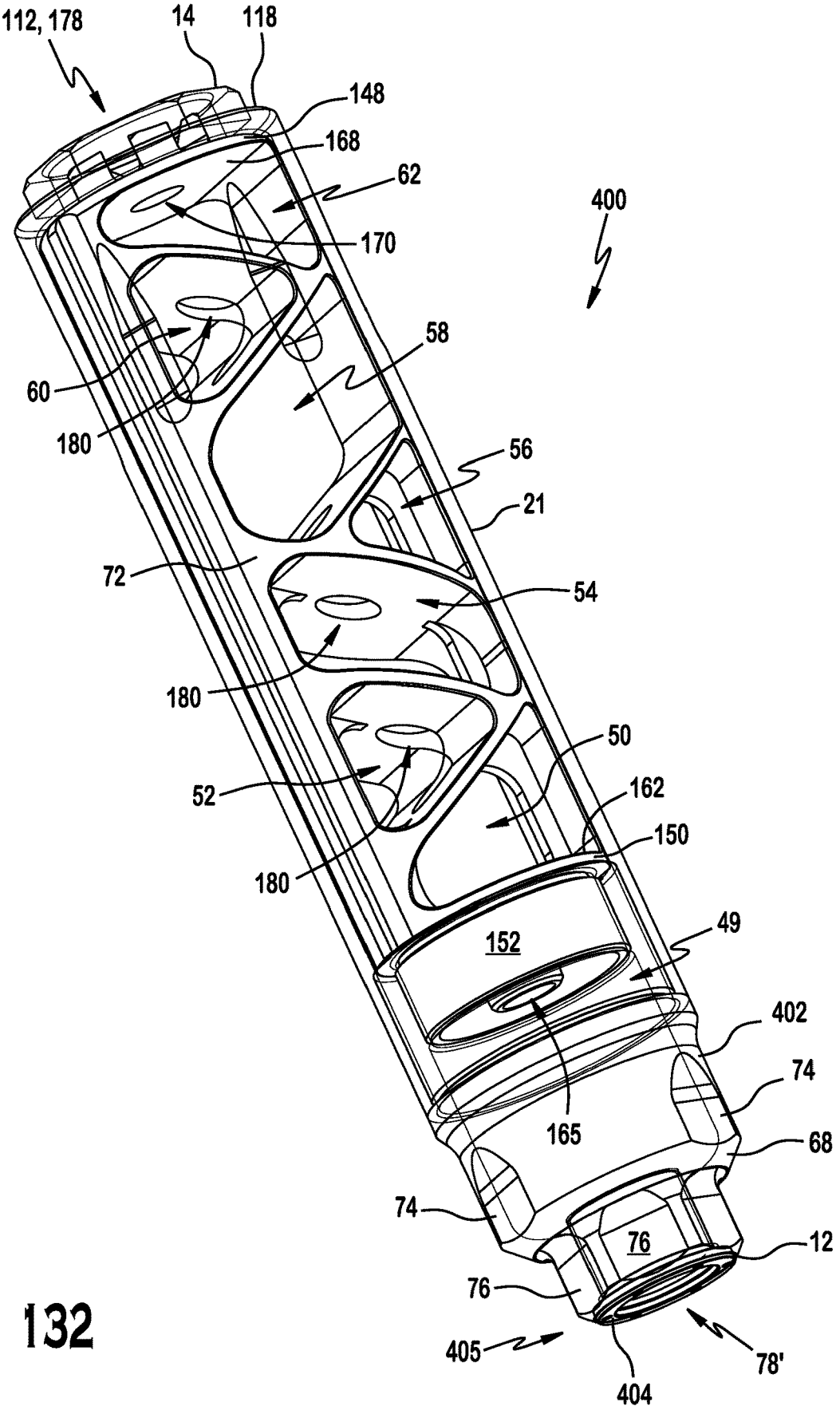
Figures 133, 134:
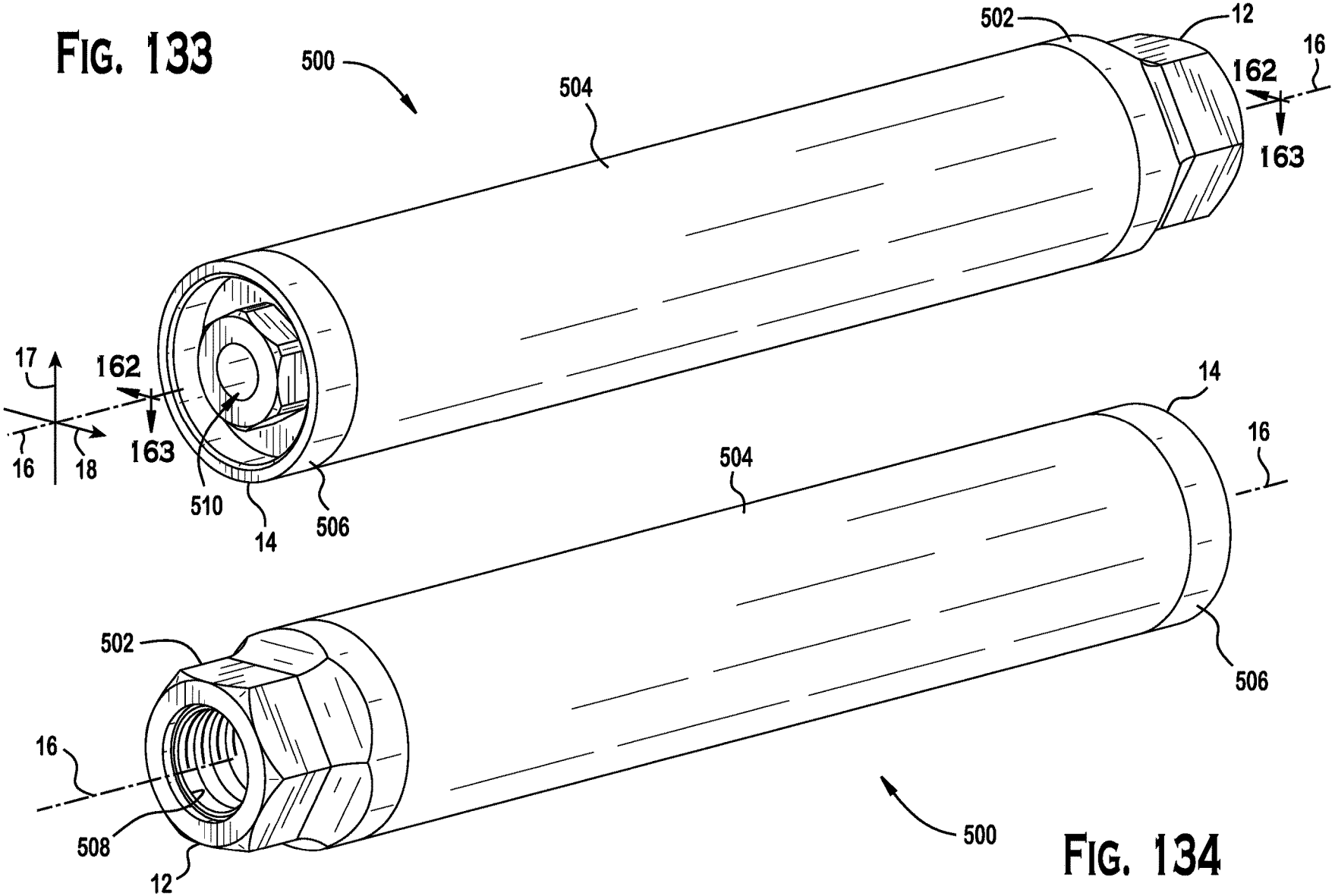
Figure 135:
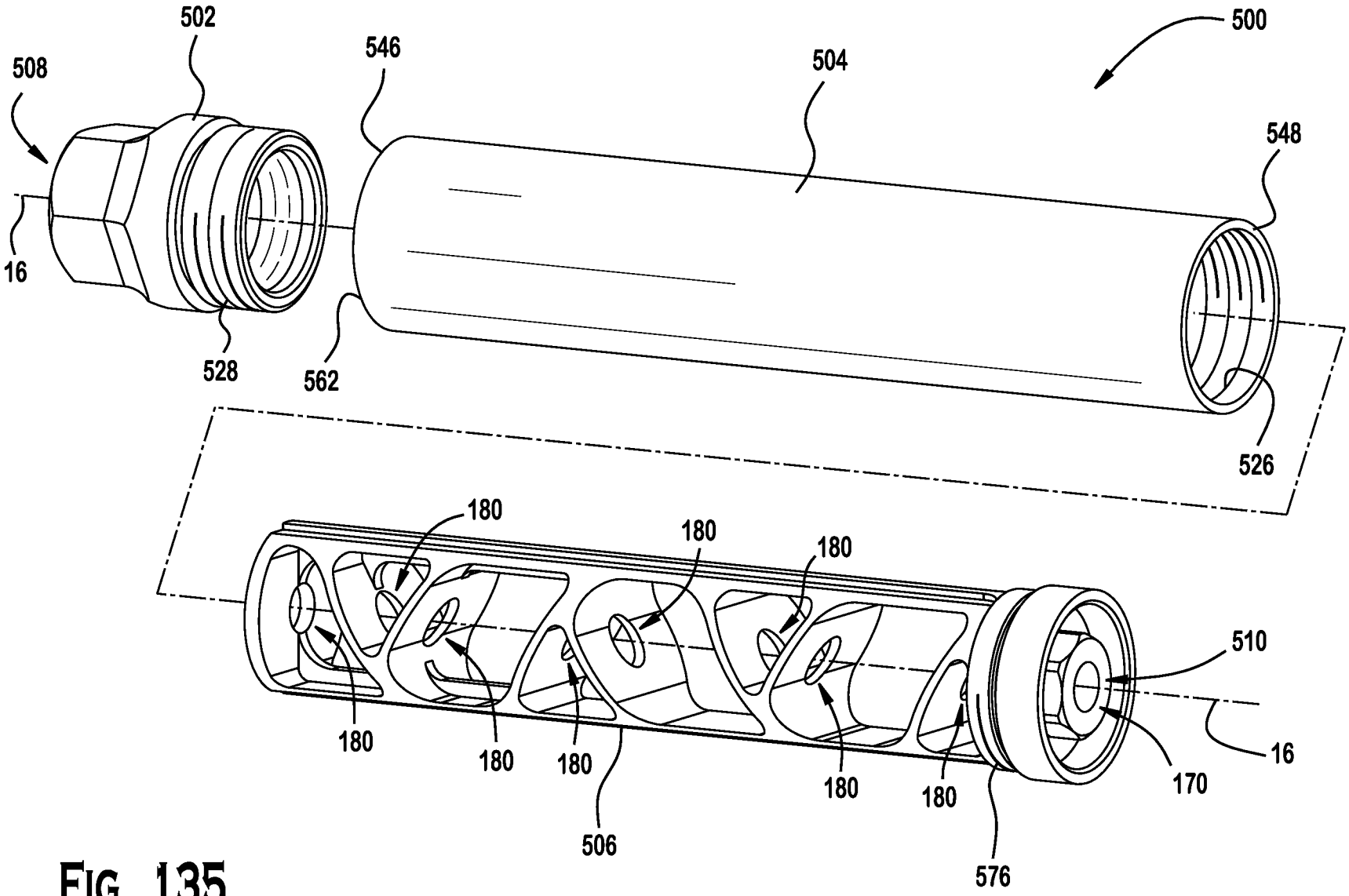
Figure 136:
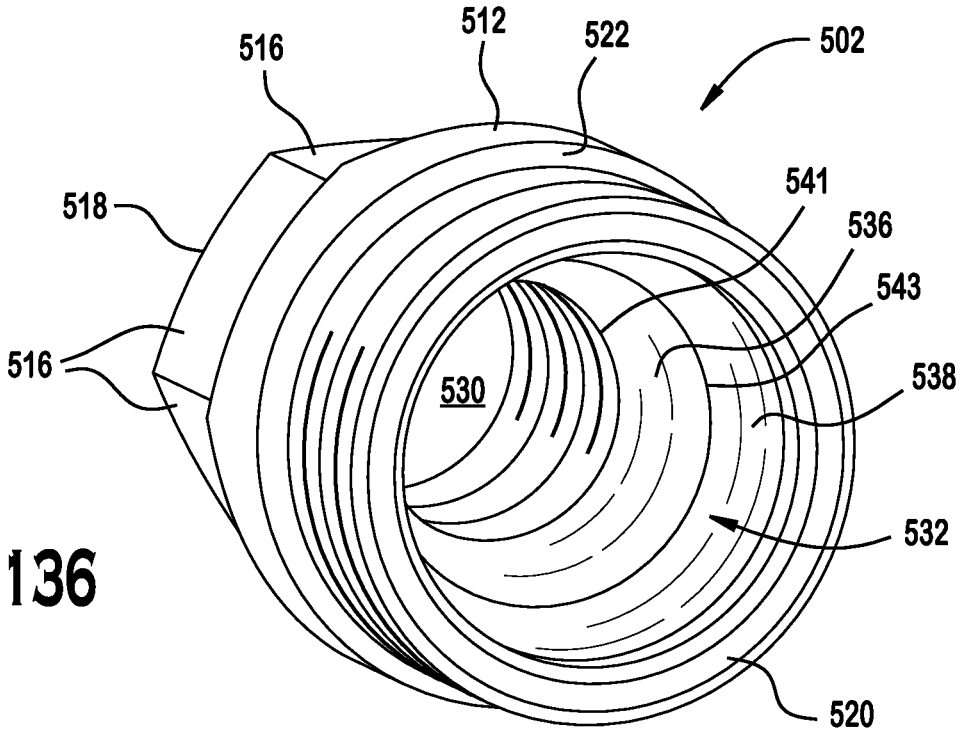
Figure 137:
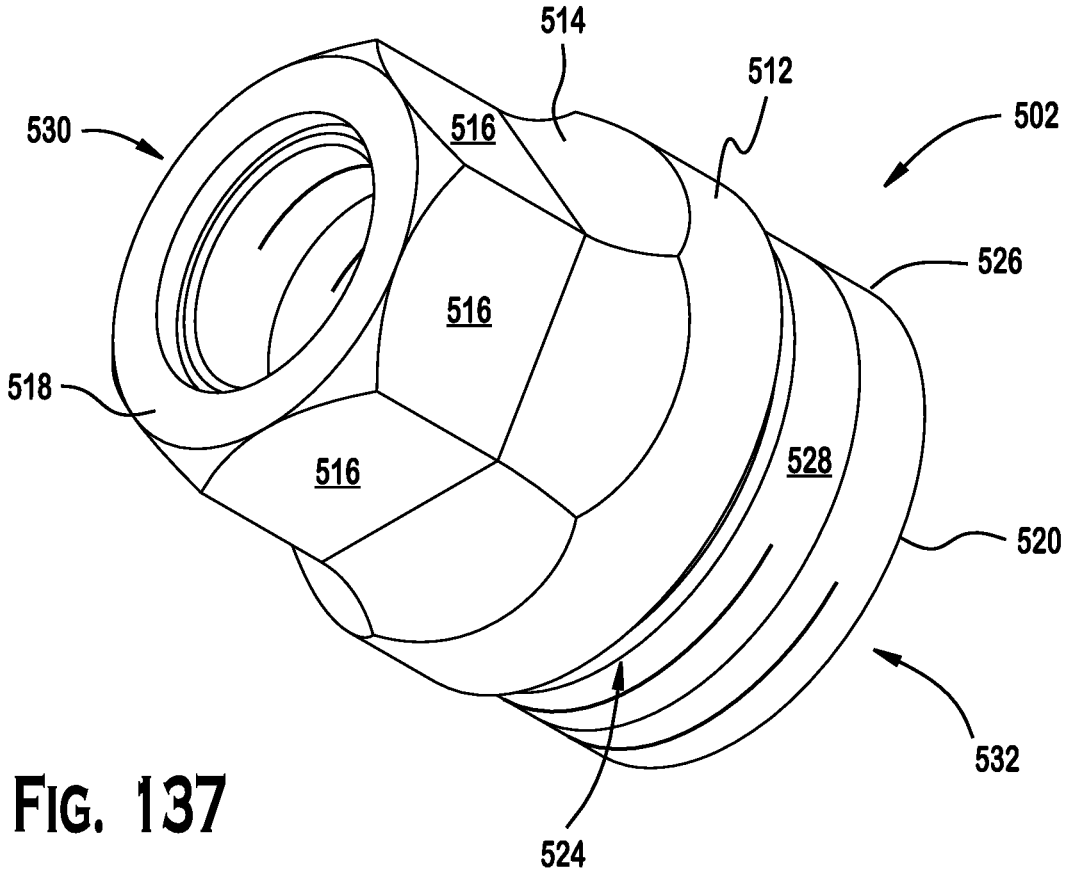
Figure 138:
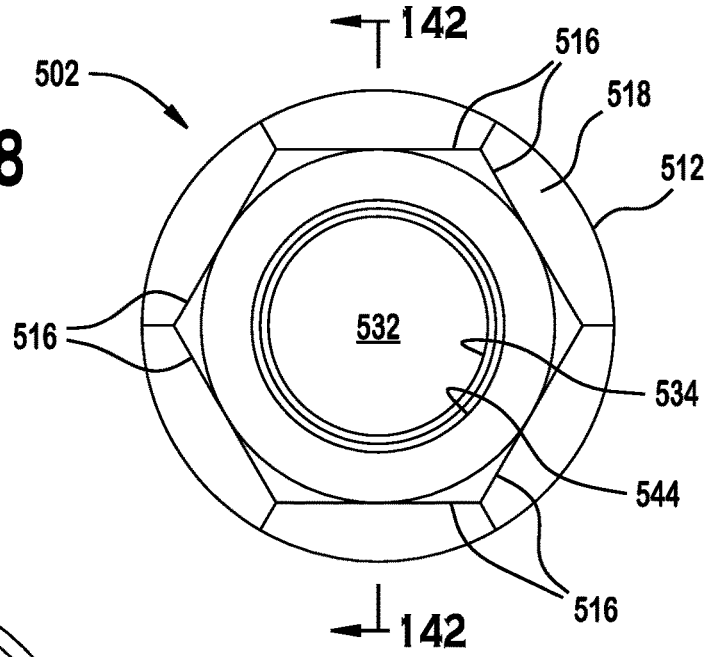
Figure 139:
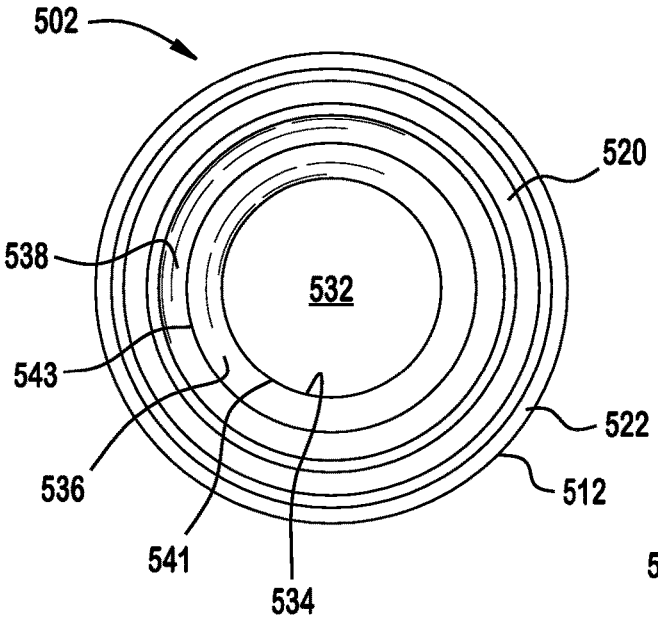
Figure 140:
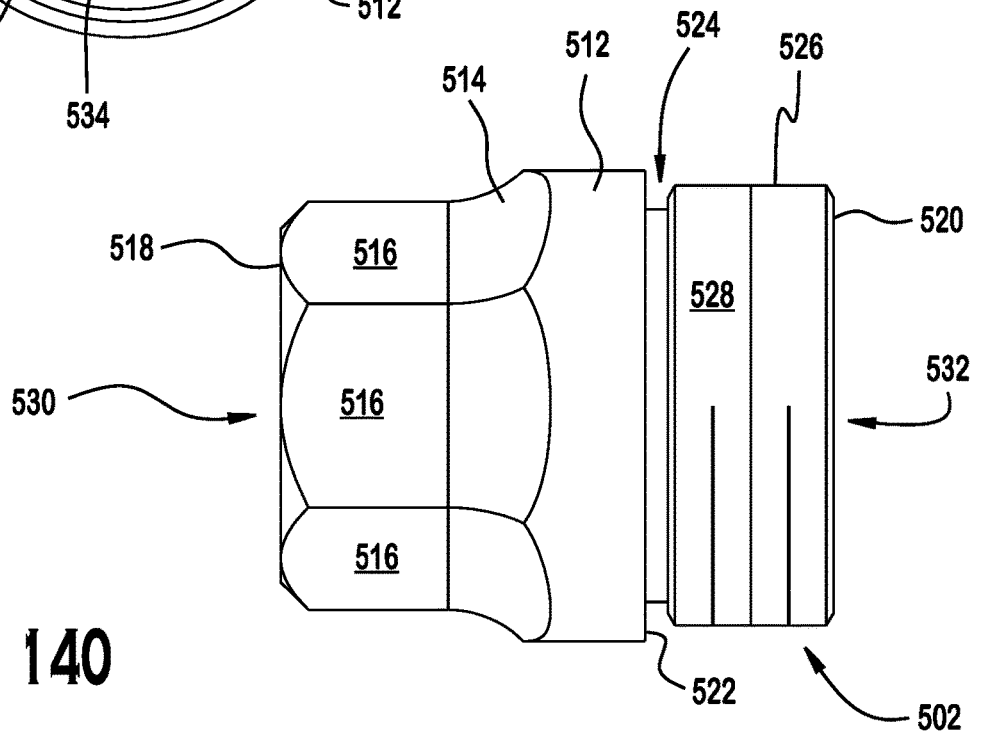
Figure 141:
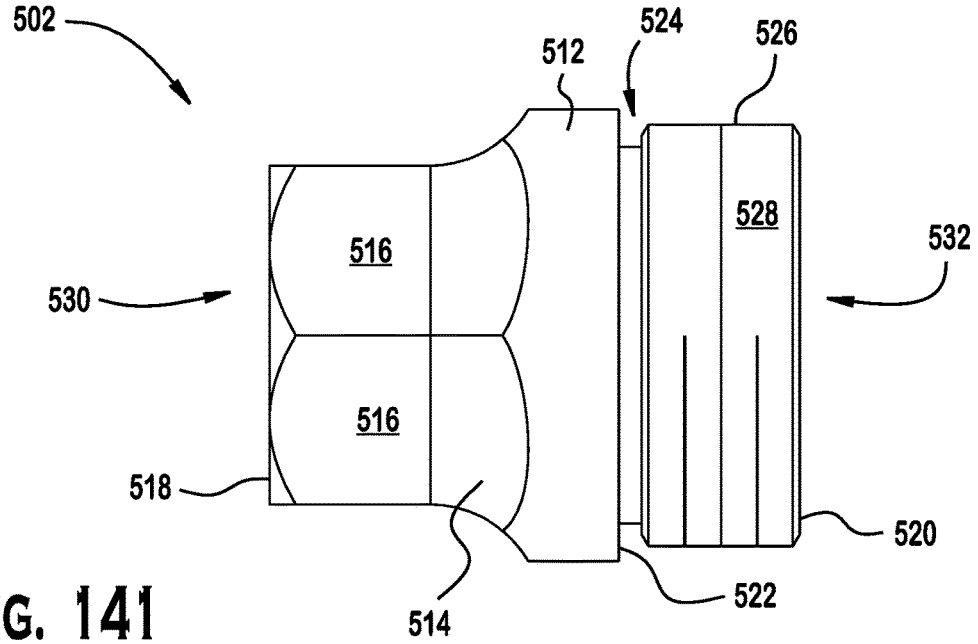
Figure 142:
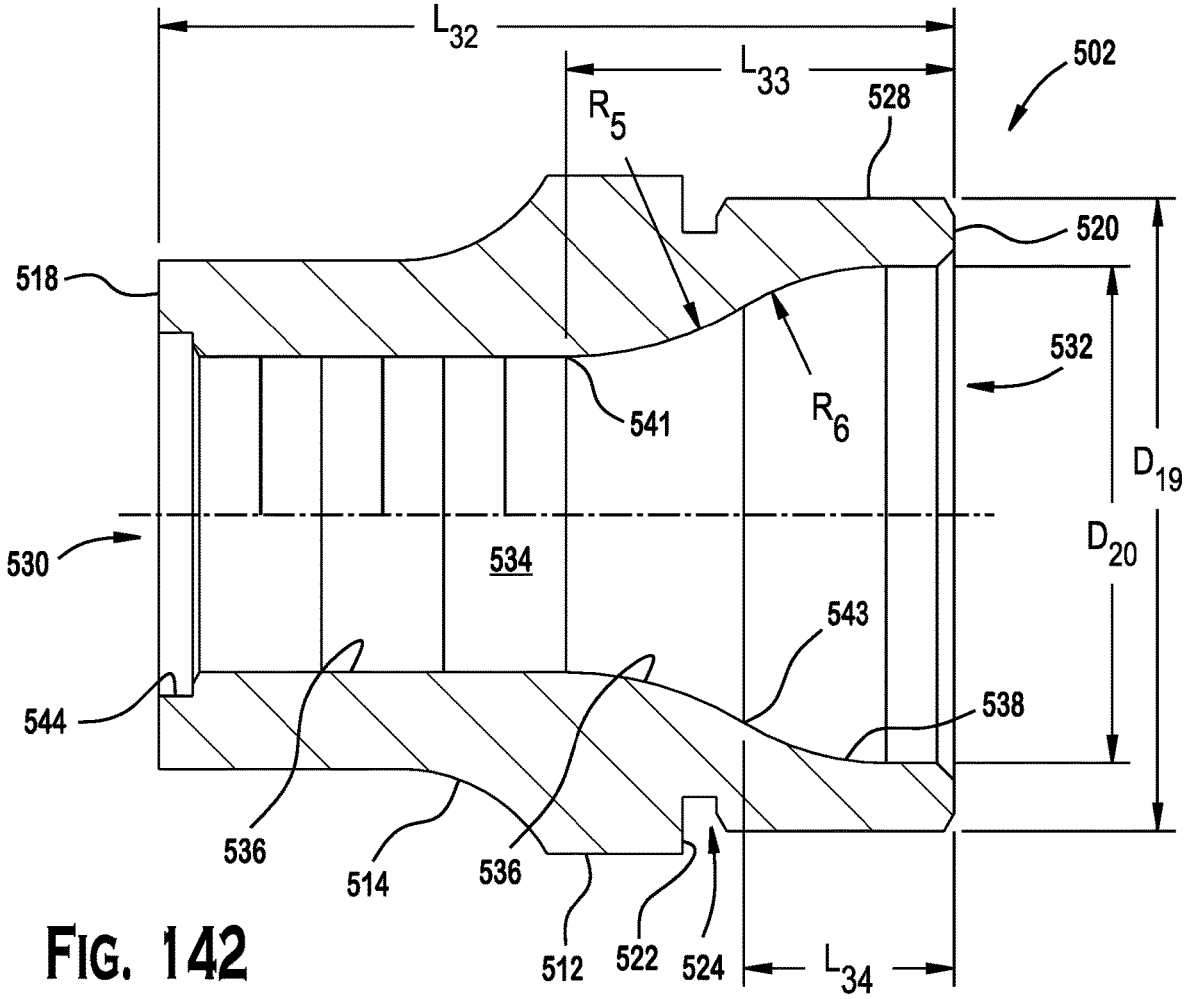
Figure 143:
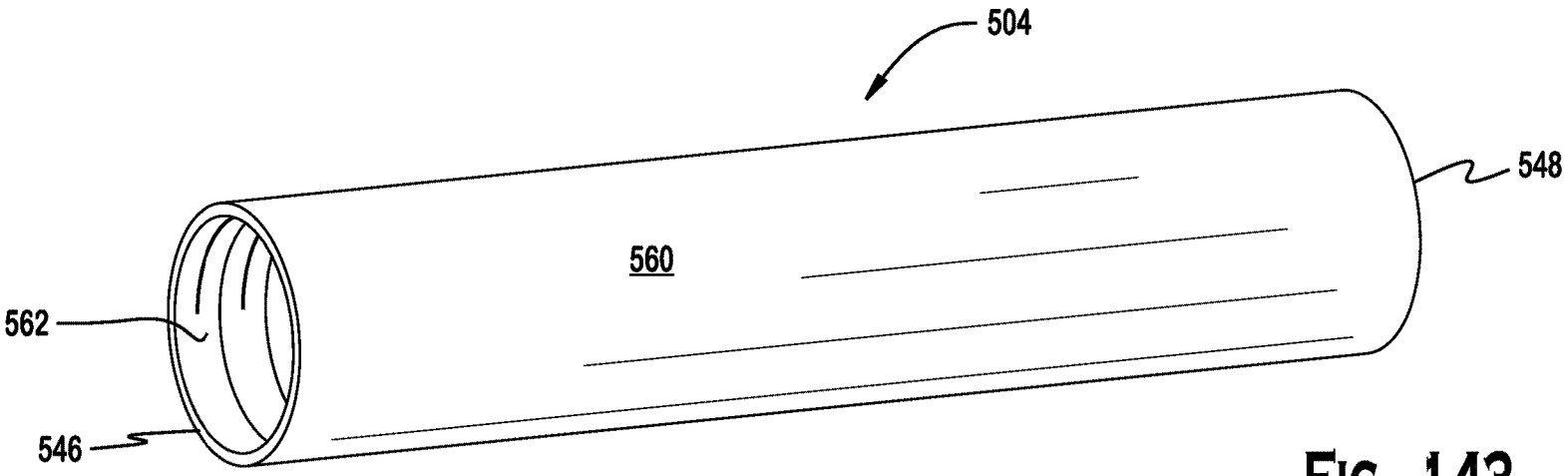
Figure 144:
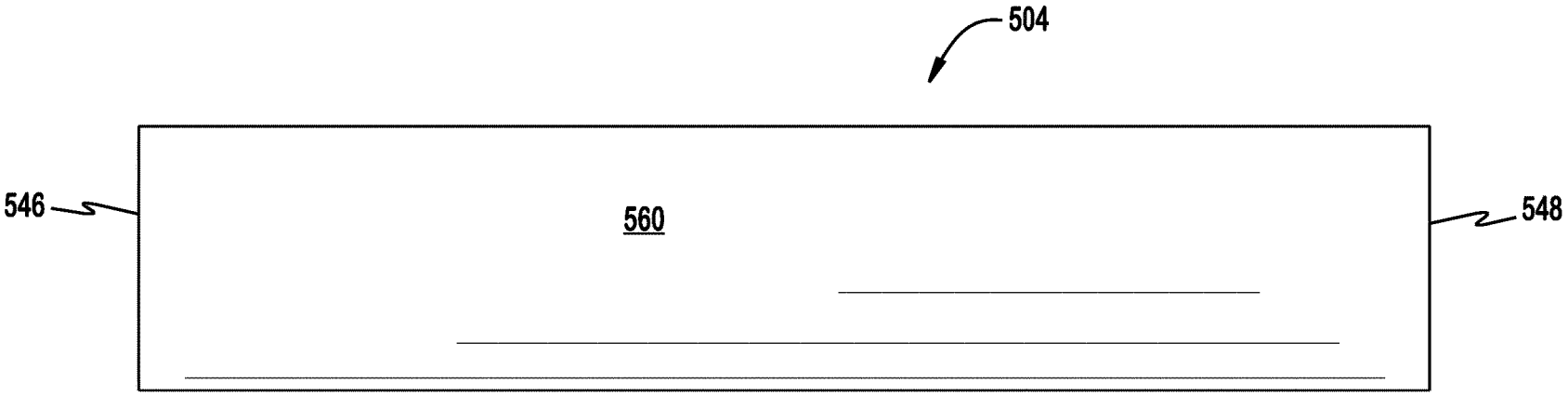
Figure 145:
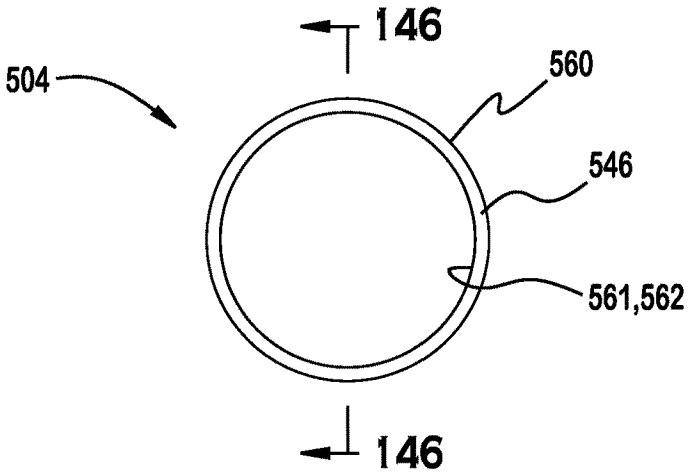
Figure 146:
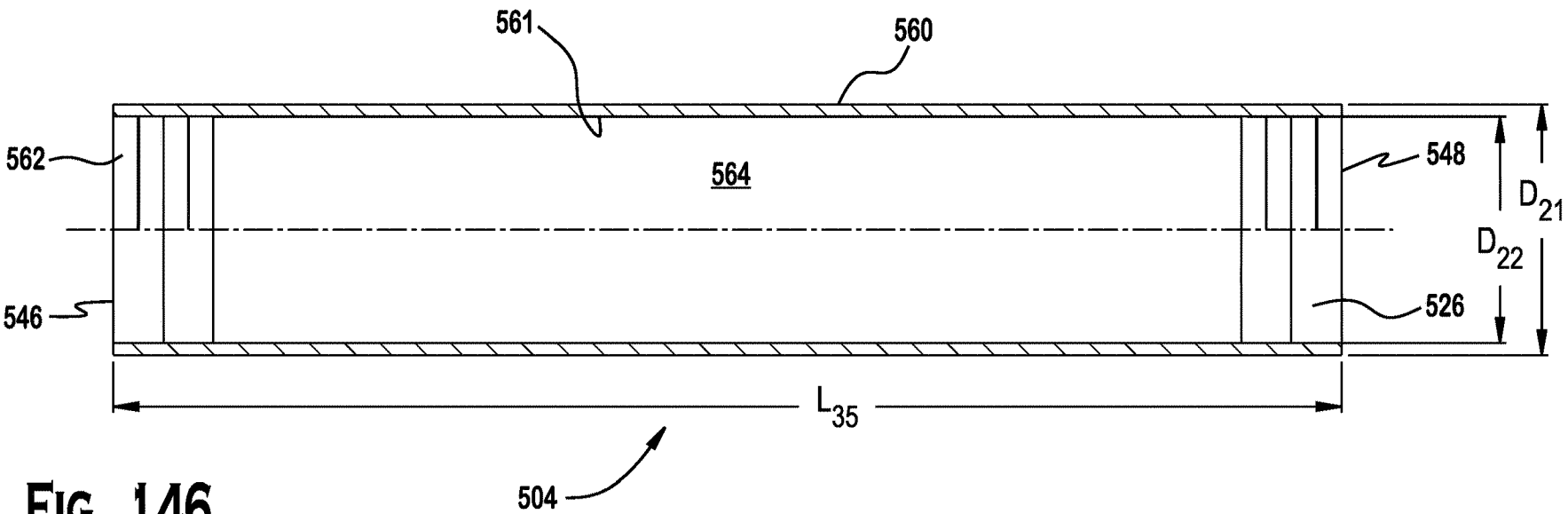
Figure 147:
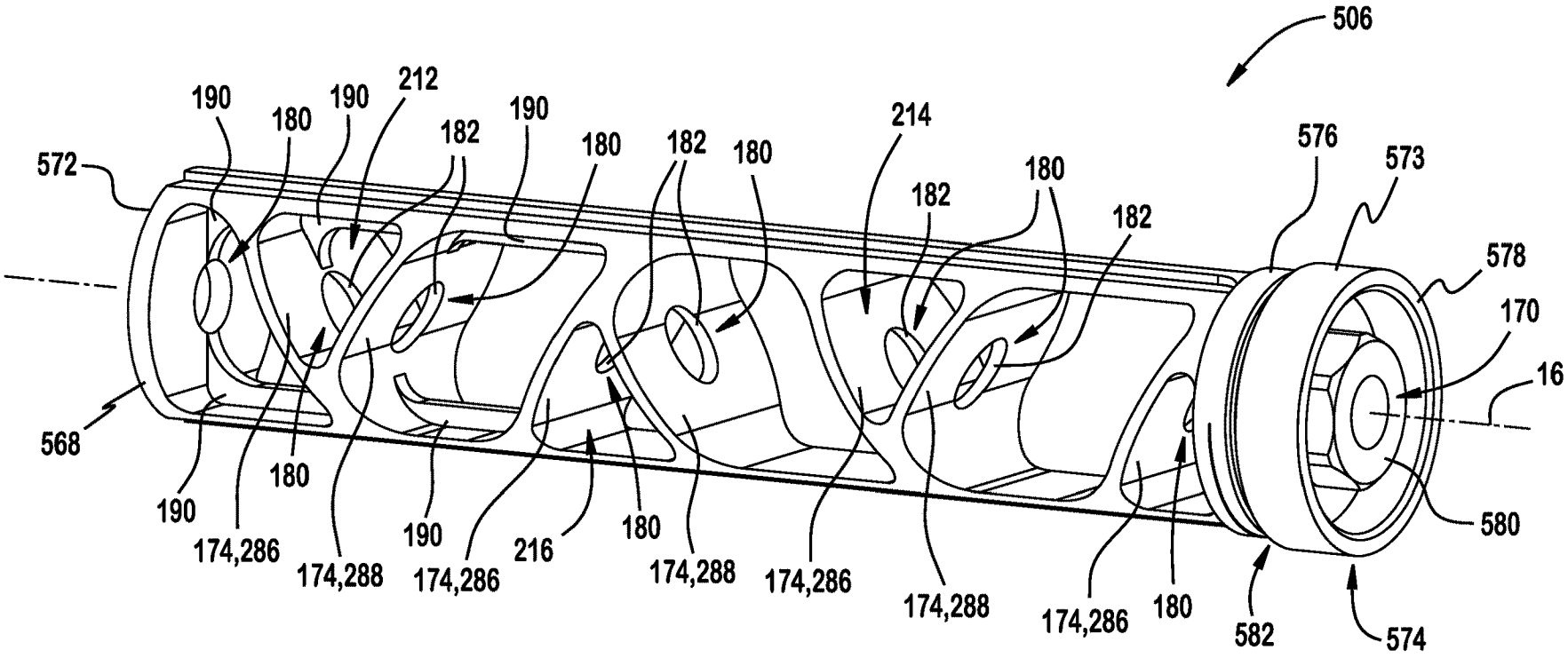
Figure 148:
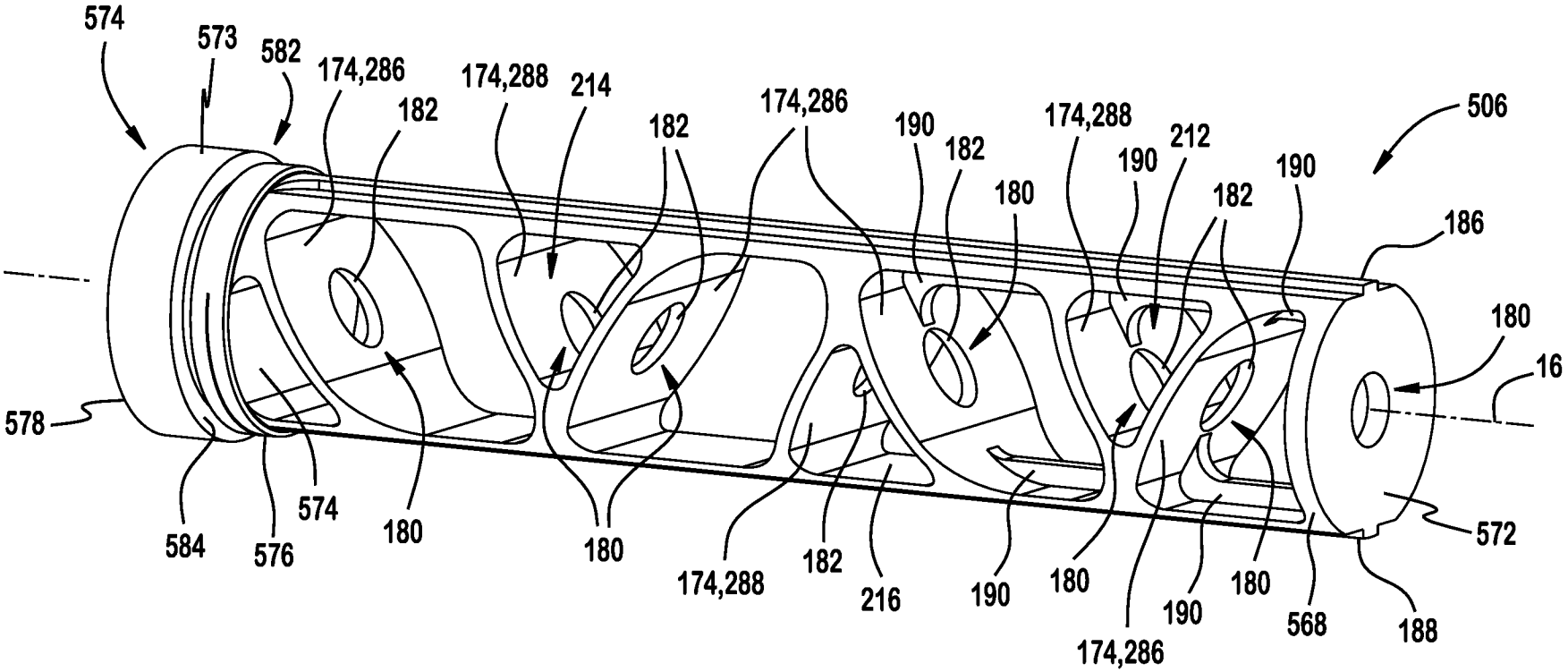
Figure 149:
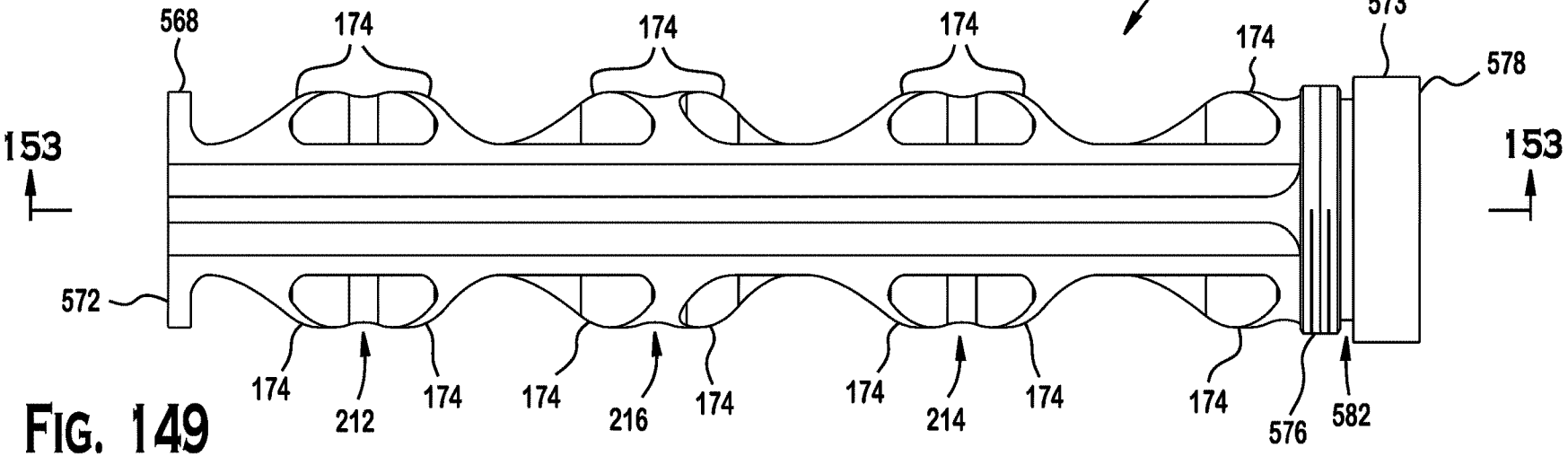
Figure 150:
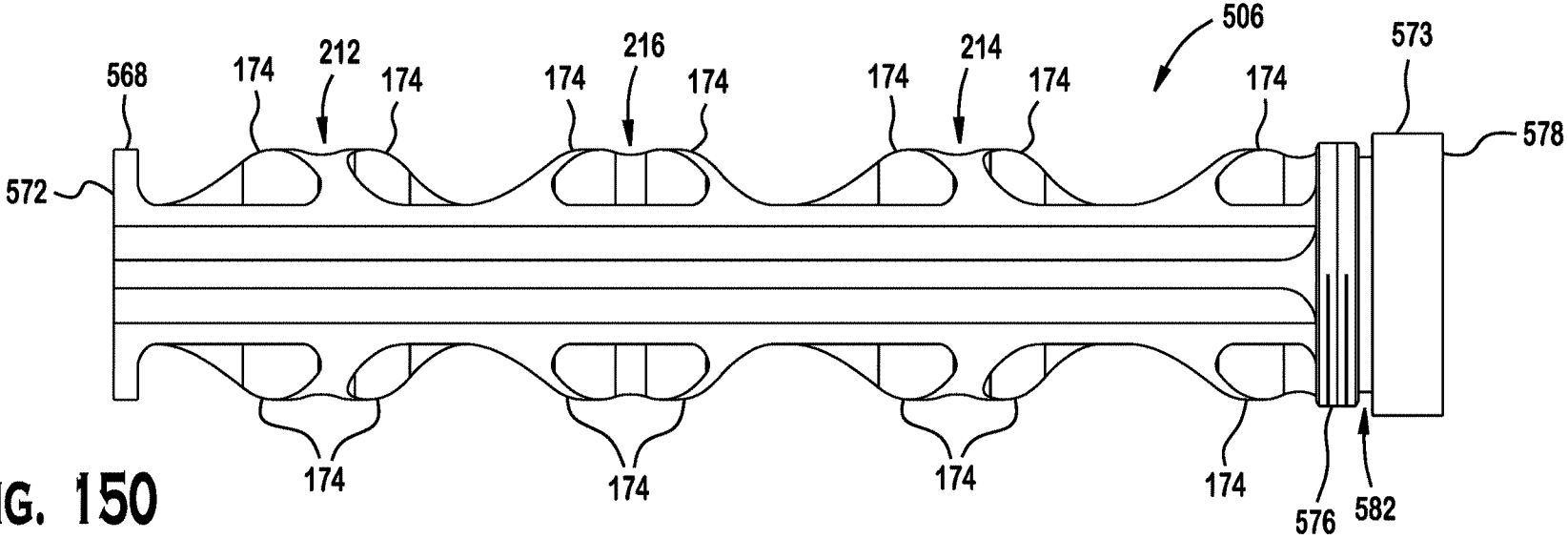
Figure 151:
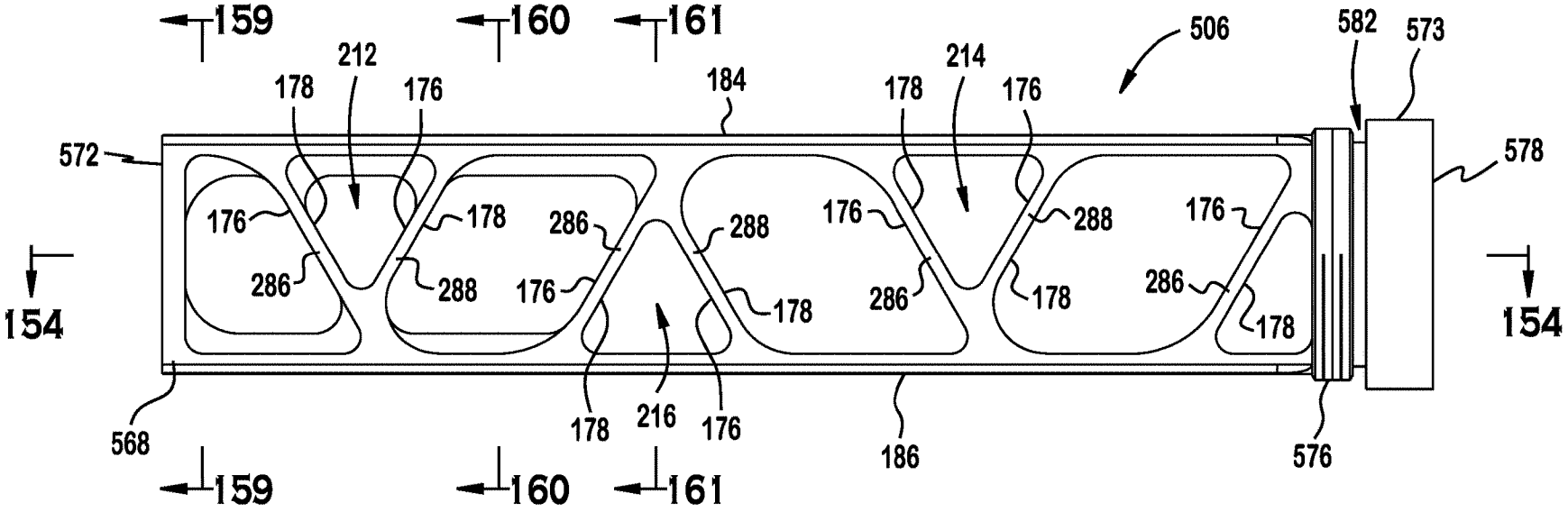
Figure 152:
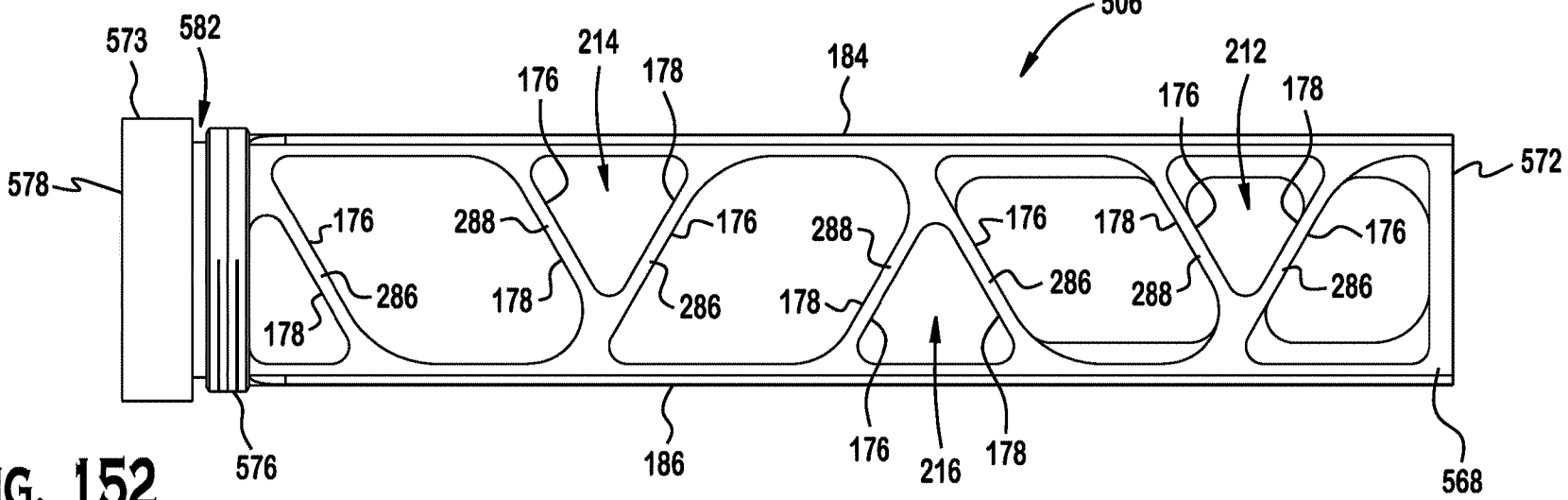
Figure 153:
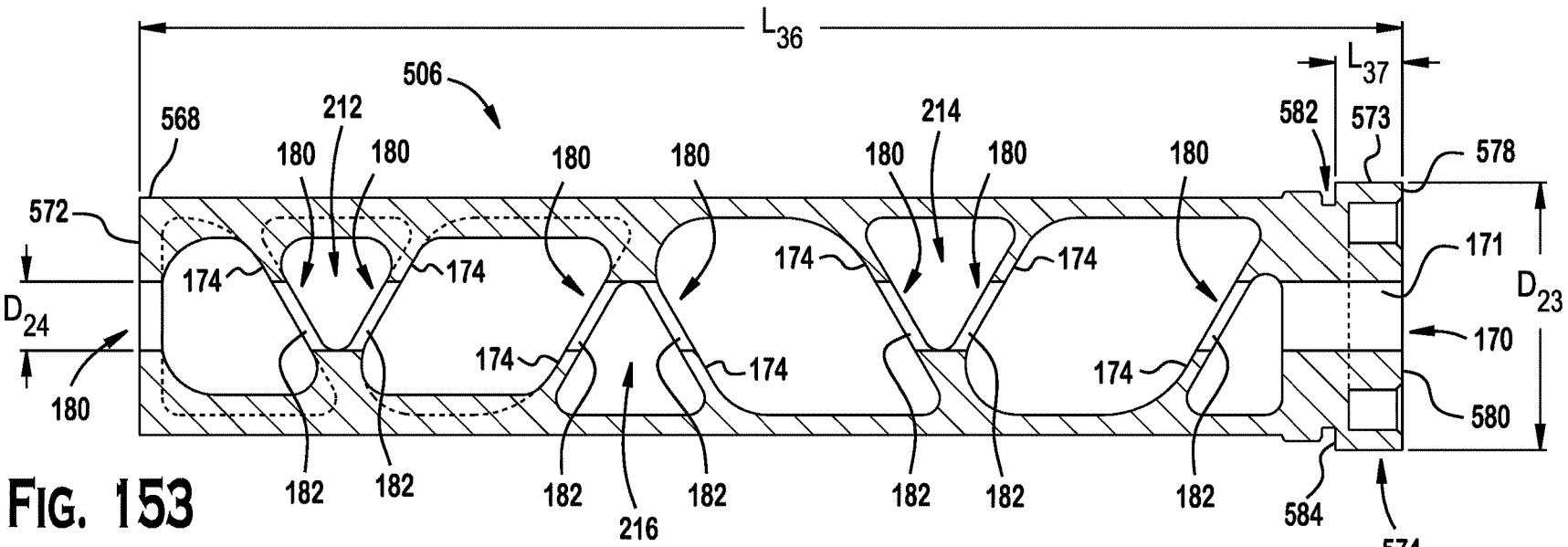
Figure 154:
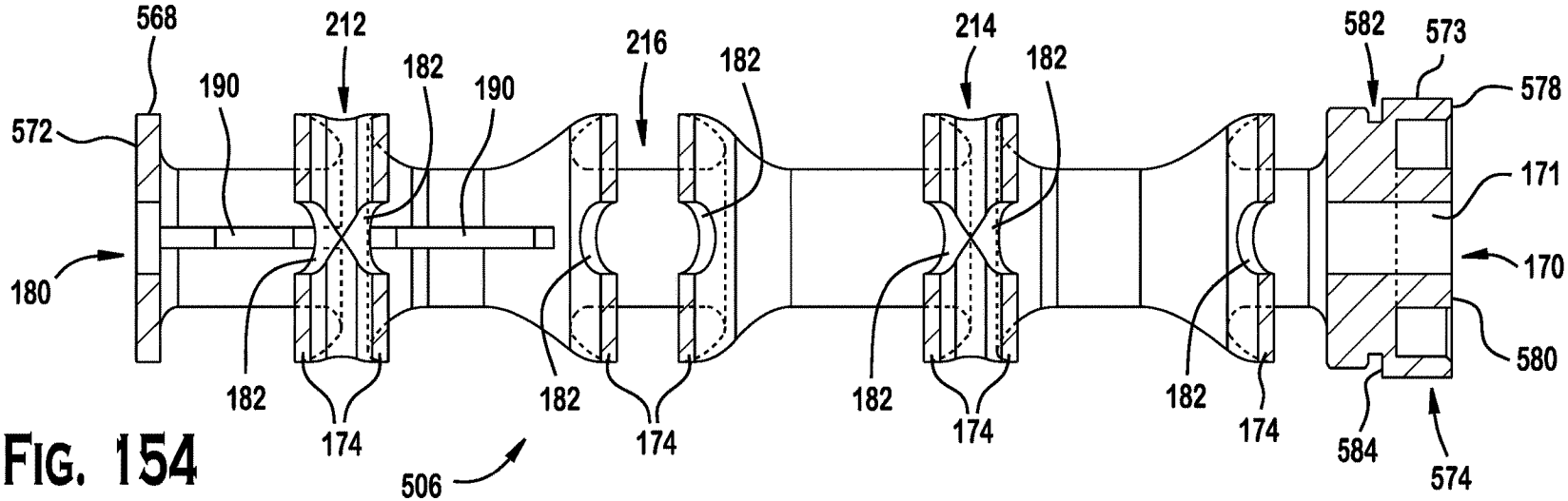
Figure 155:
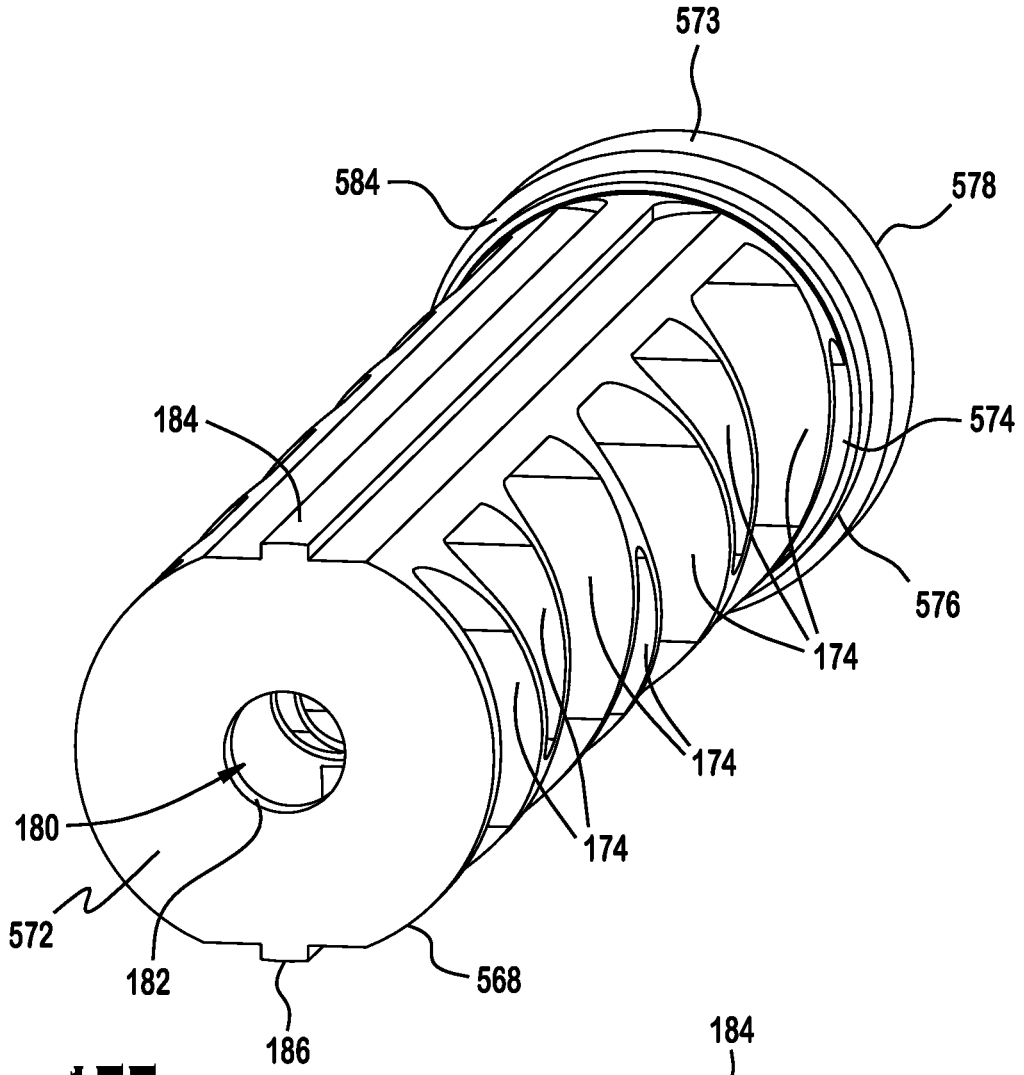
Figure 156:
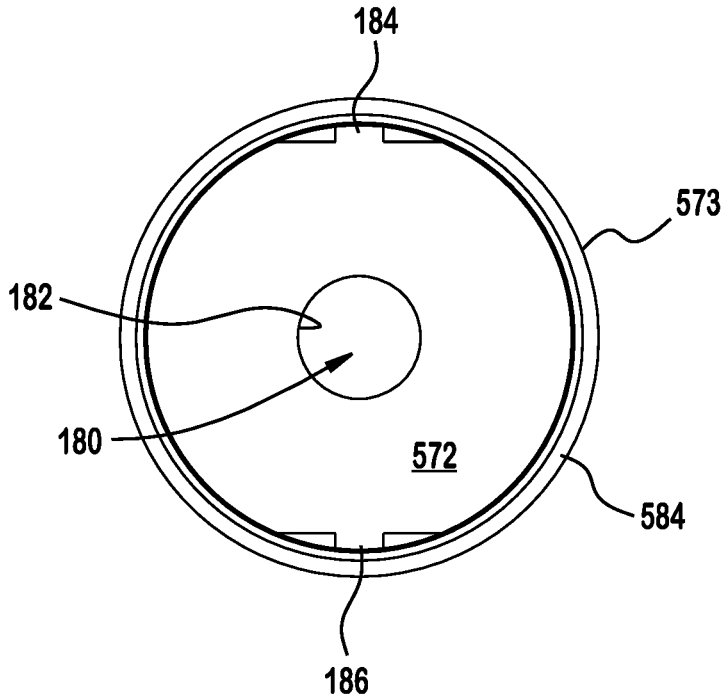
Figure 157:
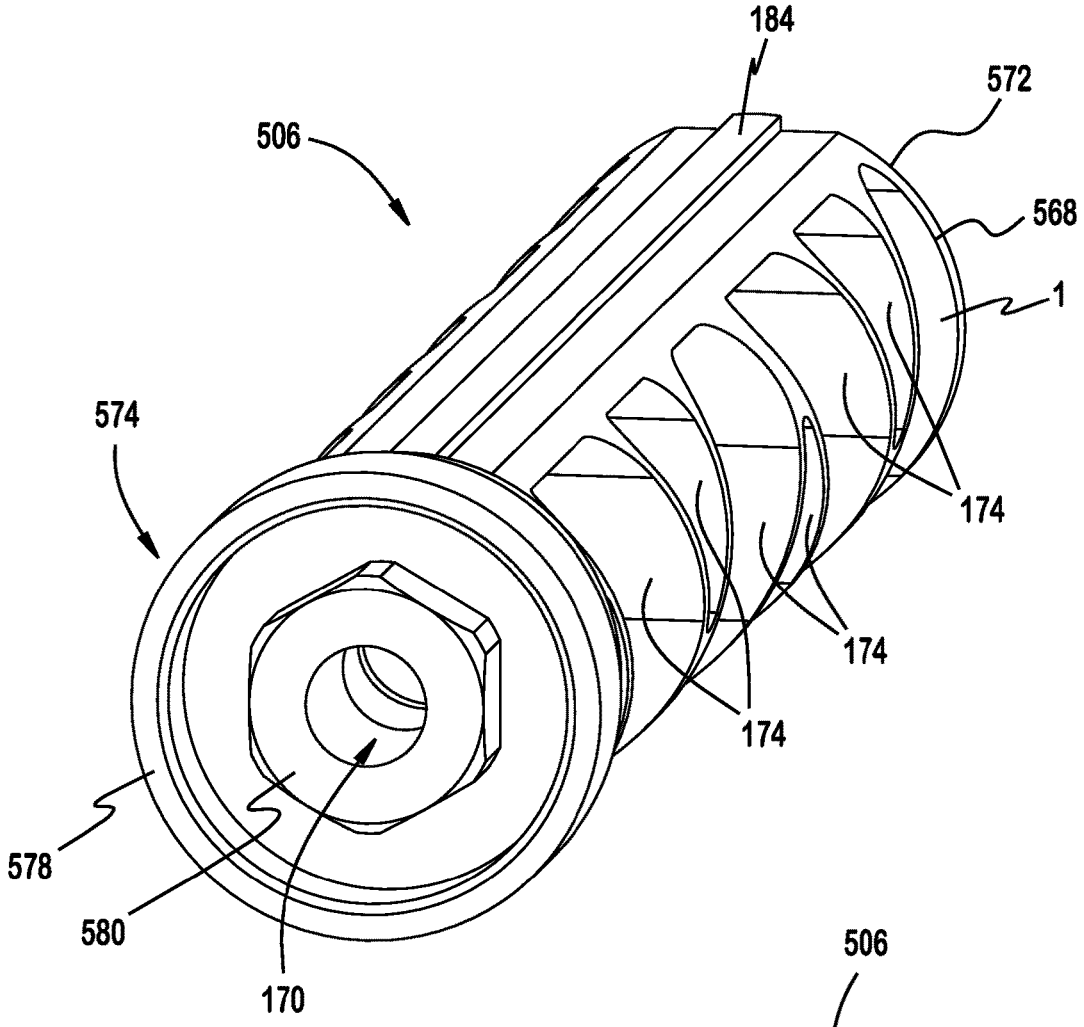
Figure 158:
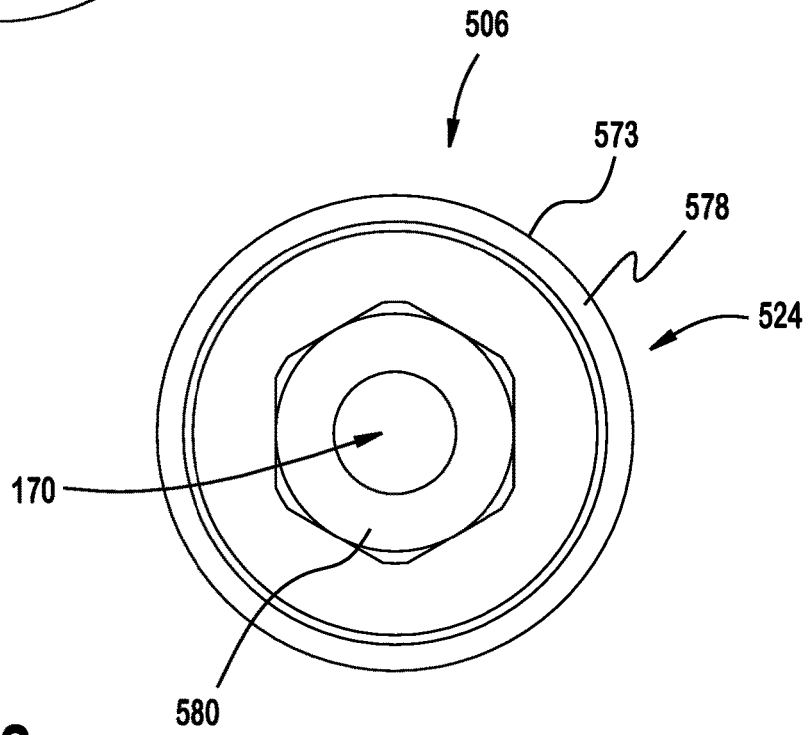
Figure 159:
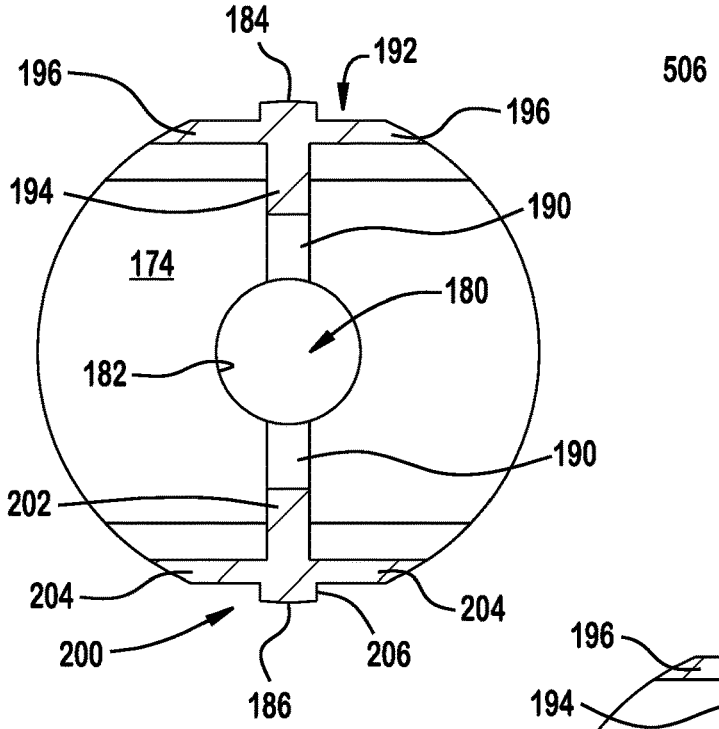
Figure 160:
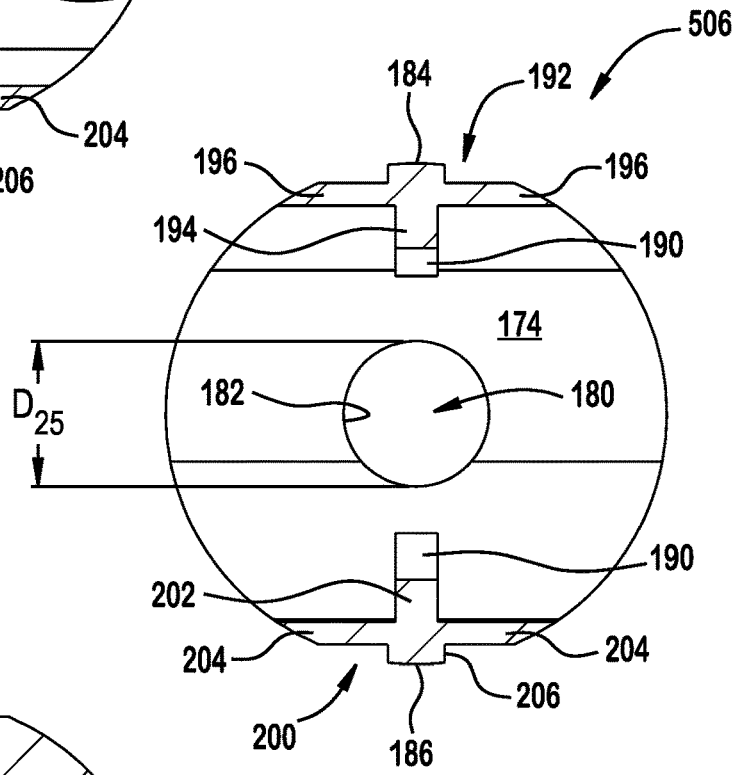
Figure 161:
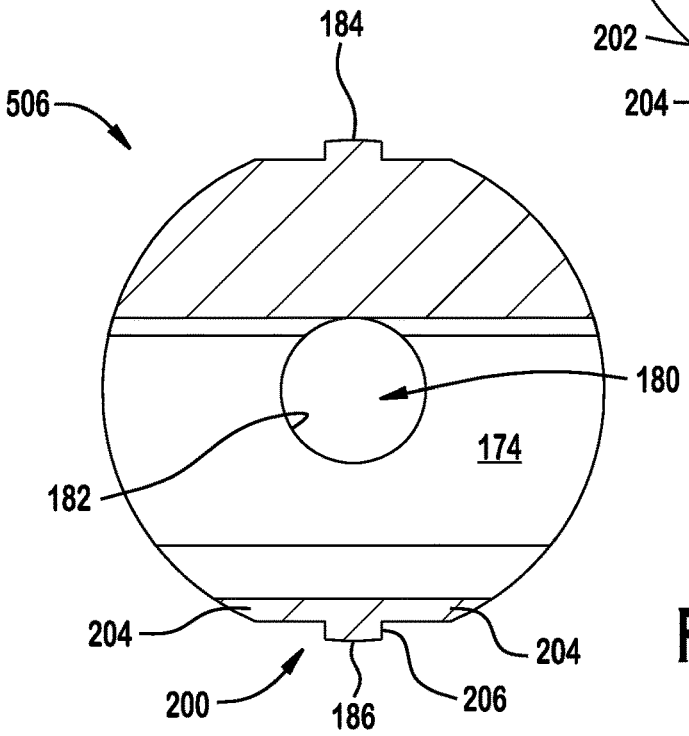
Figure 162:
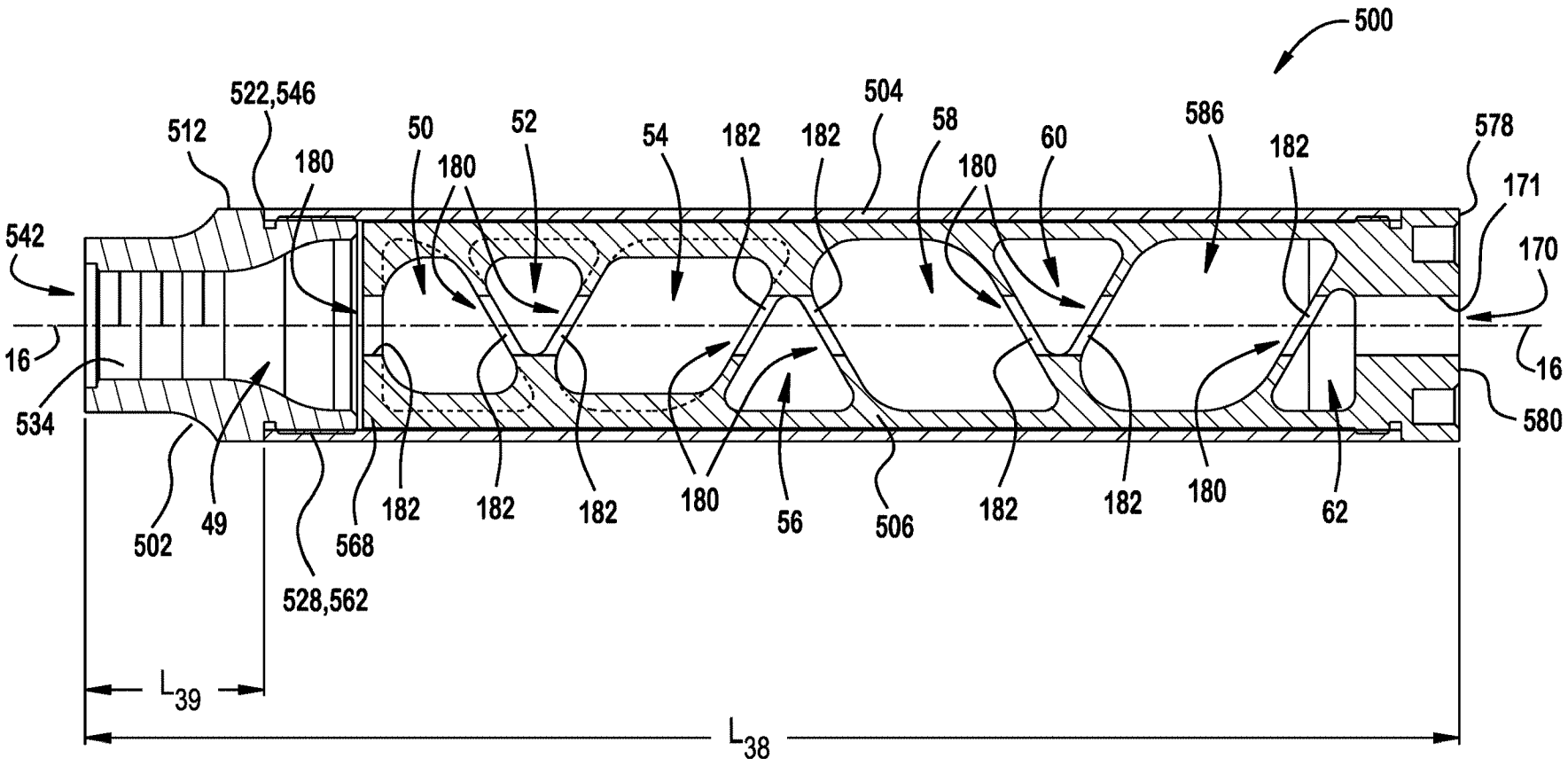
Figure 163:
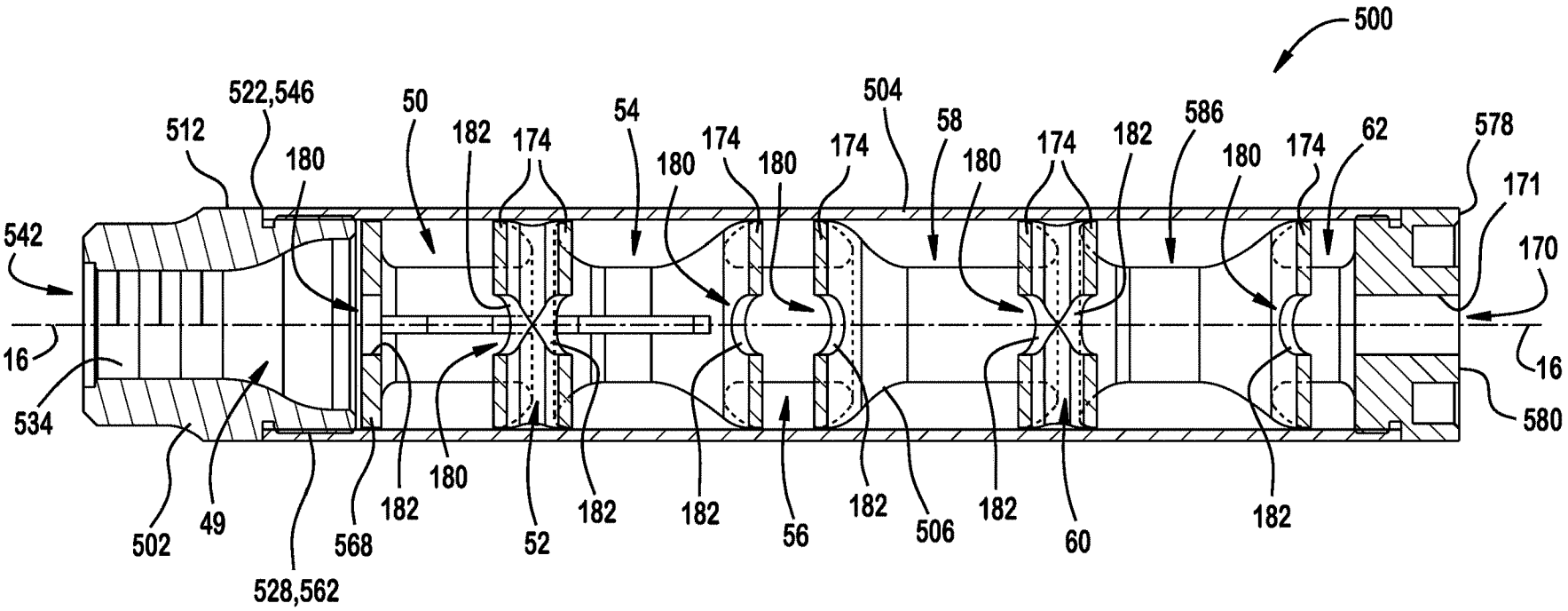
Figure 164:
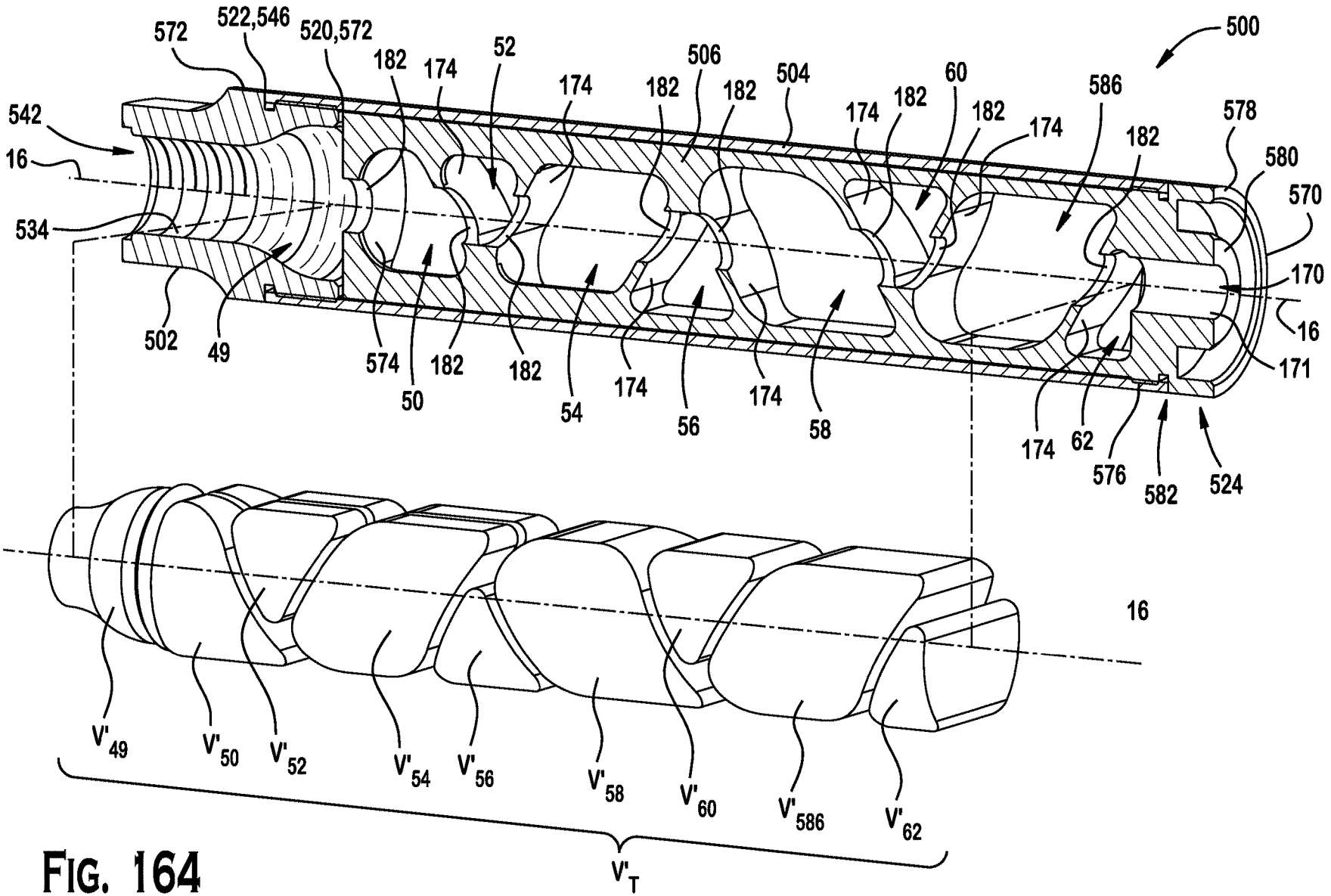
Figure 165:
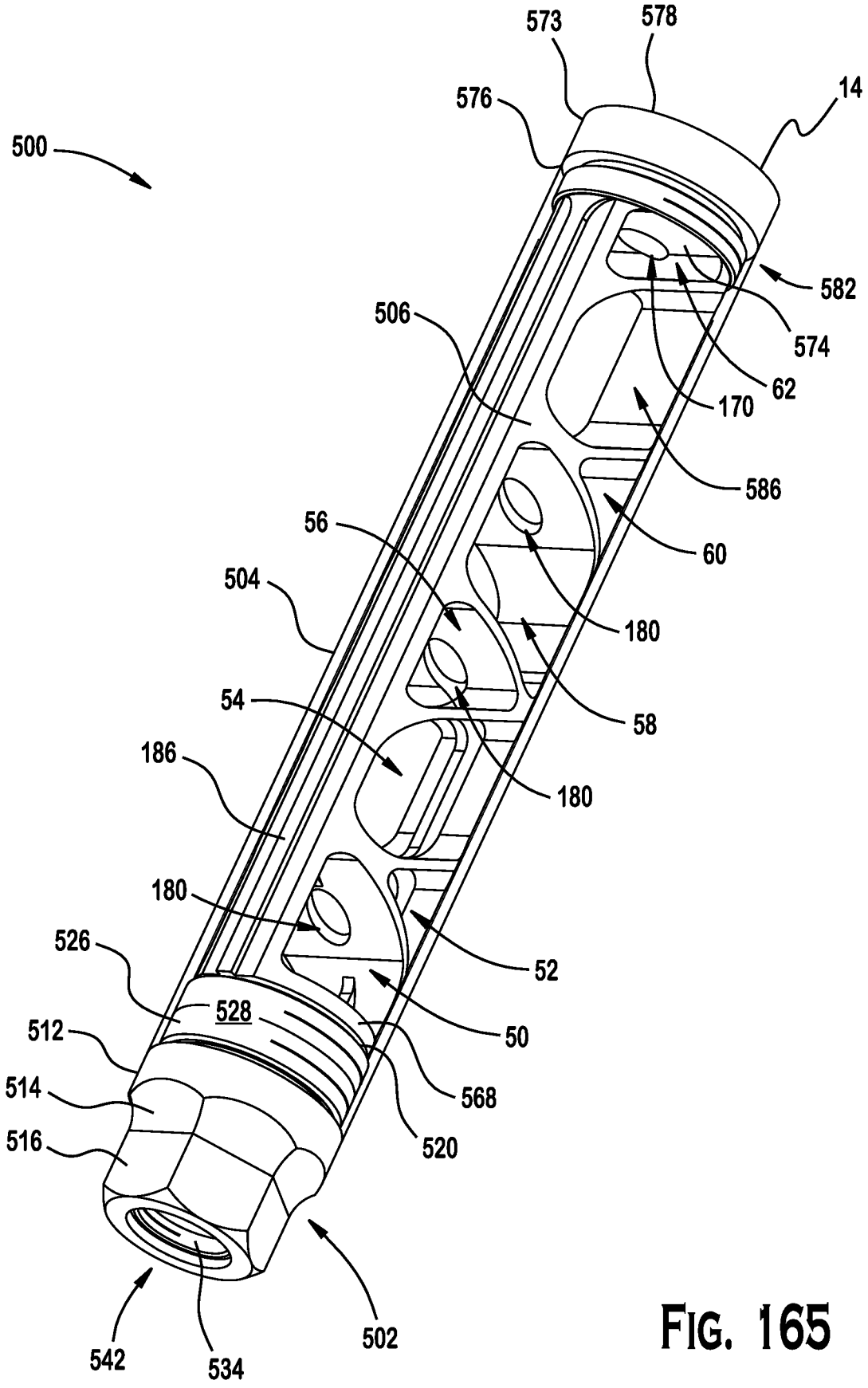

FIG. 131 is a cross-sectional view of the core of FIG. 105, along line 131-131:

FIG. 132 is another perspective view of the suppressor of FIG. 105 showing the tube in a transparent rendering:

FIG. 133 is another exemplary embodiment of a suppressor:

FIG. 134 is another perspective view of the suppressor of FIG. 133;

FIG. 135 is an exploded view of the suppressor of FIG. 133;

FIG. 136 is a perspective view of the mount body of FIG. 135:

FIG. 137 is another perspective view of the mount body of FIG. 135;

FIG. 138 is a rear view of the mount body of FIG. 135:

FIG. 139 is a front view of the mount body of FIG. 135:

FIG. 140 is a top view of the mount body of FIG. 135:

FIG. 141 is a left side view of the mount body of FIG. 135:

FIG. 142 is a cross-sectional view of the mount body of FIG. 141 along line 142-142:

FIG. 143 is a perspective view of the tube of FIG. 135:

FIG. 144 is a side view of the tube of FIG. 135:

FIG. 145 is a cross-sectional view of the tube of FIG. 144 along line 145-145:

FIG. 146 is a cross-sectional view of the tube of FIG. 144 along line 146-146:

FIG. 147 is a perspective view of the core of FIG. 135:

FIG. 148 is another perspective view of the core of FIG. 135;

FIG. 149 is a top view of the core of FIG. 135:

FIG. 150 is a bottom view of the core of FIG. 135:

FIG. 151 is a left side view of the core of FIG. 135:

FIG. 152 is a right side view of the core of FIG. 135:

FIG. 153 is a cross-sectional view of the core of FIG. 149 along line 153-153;

FIG. 154 is a cross-sectional view of the core of FIG. 151 along line 151-151:

FIG. 155 is another perspective view of the core of FIG. 135;

FIG. 156 is a rear view of the core of FIG. 135;

FIG. 157 is a top front right side perspective view of the core of FIG. 135;

FIG. 158 is a front view of the core of FIG. 135:

FIG. 159 is a cross-sectional view of the core of FIG. 151 along line 159-159:

FIG. 160 is a cross-sectional view of the core of FIG. 151 along line 160-160;

FIG. 161 is a cross-sectional view of the core of FIG. 151 along line 160-160;

FIG. 162 is a cross-sectional view of the suppressor of FIG. 133 along line 162-162:

FIG. 163 is a cross-sectional view of the suppressor of FIG. 133 along line 163-163:

FIG. 164 is a cross-sectional view of the suppressor of FIG. 133 along line 162-162, along with a perspective view of a rendering which depicts the working volume of void space enclosed by the suppressor; and FIG. 165 is a perspective view of the suppressor of FIG. 134 showing the tube in a transparent rendering.

DESCRIPTION

Figure 1:
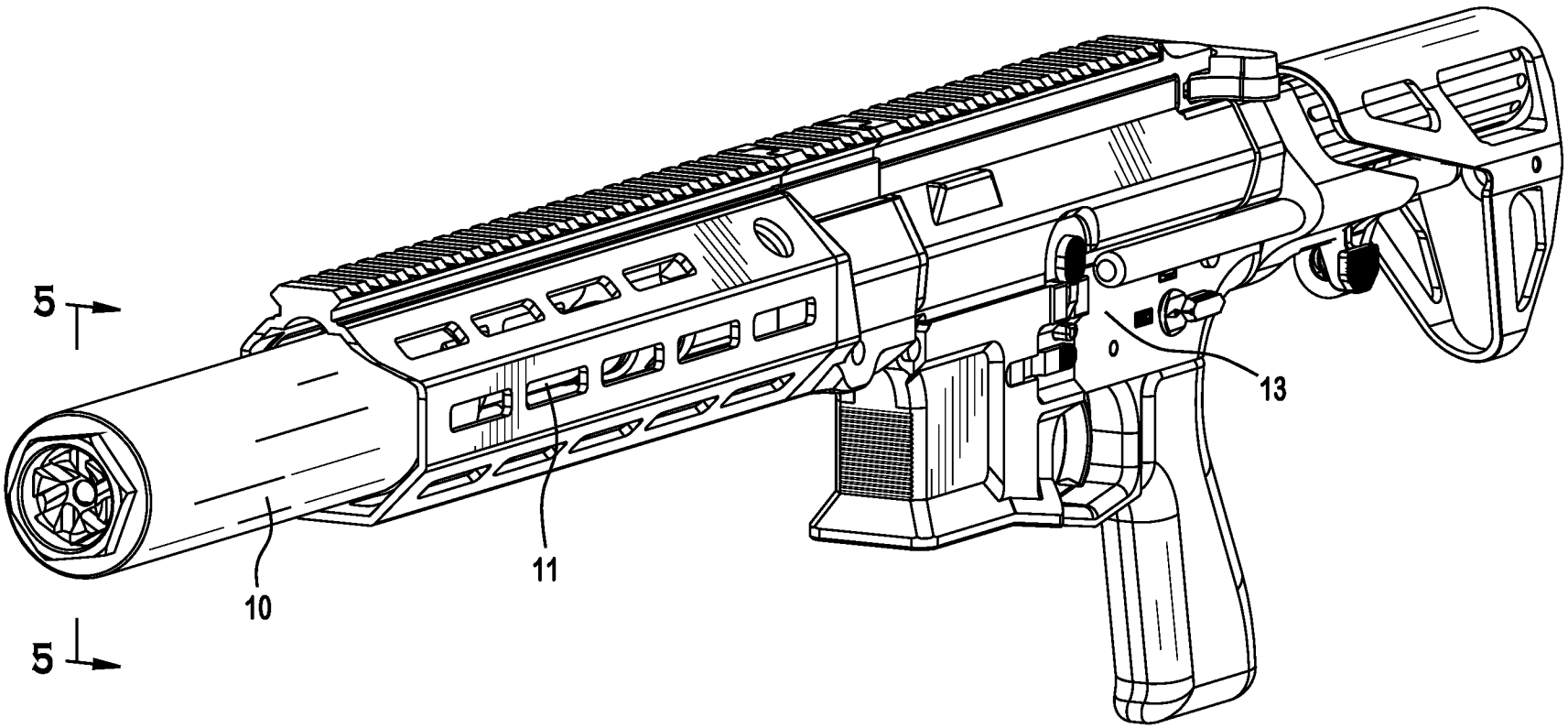
FIG. 1 is a perspective view of an exemplary embodiment of a suppressor, the suppressor being deployed on a barrel of an illustrative host firearm.
Figure 2:
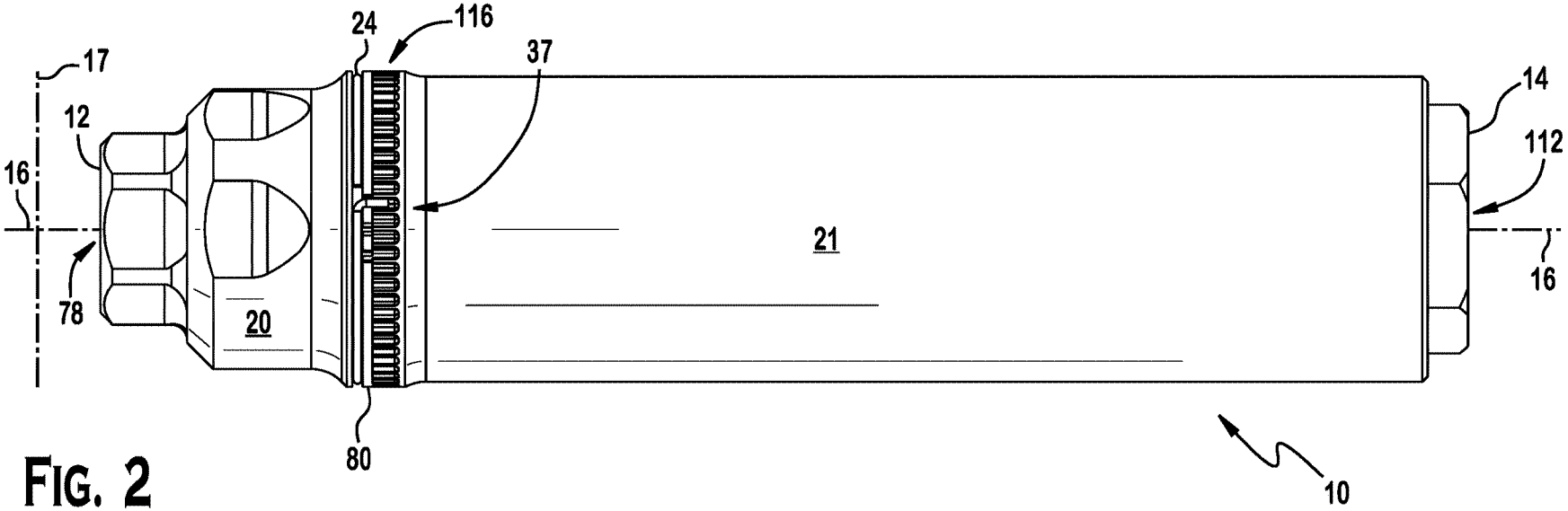
FIG. 2 is a side view of the suppressor of FIG. 1.
Figure 3:
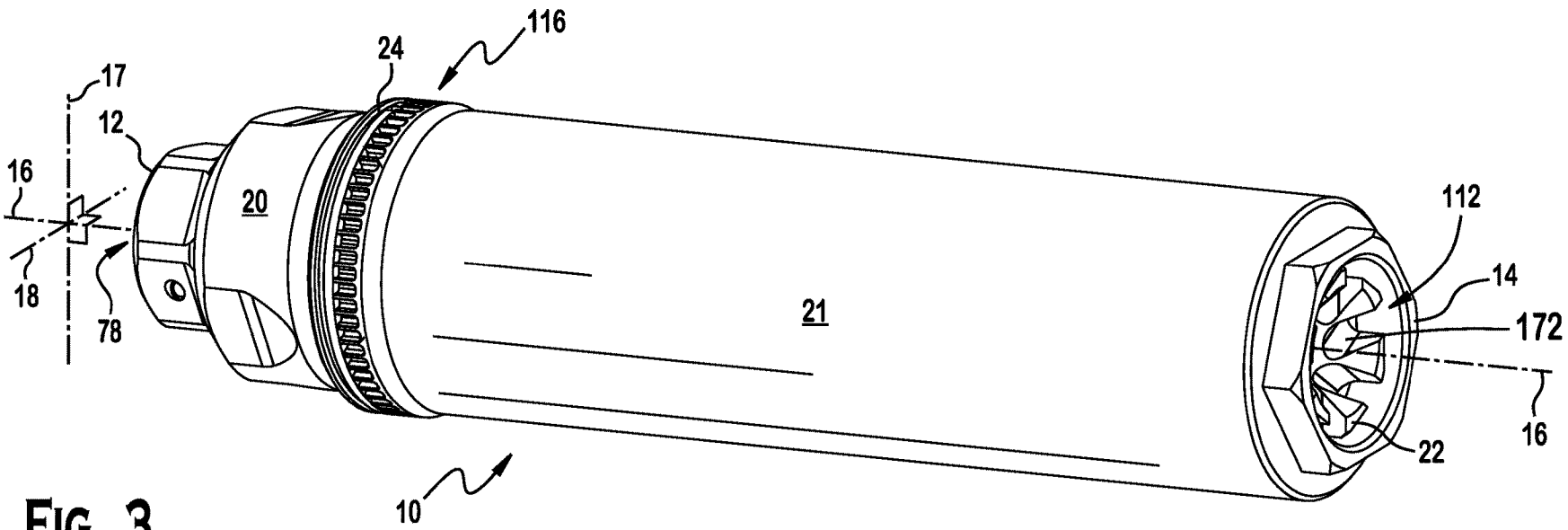
FIG. 3 is a perspective view of the suppressor of FIG. 1.
Figure 4:
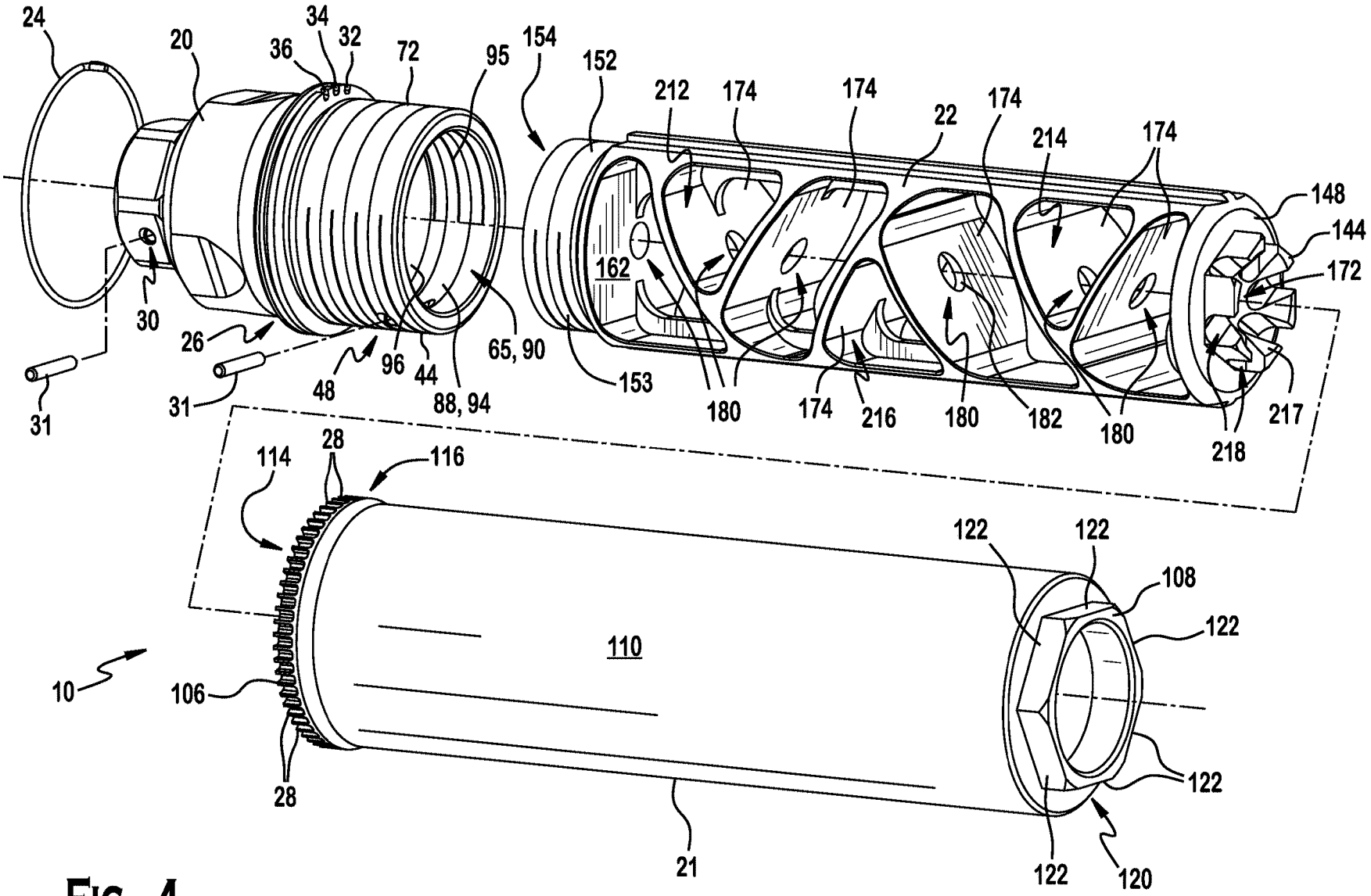
FIG. 4 is an exploded view of the suppressor of FIG. 1.
Figure 5:
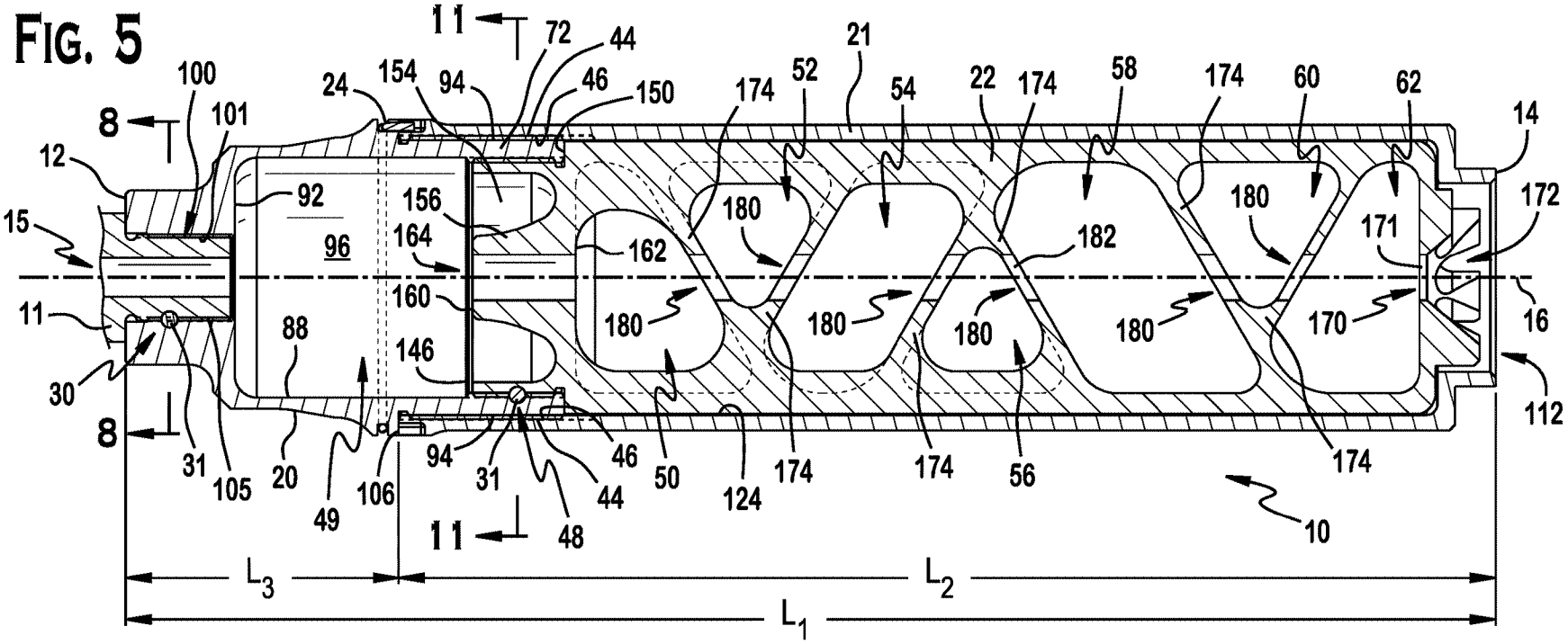
FIG. 5 is a partial cross-sectional view of the suppressor and barrel of the host firearm of FIG. 1, along line 5-5.

FIG. 1 shows an exemplary embodiment of a suppressor 10 deployed on a barrel 11 of a host firearm 13. Referring to FIGS. 2 and 3, the suppressor 10 may include a proximal end 12 and a distal end 14, as well as a longitudinal axis 16 extending from the proximal end to the distal end. Further, a lateral axis 18 may be disposed perpendicular to the longitudinal axis, and a vertical axis 17 may be disposed perpendicular to the longitudinal axis and the vertical axis. The proximal end 12 may include a mount body 20. The suppressor 10 further may include a tube 21. Referring to FIGS. 4 and 5, the mount body 20 and the tube 21 may cooperate to form a housing for internal baffles 154, 174 that may be configured and dimensioned to dissipate kinetic energy and reduce blast intensity of firearm discharge gases. Preferably, a plurality of the baffles may be formed as a unitary structure or core 22. For instance, a core 22 may be arranged inside the mount body 20 and telescopically received within the tube 21. Although, the core 22 may be a unitary structure, the core may be formed from multiple parts or combined with other parts, including M-baffles, K-baffles, or other baffle types.

The mount body 20 and tube 21 may be connected by mating screw threads 44, 46. As shown in FIGS. 4 and 12

(and as described in detail below), respective features of the mount body (e.g., grooves 26, 32, 34 and 36) and tube (e.g., elongated recesses 28) may be arranged to present a configuration (e.g., a locking index 38) which may cooperate with a fixation element (e.g., a spring 24) to further secure the connection. See also, FIGS. 31, 32 and 33. Additionally, as shown in FIG. 5, other features of the mount body 20 (e.g., proximal segment 96) may be configured and dimensioned to complement the proximal end 146 of core 22 to cooperatively form a lead chamber 49 of the suppressor. The lead chamber 49 disposed between the inner side wall 88 of the mount body 20 and the proximal end wall 150 of the core 22 may be referred to as a blast chamber.

Referring to FIGS. 22, 23, 24, 25, 26, 27, 28, 29 and 30, the mount body 20 may include a proximal end 64, as well as a distal end 66 spaced from the proximal end 64 along the longitudinal axis 16. The mount body 20 may include an intermediate body 68 disposed between the proximal end 64 and the distal end 66. Also, the mount body 20 may include a collar 70 disposed between the intermediate body 68 and the proximal end 64. The collar 70 may be adjacent to the intermediate body 68 and the proximal end 64. The collar further may include a plurality of facets 76. Referring to FIG. 12, preferably the collar may include six facets which are arranged to form a hexagonal shaped fitting. The intermediate body 68 also may include a plurality of facets 74. Preferably, the intermediate body 68 may include four facets which are arranged to form a fitting. For instance, the four facets may be arranged to form a generally square shaped fitting. Alternately, the four facets may be arranged to form another shape including four flat sides which may form a fitting of a proprietary configuration. Most preferably, however, the collar 70 and the intermediate body 68 may each include at least one pair of opposing facets such that an appropriately sized open end wrench or other tool may be used to hold or manipulate the mount body.

The mount body 20 further may include an annular stem 72 disposed between the intermediate body 68 and the distal end 66. For example, as shown in FIGS. 26-30, the intermediate body 68 may include a flange 80. A thread relief (e.g., a circumferential groove) 86 may be disposed between the outer side wall 84 of the annular stem 72 and the flange 80. The outer sidewall of 84 of the annular stem 72 may include a screw thread 44. The screw thread 44 on the outer surface of the annular stem 72 may be configured and dimensioned to mate with a screw thread 46 disposed on the interior side wall 124 of the tube (see e.g., FIG. 5) adjacent to the proximal end 106 of the tube. For example, the screw thread 44 on the outer sidewall 84 of the annular stem 72 may mate with a screw thread 46 on the annular stem housing sidewall segment 140. Preferably, the screw threads 44, 46 are right-hand screw threads. In FIG. 30, the outer dimension of the flange 80 may be greater than the outer dimension of the outer sidewall 84. Accordingly, the flange 80 may include a distal face 82 that may form a seat for the tube (see e.g., FIGS. 5 and 55). Additionally, a circumferential groove 26 may abut the flange on the proximal side, and thus the flange 80 may include a proximal face adjacent to the circumferential groove 26.

Figure 14:
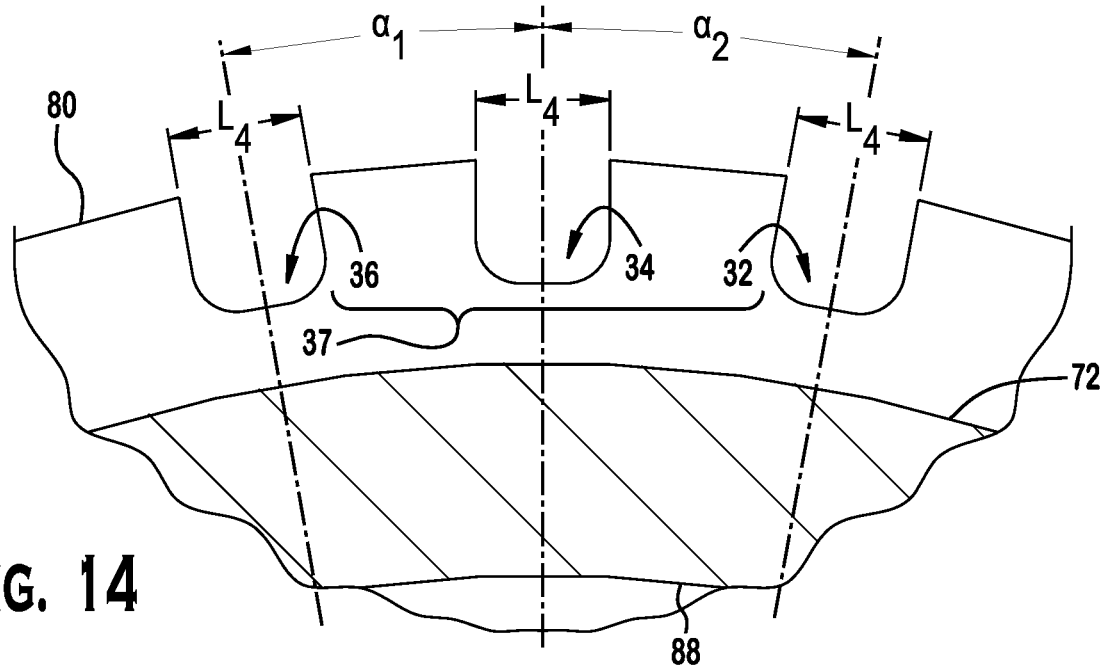
FIG. 14 is a detail view of the indexing notches of FIG. 13.
Figure 15:
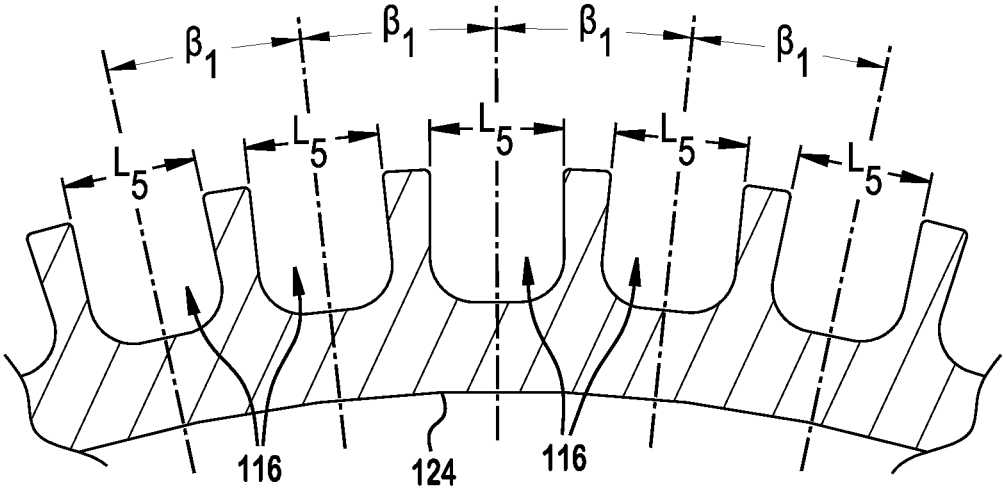
FIG. 15 is a detail view of the elongated recesses of FIG. 13.
Figure 16:
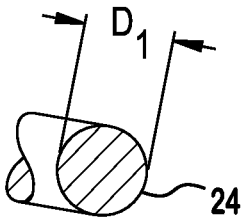
FIG. 16 is a detail view of the securing member of FIG. 13.

Referring to FIGS. 14, 22, 25 and 26, the flange 80 may include three longitudinally aligned grooves 32, 34, 36. Preferably, each of the three longitudinally aligned grooves may extend from the proximal face of the flange to the distal face of the flange. Each of the three longitudinally aligned grooves 32, 34, 36 may define a notch that possesses a transverse length L4. The spacing between the three longitudinally aligned grooves 32, 34, 36 may be unequal. Referring to FIG. 14, the centerline of the transverse length of the second longitudinal grove 34 may define a reference direction. The center line of the first longitudinal groove 36 may lie at first angle $\alpha_1$ from the reference direction. Additionally, the center line of the third longitudinal groove 32 may lie at first angle $\alpha 2$ from the reference direction. Preferably, the first angle $\alpha 1$ and the second angle $\alpha 2$ may be about 10 degrees. For example, the first angle $\alpha 1$ may measure about 9.9 degrees, and the second angle $\alpha 2$ may measure about 10.3 degrees. As shown in FIG. 12, the longitudinal grooves 32, 34, 36 may be referred to as indexing notches 37. Also, the circumferential groove 26 may be configured and dimensioned to hold a coil of spring wire 24. As shown in FIG. 16, the spring wire may have a diameter D1 which may be sized to fit in the locking index 38 (see e.g., FIGS. 12, 13, 14, 15 and 16).

Figure 9:
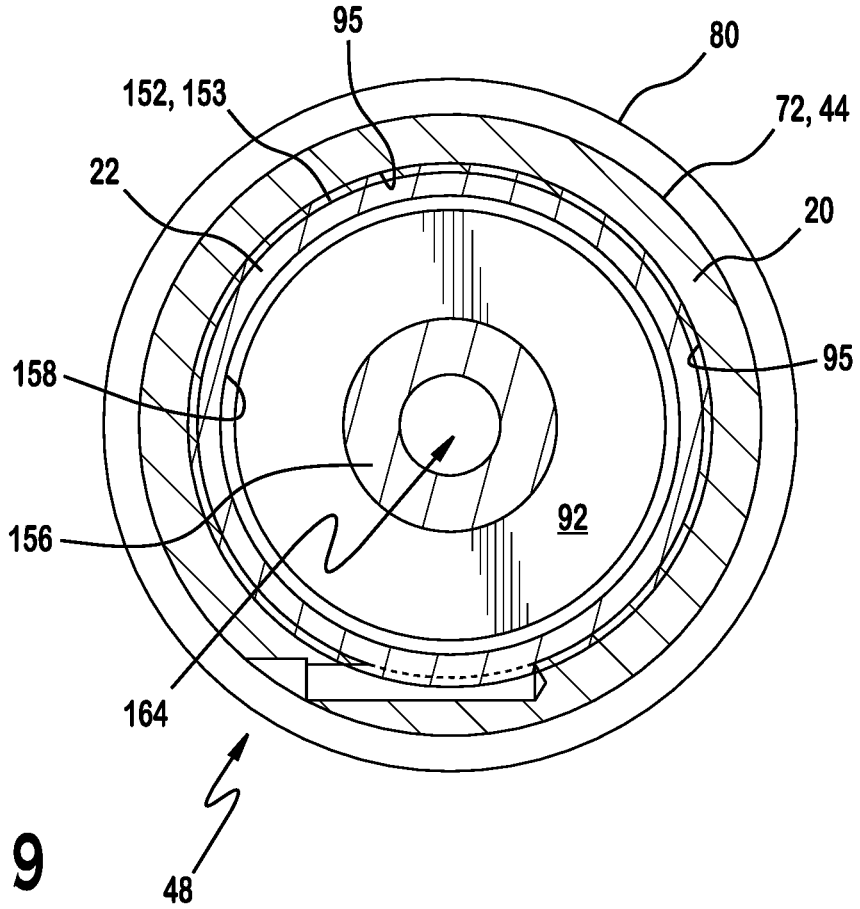
FIG. 9 is a cross-sectional view of the suppressor of FIG. 5, along line 11-11 prior to drilling a locking recess into the core.
Figure 10:
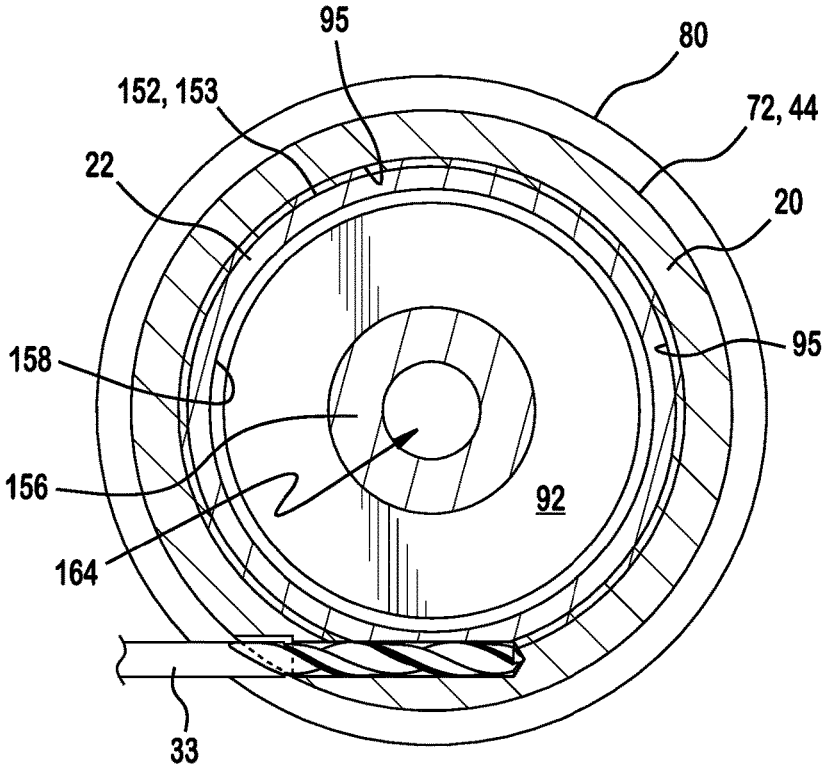
FIG. 10 is a cross-sectional view of the suppressor of FIG. 5, along line 11-11 illustrating an exemplary step of drilling a locking recess into the core.
Figure 11:
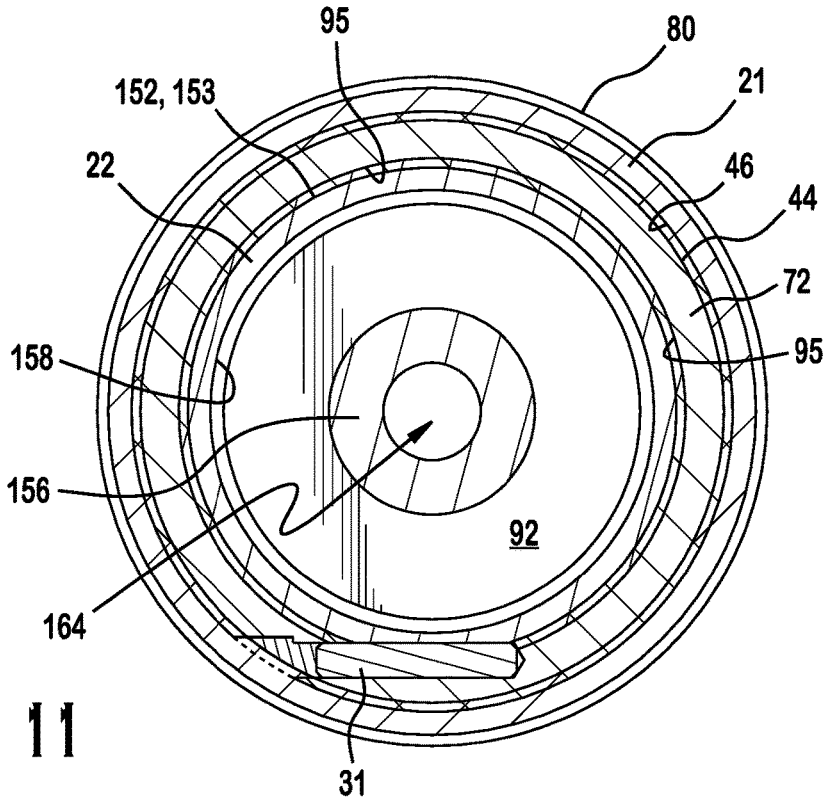
FIG. 11 is a cross-sectional view of the suppressor of FIG. 5, along line 11-11.
Figure 22:
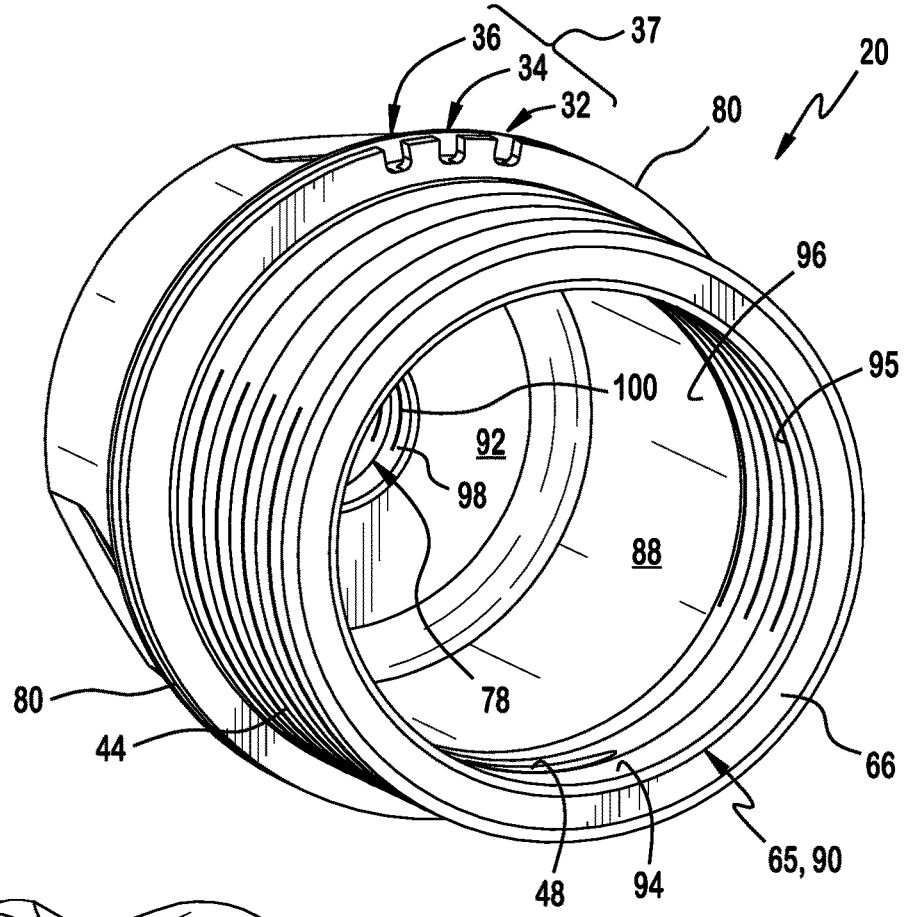
FIG. 22 is a perspective view of the mount body of FIG. 4.
Figure 23:
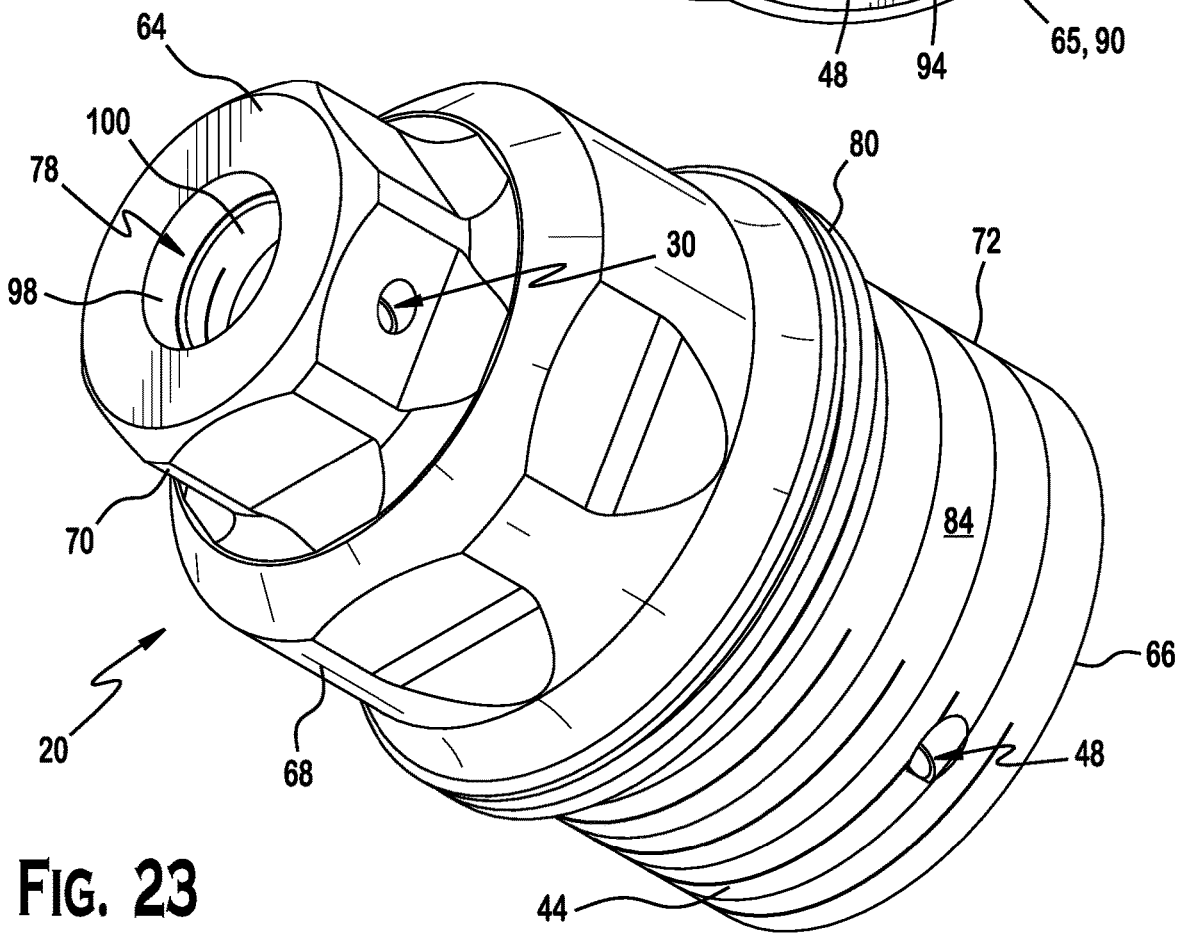
FIG. 23 is another perspective view of the mount body of FIG. 4.
Figure 24:
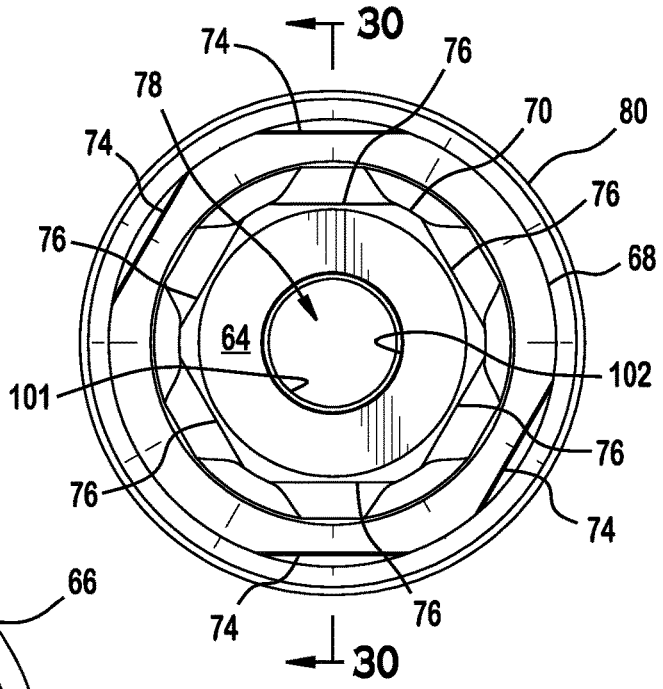
FIG. 24 is a rear view of the mount body of FIG. 4.
Figure 25:
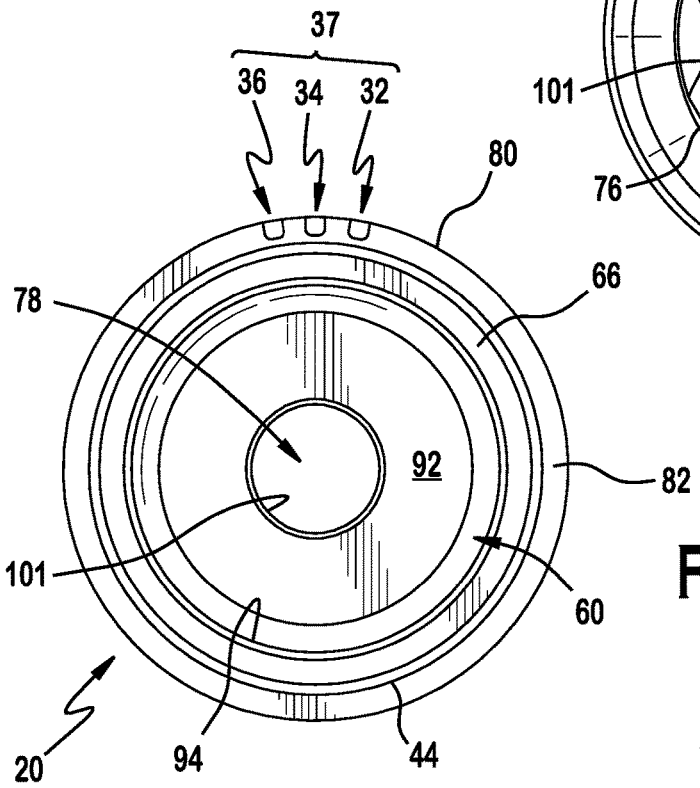
FIG. 25 is a front view of the mount body of FIG. 4.
Figure 26:
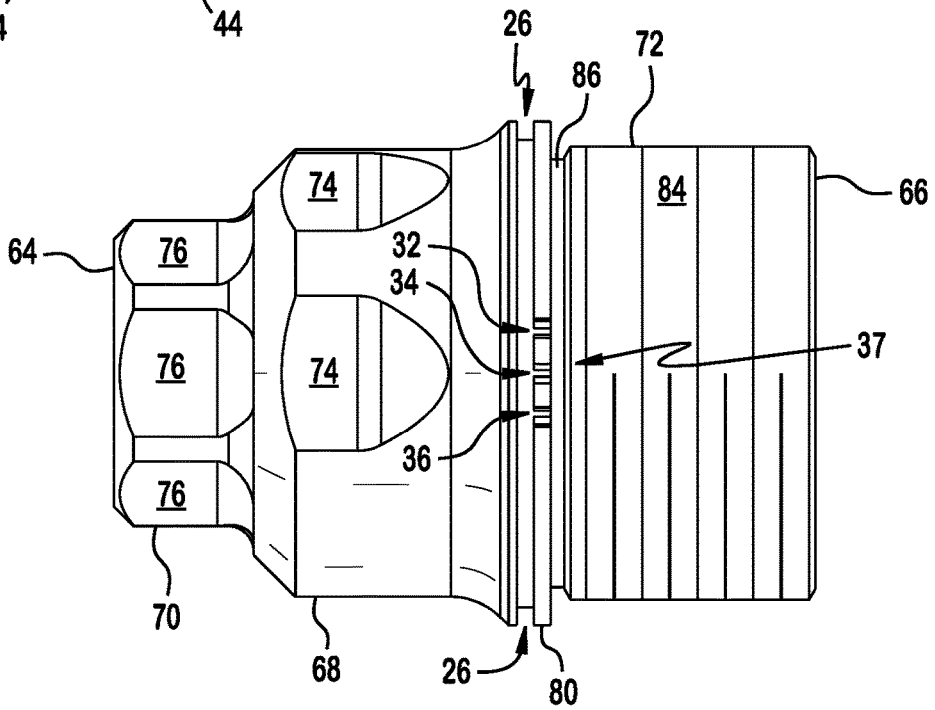
FIG. 26 is a top view of the mount body of FIG. 4.
Figure 27:
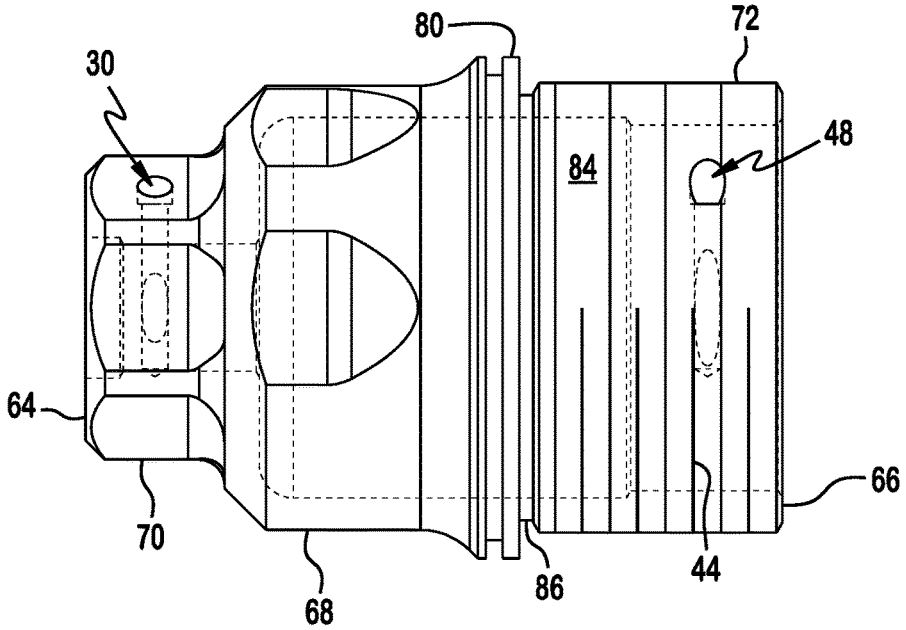
FIG. 27 is a bottom view of the mount body of FIG. 4.
Figure 28:
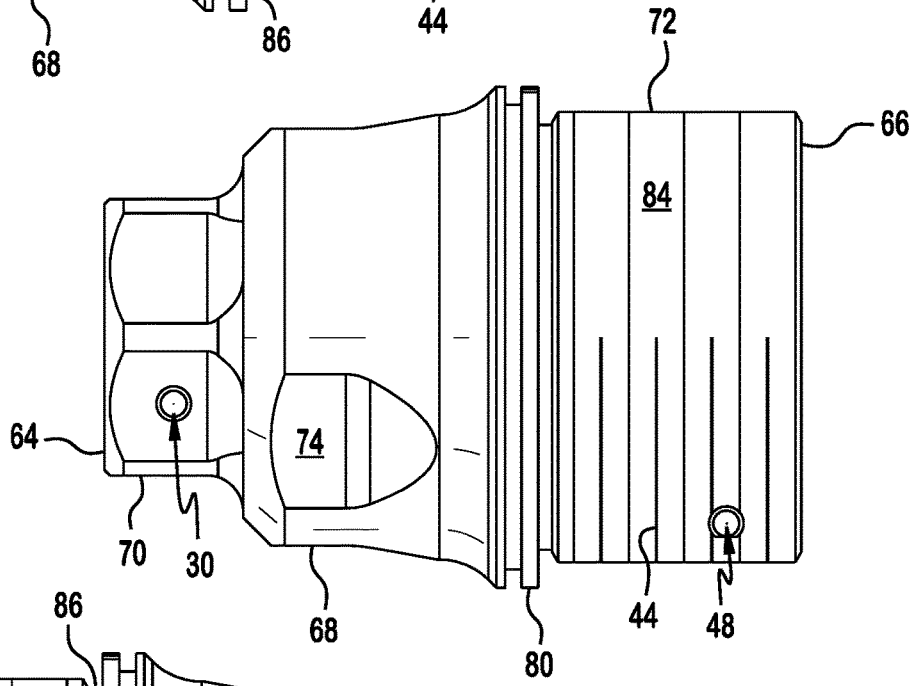
FIG. 28 is a left side view of the mount body of FIG. 4.
Figure 29:
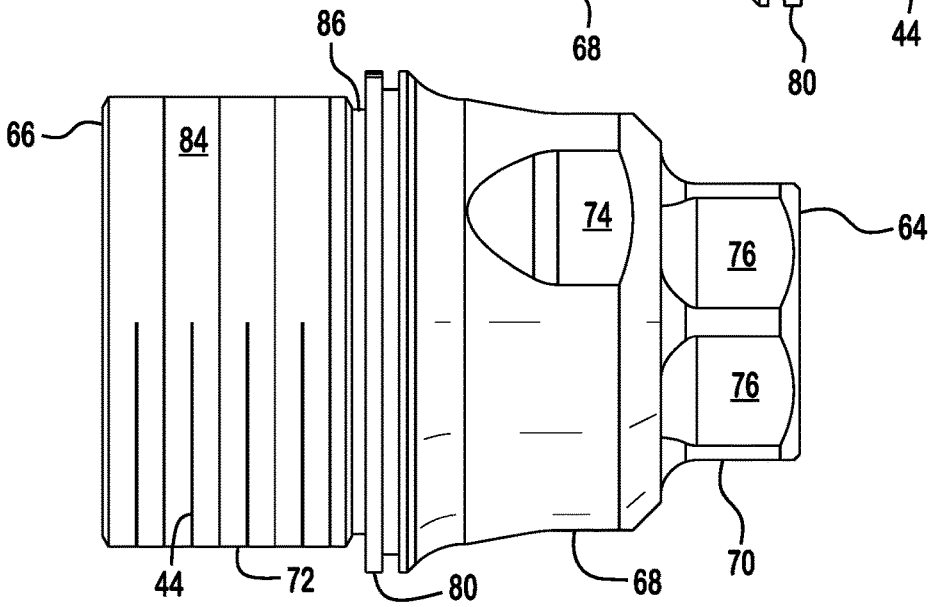
FIG. 29 is a right side view of the mount body of FIG. 4.
Figure 40:
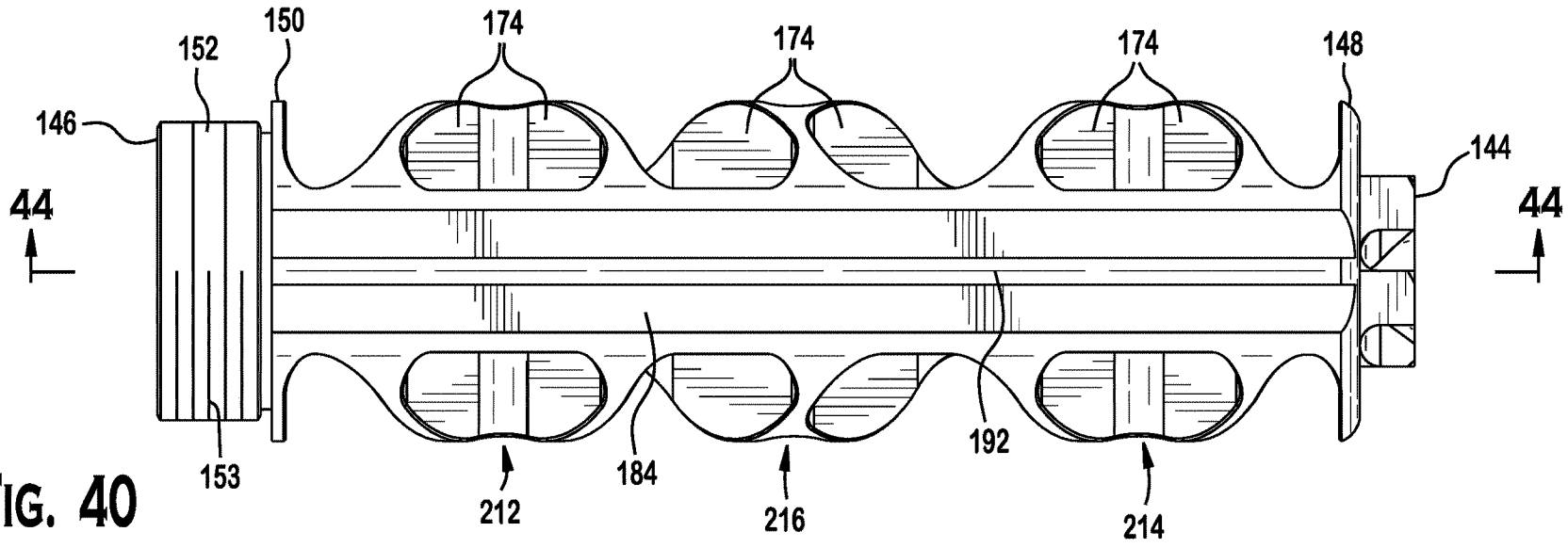
FIG. 40 is a top view of the core of FIG. 4.
Figure 41:
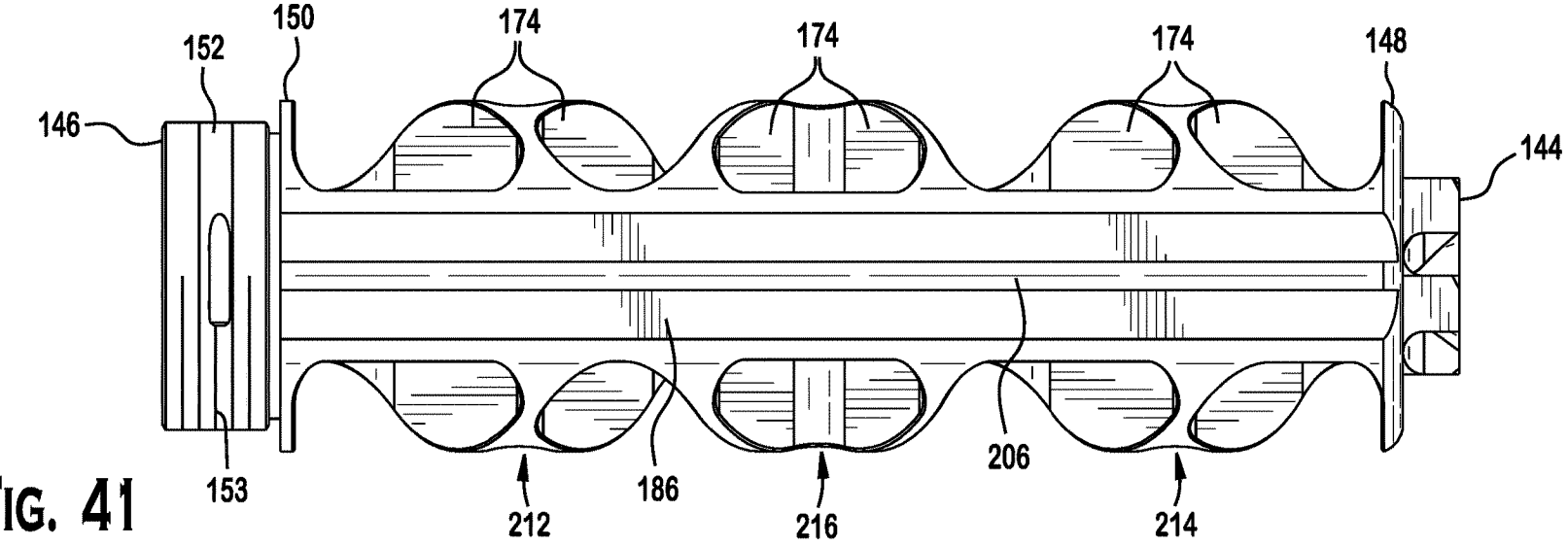
FIG. 41 is a bottom view of the core of FIG. 4.
Figure 42:
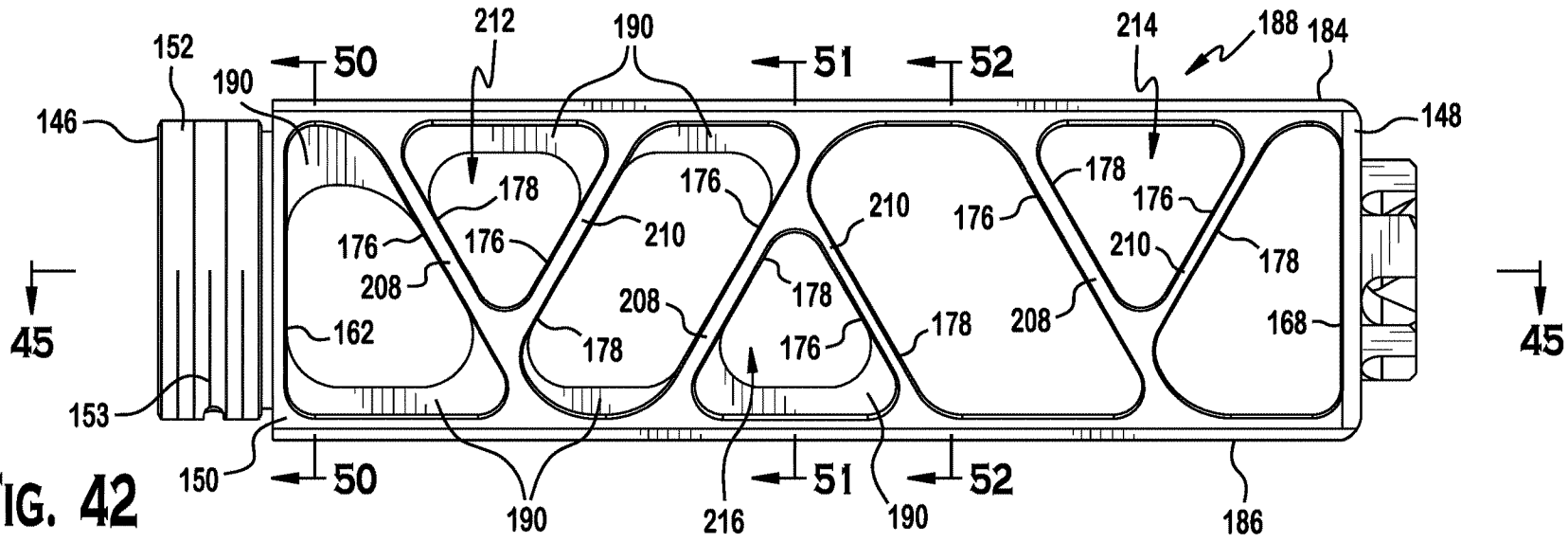
FIG. 42 is a left side view of the core of FIG. 4.
Figure 43:
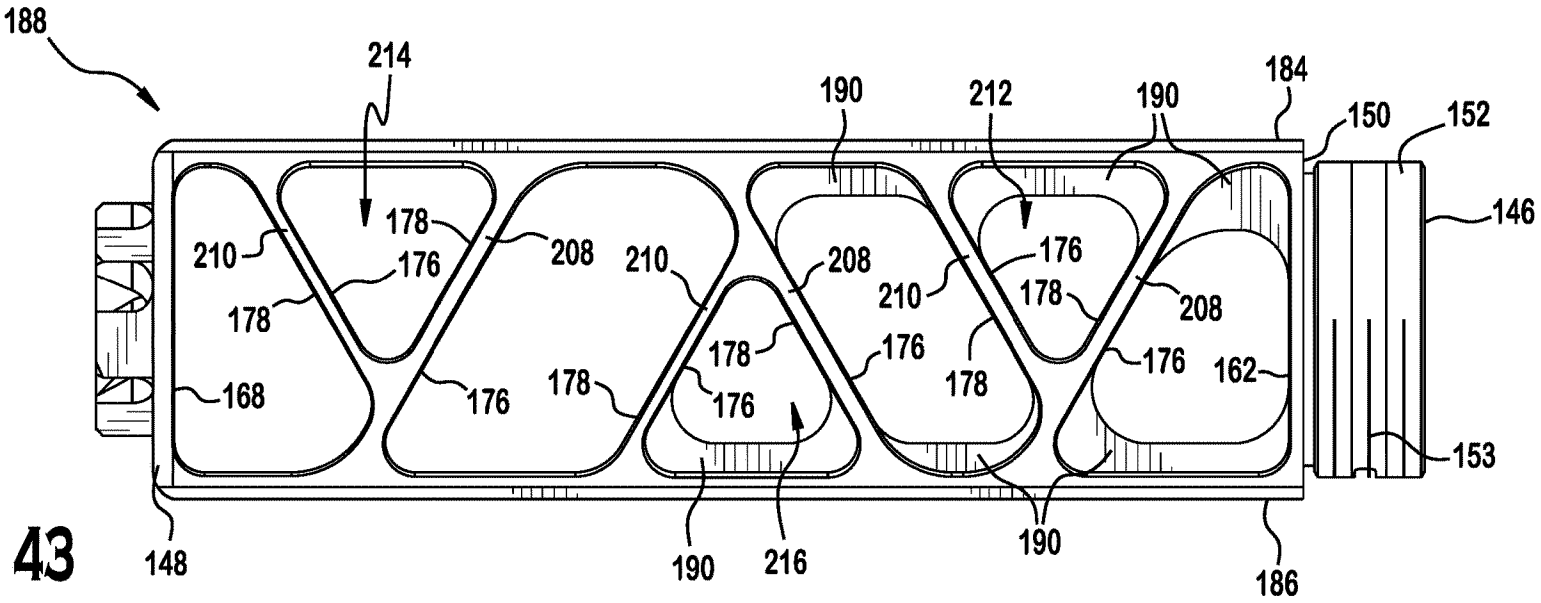
FIG. 43 is a right side view of the core of FIG. 4.

Referring to FIGS. 4, 22, 25 and 30, the annular stem 72 further may include an inner sidewall 88. As shown in FIG. 22, the inner sidewall 88 may extend from an opening 65 on the distal end 66 of the mount body 20 to the proximal end wall 92 of the intermediate body 68. The inner side wall 88 may include a distal segment 94 and a proximal segment 96. Referring to FIGS. 4, 22 and 40, the distal segment 94 may include a screw thread 95 that is configured and dimensioned to mate with a screw thread 153 on a proximal side wall 152 of the core 22. Preferably, the screw threads 95, 153 are left-hand screw threads. As shown in FIG. 22, the opening 65 on the distal end 66 of the mount body 20 and the distal segment 94 of the inner sidewall 88 may form a core mounting receptacle 90. Referring to FIGS. 9 and 10, the distal segment 94 further may include a fixation hole 48 that may be used to drill and pin the proximal end of the core to the mount body. As shown in FIGS. 4, 9, 10, 11, 22, 23, 27, 28 and 30, the fixation hole 48 may be positioned to cause a fixation pin 31 to pass through and engage the screw thread 153 on the core, and thus fix the core 22 to the mount body 20.

As shown in FIGS. 12, 22, 23 and 30, the proximal end 64 of the mount body 20 further may include a barrel receiving bore 78. The barrel receiving bore may include a sidewall 98 that extends from the proximal end 64 of the mount body to the proximal end wall 92 of the intermediate body 68. The sidewall 98 of barrel receiving bore 78 may include a threaded segment 100 and a recessed thread relief segment 102. The barrel receiving bore 78 may be configured and dimensioned to receive the muzzle end of a threaded barrel. Referring to FIGS. 4 and 5, the screw thread 101 on the threaded segment 100 may be configured and dimensioned to mate with a screw thread 9 on a host firearm barrel 11. Preferably, the screw threads 9, 101 are right-hand screw threads.

Figure 7:
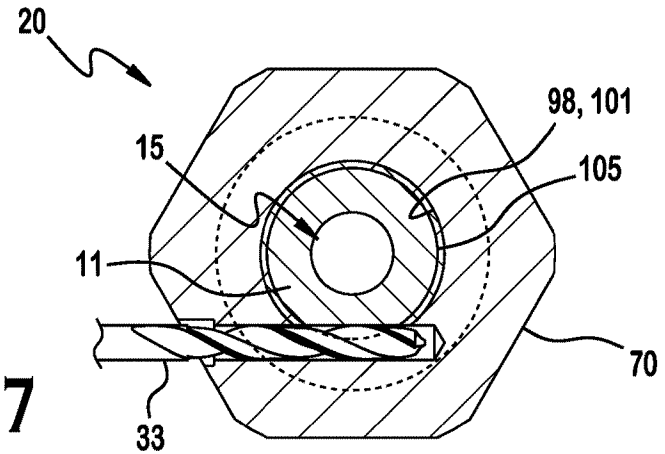
FIG. 7 is a cross-sectional view of the suppressor and barrel of the host firearm of FIG. 5, along line 8-8 illustrating an exemplary step of drilling a locking recess into the barrel.
Figure 6:
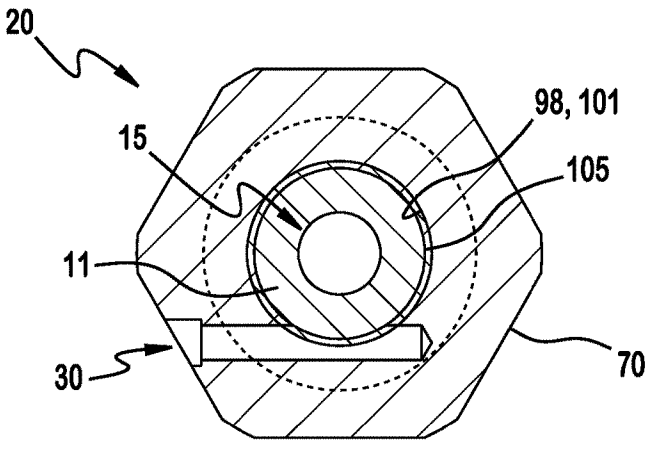
FIG. 6 is a cross-sectional view of the suppressor and barrel of the host firearm of FIG. 5, along line 8-8 prior to drilling a locking recess into the barrel.
Figure 8:
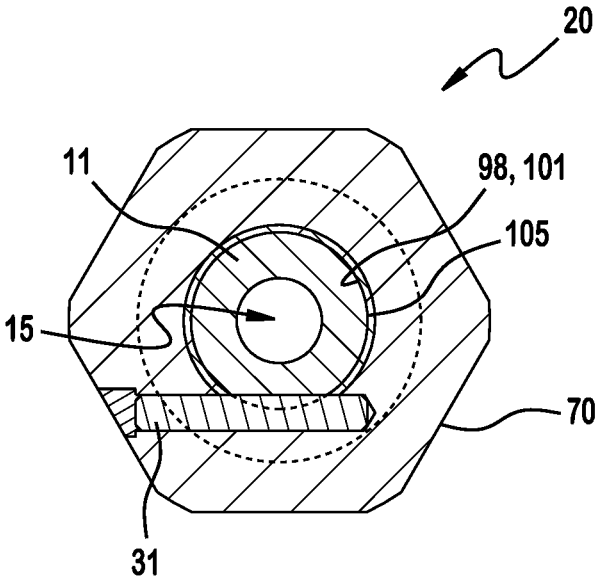
FIG. 8 is a cross-sectional view of the suppressor and barrel of the host firearm of FIG. 5, along line 8-8.

Referring to FIGS. 6, 7 and 8, the collar 70 and barrel receiving bore 78 further may include a fixation hole 30 which may be used to drill and pin the host firearm barrel that is arranged in the barrel receiving bore 70 to the mount body 20. As shown in FIGS. 5, 6, 7 and 8, the fixation hole 30 may be positioned to cause a fixation pin 31 to pass through and engage the screw thread of a mounted barrel 11, and thus fix the mount body 20 to the barrel. As described above, the barrel receiving bore 78 may include a screw thread 101. Accordingly, the barrel receiving bore 78 and associated screw thread 101 may be configured and dimensioned to mate with a firearm barrel 11 that is chambered in one of a variety of calibers and ammunition cartridges including, without limitation, 7.62×39 mm, 5.56 NATO, 300 BLK, .308 WIN, 6.5 CM, and others.

Figure 21:
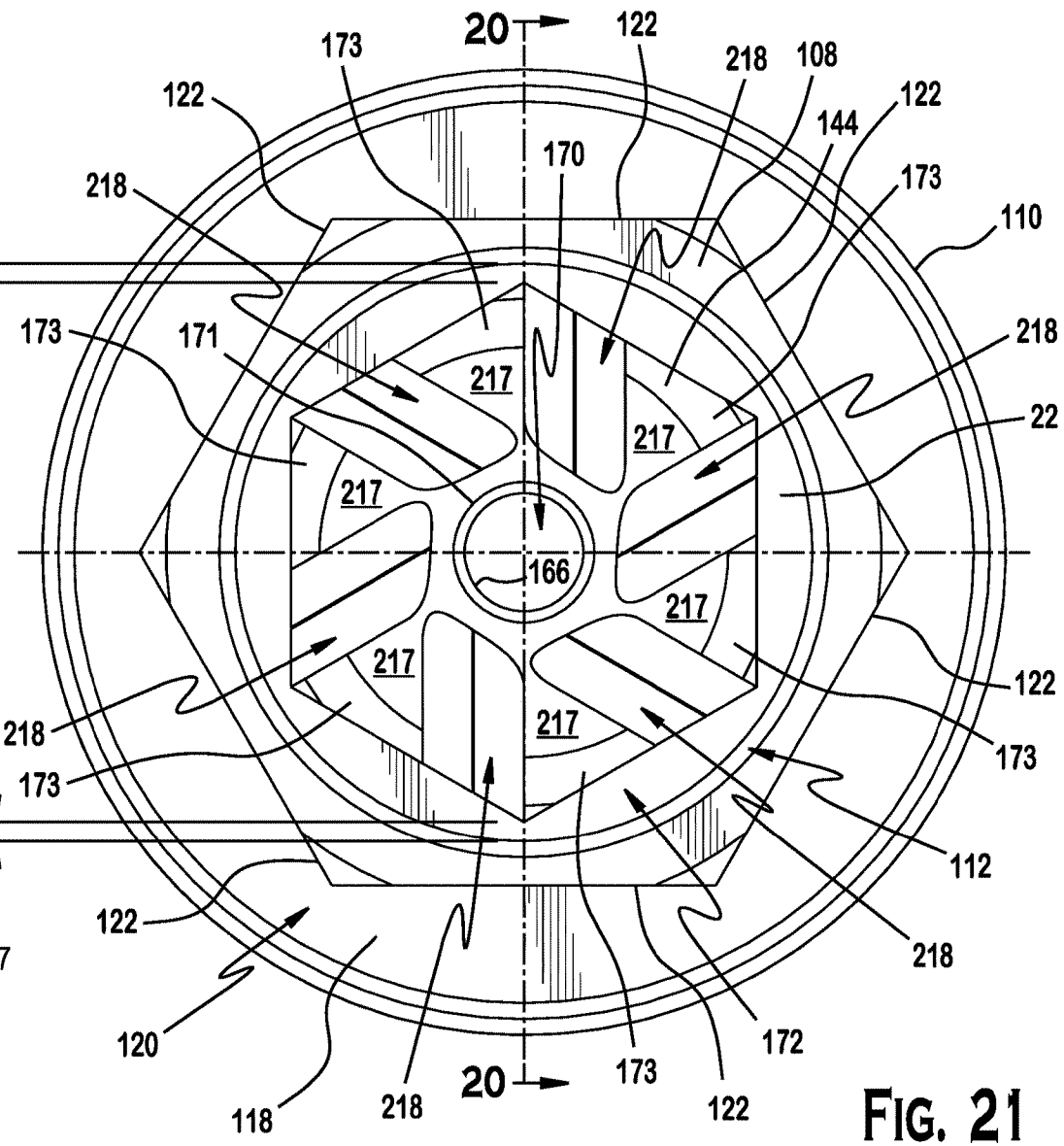
FIG. 21 is front view of the suppressor of FIG. 1.
Figure 34:
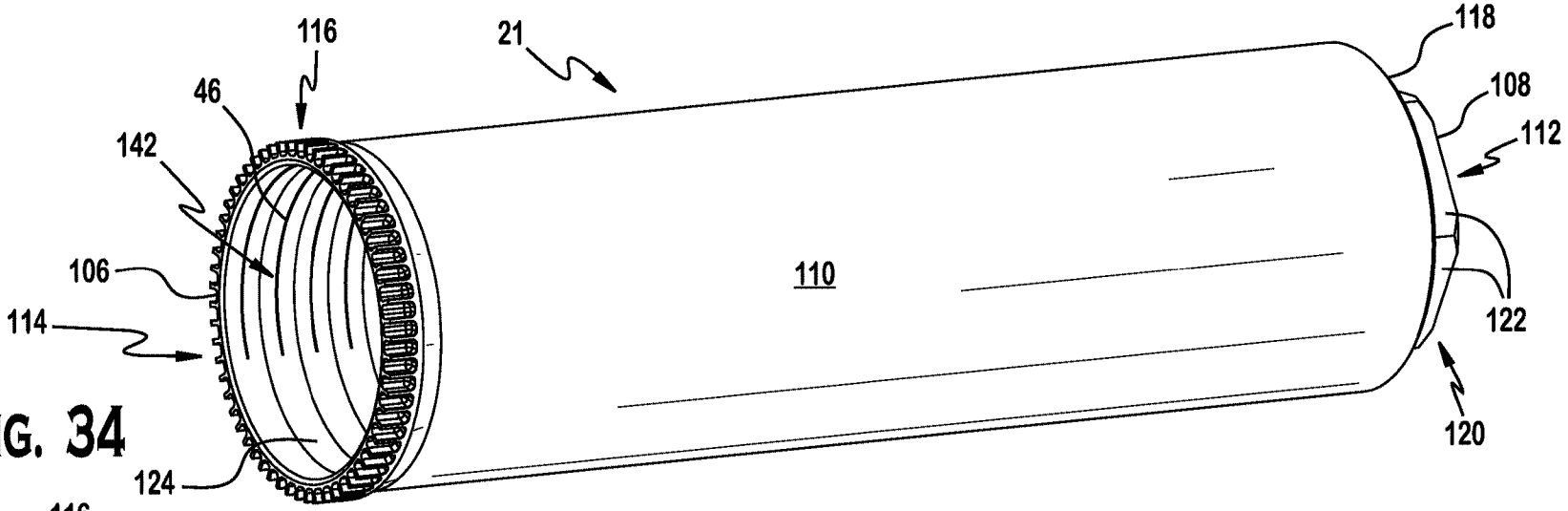
FIG. 34 is a perspective view of the tube of FIG. 4.
Figure 35:
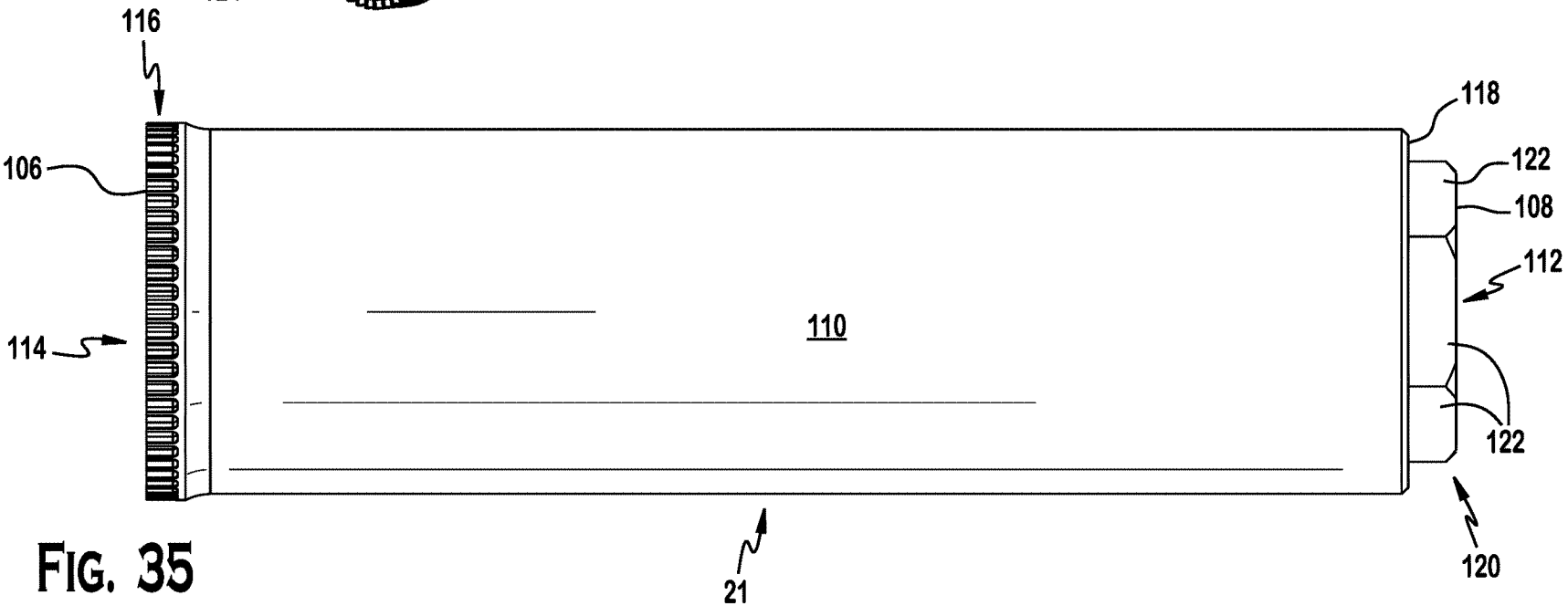
FIG. 35 is a top view of the tube of FIG. 4.
Figure 36:
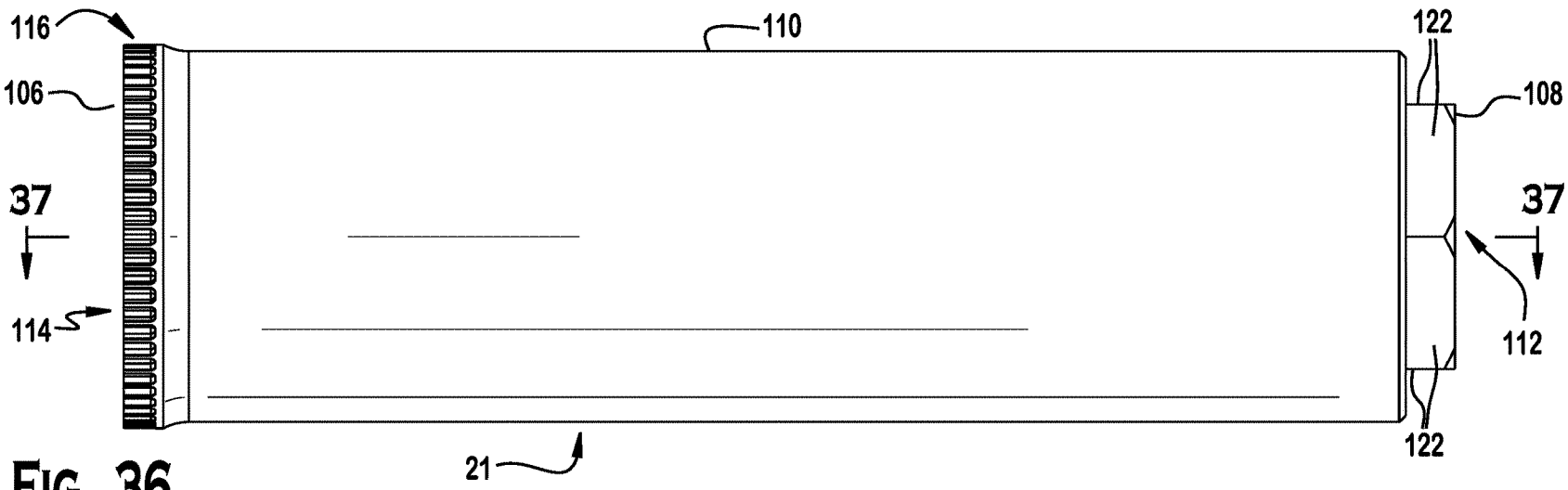
FIG. 36 is a left side view of tube of FIG. 4.
Figure 61:
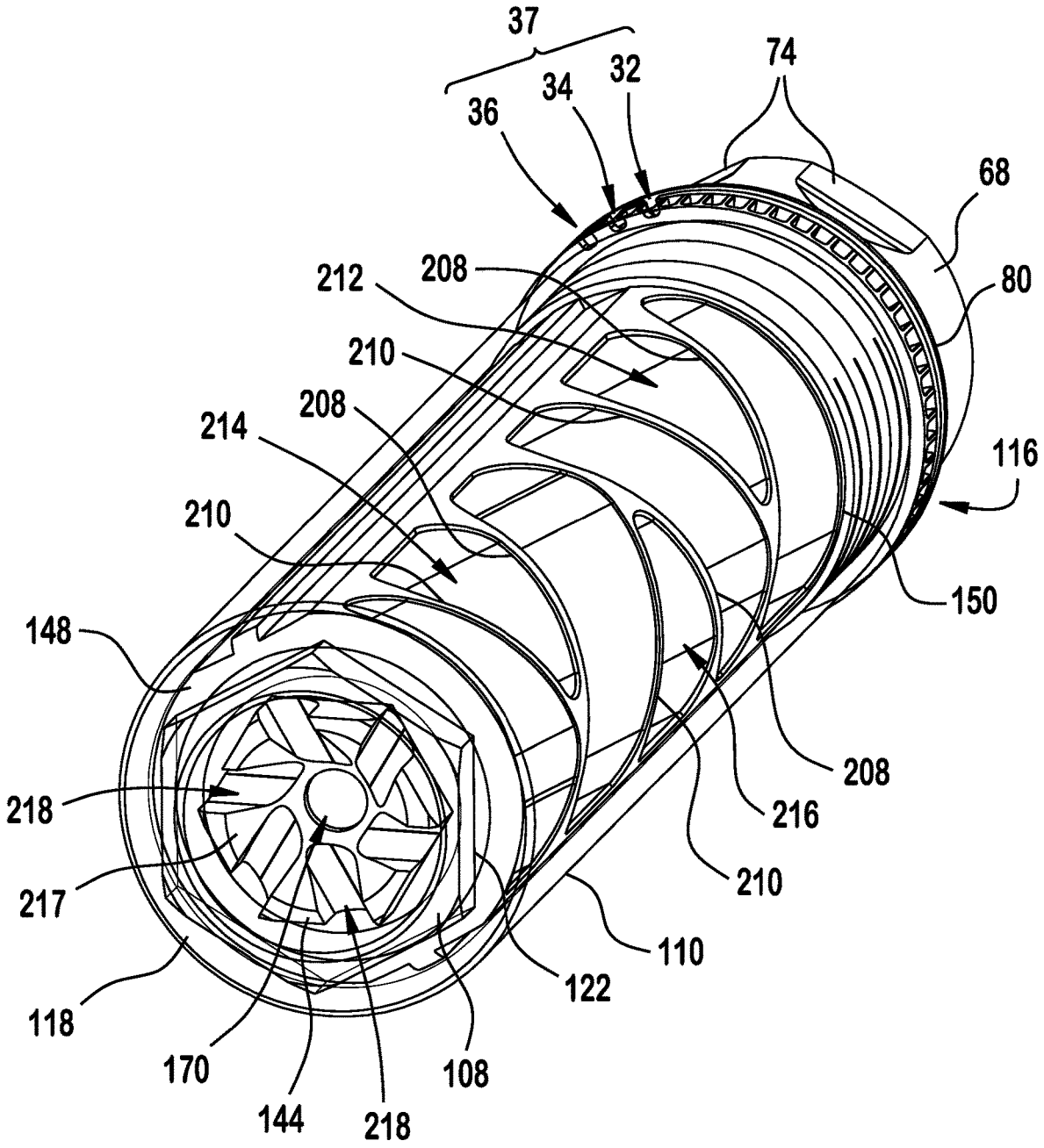
FIG. 61 is another perspective view of the suppressor of FIG. 55.

Referring to FIGS. 4, 34 and 35, the tube 21 generally may include a proximal end 106 and a distal end 108. The tube 21 further may include a distal end wall 118. The distal end wall 118 may be proximate to the distal end 108. The tube 21 may include an outer surface 110 that extends from the proximal end 106 to the distal end wall 118. The distal end wall 118 may include a tool fitting 120. The tool fitting 120 may be disposed between the distal end wall 118 and the distal end 108 of the tube. The tool fitting 120 may include a plurality of facets 122. Referring to FIGS. 21 and 61, preferably the tool fitting 120 may include six facets 122 which are arranged to form a hexagonal shaped fitting. Generally, however, the tool fitting 118 may include at least one pair of opposing facets such that an appropriately sized open end wrench may be used to hold or manipulate the tube. Further still, the distal end 108 of the tube 21 may include a distal opening 112.

Figure 37:
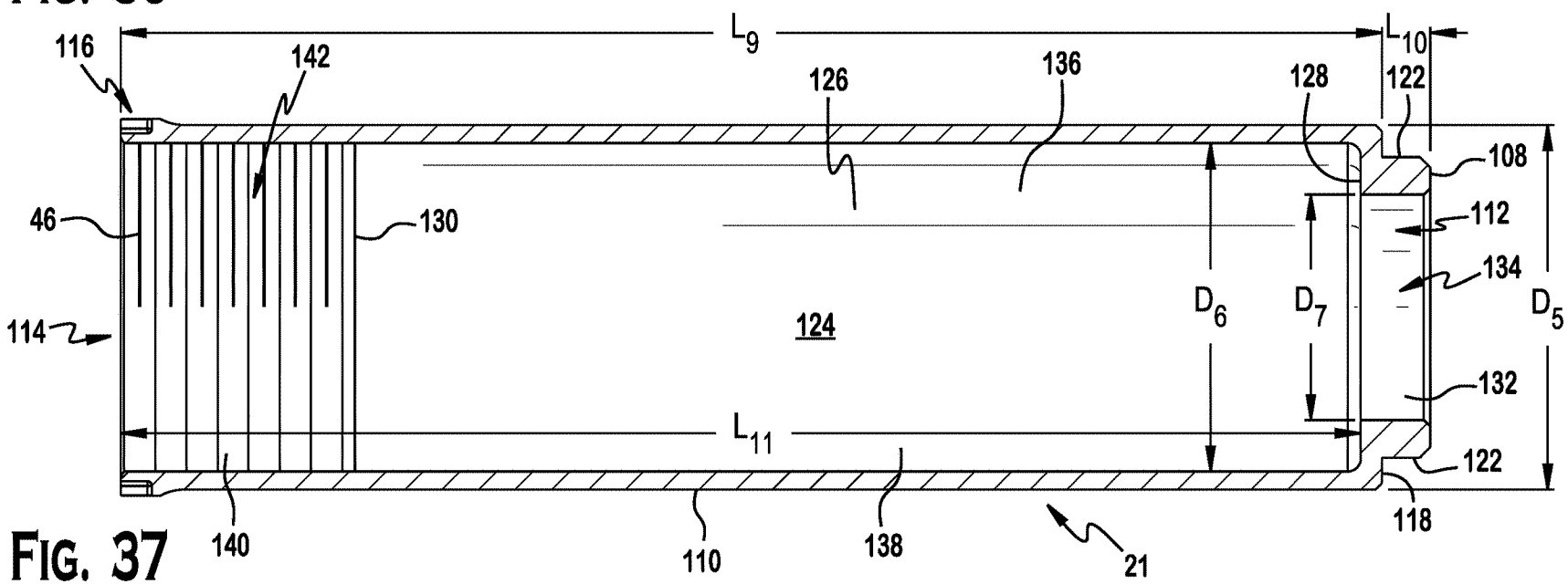
FIG. 37 is a cross-sectional view of the tube of FIG. 36 along line 37-37.
Figure 38:
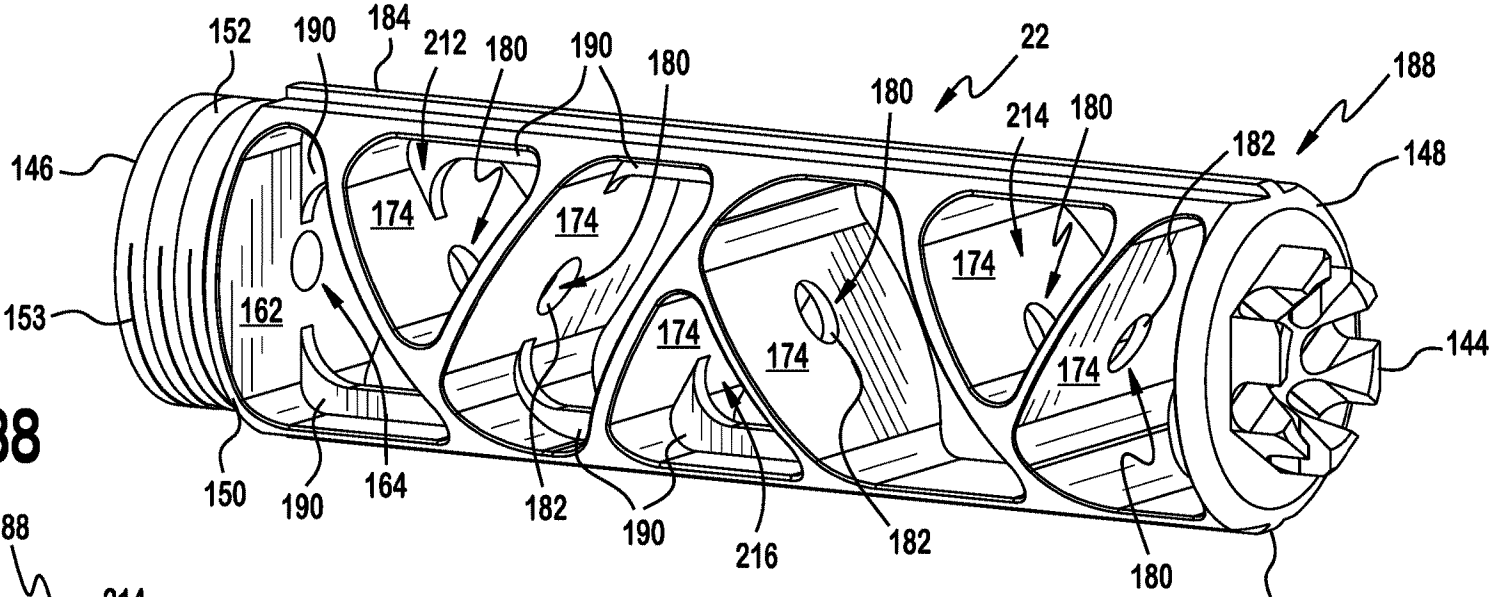
FIG. 38 is a perspective view of the core of FIG. 4.
Figure 39:
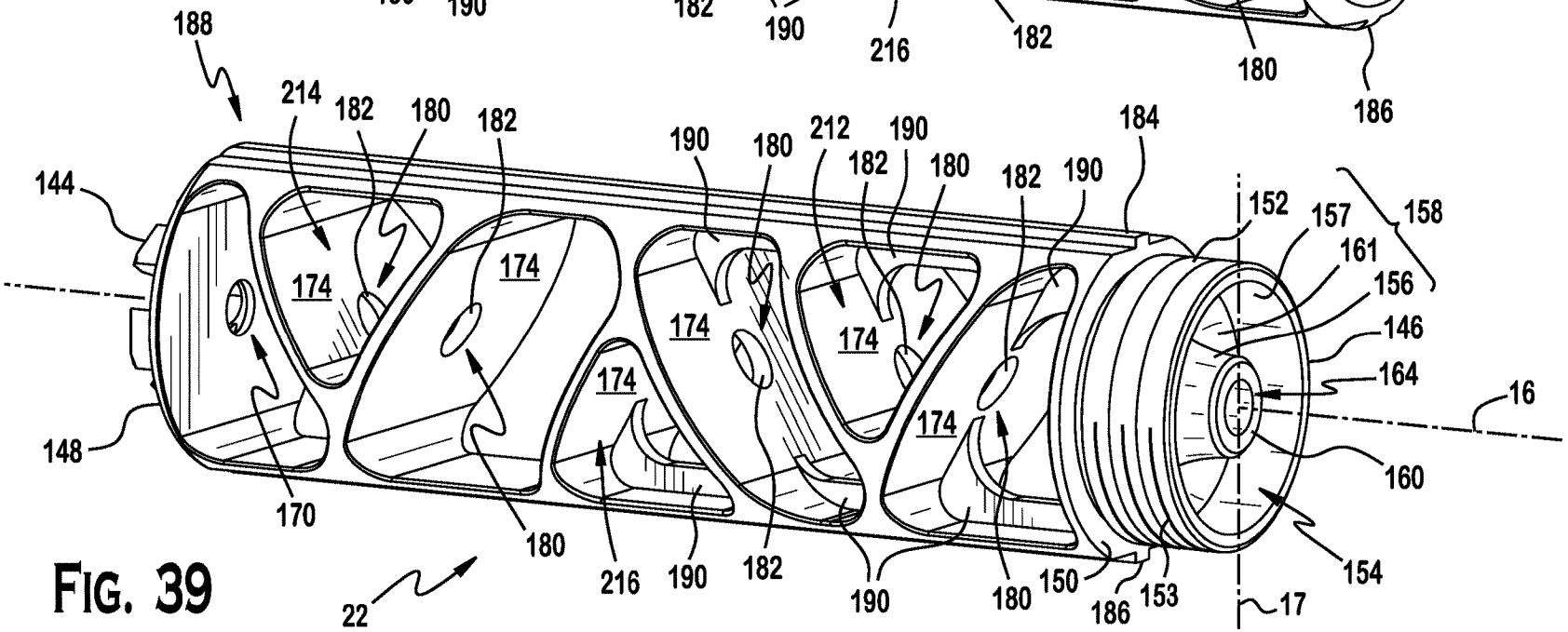
FIG. 39 is another perspective view of the core of FIG. 4.

As shown in FIGS. 12, 13, 15 and 36, the outer surface 110 of the tube 21 adjacent to the proximal end 106 may include circumferential array of longitudinally aligned elongated recesses 116. The proximal end of the tube further may include a proximal opening 114. A passage 126 may extend from the proximal opening 114 to the distal opening 112. Referring to FIG. 37, the passage may be bounded by an interior side wall 124. For instance, the interior side wall 124 may include a discharge port sidewall segment 132, a baffle array sidewall segment 136, and an annular stem side wall segment 140. The discharge port sidewall segment 132 may extend from the distal end 108 to the distal interior end wall 128. The annular stem side wall segment 136 may extend from the proximal end 106 to a proximal interior end wall of the tube 130. As described above the annular stem side wall segment 140 may include a screw thread and be configured and dimensioned to mate with the outer side wall 84 of the mount body 20. See also, FIGS. 4, 5 and 13. In view of the above, the passage 126 may include a discharge port housing segment 134, a baffle array housing segment 136, and annular stem housing segment 142.

Referring to FIG. 12, the circumferential array 116 of longitudinally aligned elongated recesses 28 may abut indexing notches 37 of the mount body. Referring to FIG. 15, each of the longitudinally aligned elongated recesses 28 may possesses a transverse length L5. The spacing between the longitudinally aligned elongated recesses 28 may be substantially the same. For example, the centerline of the transverse length of each recess 28 may lie at angle $\beta_1$ from the centerline of the transverse length of each adjacent recess 28. For example, the angle $\beta_1$ may measure approximately 6.0 degrees.

Figure 17:
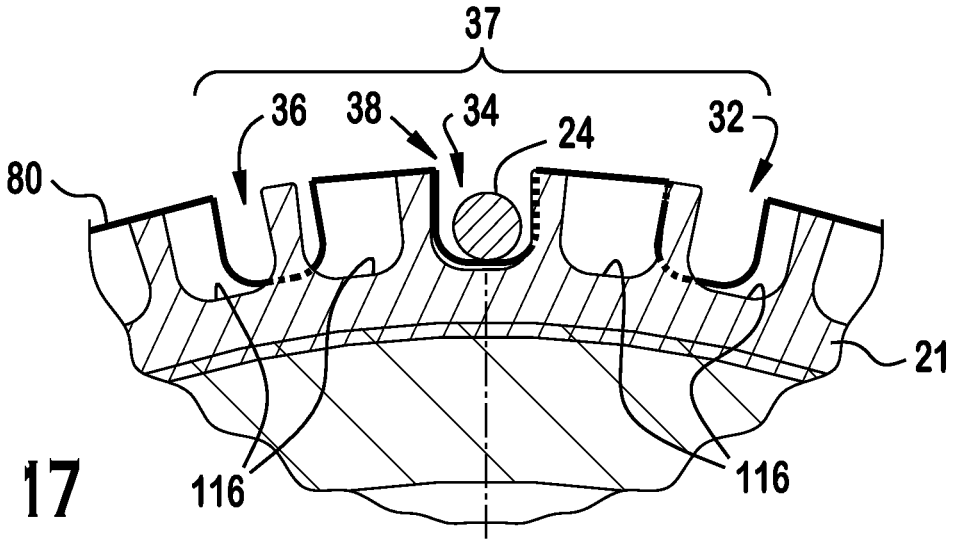
FIG. 17 is a detail view of the securing member, a first indexing notch, and a first recess arranged in a first retention configuration of the secondary retention system.
Figure 18:
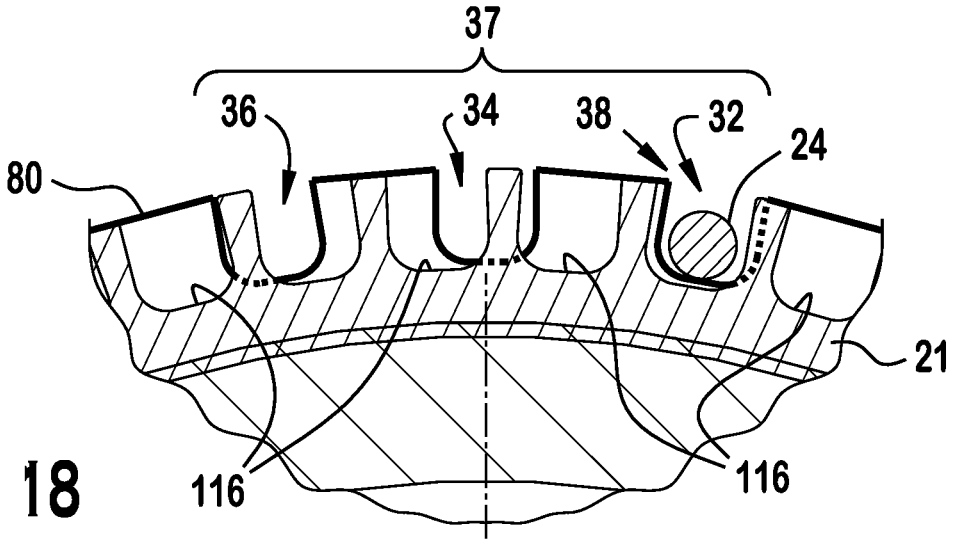
FIG. 18 is a detail view of the securing member, a second indexing notch, and a second recess arranged in a second retention configuration of the secondary retention system.
Figure 19:
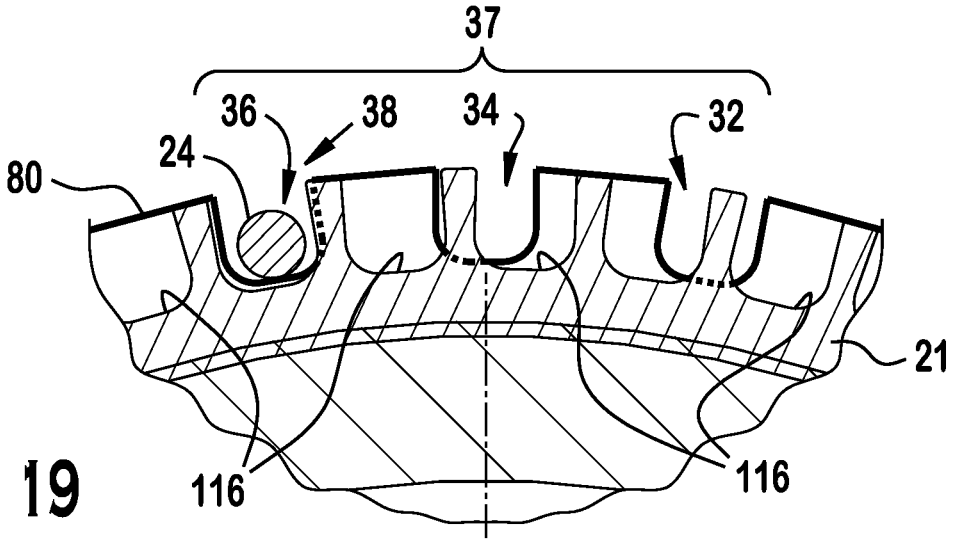
FIG. 19 is a detail view of the securing member, a third indexing notch, and a third recess arranged in a third retention configuration of the secondary retention system.

Referring to FIGS. 17, 18 and 19, at least one of the indexing notches 37 may be oriented with respect to the circumferential array 116 of longitudinally aligned elongated recesses 28 such that one aligned elongated recess 28 and one indexing notch 32, 34, 36 complement each other to define a unitary locking groove or locking index 38. Moreover, a coil of wire or spring 24 may be seated in the circumferential groove 26 of the mount body. One end of the spring 24 may be configured and dimensioned to traverse the flange 80 and seat within the locking index 38, and thus further secure the mount body-tube interface by blocking relative rotation of the tube 21 with respect to the mount body 20, and thus form a secondary retention system. The spring 24 may be selectively removed from the locking index 38 to allow relative rotation (and ultimately separation) of the tube 21 and mount body 20.

Referring to FIGS. 38, 39, 40, 41, 42, 43, 44 and 45, the core 22 may include a distal end 144 and a proximal end 146, as well as a distal end wall 148 and a proximal end wall 150. A proximal side wall 152 may extend from the proximal end wall 150 to the proximal end 146 of the core. The exterior side of the proximal side wall 152 may include an external screw thread 153. As previously described, the exterior side wall 152 and the screw thread thereon 153 may be configured and dimensioned to mate with a screw thread 95 on the core mounting receptacle 90 of the mount body 20. See e.g., FIGS. 4 and 5. Moreover, referring to FIGS. 46 and 47, the interior space circumscribed by the proximal end wall 152 may house or define a baffle. For instance, the interior side 157 of the proximal end wall 152 may cooperate with a distal end wall 161 and an adjacent baffle cone 156 to form a baffle control surface 158 of lead baffle 154. The lead baffle may be referred to as a blast baffle 154. Referring to FIGS. 5, 46, 47 and 55, the baffle cone 156 further may include a proximal end 160 and a baffle bore 164 extending from the proximal end 160 to a proximal interior end wall 162 of the core.

Referring to FIGS. 39, 44, 46 and 47, the control surface 158 may include a concave curve. The concave curve may be a compound curve. A first segment of the concave curve may possess a first radius R1. A second segment of the concave curve may possess a second radius R2. Preferably, the first radius R1 and the second radius R2 may be substantially equal to 0.853 inches and 0.138 inches, respectively. In this context, the compound curve portion may exhibit a first curve ratio (FCR). More particularly, the first curve ratio may be defined as the second radius R2 divided by the first radius R1 of the concave curve. Accordingly, the first curve ratio (FCR) of the compound curve portion of the control surface 158 may be approximately 0.16 (R2/R1).

Figure 49:
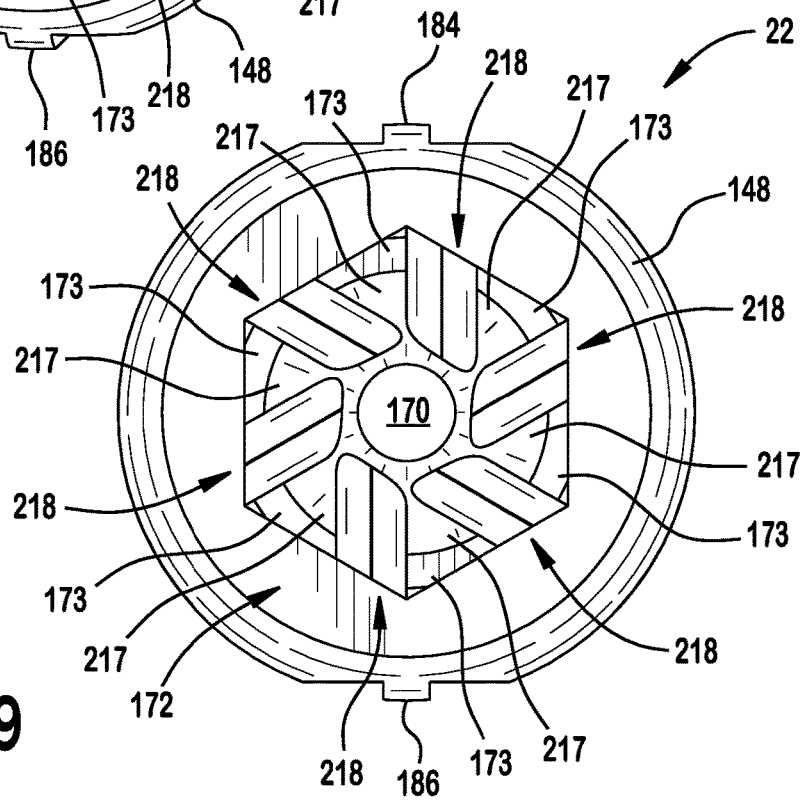
FIG. 49 is a front view of the core of FIG. 4.

Referring to FIGS. 38, 40, 41, 42, 43, 44, 45, 48 and 50, the core further may include a distal end wall 148 spaced from the proximal end wall 150 along a longitudinal axis 16. A superior longitudinal member 184 may extend from the proximal end wall 150 to the distal end wall 148. Also, an inferior longitudinal member 186 may extend from the proximal end wall 150 to the distal end wall 148. The superior longitudinal member 184 may be disposed opposite to the inferior longitudinal member 186. See also, FIGS. 49 and 51. For example, the inferior longitudinal member 186 may be spaced from the superior longitudinal member 184 along a vertical axis 17 See also, FIG. 46.

As shown in FIGS. 41, 44, 45 and 60, the distal end wall 148, proximal end wall 150, superior longitudinal member 184, and inferior longitudinal member 146 may define a frame 188. The frame further may include a plurality of transverse plates 286 which extend between the superior longitudinal member 184 and the inferior longitudinal member 186. See e.g., FIGS. 44 and 45. Each of the plurality of transverse plates 286 further may include a leading surface 176 and a trailing surface 178, along with an aperture 180 extending from the leading surface to the trailing surface. See e.g., FIG. 40. The aperture 180 may include a sidewall 182. See e.g., FIG. 46.

The frame 188 further may include a plurality of partial transverse plates 288 which extend from one of the superior longitudinal member 184 or the inferior longitudinal member 186 to a transverse plate 286. Each partial transverse plate 288 may also include a leading surface and a trailing surface, along with an aperture 180 extending from the leading surface 176 to the trailing surface 178. Although each transverse plate 286 or partial transverse plate 288 may form a baffle 174, other baffle structures may be used.

Further, the proximal interior end wall 162, the distal interior end wall 168, the superior longitudinal member 184, the inferior longitudinal member 186, the transverse plates 286, and the partial transverse plates 288 may form a plurality of partition configurations within the frame. Each of the plurality of partition configurations may define a cell which in combination with the interior side wall of the tube 124 may form a chamber inside the suppressor. For instance, referring to FIGS. 5, 55, 56, 57 and 58, the core and tube may cooperate to form seven chambers 50, 52, 54, 56, 58, 60 and 62.

Moreover, chamber 49 which may be formed by the core and the mount body may be referred to as a blast or entrance chamber. Also, the chamber 62 formed, in part, by the distal interior end wall 168 may be referred to as an exit chamber. The other chambers 50, 52, 54, 56, 58, and 60 located between the entrance chamber 50 and the exit chamber may be referred to individually as an ordinally numbered chamber and collectively as intermediate chambers or pressure modulation chambers.

Figure 55:
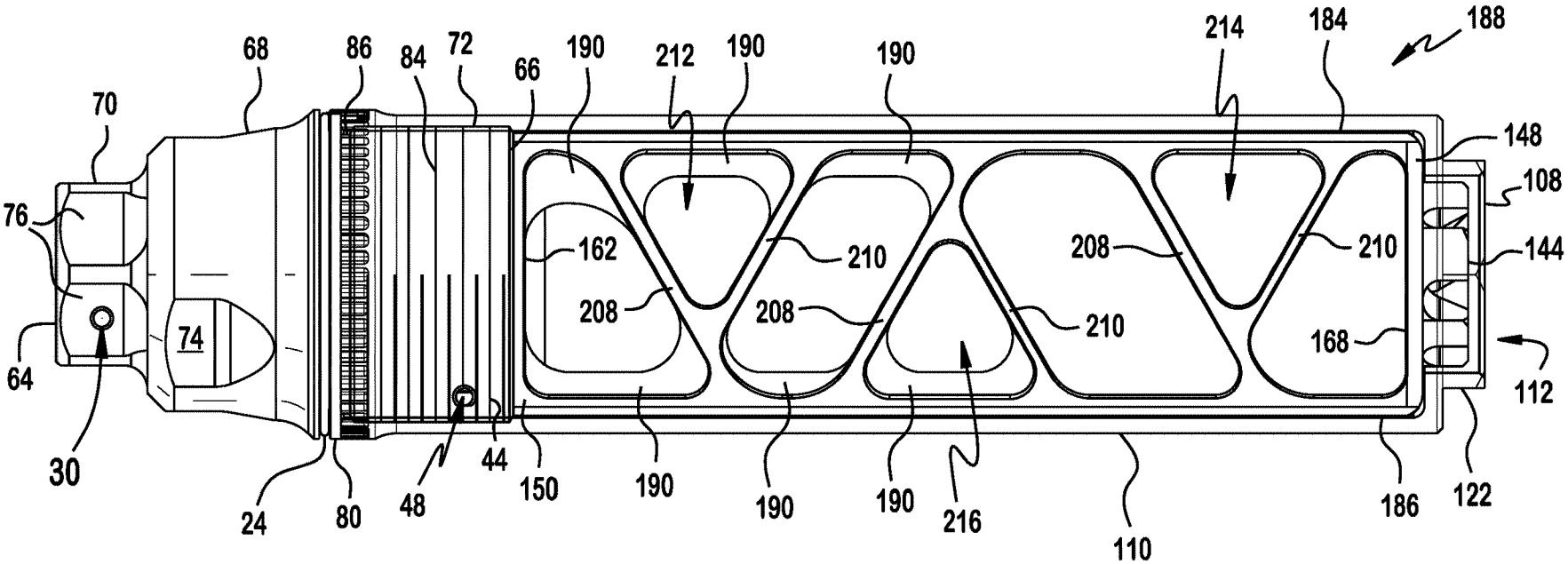
FIG. 55 is a perspective view of the suppressor of FIG. 3 showing the tube in a transparent rendering.
Figure 56:
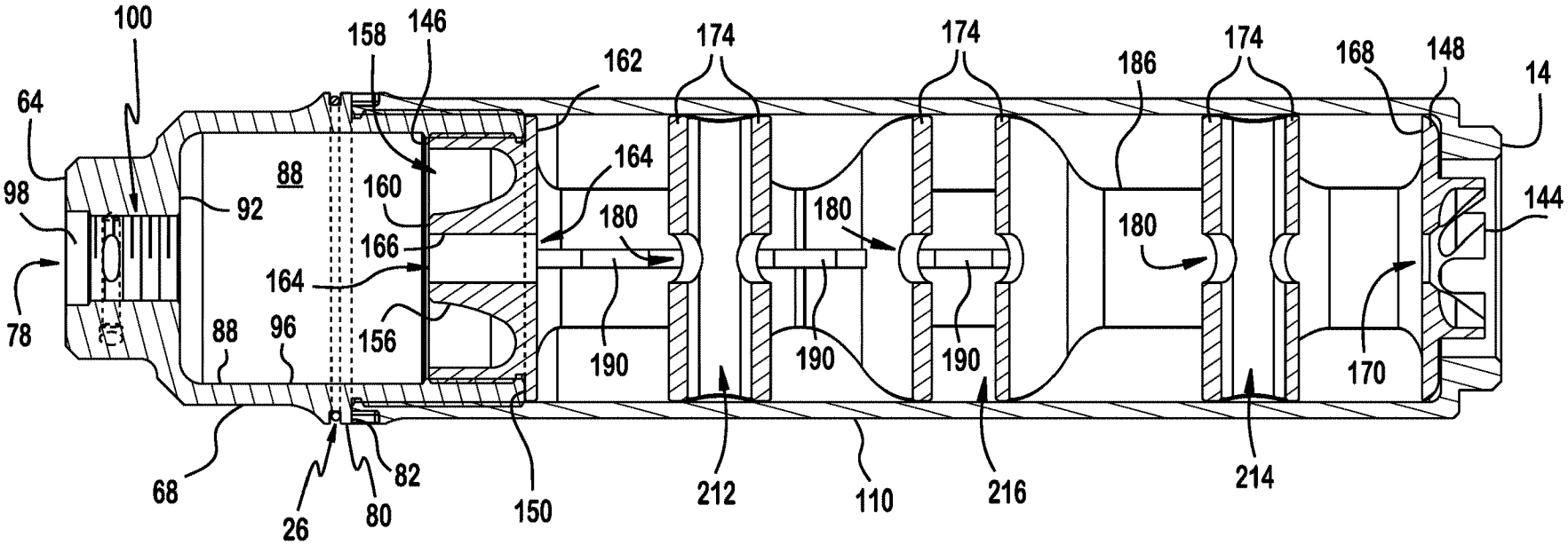
FIG. 56 is a cross-sectional view of the suppressor of FIG. 3 along line 56-56.
Figure 57:
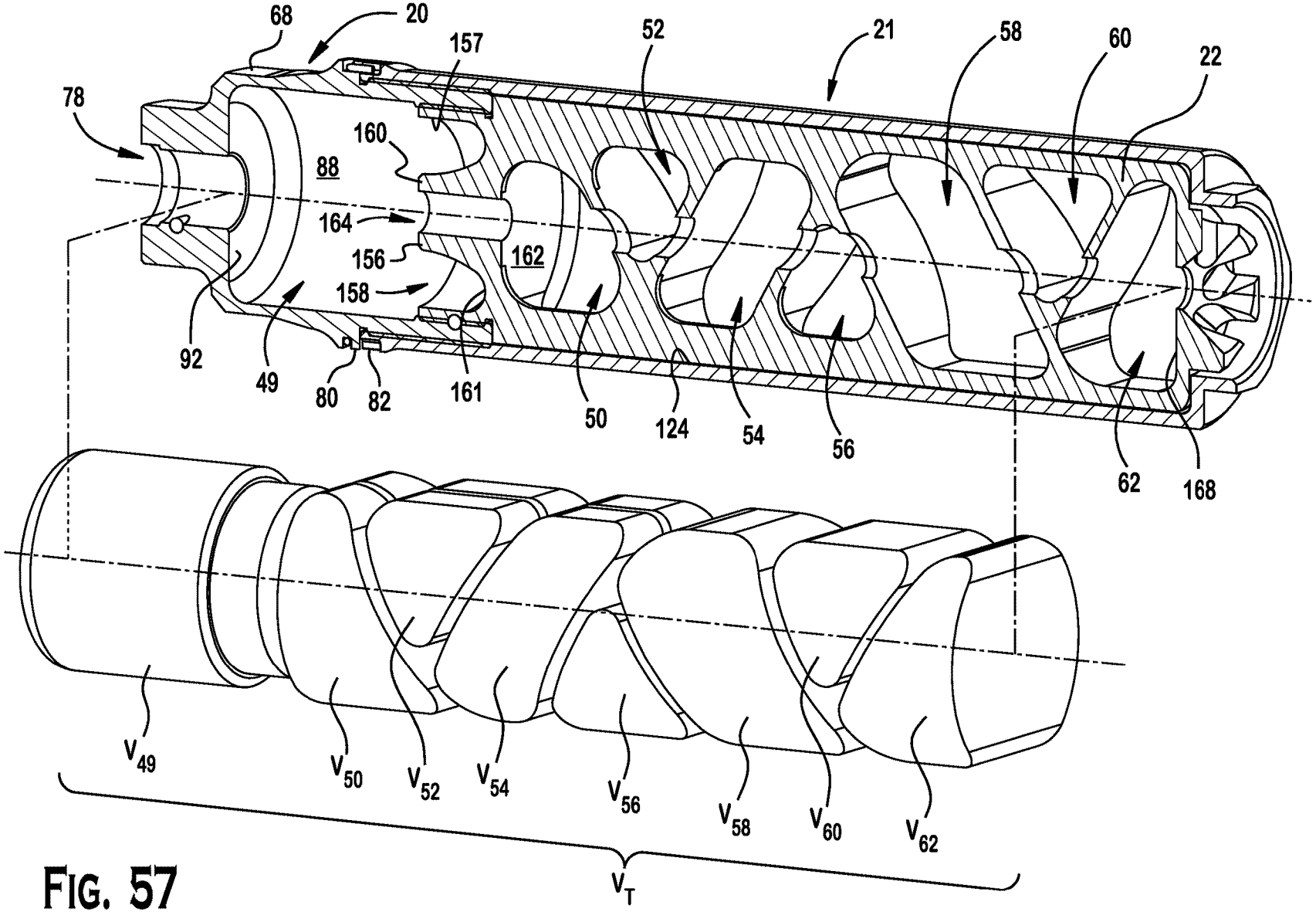
FIG. 57 is a cross-sectional view of the suppressor of FIG. 3 along line 57-57, along with a perspective view of a rendering which depicts the working volume of void space enclosed by the suppressor.
Figure 58:
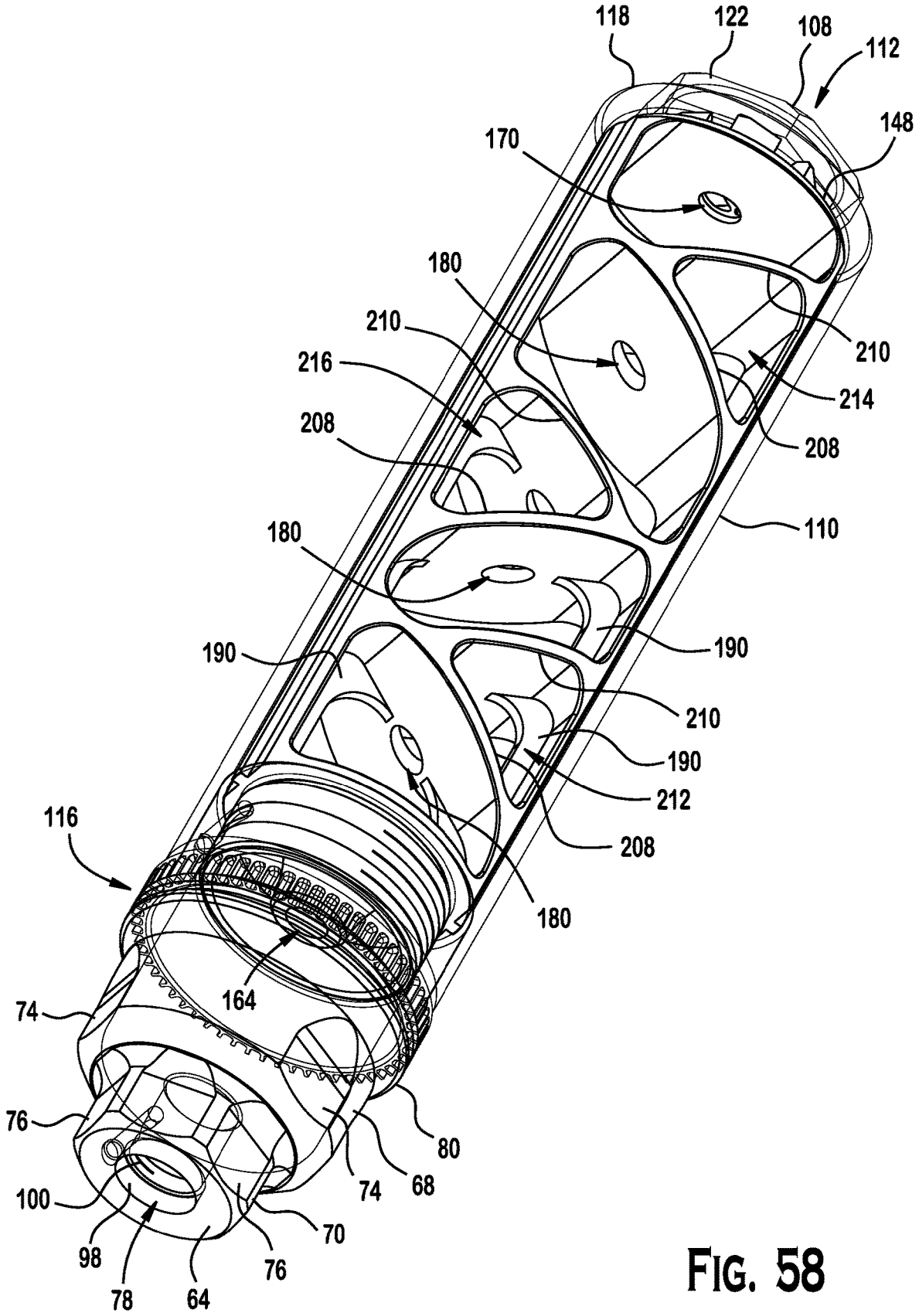
FIG. 58 is a perspective view of the suppressor of FIG. 3 showing the tube and mount body in a transparent rendering.
Figure 59:
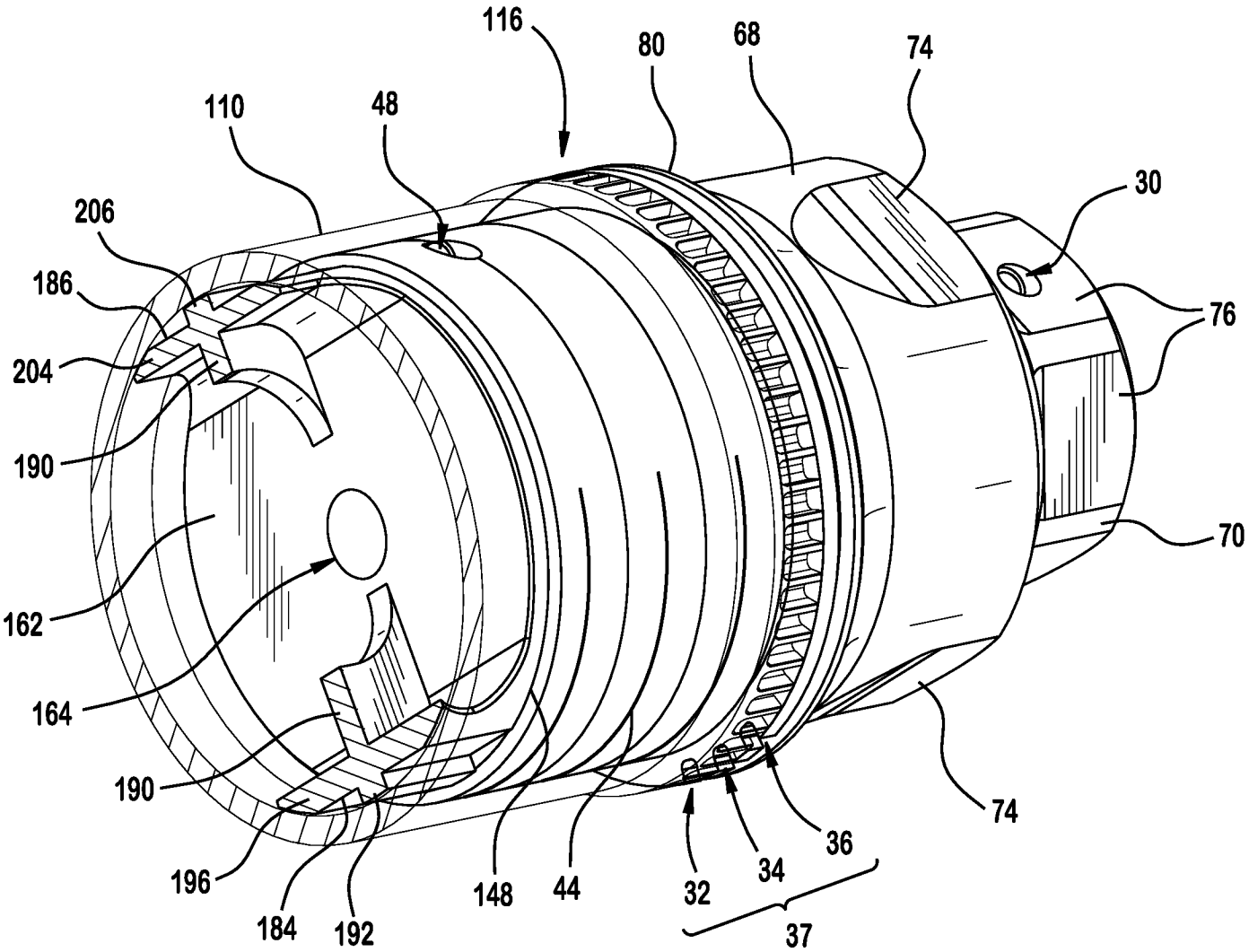
FIG. 59 is a cross-sectional view of the suppressor of FIG. 55 perpendicular to the longitudinal axis.
Figure 60:
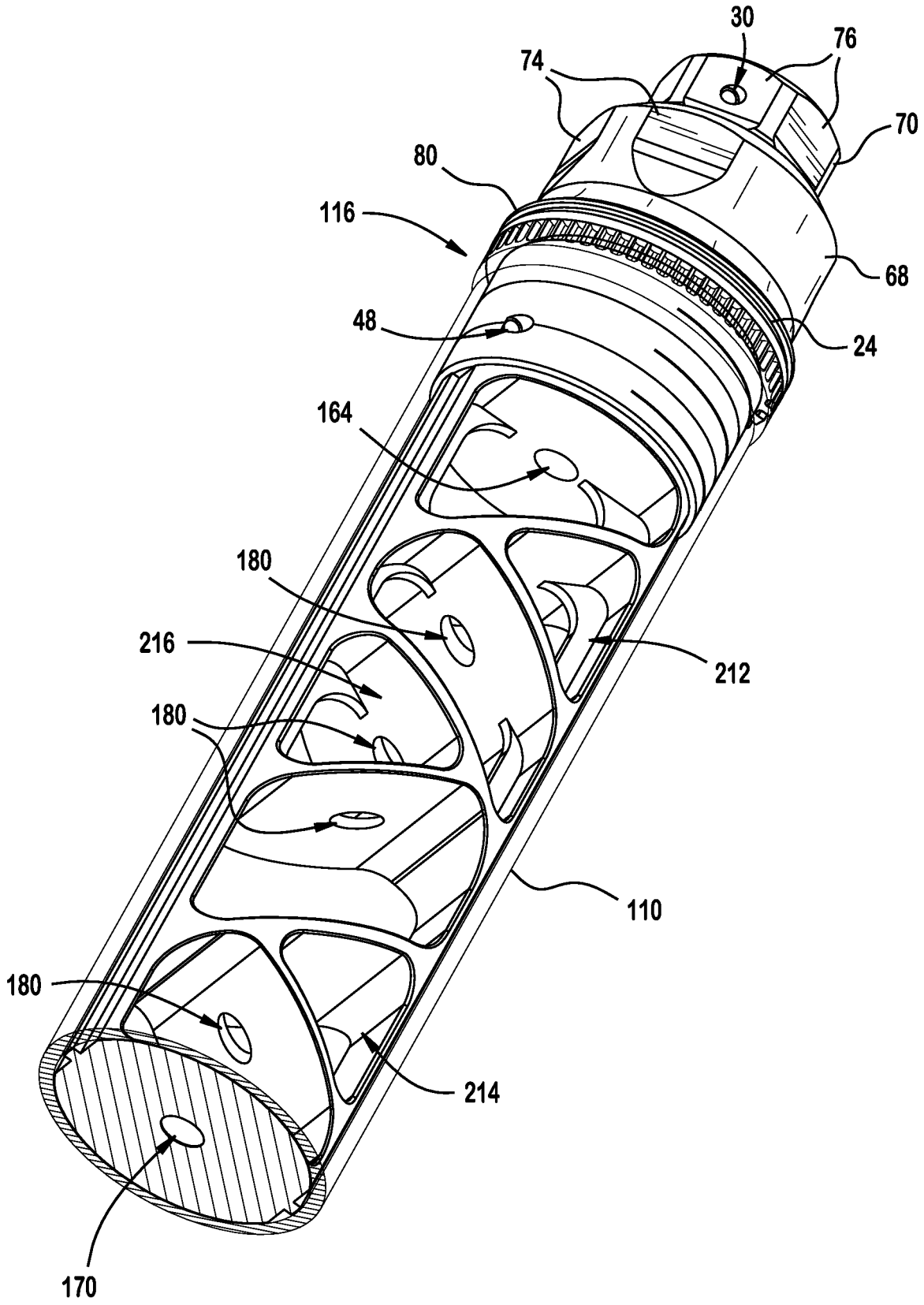
FIG. 60 is a cross-sectional view of the suppressor of FIG. 55 perpendicular to the longitudinal axis.

Each chamber may enclose a fraction of the total internal volume VT of the suppressor. Referring to FIGS. 55 and 57 each chamber 49, 50, 52, 54, 56, 58, 60, 62 of the suppressor may enclose a respective chamber volume V49, V50, V52, V54, V56, V58, V60, V62. See also, FIGS. 56-63. Table 1 (below) presents illustrative chamber volume values for the exemplary suppressor of FIG. 1.

TABLE 1

Suppressor (100, 250, 310, 400) Chamber Volumes

| Chamber (Reference Element No.) | Volume (Cubic inches) | Fraction |
|---|---|---|
| Blast chamber (49) | 2.387 | 0.24 |
| First chamber (50) | 1.245 | 0.12 |
| Second chamber (54) | 0.660 | 0.07 |
| Third chamber (56) | 1.308 | 0.13 |
| Fourth chamber (58) | 0.660 | 0.07 |
| Fifth chamber (60) | 1.820 | 0.18 |
| Sixth chamber (54) | 0.676 | 0.07 |
| Exit chamber (62) | 1.138 | 0.12 |
| All (49-62) | 9.894 | 1.00 |

Additionally, the volume V of the suppressor 10 (as calculated between the proximal end and the distal end), and the volume of solid parts of the suppressor 10 Vs (as calculated from the solid parts of the tube, core and mount body) may be approximately 17.5 cubic inches and approximately 6.8 cubic inches, respectively. Generally, the void ratio VR for a suppressor may be equal to the volume of the void space divided by the total volume [VR=((V−Vs)/V)]. In this embodiment, the void ratio VR of the suppressor 10 may be approximately 0.61.

Figure 44:
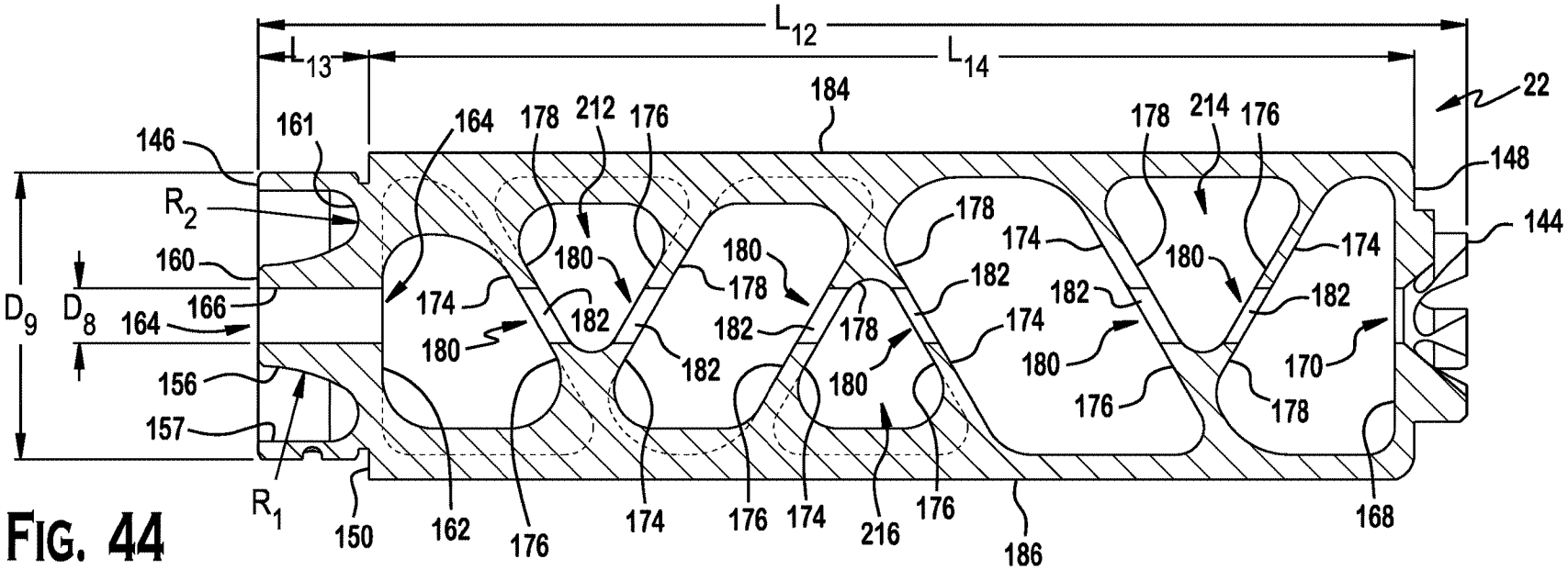
FIG. 44 is a cross-sectional view of the core of FIG. 40 along line 44-44.
Figure 45:
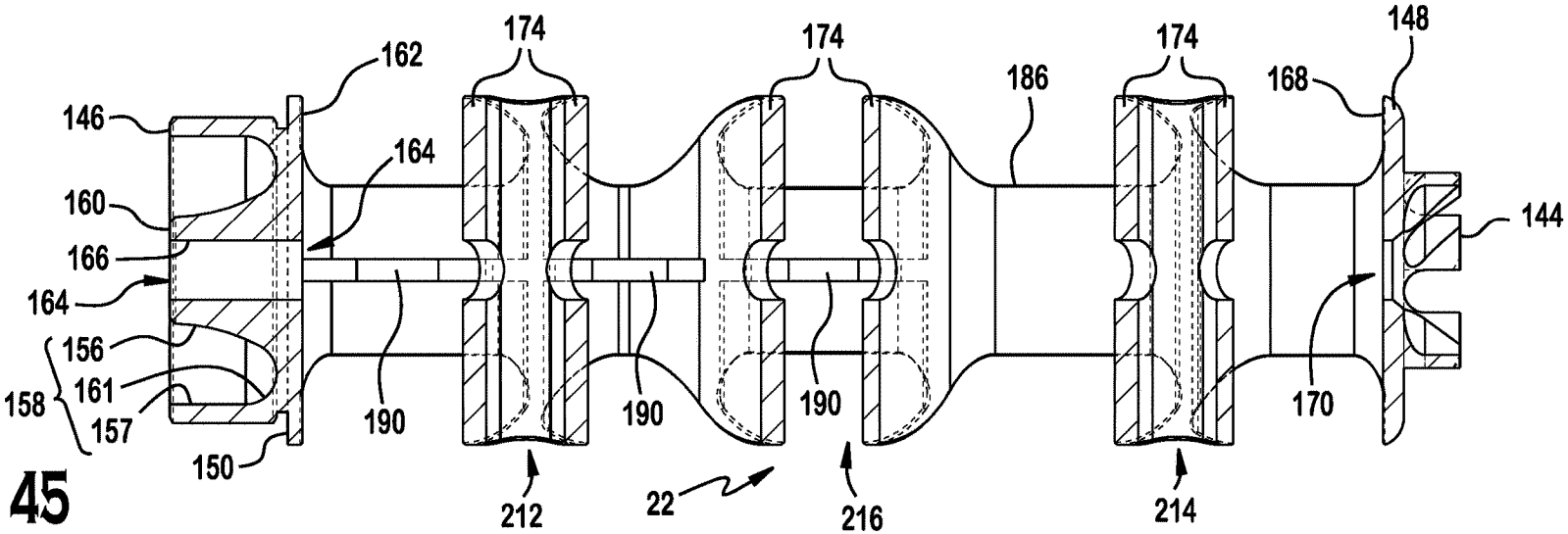
FIG. 45 is a cross-sectional view of the core of FIG. 42 along line 45-45.
Figure 46:
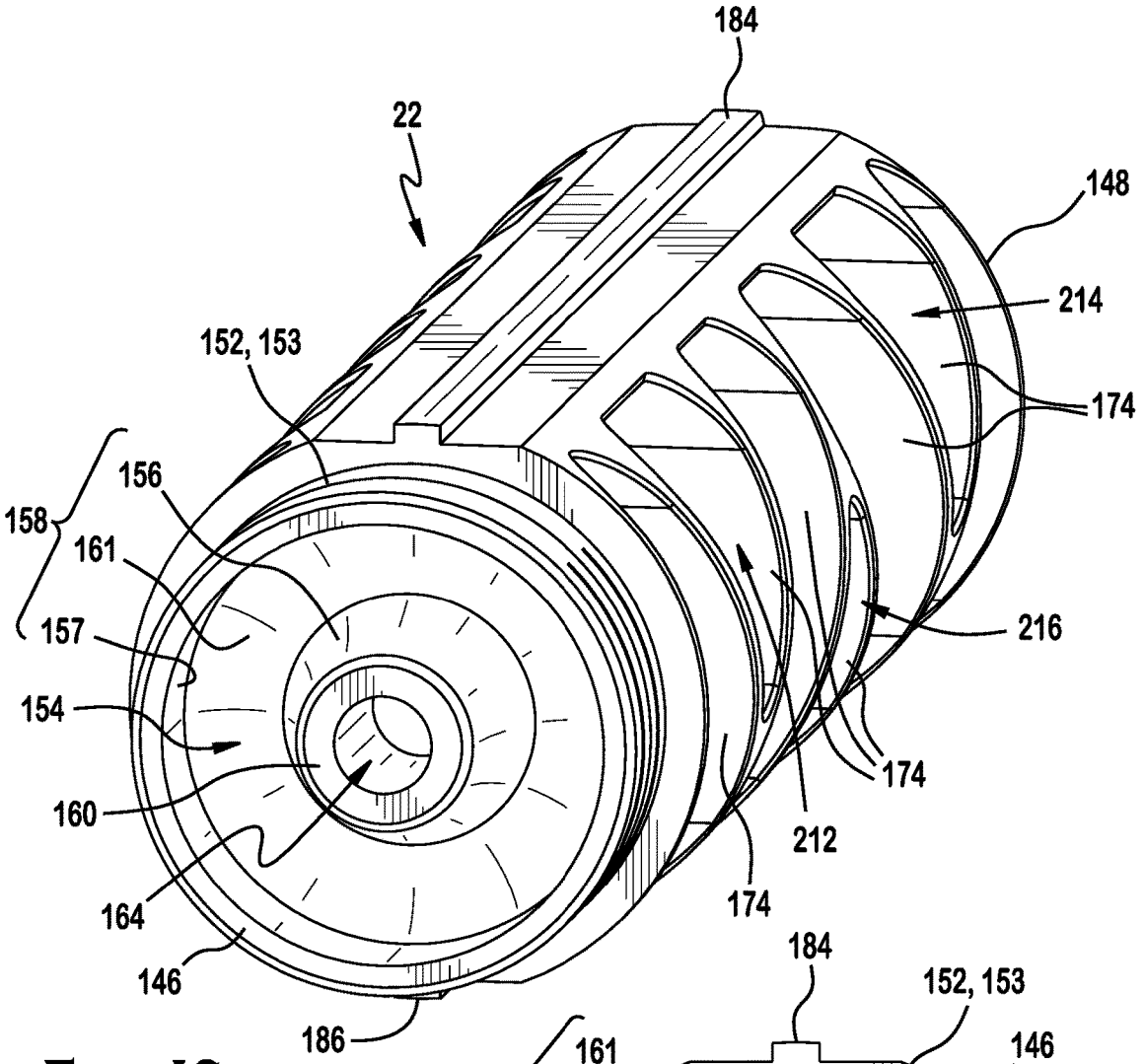
FIG. 46 is a rear top left side perspective view of the core of FIG. 4.
Figure 47:
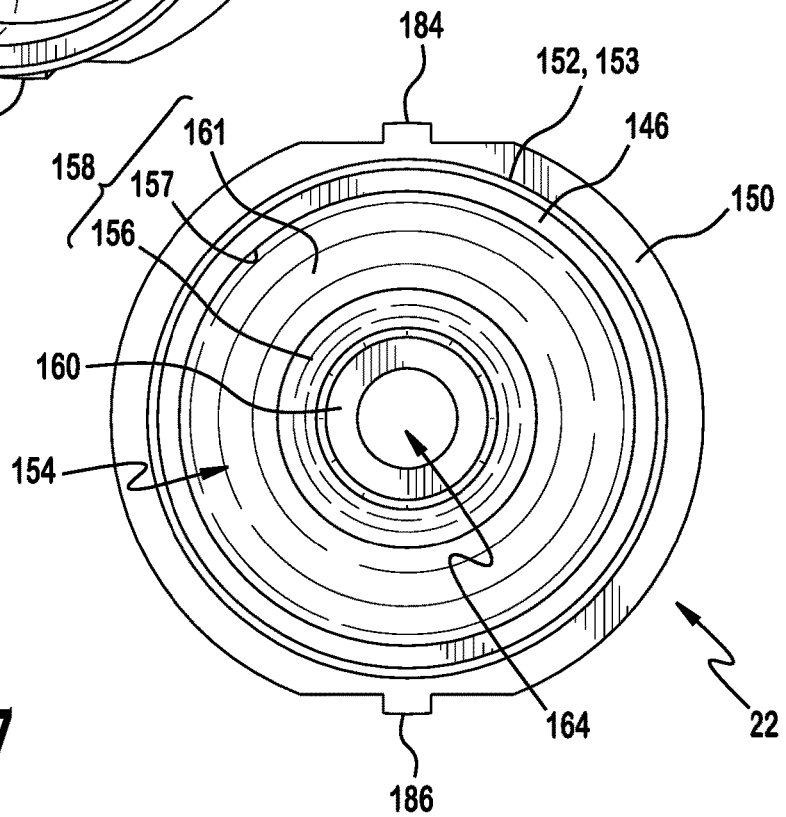
FIG. 47 is a rear view of the core of FIG. 4.
Figure 48:
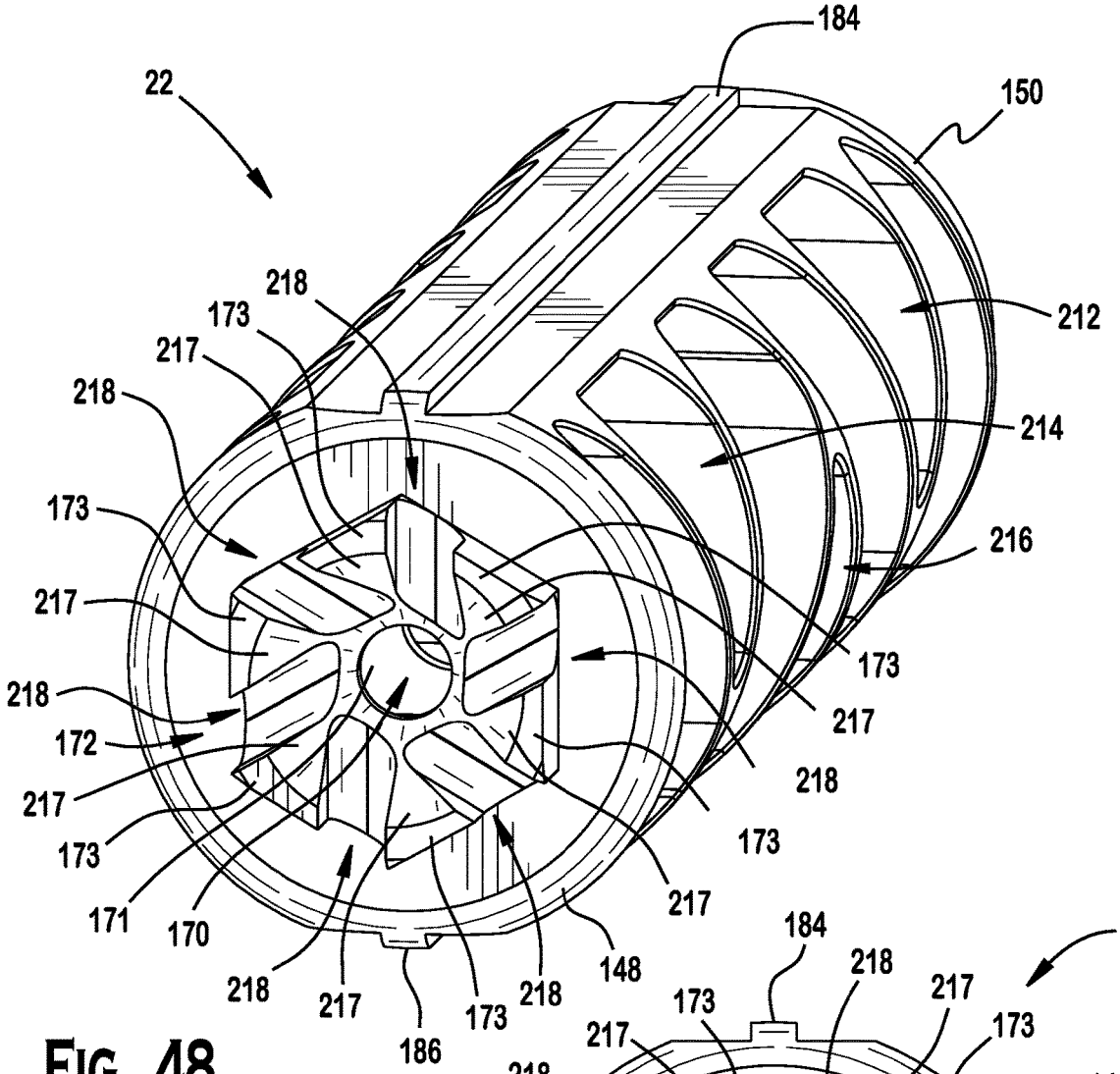
FIG. 48 is a front top right side perspective view of the core of FIG. 4.

Referring to FIGS. 44 and 45, the frame may include one (or more) triangularly shaped partition(s) formed by one of the superior longitudinal member 184 or the inferior longitudinal member 186, a transverse plate 208, and a partial transverse plate 210. The triangularly shaped partition may resemble an equilateral triangle. For instance, in this embodiment the frame 188 may include three partitions 212, 214, 216 which resemble an equilateral triangle (see also, FIG. 46). The configuration of core 21, including three partitions resembling an equilateral triangle, may provide enhanced structural properties to the core 22. Moreover, referring to FIGS. 52, 53, 54 and 59 the superior longitudinal member 184 and the inferior longitudinal member 186 may each include a cross-section 192, 200 perpendicular to the longitudinal axis 16 of the core 22. The cross-section may include: an exterior rib portion 198, 206; a beam portion 194, 202; and a flanged portion 196, 204. Accordingly, the frame 188 may include one or more ribs 190 that may provide structural reinforcement.

Figure 20:
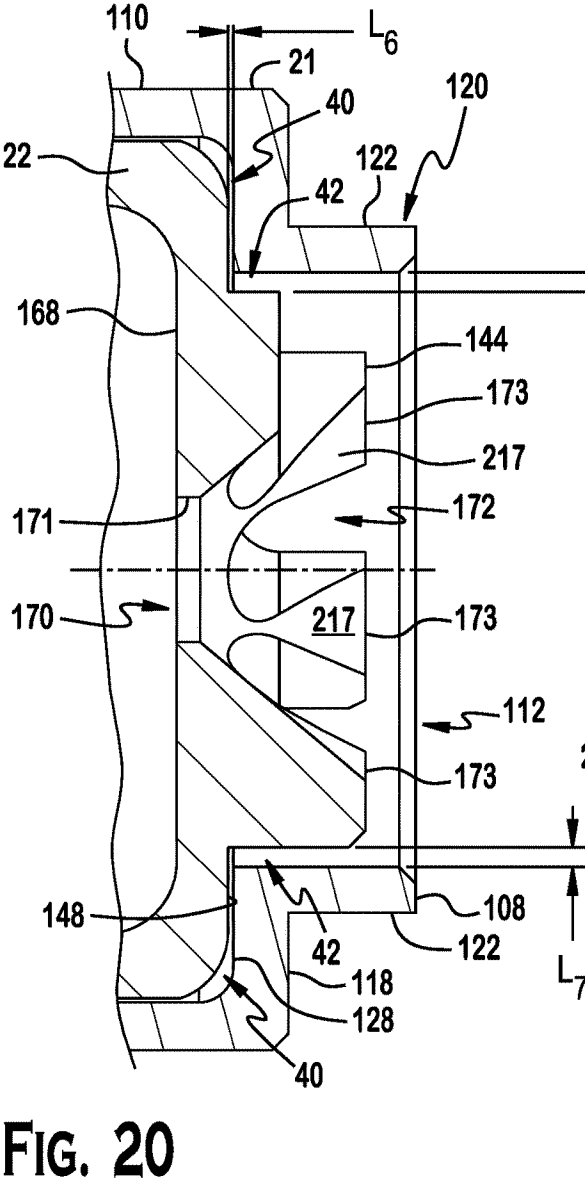
FIG. 20 is a detail view of the distal end of the suppressor of FIG. 5.
Figure 50:
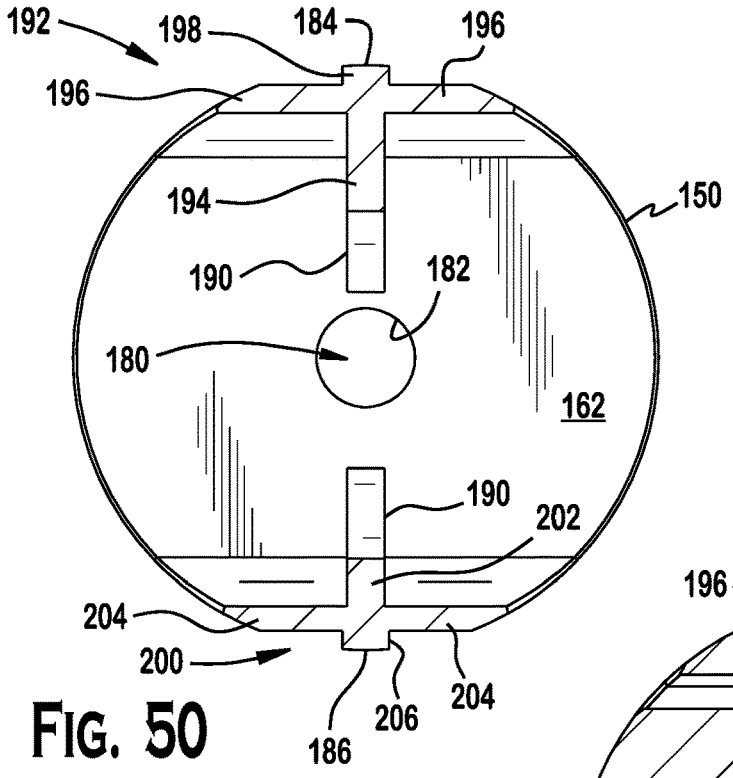
FIG. 50 is a cross-sectional view of the core of FIG. 42 along line 50-50.
Figure 51:
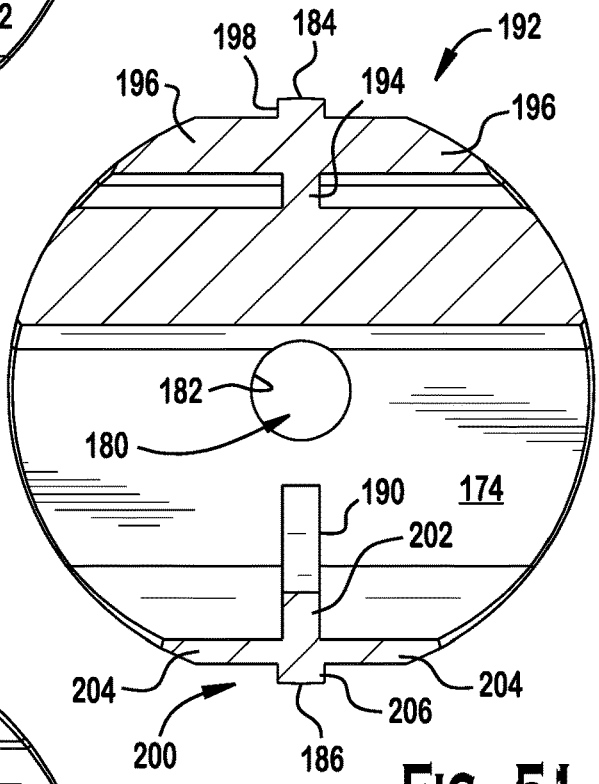
FIG. 51 is a cross-sectional view of the core of FIG. 42 along line 51-51.
Figure 52:
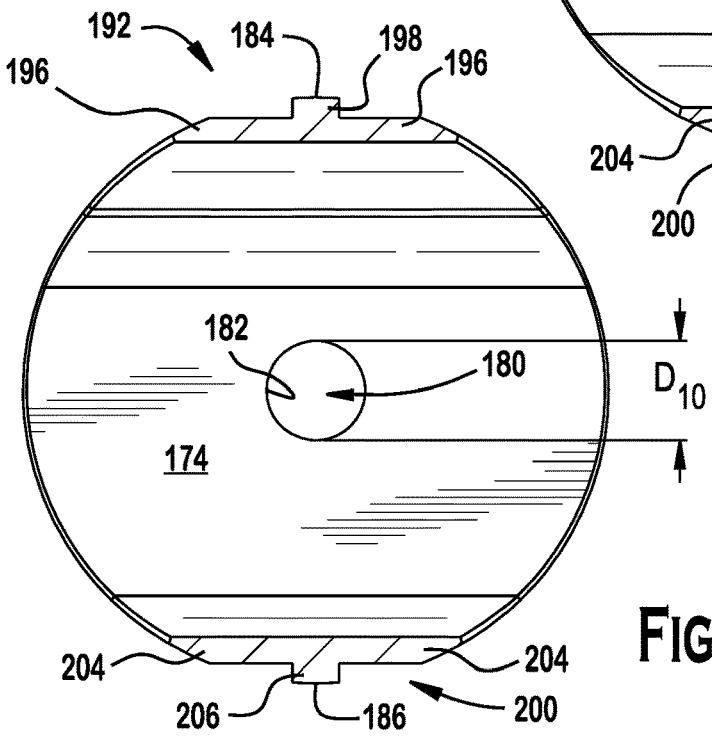
FIG. 52 is a cross-sectional view of the core of FIG. 42 along line 52-52.
Figure 53:
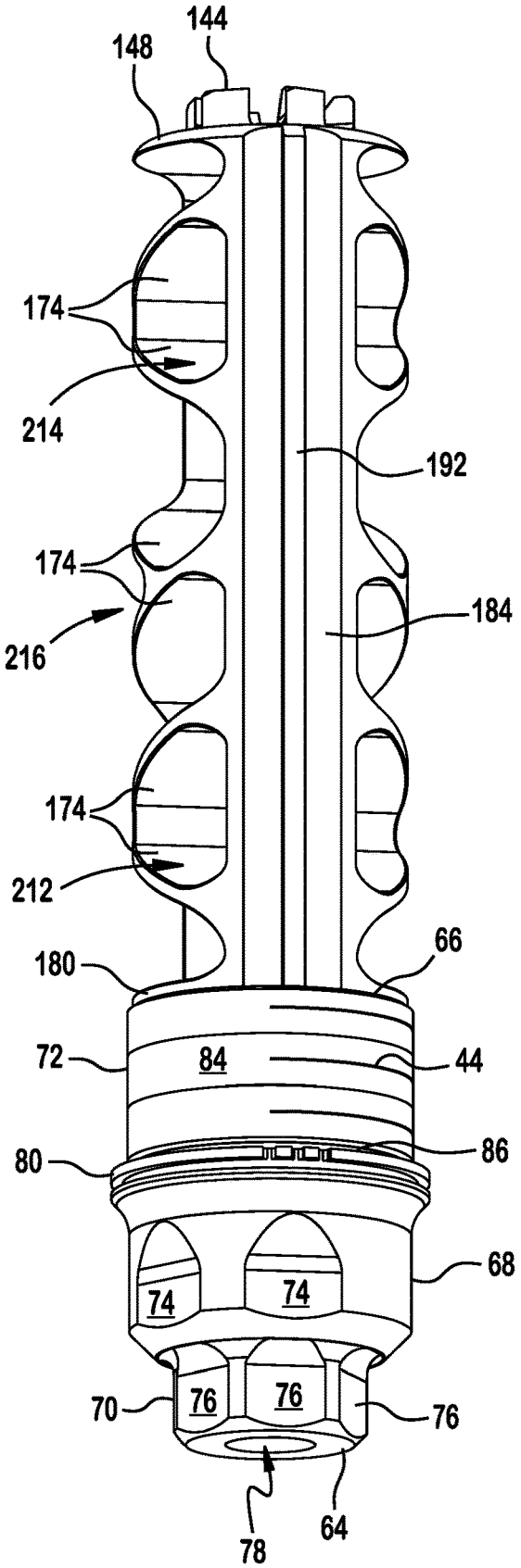
FIG. 53 is a perspective view of the core and mount body assembly of FIG. 5.
Figure 54:
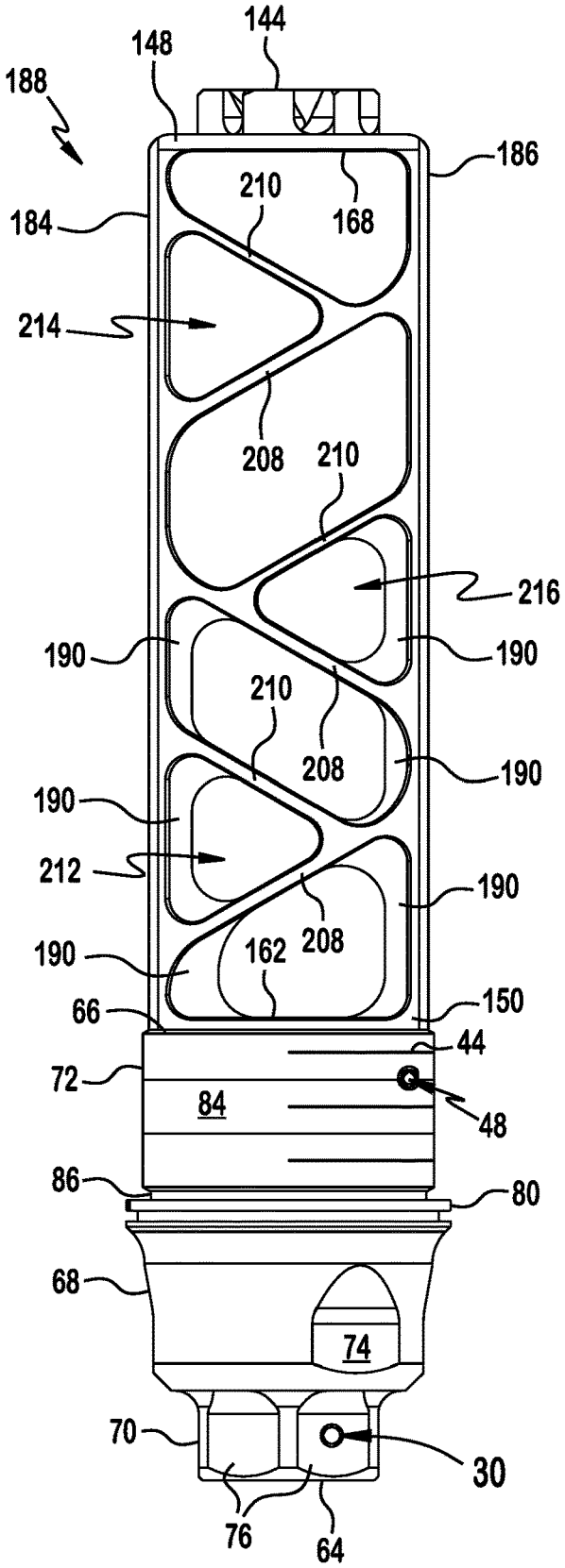
FIG. 54 is another perspective view of the core and mount body assembly of FIG. 53.

Referring to FIGS. 20, 21 and 61, the tube 21 may include a distal opening 112. The distal opening 112 of the tube may be configured and dimensioned to house the distal end 144 of the core. More particularly, the distal end 144 of the core may include an exterior vent 172. The vent 172 may include a plurality of facets 173. The facets 173 may project into the distal opening 112. Referring to FIGS. 50 and 51, the facets 173 may surround the discharge port 170 of the core and may be shaped to direct ammunition discharge gases away from the suppressor. For example, each facet 173 may include a curved surface 217 which may direct exiting discharge gases forward and radially outward. See e.g., FIGS. 20 and 21. Collectively, the curved surfaces of the facets 173 may define a set of outwardly facing concave surfaces. The set of concave surfaces may define semi hemispherical shape. Additionally, the exterior vent 172 may include a plurality of troughs 218. Generally, the plurality of troughs may direct discharge gases radially.

Referring to FIG. 20, preferably a longitudinal gap 40 may exist between the distal end wall 148 of the core and the distal interior end wall 128 of the tube. The longitudinal gap 40 may have a length L6. For example, the length L6 of the longitudinal gap 40 may range from approximately 0.005 inches to approximately 0.015 inches. Similarly, a radial gap 42 may exist between the distal tool fitting 120 at the distal end of the tube 108 and the exterior vent 172 near the distal end 144 of the core. The radial gap 42 may have a length L7. For example, the length L7 of the radial gap 42 may range from approximately 0.03 inches to approximately 0.05 inches. Additionally, the radial gap between the core and the tube may be approximately 0.0075 inches. Illustrative dimensions for the exemplary suppressor of FIG. 1 are presented in Table 7 and Table 8 (below).

The longitudinal gap 40, the radial gap 42 and any radial space between core and the tube may be reduced or eliminated during use of the suppressor due to thermal expansion of the suppressor components (e.g., mount body, core, and tube). Thermal expansion of suppressor components may result in the distal end of the core being compressed between the mount body and the tube. Accordingly, the suppressor may be post-tensioned by compressive forces acting on the core and by tensile forces acting on the tube. The suppressor, therefore, may form a post-stressed assembly that enhances structural properties or operational performance of the suppressor. For example, the post-tensioned assembly may deflect less under dynamic loads or allow for a reduction in the material requirements for the tube or core, resulting in a lighter suppressor.

The proximal side wall 152 of the core may be advanced into the inner side wall 88 of the mount body 20, until the proximal end 106 of the tube is seated on the distal face 82 of the flange 80. Optionally, the core 22 may then be pinned to the mount body 20 at fixation hole 48. The tube may then be secured to the outer surface 88 of the annular stem. After being torqued into place, the spring may be arranged in the locking index to further secure the connection between the tube and the mount body. After the assembly of the suppressor is complete, the muzzle end of a threaded barrel may be advanced into the barrel receiving bore. The suppressed firearm may then be operated. After being torqued into place, however, the mount body further may be pinned to the barrel at fixation hole 30.

Generally, the mount body 20, core 22 and tube 21 may be formed from a high temperature heat resistant alloy (e.g., Grade-5 6AL-4V Titanium, or 17-4 stainless steel), and further may include a high temperature heat resistant coating, including without limitation diffusional coatings, overlay coatings, or thermal barrier coatings (TBC). For instance, the mount body 20, core 22, and tube 21 may be formed from one material composition (e.g., Grade-5 Titanium). Alternatively, the mount body 20 and tube 21 may be formed from one material composition (e.g., Grade-5 Titanium), and the core 22 may be formed from another material composition (e.g., 17-4 Stainless Steel). The suppressor components further may include a high temperature heat resistant coating, including without limitation diffusional coatings, overlay coatings, or thermal barrier coatings (TBC). For example, the mount body 20 may be coated with Diamond Like Coating (DLC), and the tube 21 may have a Cerakote finish.

Generally, the suppressor 10 may be configured for rifle caliber ammunition including—without limitation—5.56 mm, 7.62 mm and 6.5 mm caliber ammunition. Accordingly, the suppressor 10 may be hosted on barrels chambered for rifle caliber ammunition, including barrels of full auto rated firearms.

The suppressor 10 may weigh approximately 21 ounces, may include an outer diameter of approximately 1.75 inches, and may have an overall length of approximately 7.9 inches. The suppressor may add approximately 7.25 inches of length to the muzzle of the hosted firearm. As described above, the barrel receiving bore of the suppressor may include a direct thread mount. For example, the barrel receiving bore for a barrel chambered in 5.56 mm caliber ammunition may include a ½-28 thread mount; whereas, the barrel receiving bore for a barrel chambered in 7.62 mm or 6.5 mm caliber ammunition may include a ⅝-24 thread mount. Additionally, the suppressor components may have a Cerkote finish.

Generally, the suppressor 10 may be hosted on a barrel having a barrel length of approximately 5.5 inches, 8.5 inches, 10.3 inches, or greater. As described above, the suppressor may be pinned to a 10.3 inch barrel to provide a 16 inch overall barrel length. During use the suppressor 10 may provide a reduction of sound signature and recoil, as well as decreasing the flash signature of the hosted weapon. For example, the suppressor 10 may achieve a peak sound level measurement of 134 dB—measured at the shooter's left ear—for an AR-15 with a 10.3 inch barrel chambered in 5.56 mm in accordance with MIL-STD-1474D (12 Feb. 1997). Operational data for the suppressor 10 of FIG. 1 are presented in Table 2 (below).

TABLE 2

Suppressor 10: Measured Peak Sound Levels

| Caliber | Rating | Reduction |
|---|---|---|
| 5.56 NATO | 8.5" 5.56 Full Auto | 135.9 dB |
| 7.62 × 39 mm | 8.5" 7.62 × 39 Full Auto | 136.3 dB |
| 6.5 CM | 12" 6.5 CM Full Auto | 134.7 dB |

Notes:

(a) All sound measurements performed in accordance with MIL-STD 1474-D.

(b) Reduction measurements taken from the Shooter's Left Ear measurement location.

(c) Sound reduction measurements were performed with a Larson and Davis LXT sound meter that was within its certification and that was calibrated before every use, in C weighting.

(d) 5.56 and 7.62 × 39 suppressors were measured on a 10.3" barrel using M855 ball and Wolf Military Classic ammunition respectively.

(e) .308 and 6.5 suppressors are measured with 18" barrel weapon systems and M80 ball and Hornady 140 gr ELD Match respectively.

Accordingly, the suppressor may achieve a measured peak sound level measurement less than 136.62 dB at the shooter's left ear with a C-weighting on the meter. The measurement of the peak sound level being conducted in accordance with MIL-STD-1474D (12 Feb. 1997).

Figure 62:
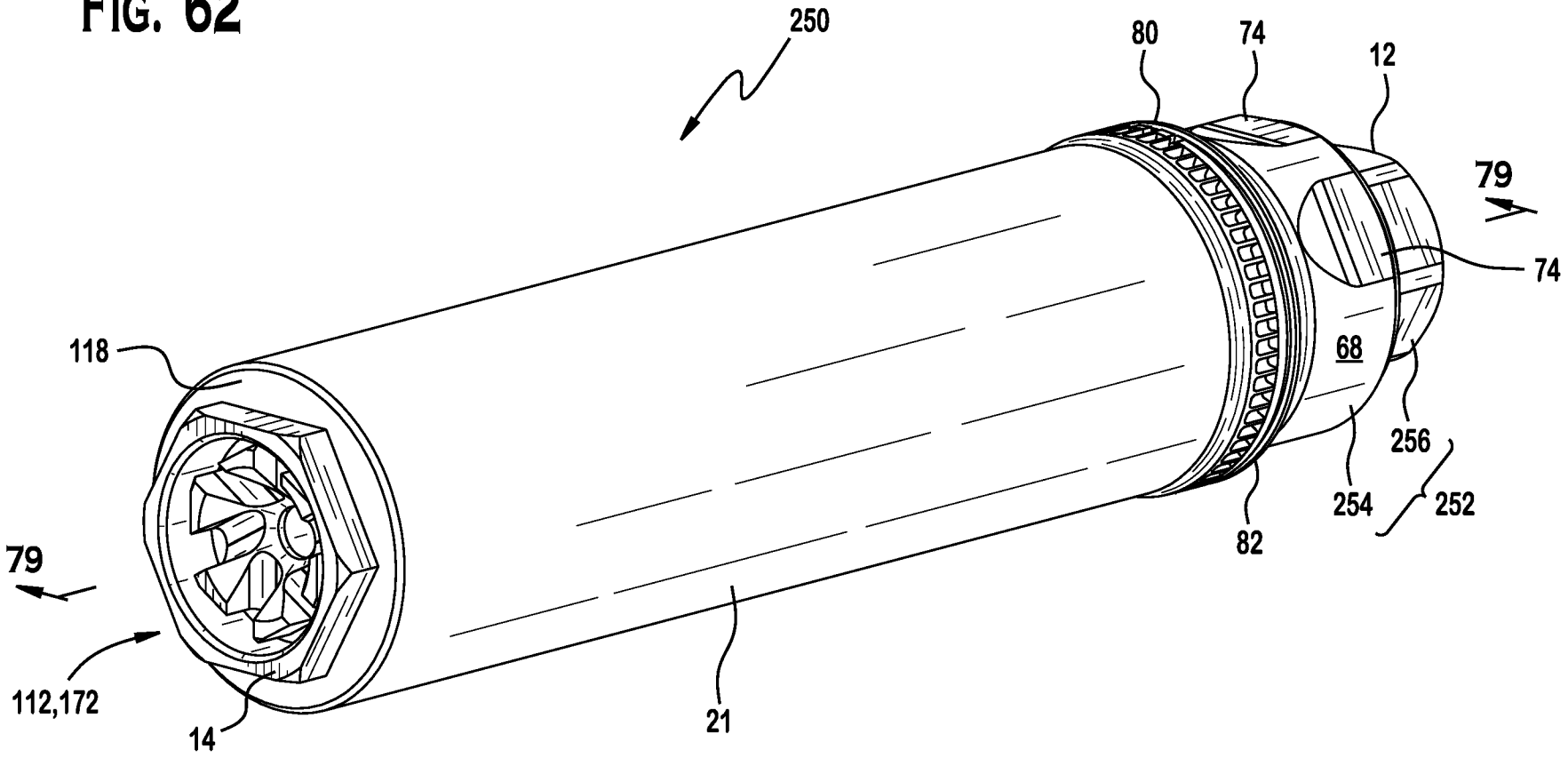
FIG. 62 is a perspective view of another exemplary embodiment of a suppressor.
Figure 63:
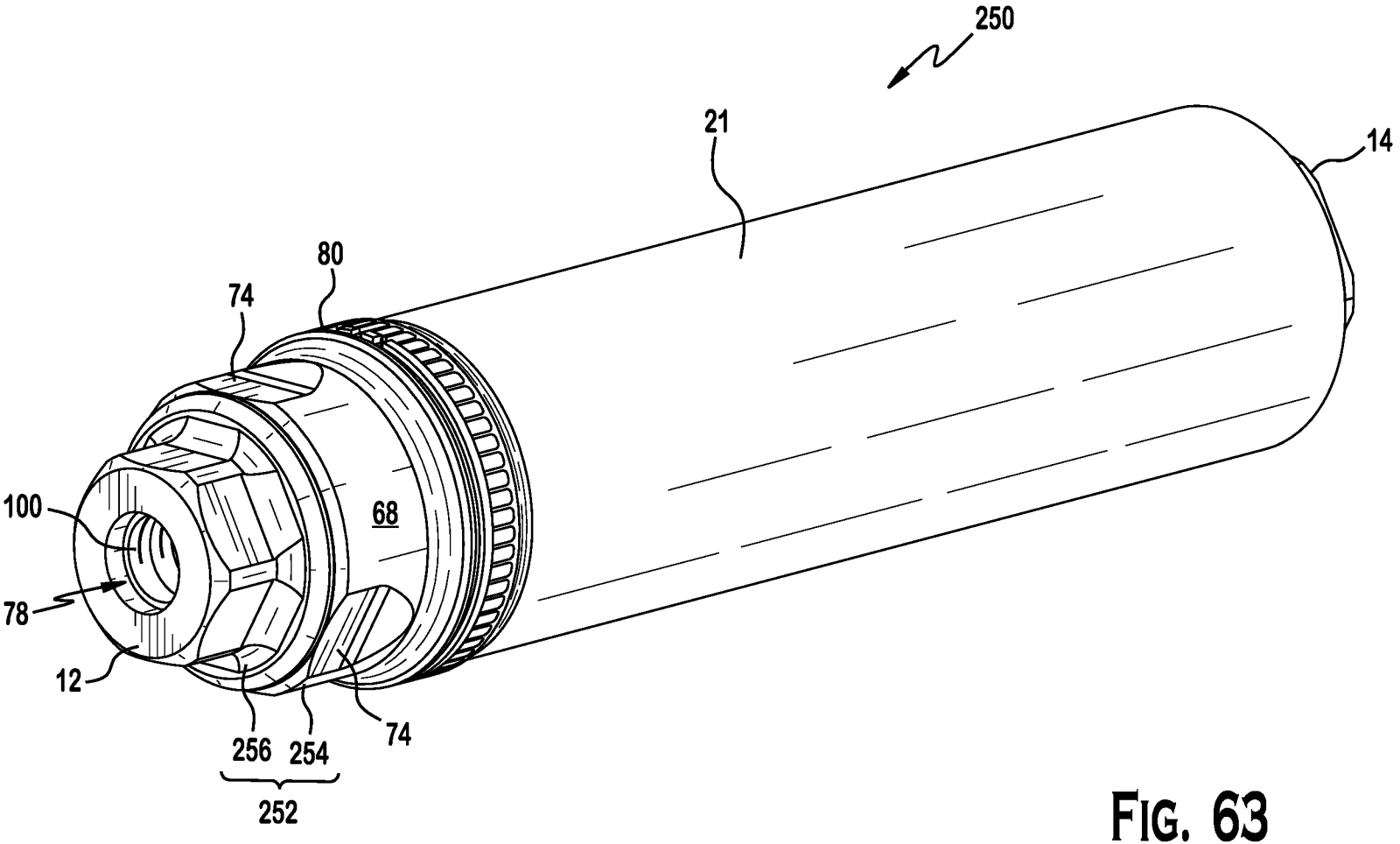
FIG. 63 is another perspective view of the suppressor of FIG. 62.
Figure 78:
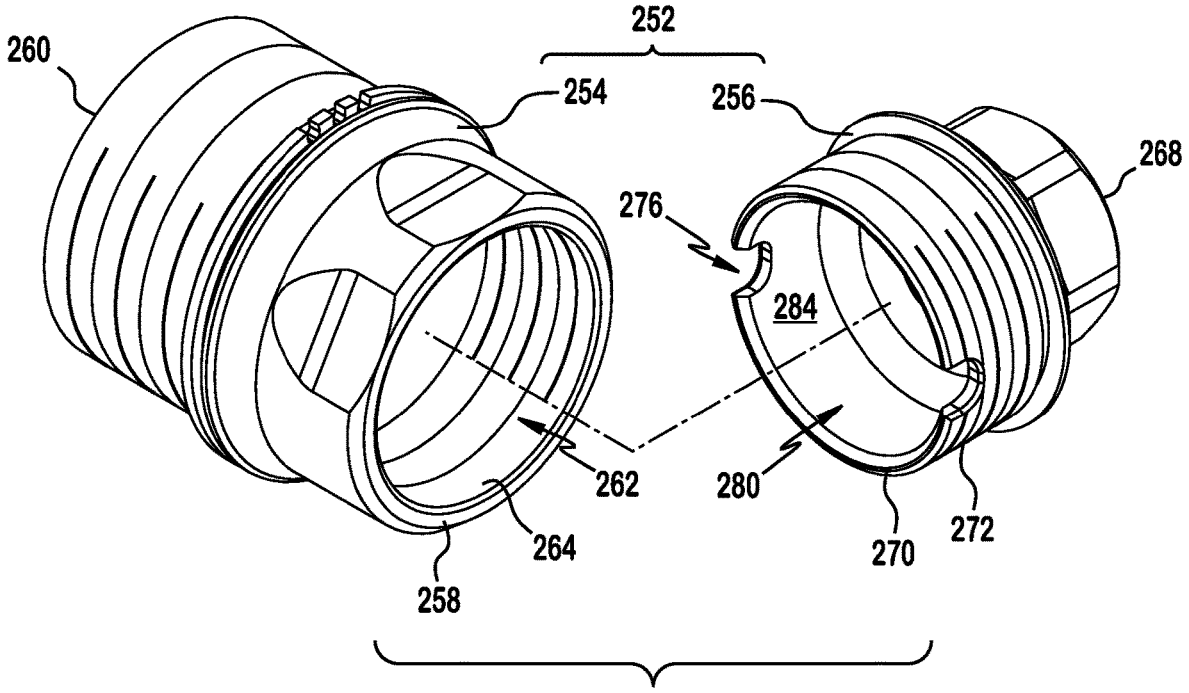
FIG. 78 is an exploded view of the mount body assembly of FIG. 62.

FIG. 62 shows another embodiment of an exemplary suppressor 250. In this embodiment, the suppressor 250 may include a mount body assembly 252. Referring to FIG. 78, the mount body assembly 252 may include a mount body base 254 and a modular mount 256. Preferably, the mount body assembly 252 may be substantially the same as the mount body 20 of FIG. 4. The mount body assembly 252, however, may be formed from at least two complementary parts: a mount body base 254 and a modular mount 256. As shown in FIGS. 65, 66, 67 and 68, the mount body base 254 may include an intermediate body 68, a plurality of facets 74 on the intermediate body, a flange 80, a distal face 82 of the flange, an annular stem 72, and an outer sidewall of the annular stem 84.

Figure 64:
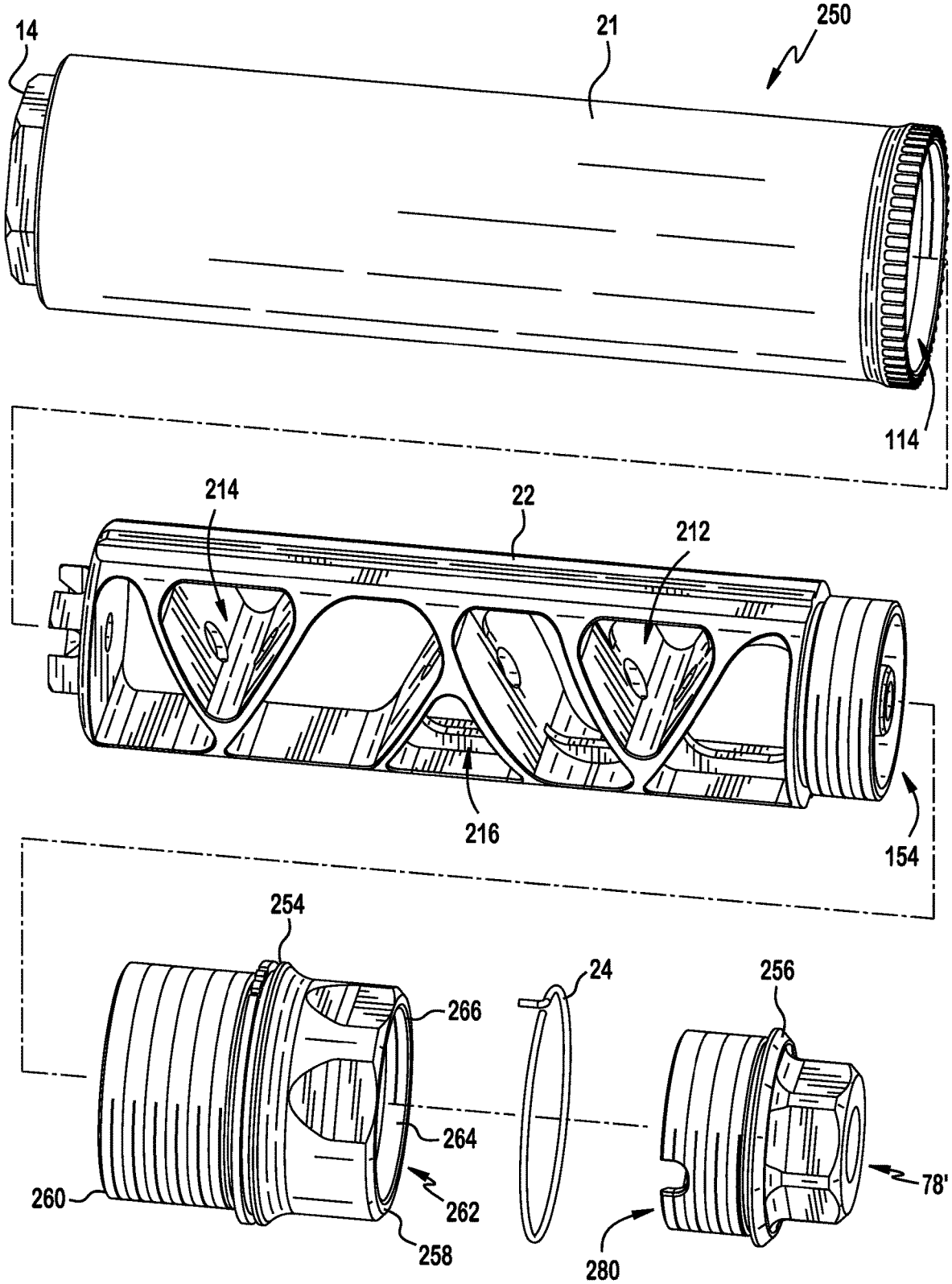
FIG. 64 is an exploded view of the suppressor of FIG. 62.
Figure 65:
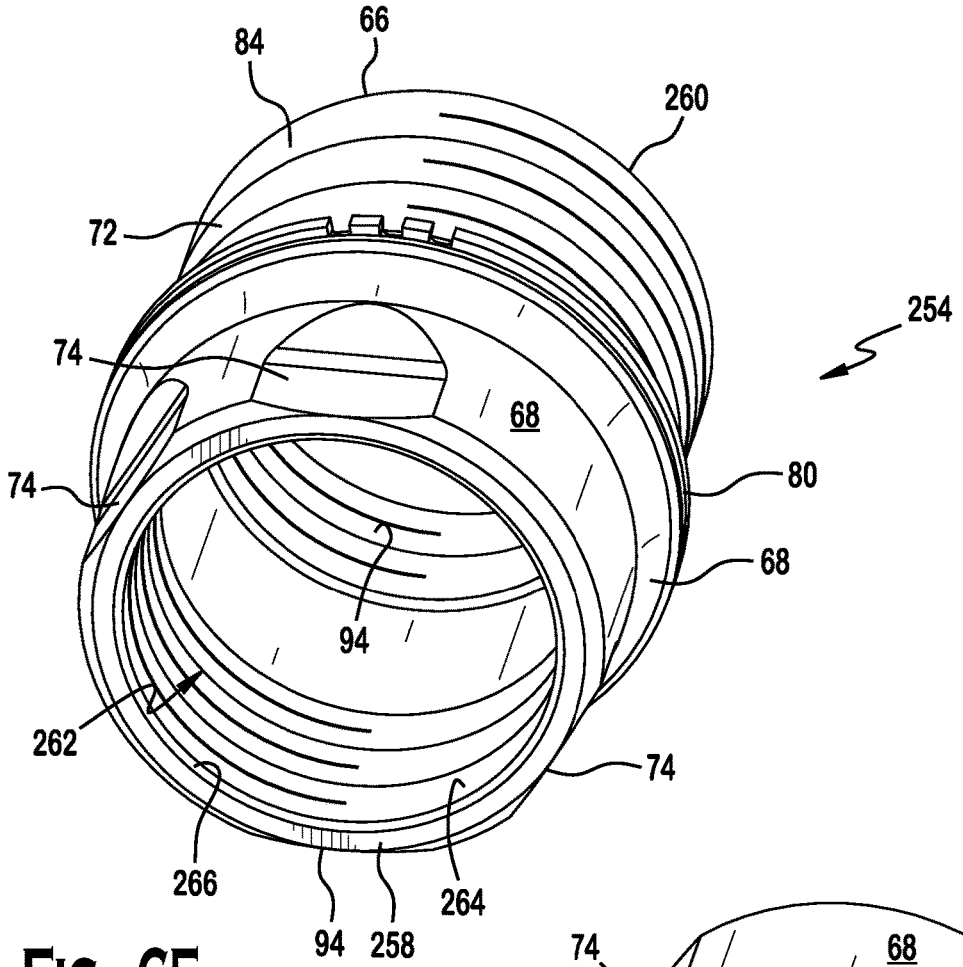
FIG. 65 is a perspective view of the mount body base of FIG. 64.
Figure 66:
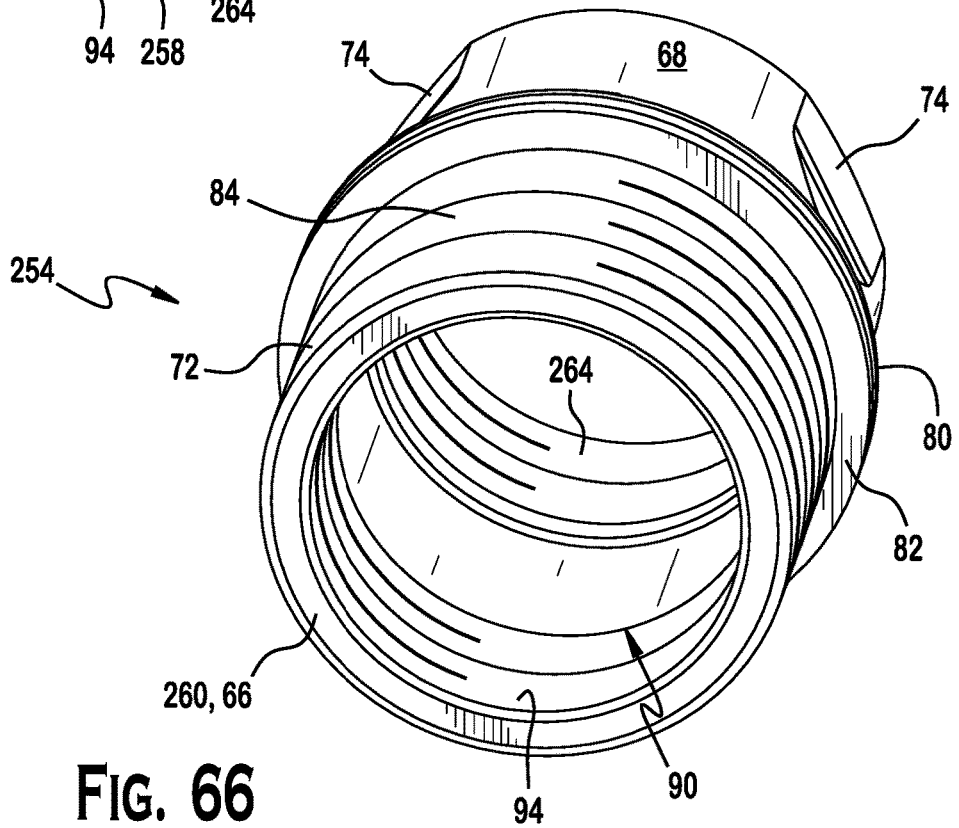
FIG. 66 is a perspective view of the mount body base of FIG. 64.
Figure 67:
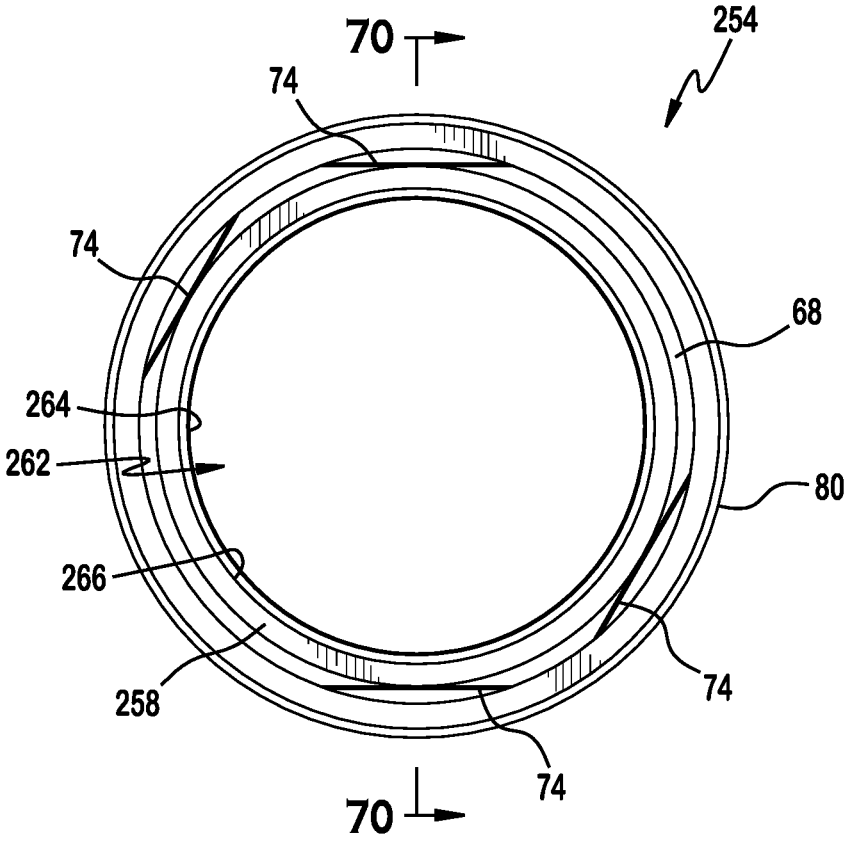
FIG. 67 is a rear view of the mount body base of FIG. 64.
Figure 68:
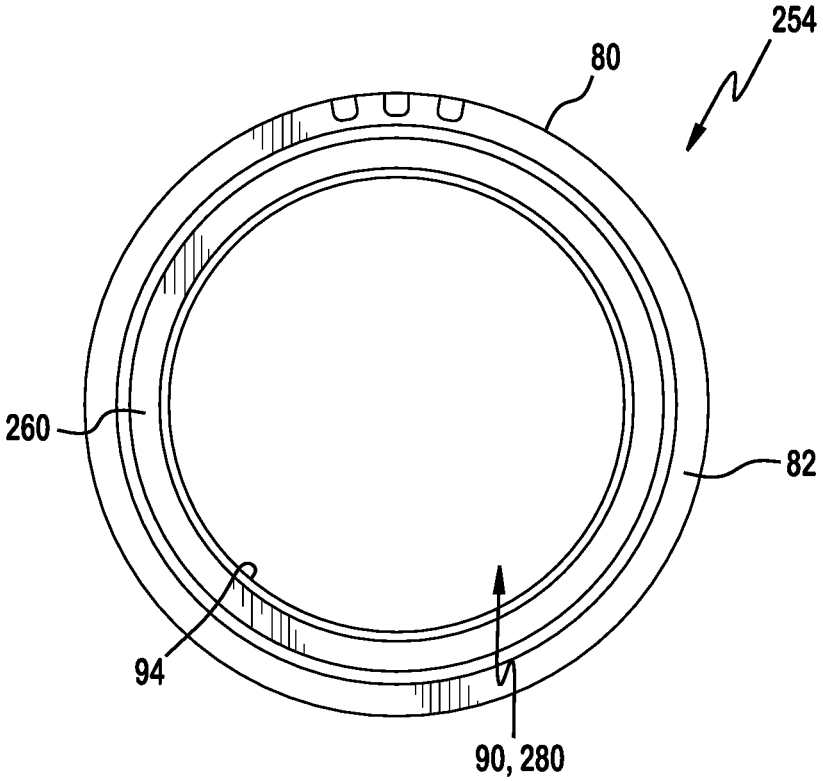
FIG. 68 is a front view of the mount body base of FIG. 64.
Figure 69:
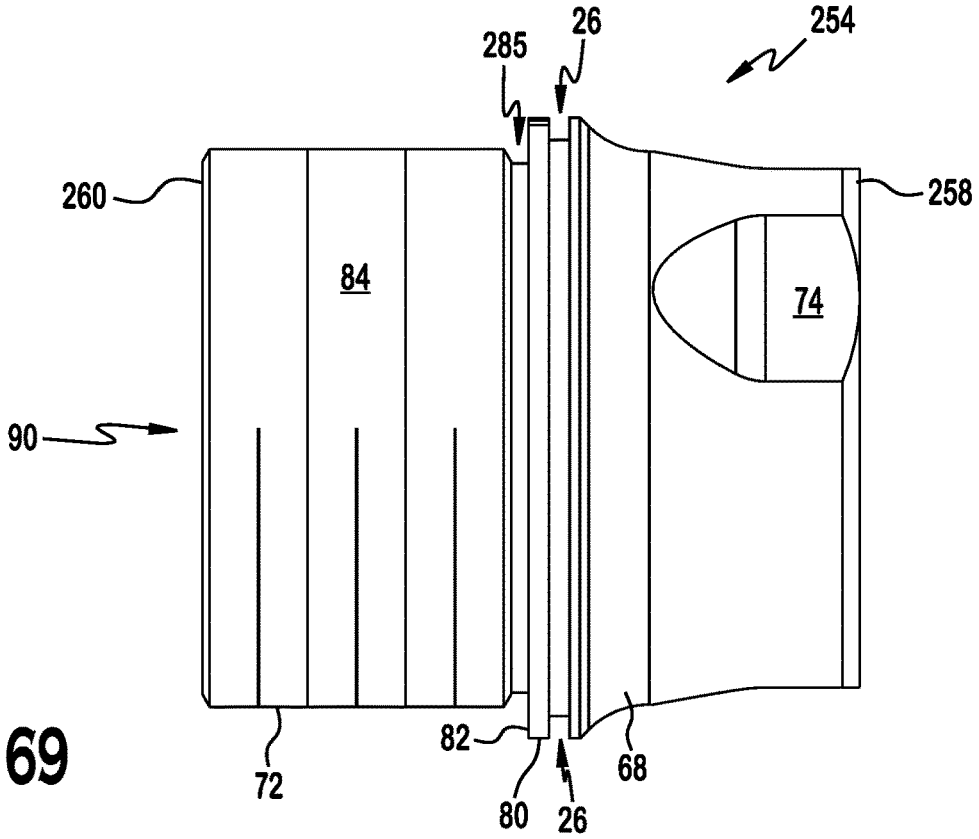
FIG. 69 is a right side view of the mount body base of FIG. 64.
Figure 70:
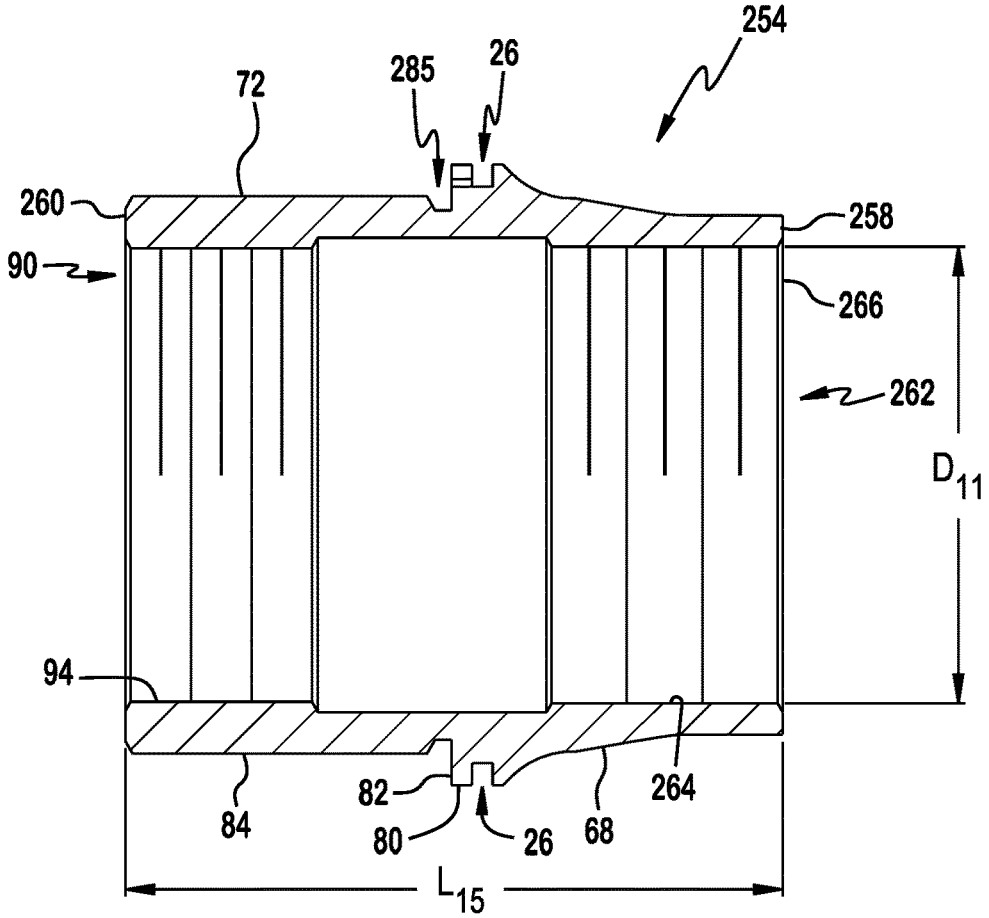
FIG. 70 is a cross-sectional view of the mount body base of FIG. 69 along line 70-70.

Referring to FIGS. 64 and 65, the mount body base 254 may be a generally tubular structure which may include a proximal end 258 and a distal end 260. The proximal end 258 further may include a proximal opening 262. The proximal end 258 may form an annular face. The mount body base further may include a proximal interior side wall 264 adjacent to the proximal end 258. The proximal interior side wall 264 may include a screw thread. Moreover, the proximal interior side wall 264 may include a thread relief (or recess) 266 between the screw thread and the proximal end 258. Referring to FIG. 66, the distal end 260 of the mount body base 254 may include a distal opening. The distal end may form another annular face. The mount body base 254 further may include a distal inner side wall 94. The distal inner sidewall 94 further may include a screw thread. The distal inner sidewall 94 may form a core mounting receptacle 90.

Referring to FIG. 71, the modular mount 256 may include a proximal end 268 and a distal end 270. The proximal end 268 may include a barrel receiving bore 78. The barrel receiving bore may include a sidewall 98 that extends from the proximal end 270 of the modular mount to the distal end 270. The sidewall 98 of barrel receiving bore 78 may include a threaded segment 100 and a recessed thread relief segment 102. See e.g., FIG. 76. The barrel receiving bore 78 may be configured and dimensioned to receive the muzzle end of a threaded barrel. Accordingly, screw threads on the threaded segment 100 may be configured and dimensioned to mate with screw threads on a host firearm barrel. Moreover, the modular mount may include a collar 70, a plurality of facets 76 on the collar, and a shoulder 274. As shown in FIG. 72, the modular mount 256 further may include an annular plug and a circumferential ledge 278.

Figure 74:
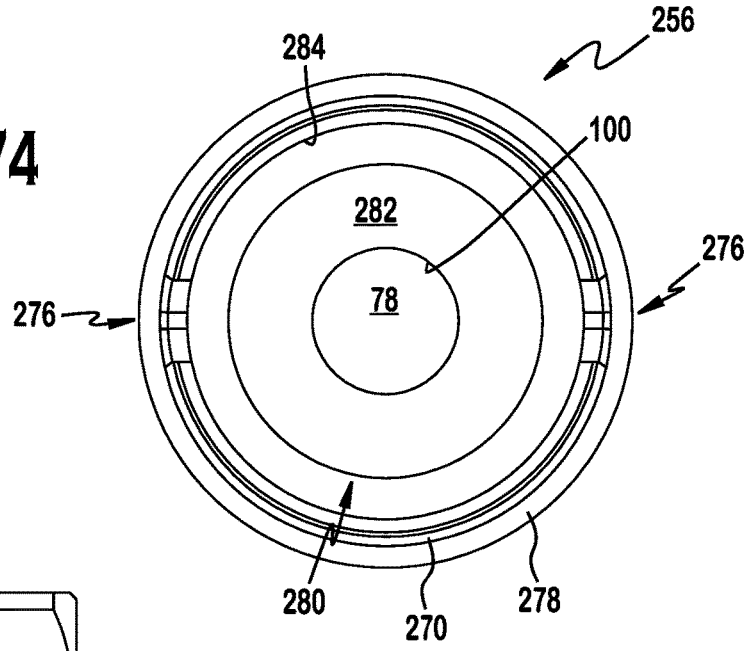
FIG. 74 is a front view of the modular mount of FIG. 64.
Figure 75:
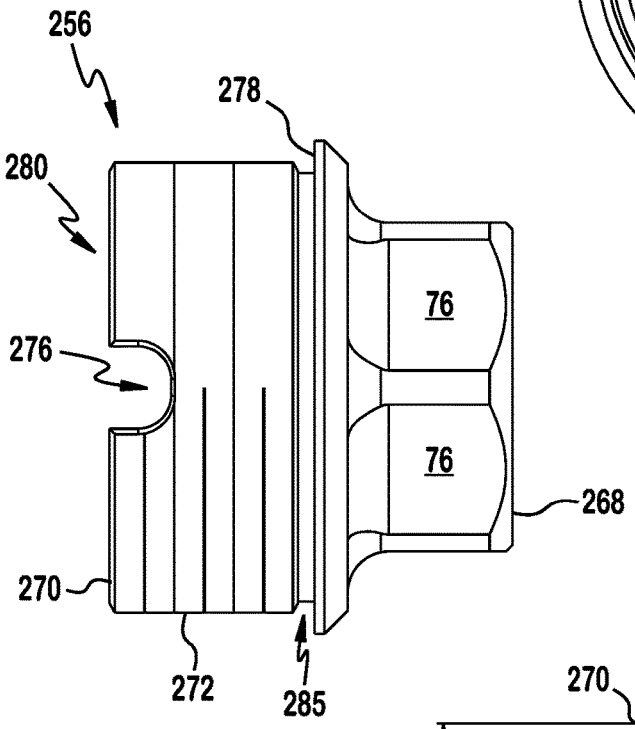
FIG. 75 is a right side view of the modular mount of FIG. 64.
Figure 76:
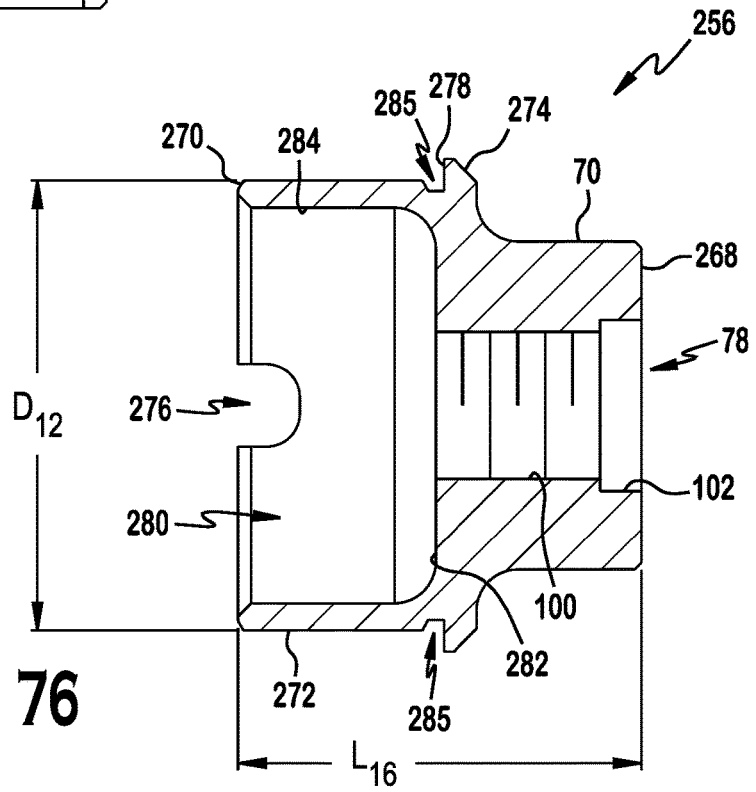
FIG. 76 is a cross-sectional view of the modular mount of FIG. 75 along line 76-76.
Figure 77:
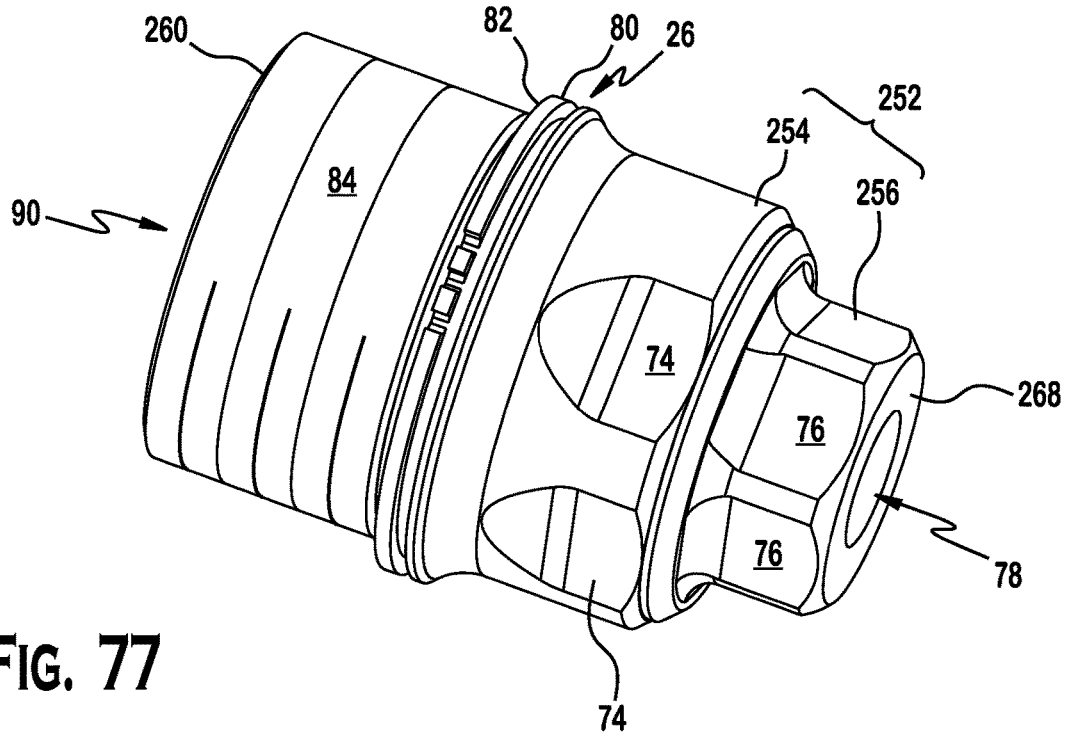
FIG. 77 is a perspective view of the mount body assembly of FIG. 62.

Referring to FIGS. 72, 74 and 76, the annular plug may include a distal opening 280, an interior end wall 282, and an inner sidewall 284 that may extend from the distal end 270 of the modular mount to the interior end wall 282. The side wall of the annular plug may include a pair of notches 276 at the distal end of the annular plug. These notches may form a fitting for a wrench or driver. Additionally, the annular plug may include a distally facing circumferential ledge 278 opposite the shoulder 274, as well as an outer sidewall 272. The outer side wall 272 may include a screw thread. A thread relief (or circumferential recess) 285 may be disposed between the circumferential ledge 278 and the screw thread on the outer sidewall 272.

Figure 79:
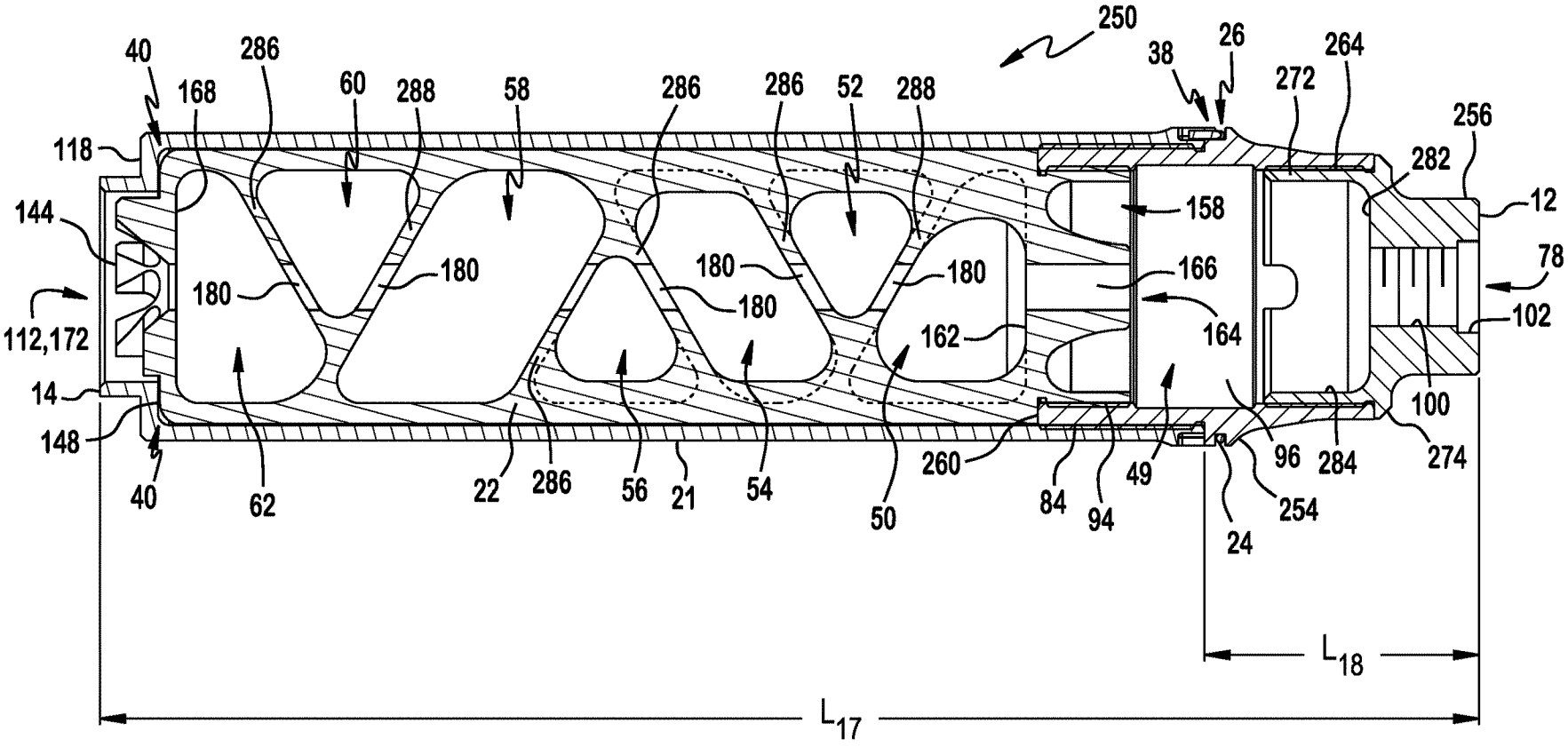
FIG. 79 is a cross-sectional view of the suppressor of FIG. 62 along line 79-79.

Referring to FIGS. 71, 77, 78, 79 and 80, the modular mount 256 may be connected to the mount body base 254 by advancing a screw thread (not shown) on the outer sidewall 272 of the modular mount (see e.g., FIG. 71) with respect to the screw thread on the proximal interior side wall 264 of the mount body base. The modular mount 256 may be advanced into the mount body base until the circumferential ledge 278 is seated against the annular face of the proximal end 258 of the mount body base (see e.g., FIG. 77 and FIG. 78). Referring to FIG. 79, the mount body assembly 252 may be incorporated into a suppressor 250 in which the remaining components (e.g. tube 21, core 22, and spring 24) possess the same features or substantially the same features as the suppressor 10 of FIG. 1.

Figure 80:
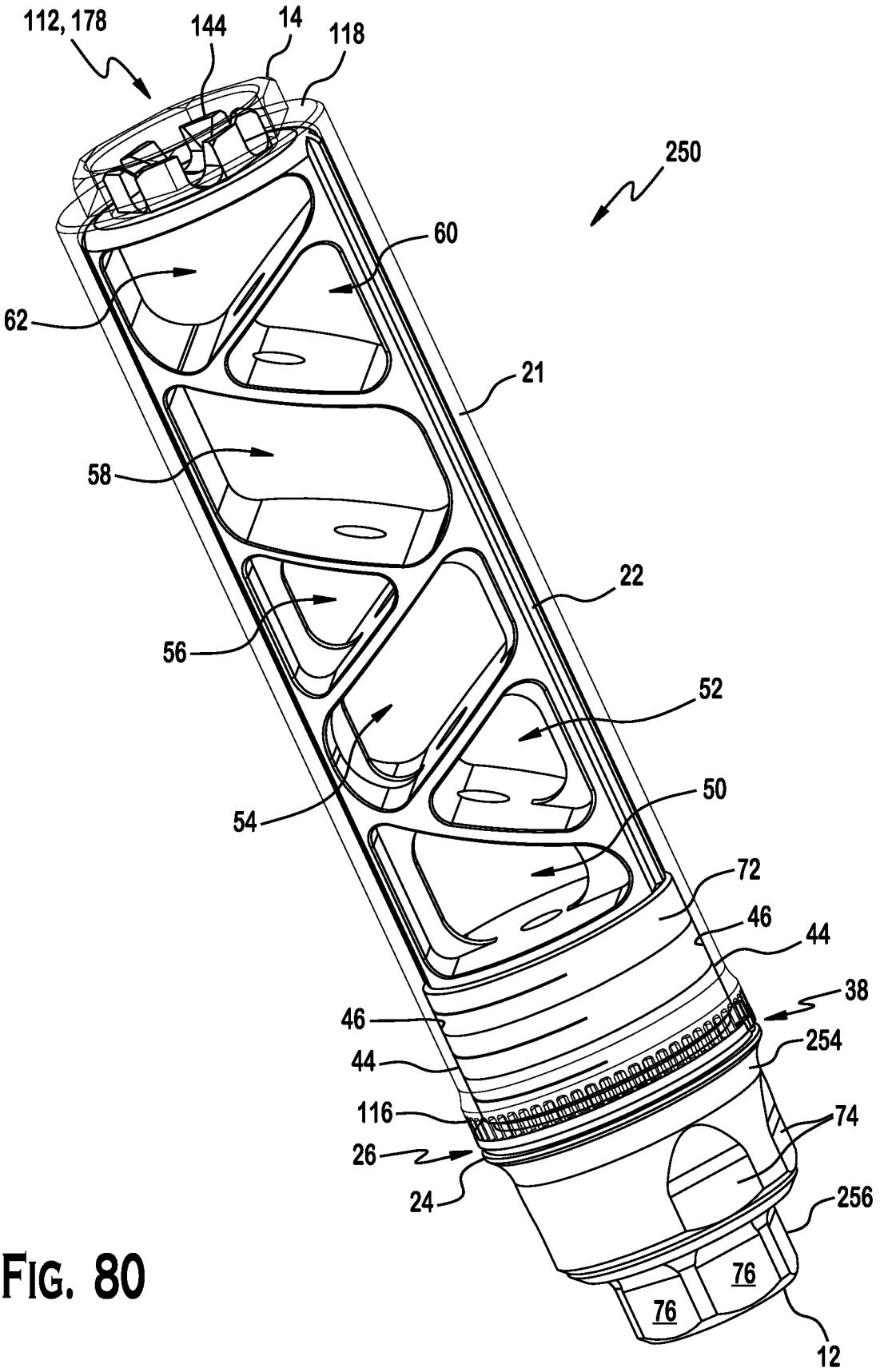
FIG. 80 is a perspective view of the suppressor of FIG. 62 showing the tube in a transparent rendering.

In the embodiment of the suppressor 250 shown in FIGS. 62 and 80, the barrel receiving bore 78 is configured and dimensioned for use with a barrel chambered in 5.56 mm caliber ammunition. In other embodiments, the barrel receiving bore 78 of a modular mount may be configured and dimensioned for use with a barrel chambered in other rifle ammunition calibers. For instance, the modular mount body 256 may be configured for 7.62 mm, 6.5 mm, or other rifle ammunition calibers. For example, in FIGS. 81, 82, 83, 84, 85, 86 and 87, the suppressor 300 may include a modular mount 304 and a core 22 that are configured and dimensioned for .30 caliber ammunition. Additionally, in other embodiments a modular mount body 256 may be adapted to secure to a barrel with a flash suppressor or some other muzzle configuration of a host firearm. For example, in FIGS. 89, 90, 91, 92, 93, 94, 95, 96, 97, 98, 99, 100, 101, 102, 103 and 104, the mount body assembly 312 may be adapted to mount the suppressor 310 onto a barrel chambered in 5.56 mm caliber rifle ammunition and including an A2 flash suppressor.

Figure 81:
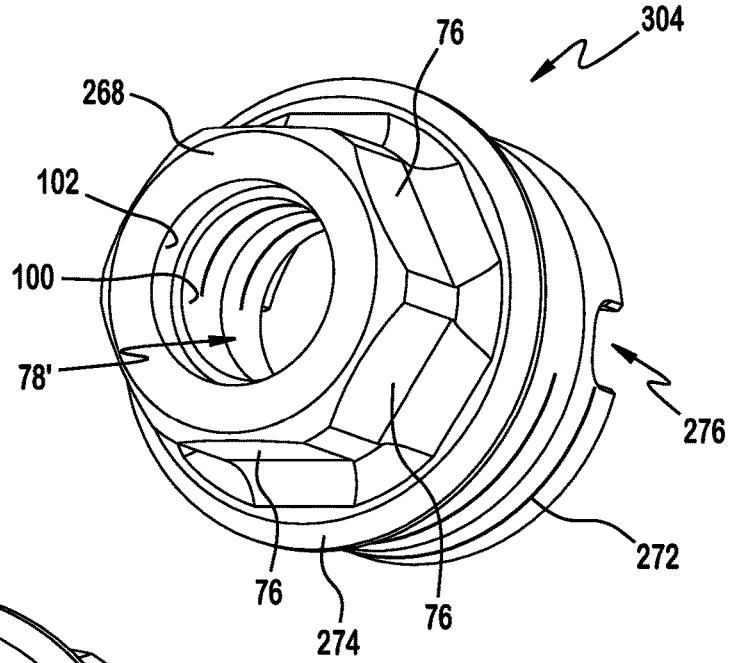
FIG. 81 is another exemplary embodiment of a modular mount.
Figure 82:
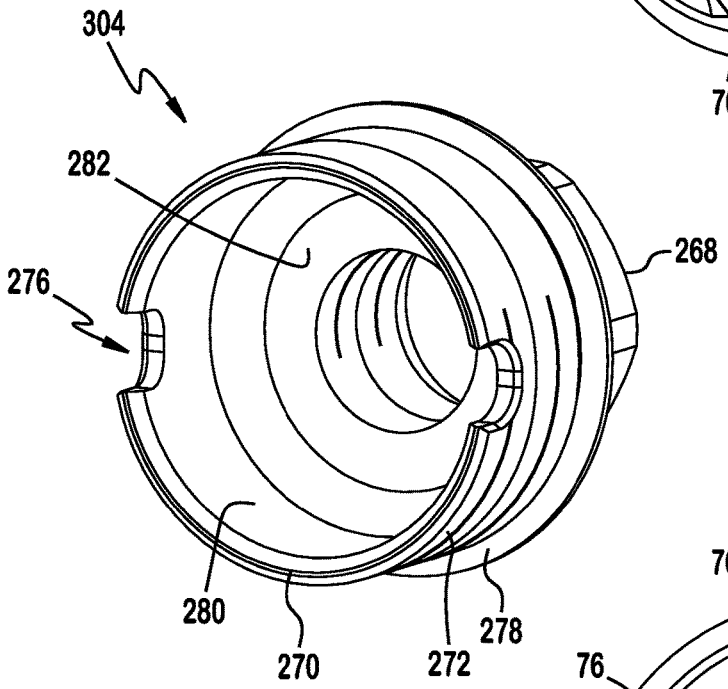
FIG. 82 is another perspective view of the modular mount of FIG. 81.
Figure 83:
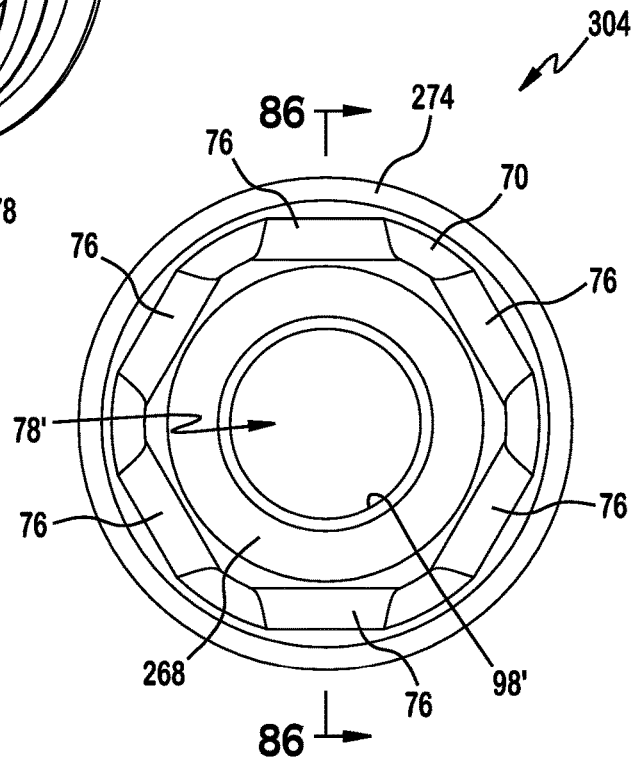
FIG. 83 is a rear view of the modular mount of FIG. 81.
Figure 84:
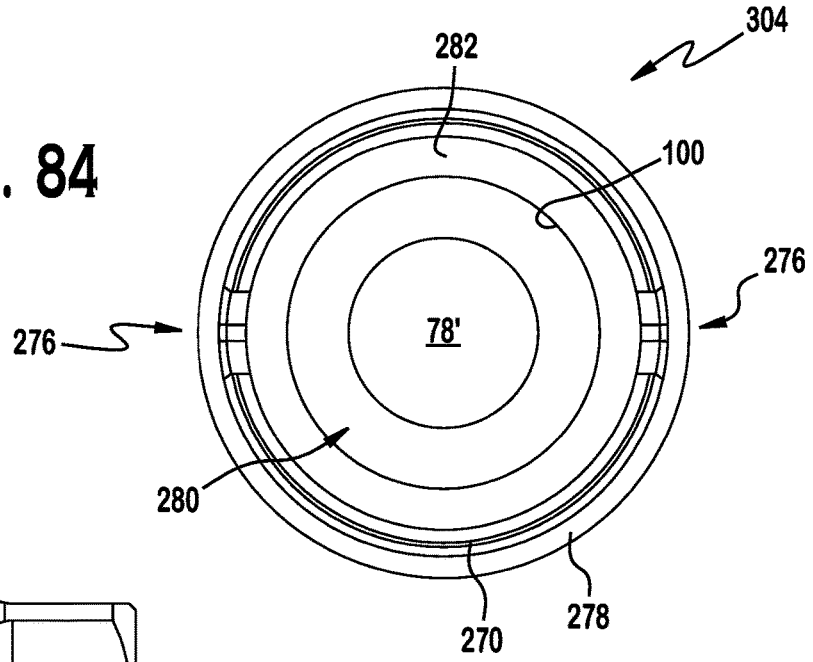
FIG. 84 is a front view of the modular mount of FIG. 81.
Figure 85:
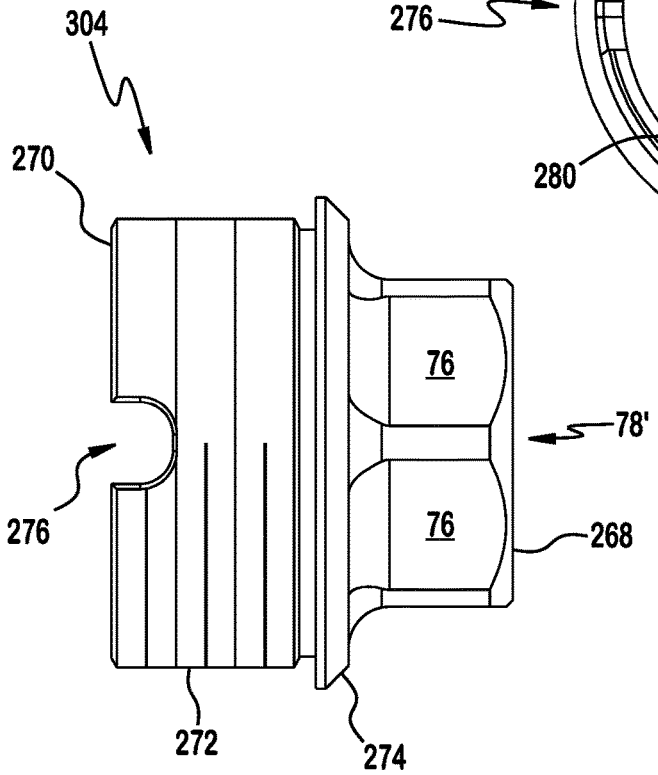
FIG. 85 is a right side view of the modular mount of FIG. 81.
Figure 86:
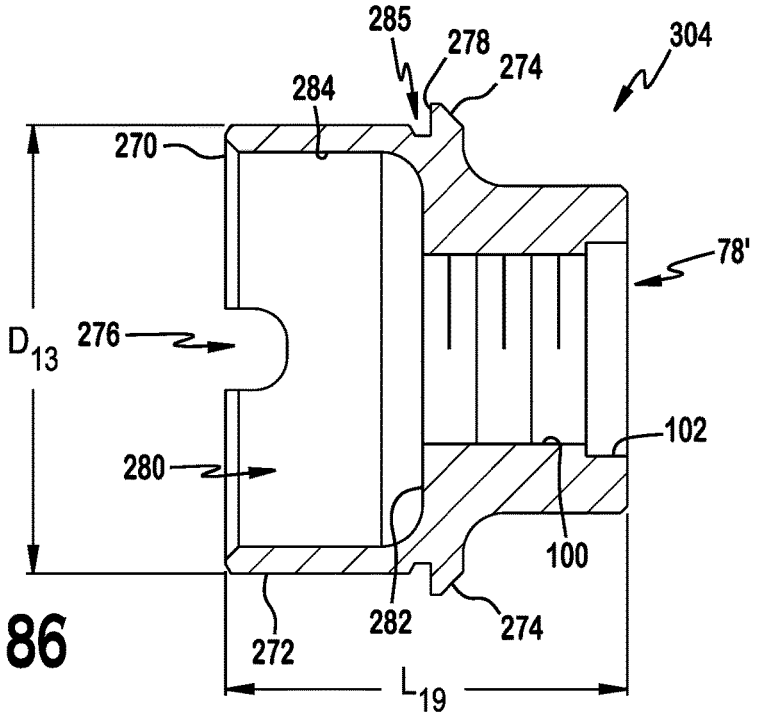
FIG. 86 is a cross-sectional view of the modular mount of FIG. 85 along line 86-86.
Figure 87:
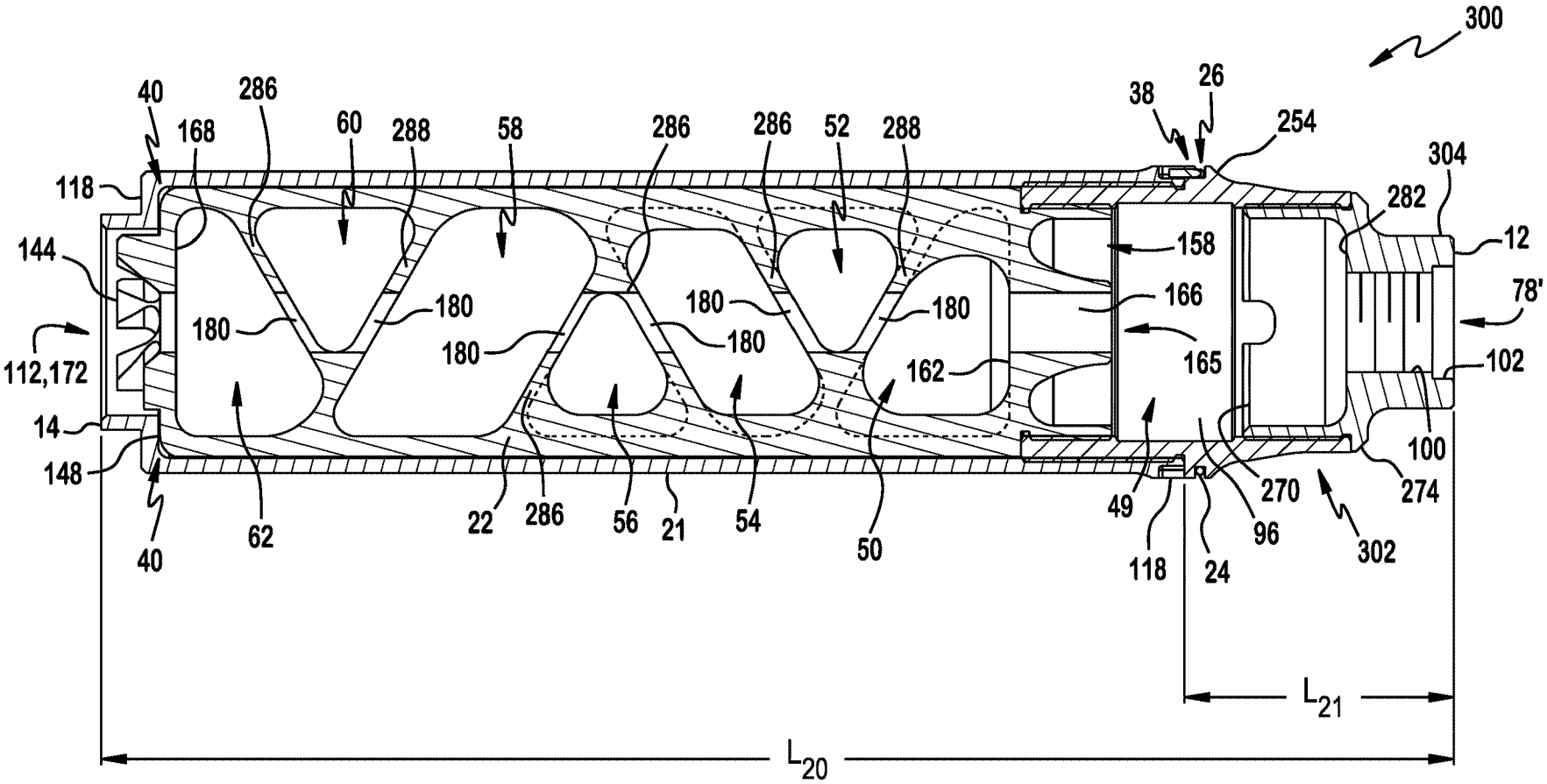
FIG. 87 is a cross-sectional view of the suppressor of FIG. 88 along line 87-87.

Illustrative dimensions for the exemplary suppressors of FIGS. 62 and 81 are presented in Table 7 and Table 8 (below).

Figure 88:
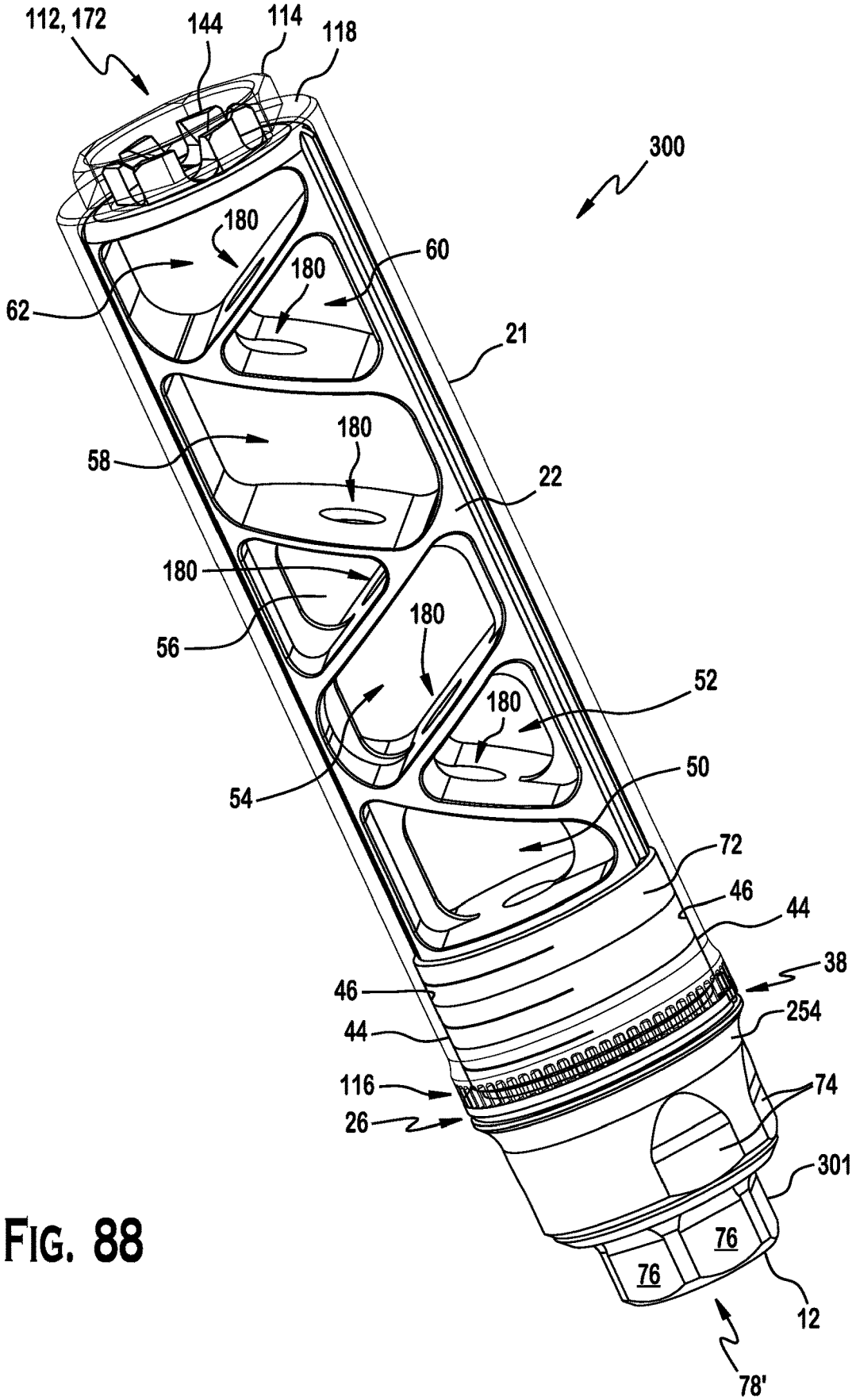
FIG. 88 is a perspective view of another exemplary embodiment of a suppressor, the suppressor tube being shown in a transparent rendering.

Generally, each of these suppressor embodiments 250, 300, 301 may be hosted on a barrel having a barrel length of approximately 8.5 inches, 10.3 inches, or greater. As described above, the suppressor may be pinned to a 10.3 inch barrel to provide a 16 inch overall barrel length. During use, the suppressor 250, 300, 301 may provide a reduction of sound signature and recoil, as well as decreasing the flash signature of the hosted weapon. For example, the suppressor 250 may achieve a peak sound level measurement of 134 dB—measured at the shooter's left ear—for an AR-15 with a 10.3 inch barrel chambered in 5.56 mm in accordance with MIL-STD-1474D (12 Feb. 1997). Operational data for the suppressor 250 of FIG. 62 and for the suppressor 300 of FIG. 88 are presented in Table 3 (below).

TABLE 3

Suppressor 250 & 310: Measured Peak Sound Levels

| Caliber | Rating | Reduction |
|---|---|---|
| 5.56 NATO | 8.5" 5.56 Full Auto | 131.6 dB |
| 7.62 × 39 mm | 8.5" 7.62 × 39 Full Auto | 135.7 dB |

Notes:

(a) All sound measurements performed in accordance with MIL-STD 1474-D.

(b) Reduction measurements taken from the Shooter's Left Ear measurement location.

(c) Sound reduction measurements were performed with a Larson and Davis LXT sound meter that was within its certification and that was calibrated before every use, in C weighting.

(d) 5.56 and 7.62 × 39 suppressors were measured on a 10.3" barrel using M855 ball and Wolf Military Classic ammunition respectively.

(e) .308 and 6.5 suppressors are measured with 18" barrel weapon systems and M80 ball and Hornady 140 gr ELD Match respectively.

Accordingly, the embodiment of the suppressor 250 of FIG. 62 and the embodiment of the suppressor 300 of FIG. 88, respectively may achieve a measured peak sound level measurement less than 136.62 dB at the shooter's left ear with a C-weighting on the meter. The measurement of the peak sound level being conducted in accordance with MIL-STD-1474D (12 Feb. 1997).

Figure 89:
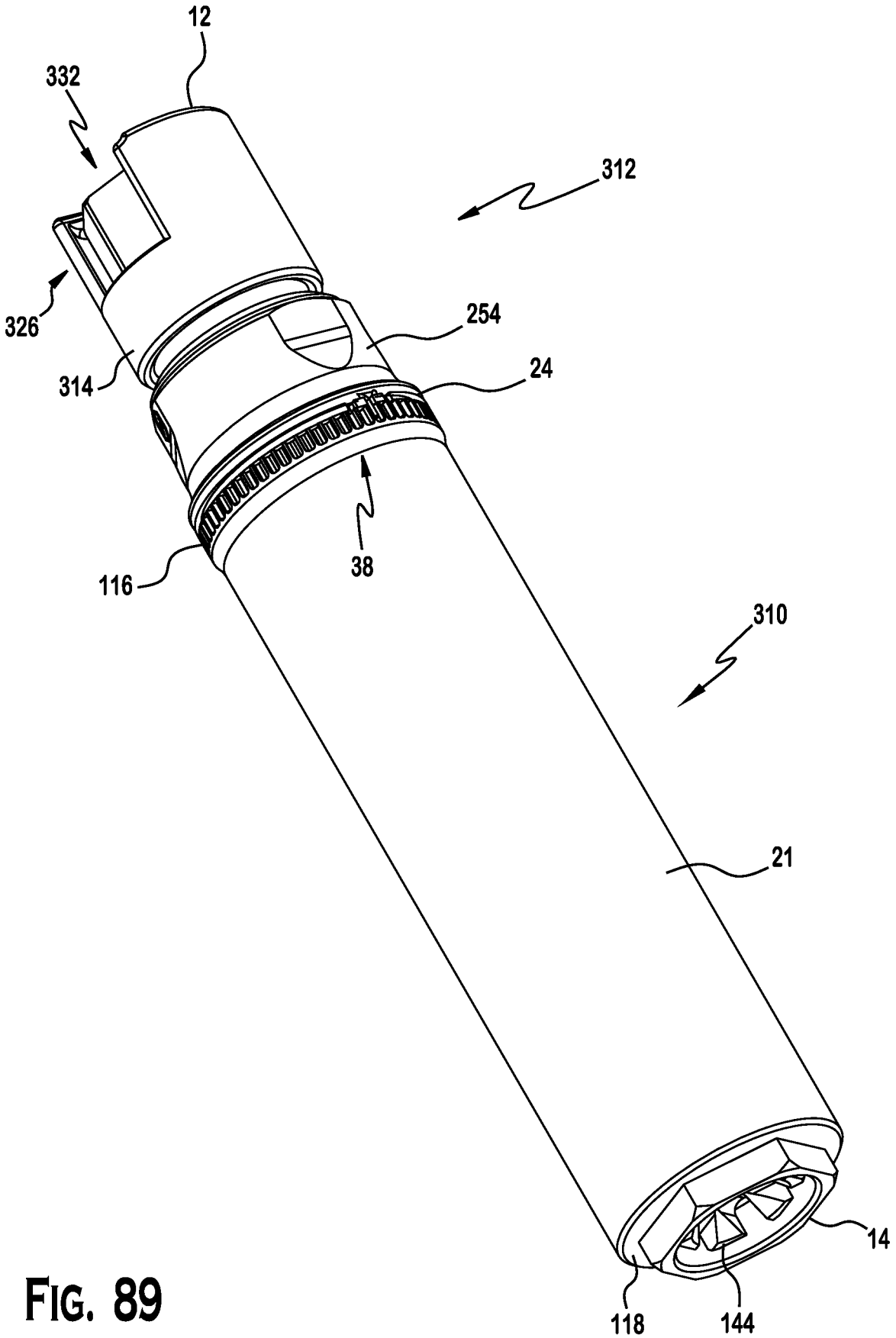
FIG. 89 is a perspective view of another exemplary embodiment of a suppressor.
Figure 90:
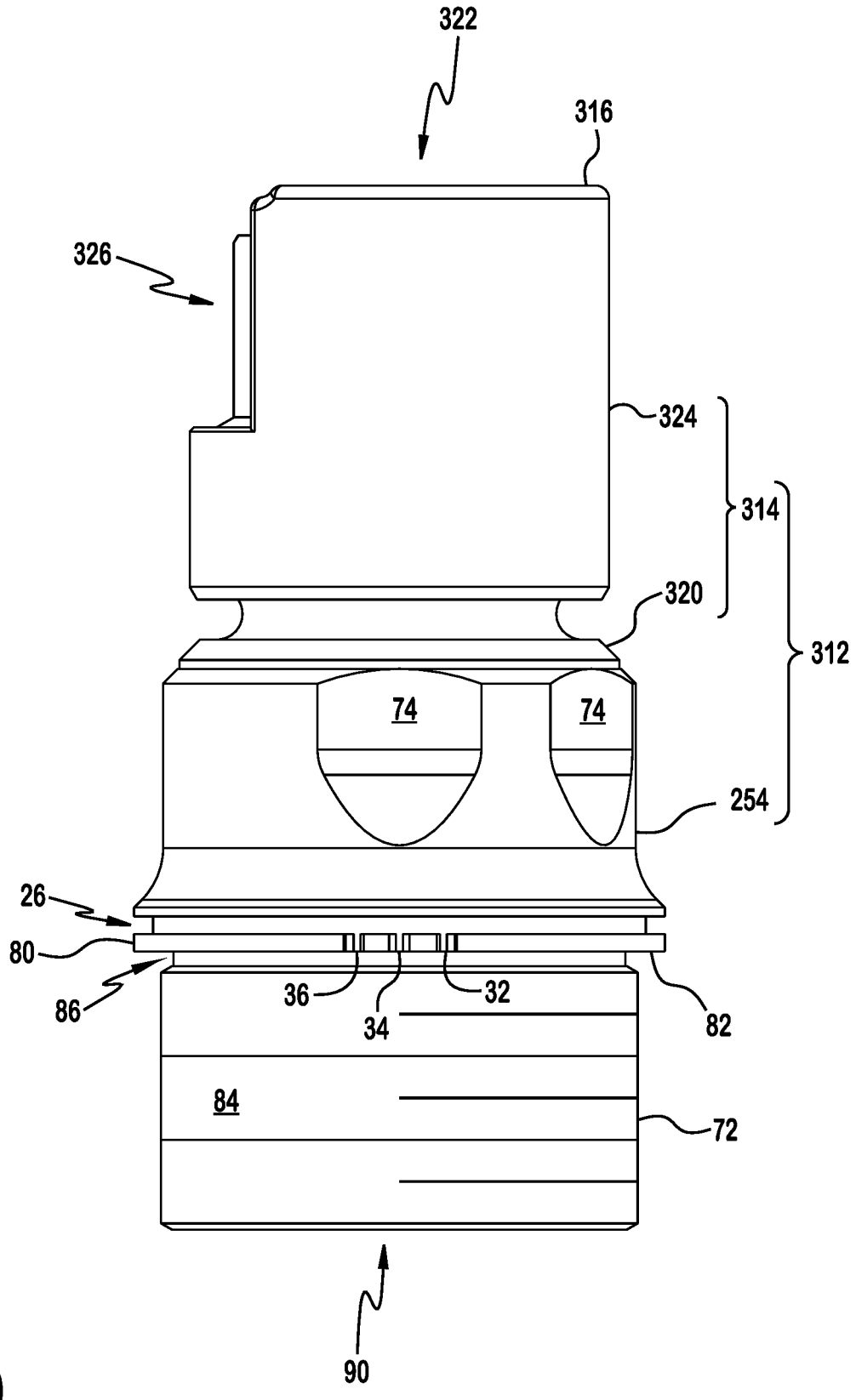
FIG. 90 is a perspective view of the mount body assembly of FIG. 89.
Figure 98:
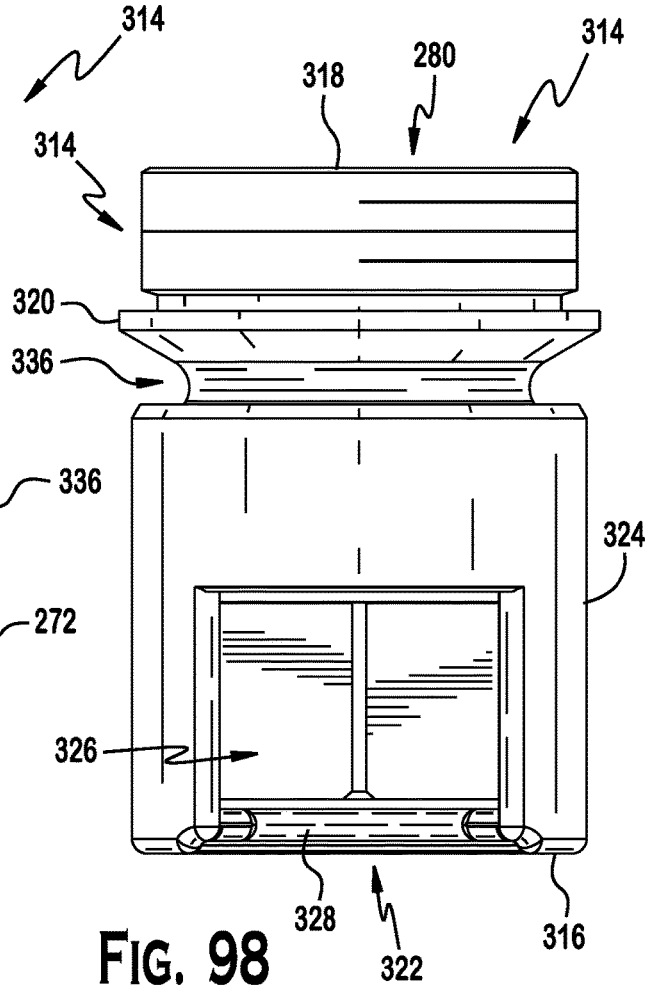
FIG. 98 is a bottom view of the mount body assembly of FIG. 95.
Figure 99:
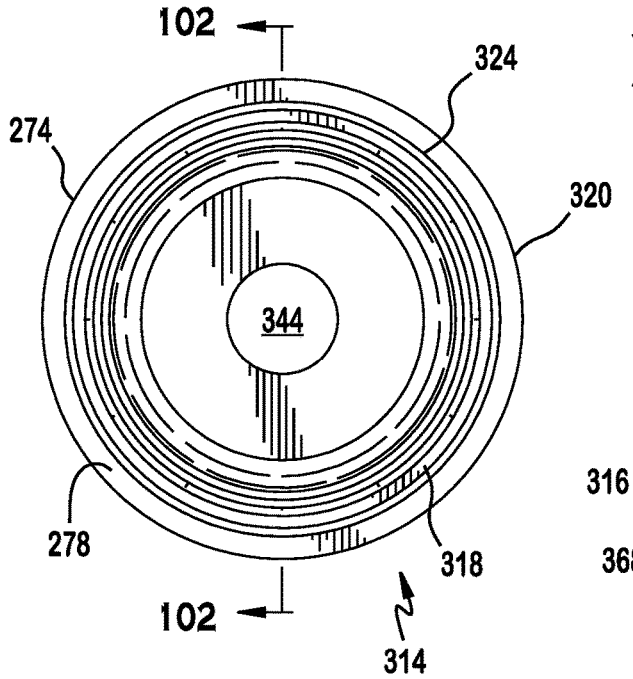
FIG. 99 is front view of the mount body assembly of FIG. 95.

FIG. 89, shows another embodiment of an exemplary suppressor 310. In this embodiment, the suppressor 310 may include a mount body assembly 312, along with a tube 21, core 22 and spring 24. Referring to FIGS. 89, 90, 98, the mount body assembly 312 may include a mount body base 254 and a modular mount 314. Preferably, the mount body base 254 and components of the suppressor 310 other than the modular mount 314 may be substantially the same as the respective components of the embodiment of the exemplary suppressor 250 of FIG. 62. See e.g., FIGS. 89, 90, 93, 94 and 98.

Figure 91:
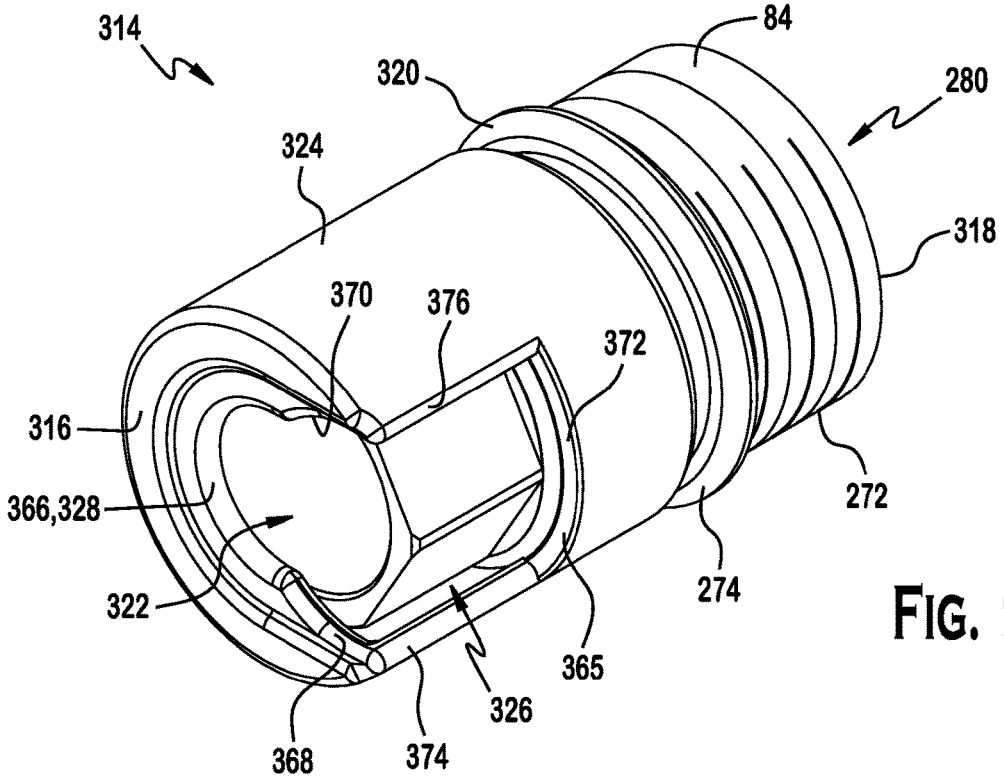
FIG. 91 is another perspective view of the mount body assembly of FIG. 89.
Figure 95:
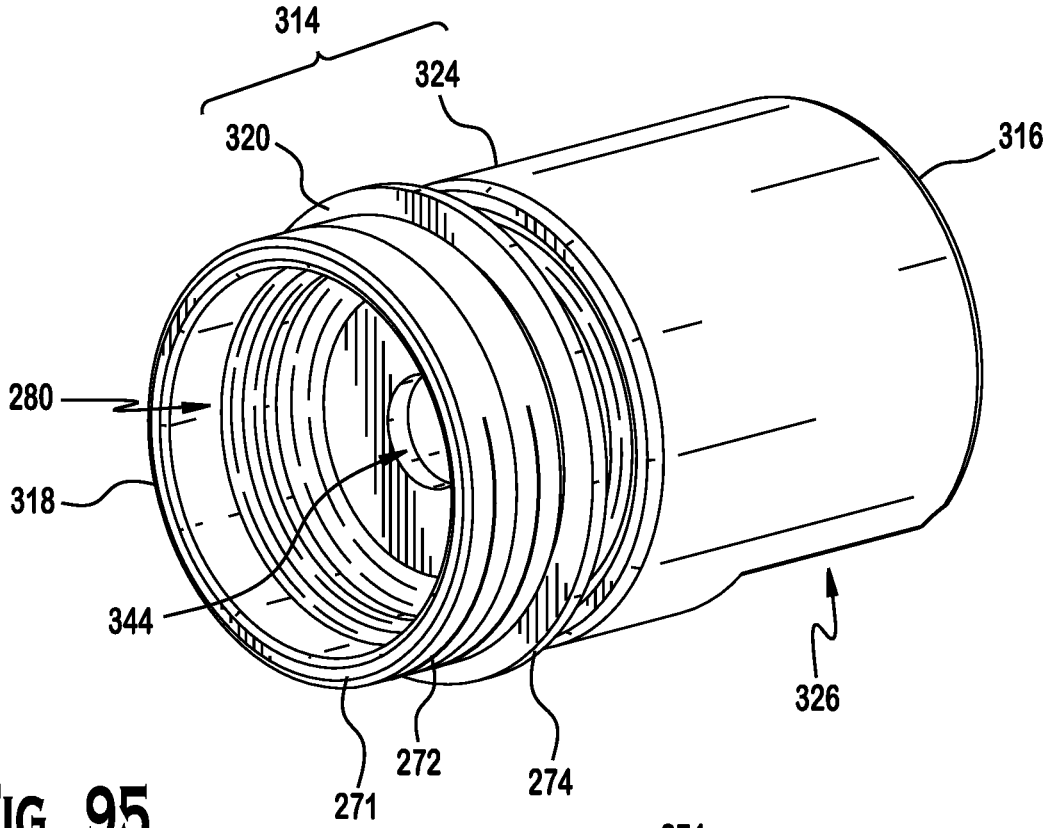
FIG. 95 is another perspective view of the mount body assembly of FIG. 89.
Figure 96:
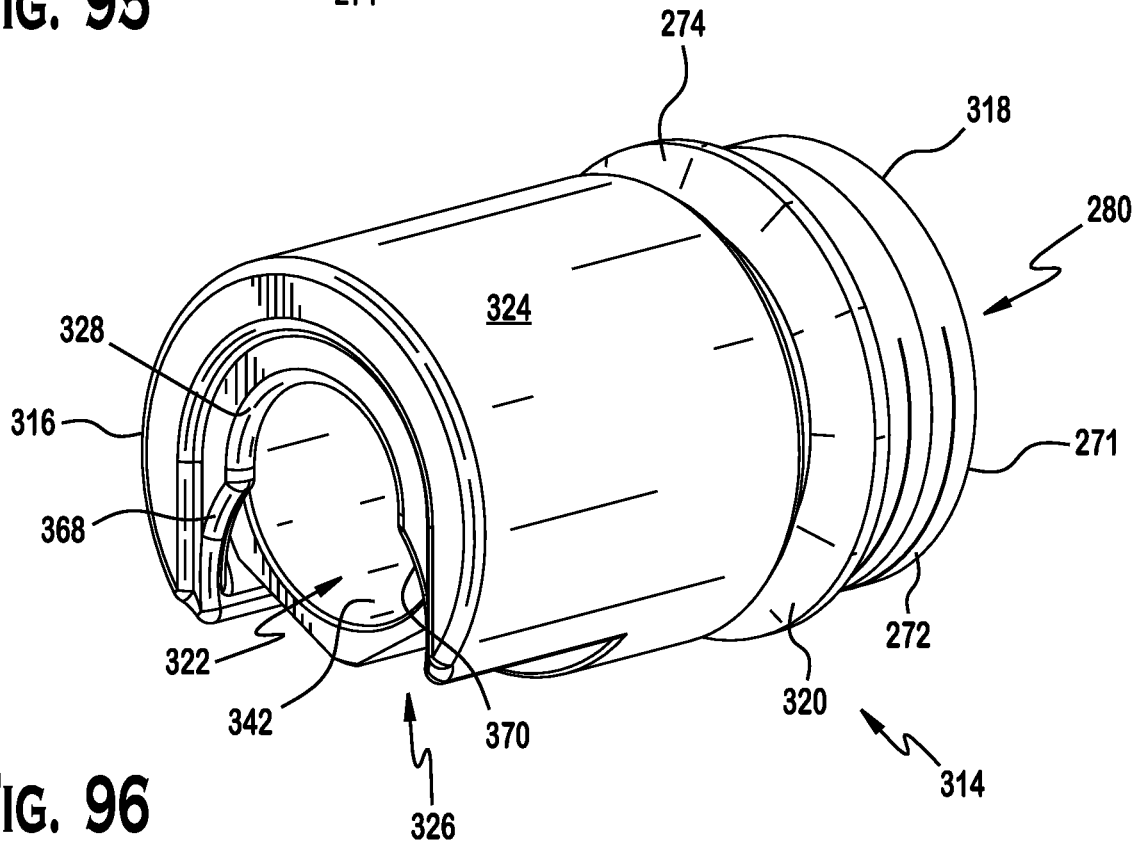
FIG. 96 is another perspective view of the mount body assembly of FIG. 95.
Figure 97:
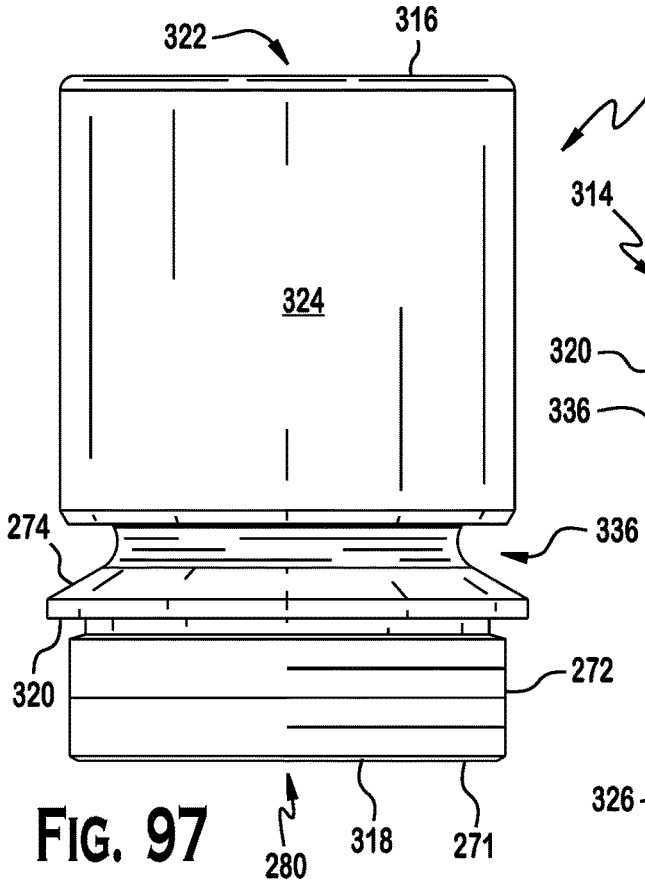
FIG. 97 is a top view of the mount body assembly of FIG. 95.

Referring to FIGS. 91, 95 and 96, the modular mount 314 may include a proximal end 316 and a distal end 318, as well as a shoulder 274 disposed between the proximal end 316 and the distal end 318. The modular mount 314 further may include a distal opening 280 on the distal end 318, as well as an annular plug 271 extending from the shoulder 274 to the distal end 318. The annular plug 271 may include an outer sidewall 272. The modular mount 314 may include a modular base 320 and a closure (or closer, retention nut) 324. The modular base 320 may include a flash suppressor receiving bore 322 near the proximal end 316. The closure 324 may include a flash suppressor receiving opening 326 adjacent to the flash suppressor receiving bore 322 of the modular base 320. The closure 324 further may include a locking ring 328 adjacent to the proximal end 316.

Referring to FIGS. 92, 93, 102, 103, 104, the modular base 320 may include a proximal end 330, a distal end 332, and an intermediate body 334 disposed between the proximal end 330 and the distal end 332. The modular base further may include a shoulder 274 and an annular plug 271 between the intermediate body 334 and the distal end 332 of the modular base 320. The modular base 320 further may include a circumferential ledge 278 adjacent to the shoulder 274. The modular base further may include a thread relief 285 between the outer surface of the annular stem 272 and the circumferential ledge 278. Also, the modular base 320 may include a thread relief between the intermediate body and the shoulder 274. Accordingly, the outer surface of the annular stem 272 may include a screw thread, and the outer surface of the intermediate body 334 also may include a screw thread.

Figure 92:
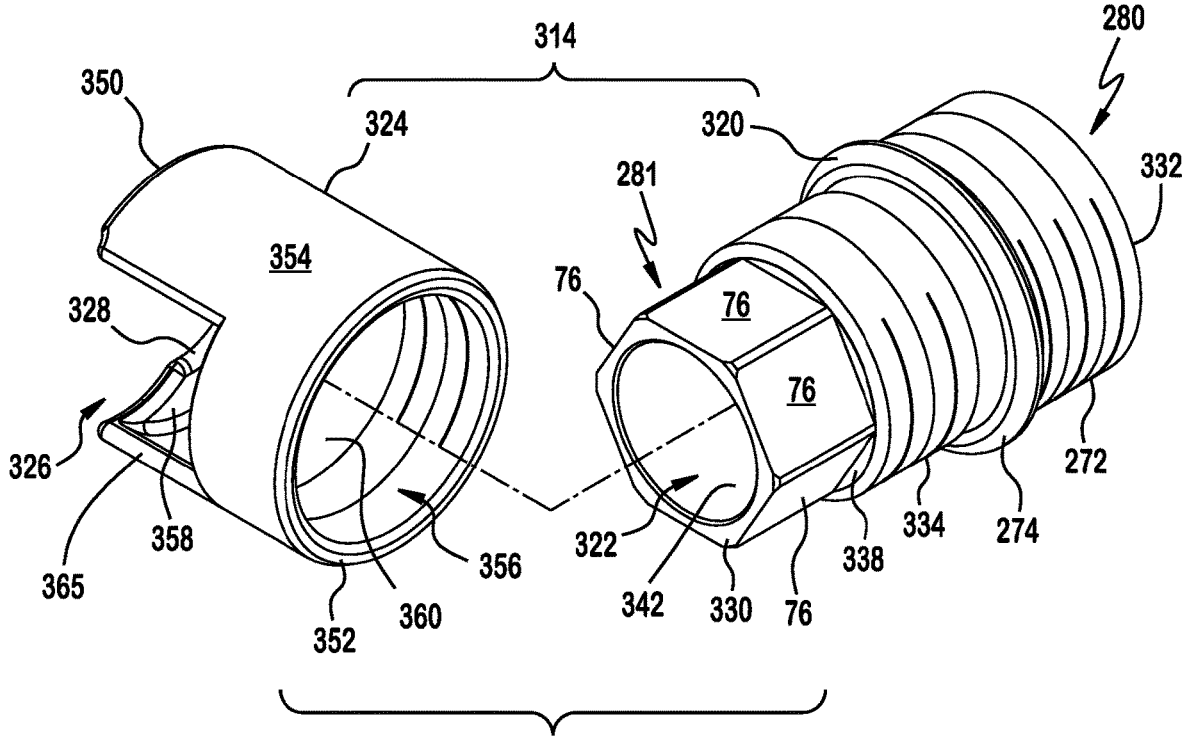
FIG. 92 is an exploded view of the mount body assembly of FIG. 89.

Referring to FIG. 92, the intermediate body 334 further may include a proximal landing 338 adjacent to the outer surface of the intermediate body 334. Moreover, the modular base 320 further may include a neck portion 281 between the proximal landing 338 and the proximal end 330. The flash suppressor receiving bore 322 may extend from the proximal end 330 of the modular base 320 to an interior end wall 340. See e.g., FIG. 102. The interior end wall 340 may include an orifice 344. See e.g., FIG. 100. The flash suppressor receiving bore 322 further may include an inner sidewall 342 that extends from the proximal end 330 to the interior end wall 340.

Referring to FIGS. 92, 102, 103 and 104, the neck portion 281 may include a plurality of facets 76. The plurality of facets 76 may form a tool fitting. Preferably the tool fitting may include six facets 122 which are arranged to form a hexagonal shaped fitting. Generally, however, the tool fitting may include at least one pair of opposing facets such that an appropriately sized wrench may be used to hold or manipulate the neck portion 281.

Referring to FIGS. 93, 102, 103 and 104, the orifice 344 may extend from the interior end wall 340 of the barrel receiving bore to the interior end wall 282 of the distal opening 280 of the modular base 320. Accordingly, the orifice 344 may include a side wall 346 that extends from the interior end wall 340 of the barrel receiving bore to the interior end wall 282 of the distal opening 280. Additionally, the annular plug 271 of the modular base may include an inner sidewall 284 that extends from the distal end 332 to the interior end wall 282 of the distal opening 280.

Referring to FIG. 92, the closure 324 may include a proximal end 350, a distal end 352, and an exterior side wall 354 extending from the proximal end 350 to the distal end 352. The distal end 352 may include a modular base receiving opening 356. As shown in FIGS. 92, 93, 100 and 102, a flash suppressor receiving opening 326 may extend from the distal end 350 to the side 354 of the closure 324. Referring to FIG. 92, an inner sidewall 360 may extend from the proximal end 350 to the distal side 352. The inner sidewall may include a distal segment 362 and a proximal segment 364. The distal segment 362 of the inner sidewall may include a screw thread.

Figure 100:
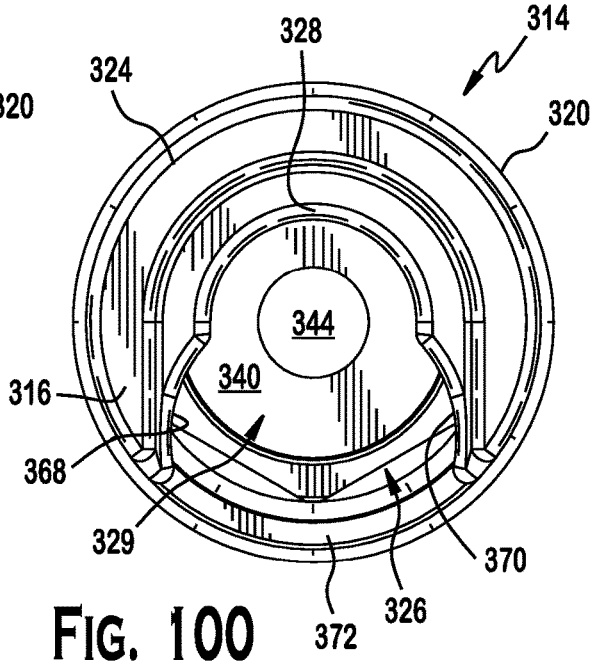
FIG. 100 is rear view of the mount body assembly of FIG. 95.
Figure 101:
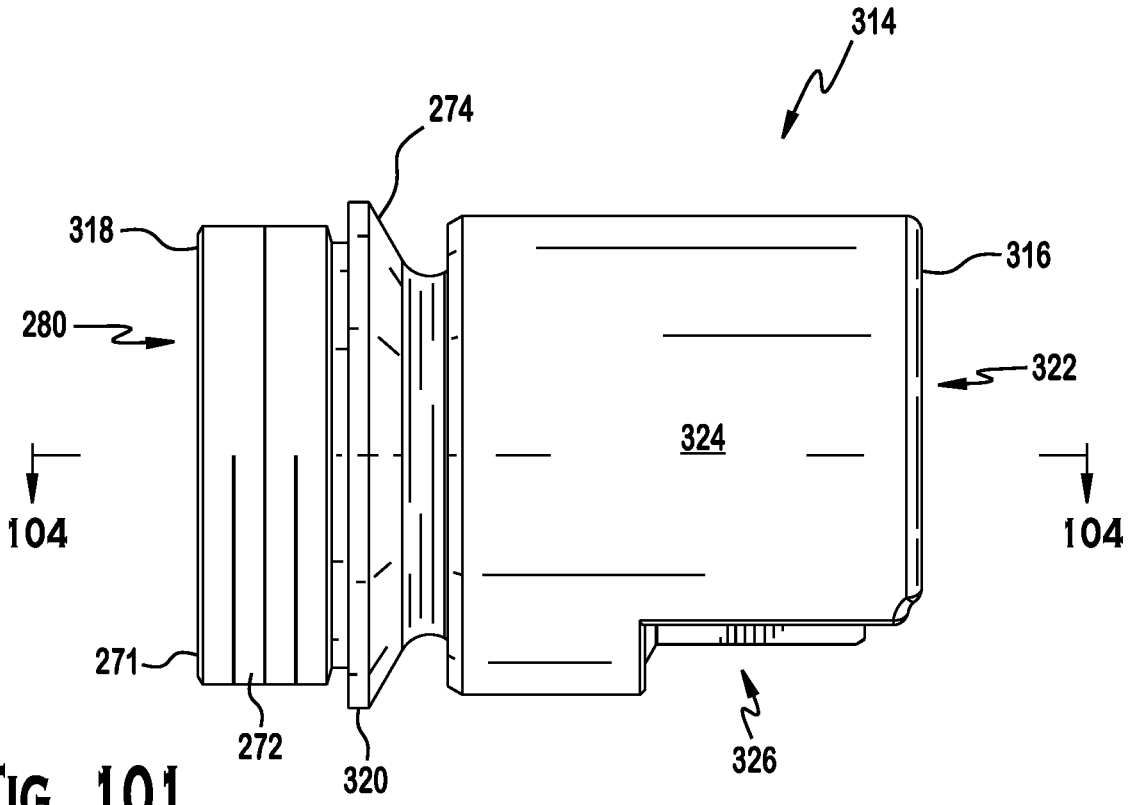
FIG. 101 is a right side view of the mount body assembly of FIG. 95.
Figure 102:
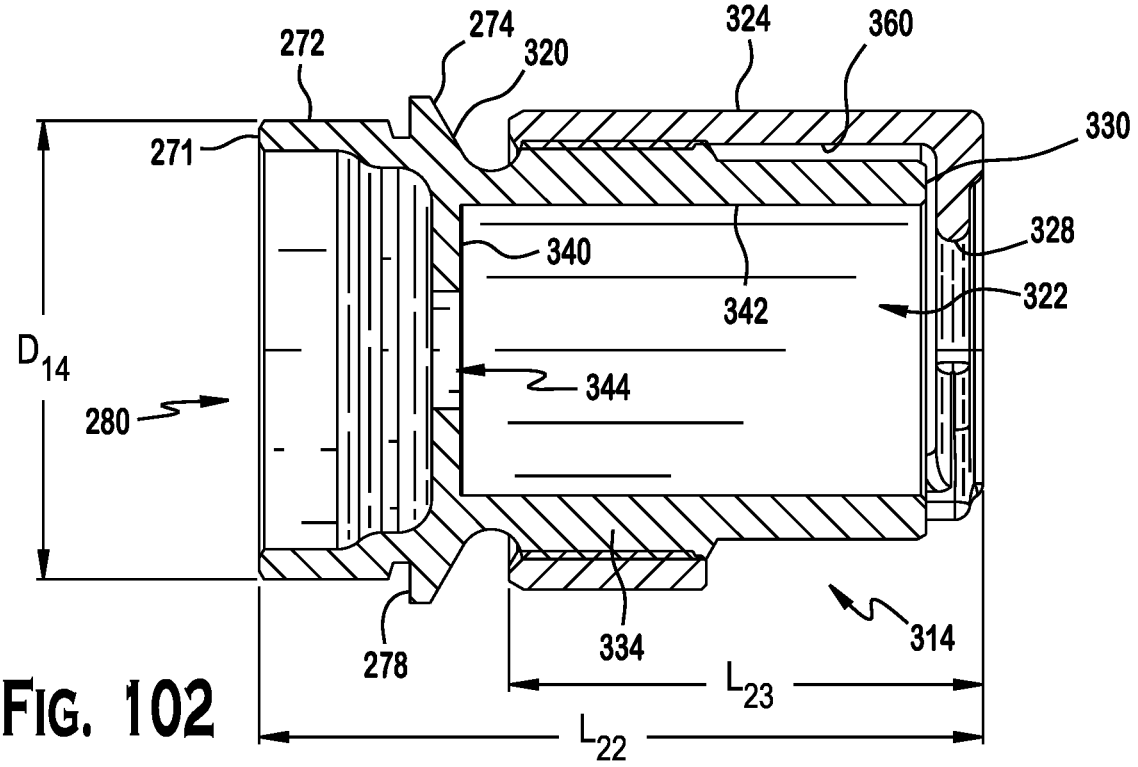
FIG. 102 is a cross-sectional view of the mount body assembly of FIG. 99, along line 102-102.
Figure 103:
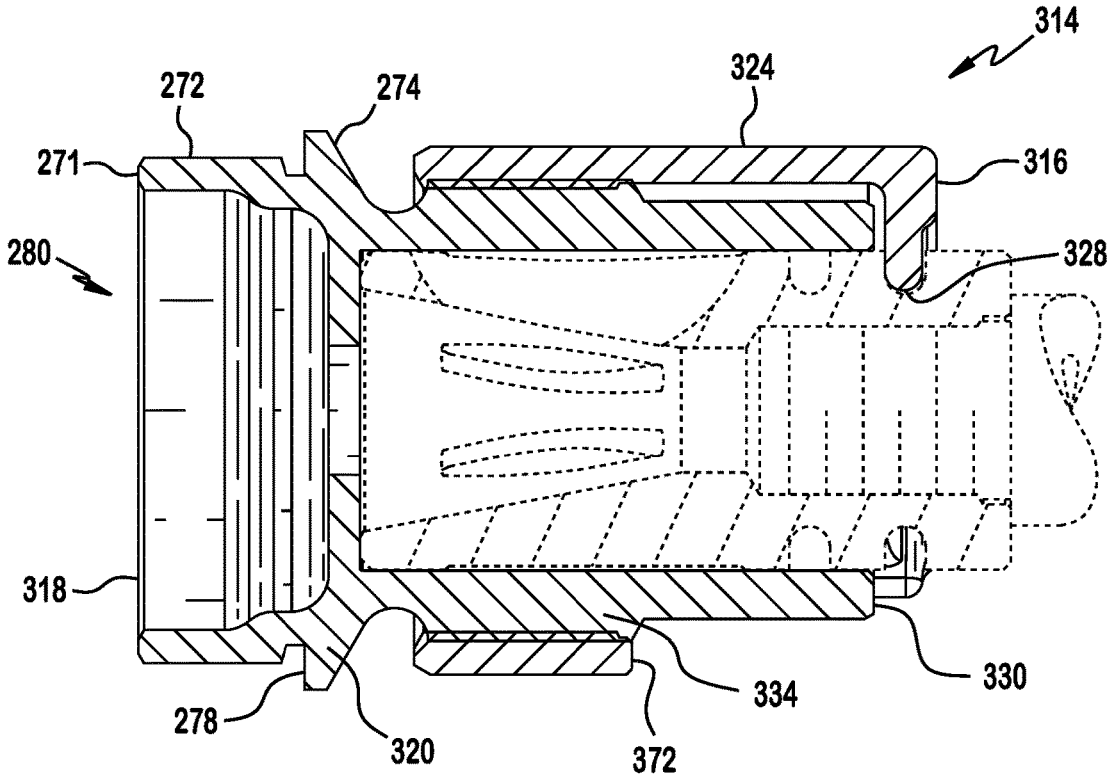
FIG. 103 is a cross-sectional view of the mount body assembly of FIG. 99, along line 103-103.
Figure 104:
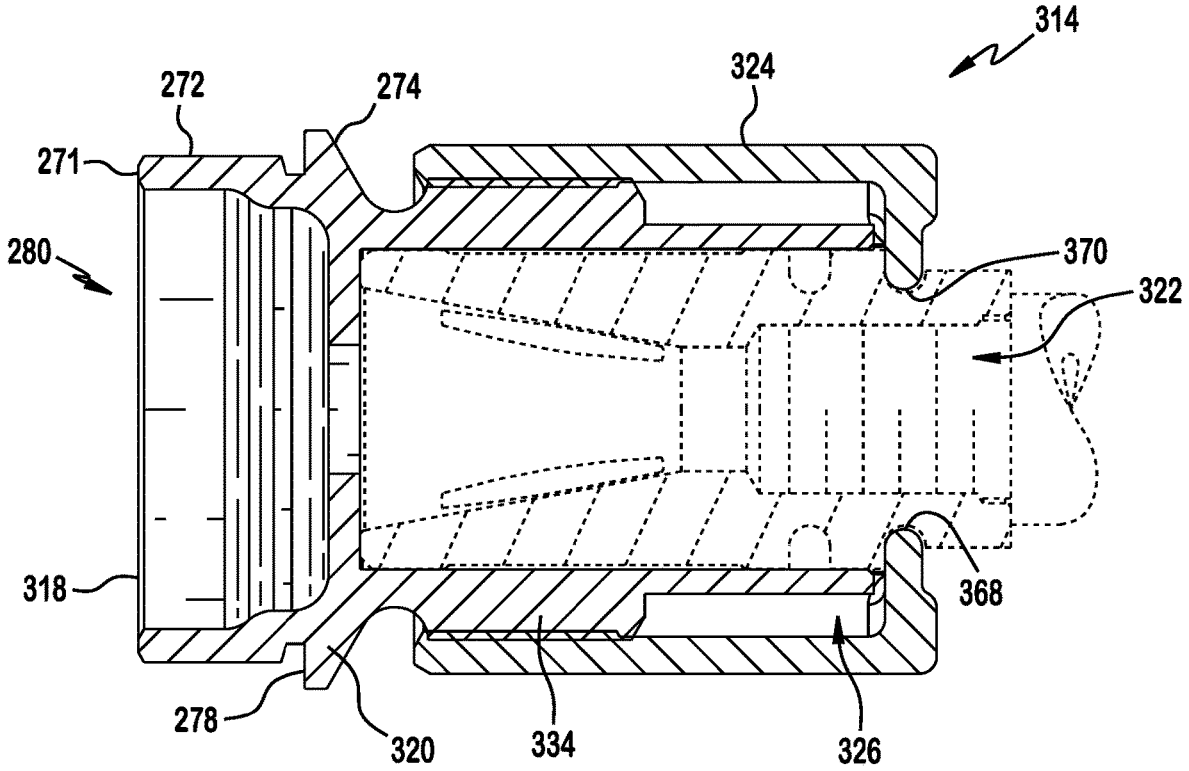
FIG. 104 is a cross-sectional view of the mount body assembly of FIG. 101, along line 104-104.

Referring to FIG. 91, the flash suppressor receiving opening 326 may include a boundary sidewall 365. The boundary sidewall further may include a first boundary side wall segment 366, a second boundary side wall segment 368, a third boundary side wall segment 370, a fourth boundary side wall segment 372, a fifth boundary side wall segment 374, and a sixth boundary side wall segment 376. In the embodiment of FIG. 91 and FIG. 100, the first boundary side wall segment 366, the second boundary side wall segment 368, the third boundary side wall segment 370 may abut a flash suppressor locking ring 328. Moreover, the fourth boundary side wall segment 372, the fifth boundary side wall segment 374, and the sixth boundary side wall segment 376 may be part of the exterior side wall 354. Additionally, the fourth boundary side wall segment 372, the fifth boundary side wall segment 374, and the sixth boundary side wall segment 376 may abut the proximal segment 364 of the inner sidewall 360.

Figure 93:
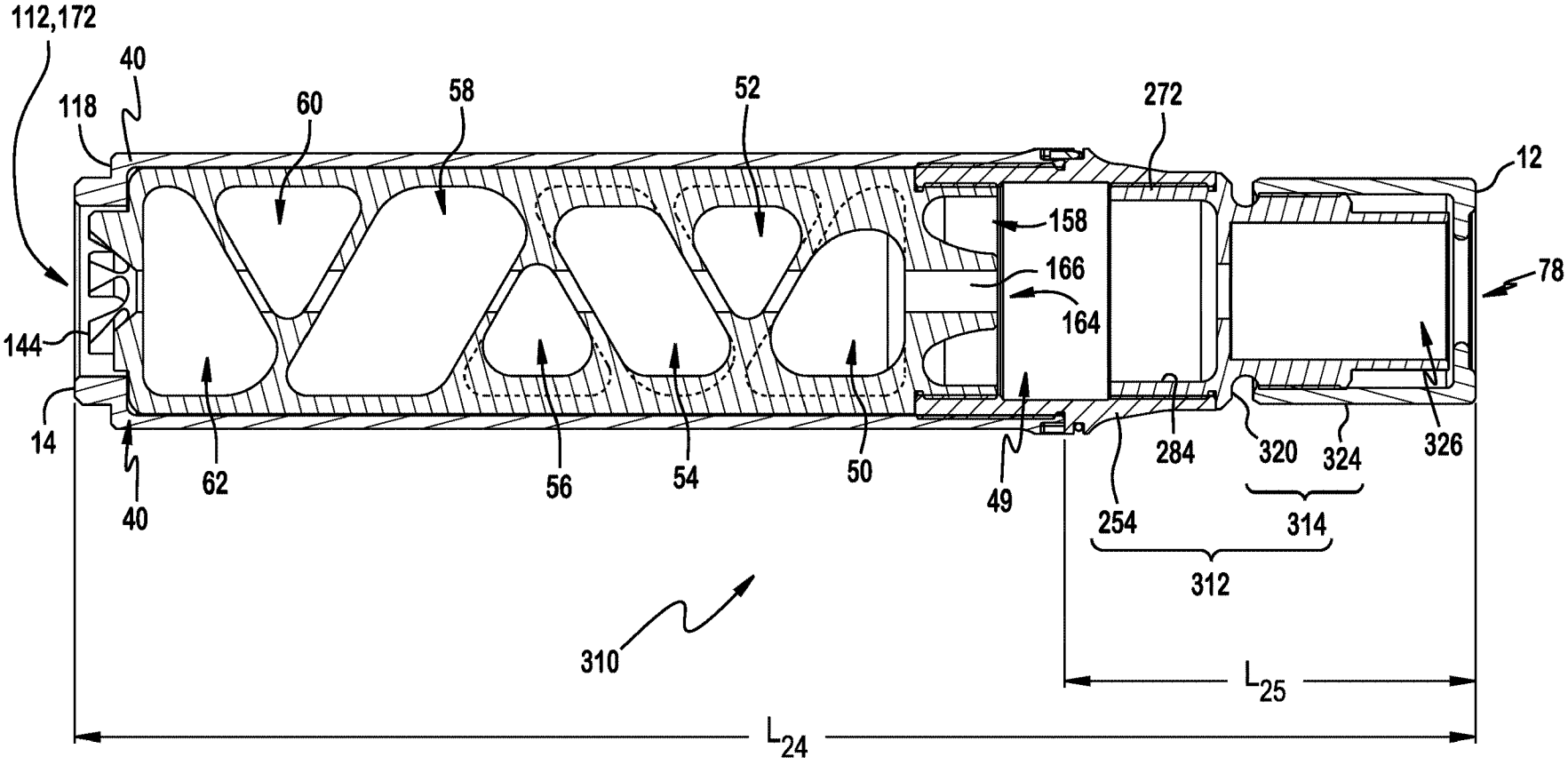
FIG. 93 is a cross-sectional view of the suppressor of FIG. 89, along line 93-93.

Referring to FIG. 92 and FIG. 93, an external screw thread on the annular plug 271 of the modular base 320 may be advanced into a mating screw thread on the proximal interior side wall 264 of the mount body base 254. Referring to FIG. 93, the combined modular base 320 and mount body base 254 may then receive the core 22. More particularly, the proximal side wall 150 of the core 22 may be advanced into the distal segment 94 of the mount body base 254. The tube 21 may then be positioned around the core 22 and advanced over the outer side wall 84 of the annular stem 72. The closure 324 may then be fastened to the intermediate body 334.

In use, the closure 324 may be removed from the intermediate body 334. See e.g., FIG. 92. The flash suppressor (e.g. an A2 flash suppressor) mounted to the muzzle of a barrel may be inserted through the flash suppressor receiving opening 326. See e.g., FIG. 103 and FIG. 104. The flash suppressor may then be inserted into the flash suppressor receiving bore 322. The flash suppressor may be positioned against the interior end wall 340 of the flash suppressor receiving bore 322. The locking ring 358 may then be manipulated to engage with a feature of the flash suppressor. The flash suppressor closure may be advanced on to the intermediate body 334 to fix the flash suppressor and barrel to the mount body assembly 312.

Figure 94:
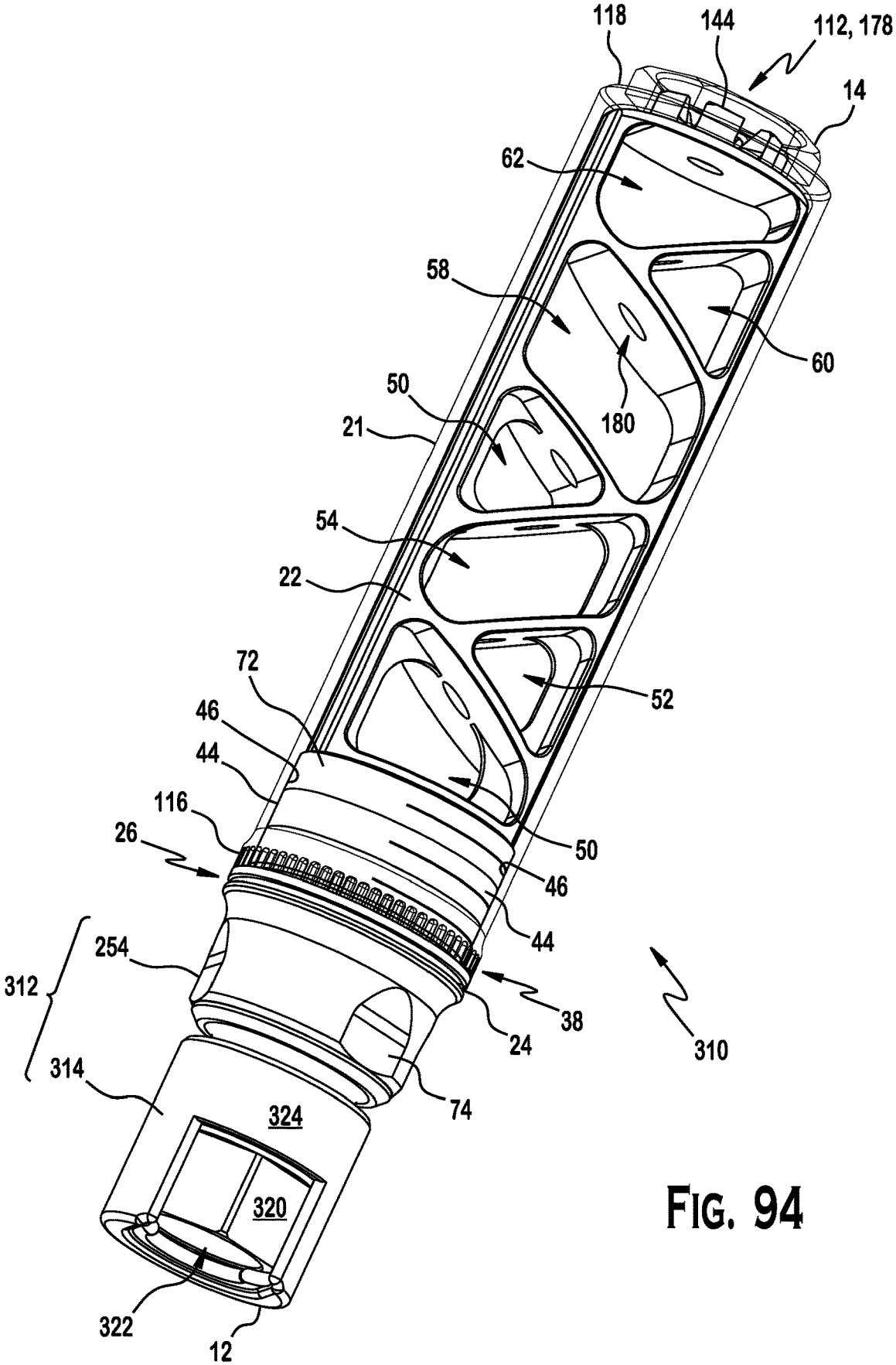
FIG. 94 is another perspective view of the suppressor of FIG. 89 showing the tube in a transparent rendering.

In the embodiment of the suppressor 310 shown in FIGS. 89, 93 and 94, the mount body assembly 312 and core 22 are configured and dimensioned for use with a barrel chambered in 5.56 mm caliber ammunition. In other embodiments, mount body assembly and core may be configured and dimensioned for use with a barrel chambered in other rifle ammunition calibers. For instance, the mount body assembly 312 and core 22 may be configured for 7.62 mm, 6.5 mm, or other rifle ammunition calibers. Illustrative dimensions for the exemplary suppressor of FIG. 89 are presented in Table 7 and Table 8 (below).

Generally, the suppressor 310 may be hosted on a barrel having a barrel length of approximately 8.5 inches, 10.3 inches, or greater. During use the suppressor 310 may provide a reduction of sound signature and recoil, as well as decreasing the flash signature of the hosted weapon, as described above in connection with the embodiment of the suppressor 250 of FIG. 62. For example, the suppressor 310 may achieve a peak sound level measurement of 134 dB—measured at the shooter's left ear—for an AR-15 with a 10.3" barrel chambered in 5.56 mm in accordance with MIL-STD-1474D (12 Feb. 1997).

Figure 106:
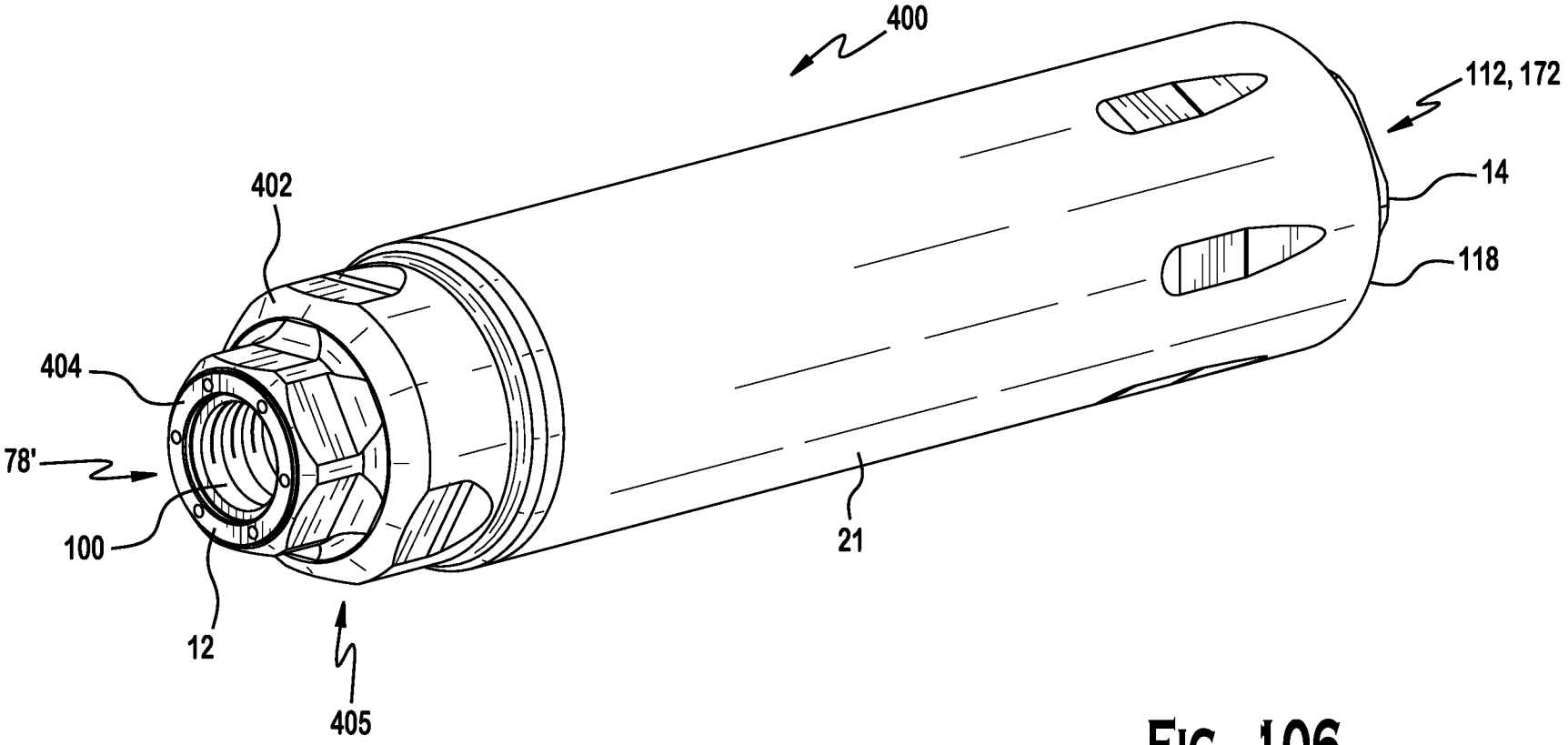
FIG. 106 is another perspective view of the suppressor of FIG. 105.

FIGS. 105-132 show another embodiment of an exemplary suppressor 400. In this embodiment, the suppressor 400 may include a mount body assembly 405, a core 22, and a tube 21. See e.g., FIGS. 107, 130, 131 and 132. Referring to FIG. 106, the mount body assembly 405 may include a mount body 402 and a mounting ring 404. This embodiment of the suppressor 400 may be directed toward a relatively light weight suppressor suitable for sport and competition shooting. Generally, the mount body 402 and the tube 21 may be secured by mating screw threads on the respective parts (84, 140). See e.g., FIG. 107. Preferably, the circumferential groove 26 and indexing notches 37 on the mount body 20 of the suppressor 10 of FIG. 2, as well as the circumferential array of longitudinally aligned elongated recesses 116 on the tube 21 shown in FIG. 4 may be absent from the suppressor 400. See e.g., FIGS. 105 and 106. Still, the structure and operation of the suppressor 400 shown in of FIG. 105 generally may share common features with the suppressor embodiments of FIG. 1, FIG. 62, FIG. 88, and FIG. 89, as may be apparent to one of ordinary skill in the art.

FIGS. 105 and 106 show an exemplary embodiment of a suppressor 400. The suppressor 400 may include a proximal end 12 and a distal end 14, as well as a longitudinal axis 16 extending from the proximal end to the distal end. Further, a lateral axis 18 may be disposed perpendicular to the longitudinal axis, and a vertical axis 17 may be disposed perpendicular to the longitudinal axis and the vertical axis. The proximal end 12 may include a mount body assembly 405. The suppressor 400 further may include a tube 21. Generally, the interior structure and configuration of the tube 21 in this embodiment may be substantially the same as that shown in FIG. 37. Referring to FIGS. 107, 130, 131, 132, the mount body assembly 405 and the tube 21 may cooperate to form a housing for internal baffles 154, 174 that may be configured and dimensioned to dissipate kinetic energy and reduce blast intensity of firearm discharge gases. Preferably, a plurality of the baffles may be formed as a unitary structure or core 22. For instance, a core 22 may be arranged inside the mount body assembly 405 and telescopically received within the tube 21. Although, the core 22 may be a unitary structure, the core may be formed from multiple parts or combined with other parts, including M-baffles, K-baffles, or other baffle types.

Figure 108:
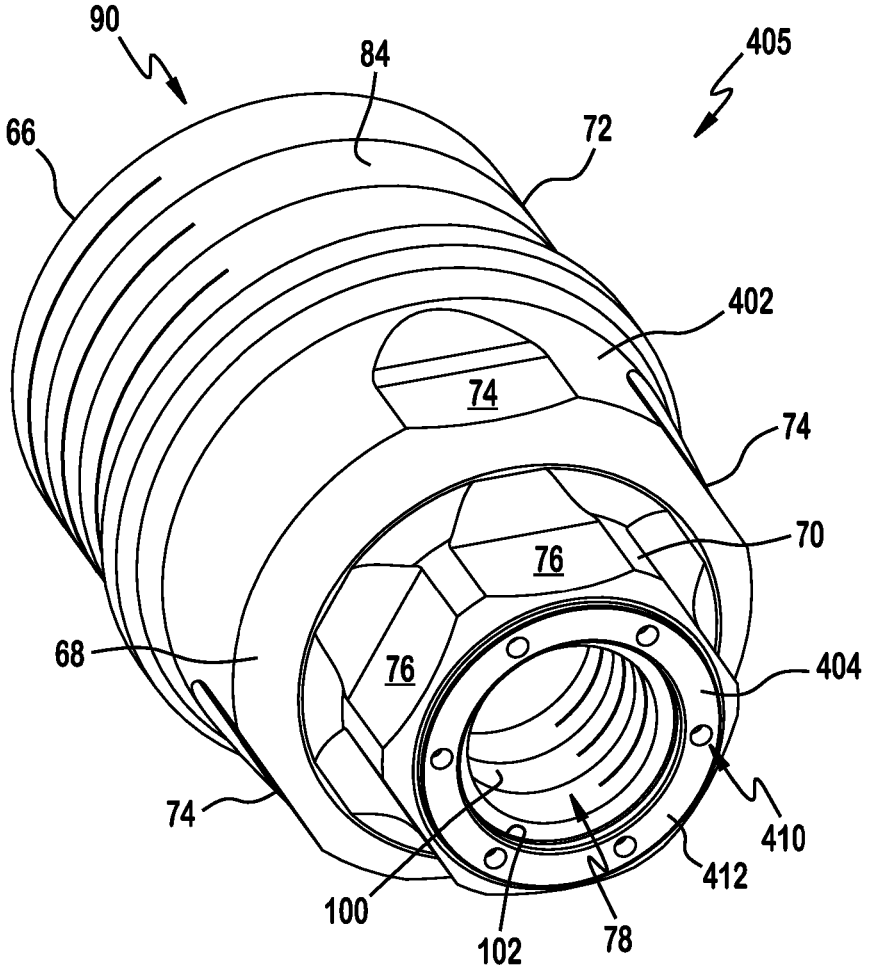
FIG. 108 is a perspective view of the mount body assembly of FIG. 105.
Figure 110:
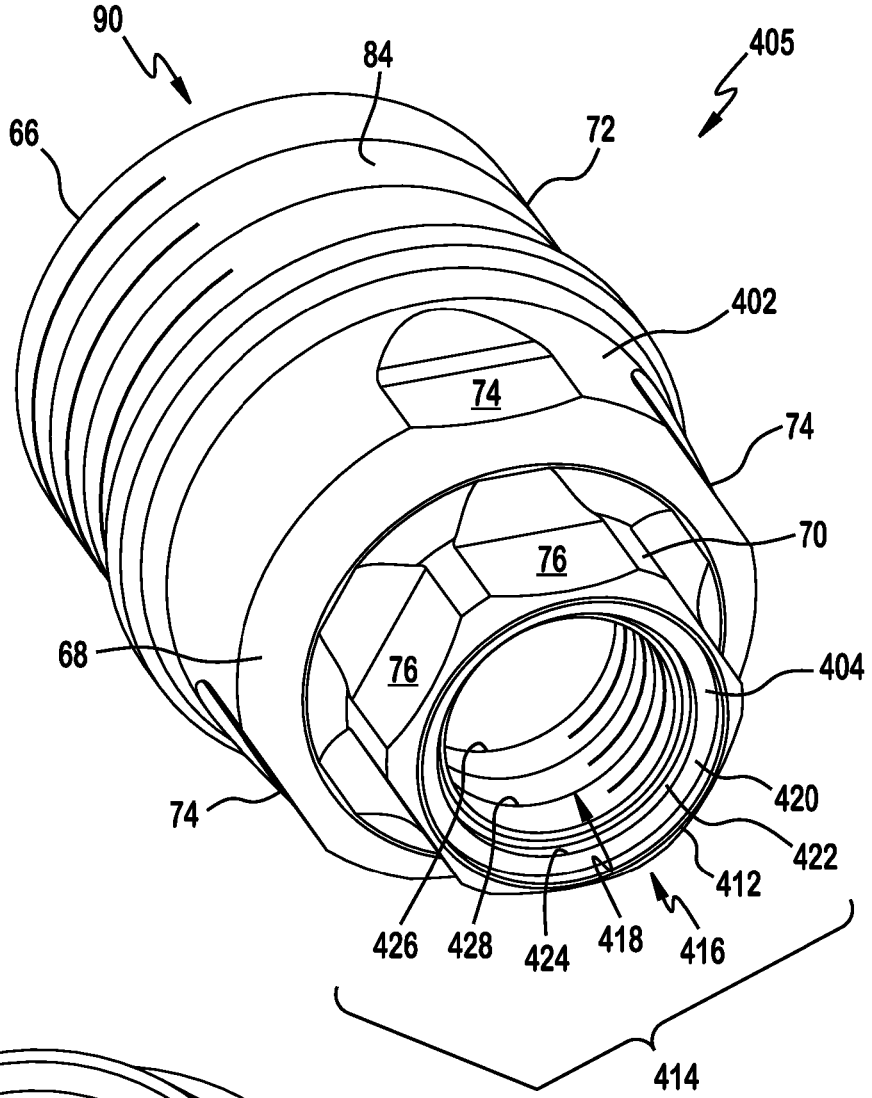
FIG. 110 is a perspective view of the mount body of FIG. 108.
Figure 116:
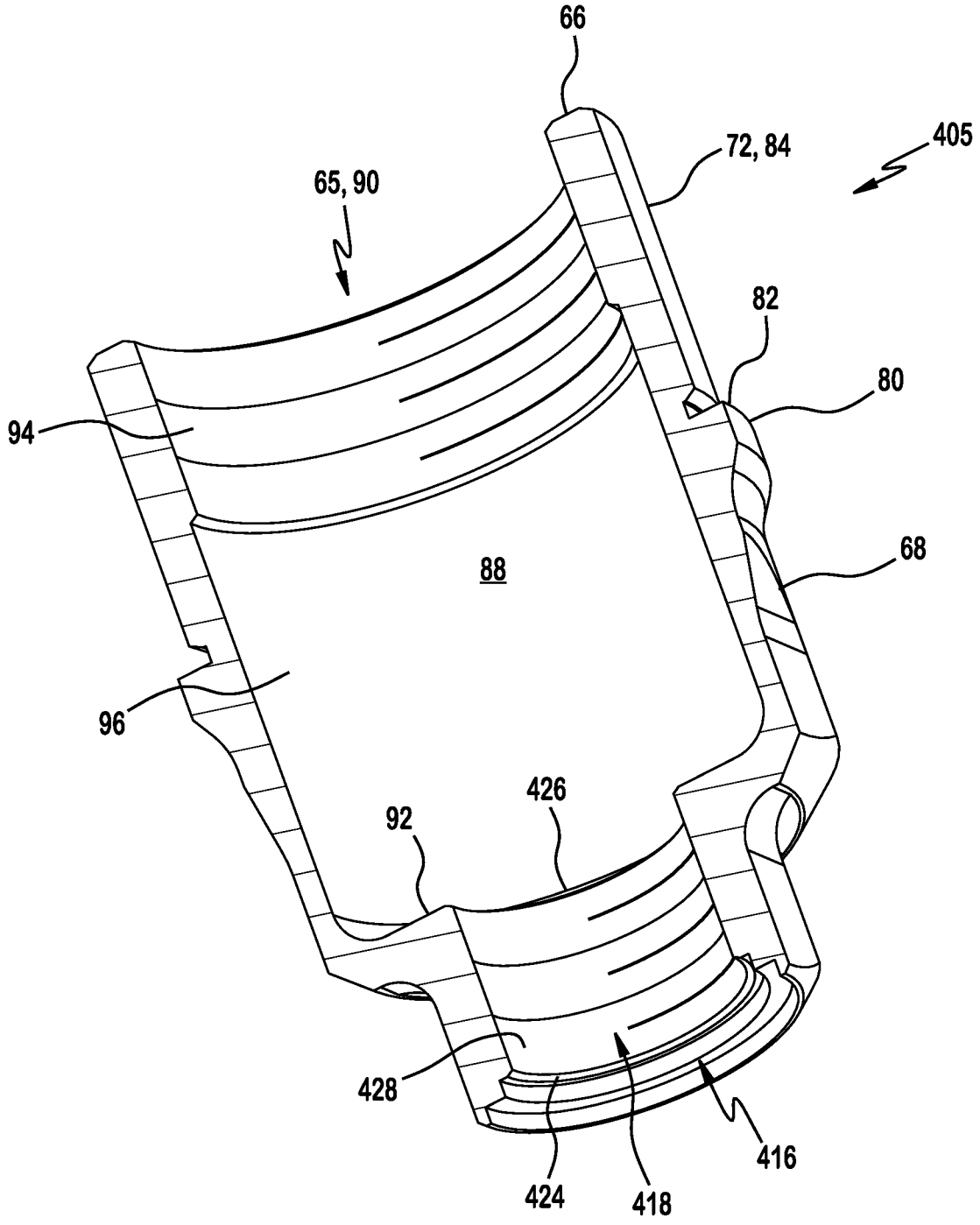
FIG. 116 is a cross-sectional view of the mount body of FIG. 110.

Referring to FIG. 108, the mount body assembly 405 may be formed from two complementary parts: a mount body 402 and a mounting ring 404. As shown in FIGS. 110, 112, 113, 114, 115, 116, the mount body may include an intermediate body 68, a plurality of facets 74 on the intermediate body, a flange 80, a distal face 82 of the flange, an annular stem 72, and an outer sidewall of the annular stem 84. Referring to FIG. 110, the mount body 402 may include a proximal end 412. The proximal end 412 may include a mounting ring receptacle 414, The mounting ring receptacle 412 may include a mounting ring receiving opening 416 and a mounting ring receiving bore 418. The mounting ring receiving bore 418 may include a proximal end 424, a distal end 426, and a sidewall 426 extending from the proximal end 424 to the distal end 426. The mount body 402 further may include a major annular face (or outer ring seat) 420 adjacent to the proximal end 412, as well as a minor annular face (or inner ring seat) 422 adjacent to the sidewall 428 of the mounting ring receiving bore 418. Referring to FIG. 116, the mount body 402 further may include a major riser 421 between the proximal end 412 and the major annular face, as well as a minor riser 423 between the major annular face 420 and the minor annular face 422.

Figure 112:
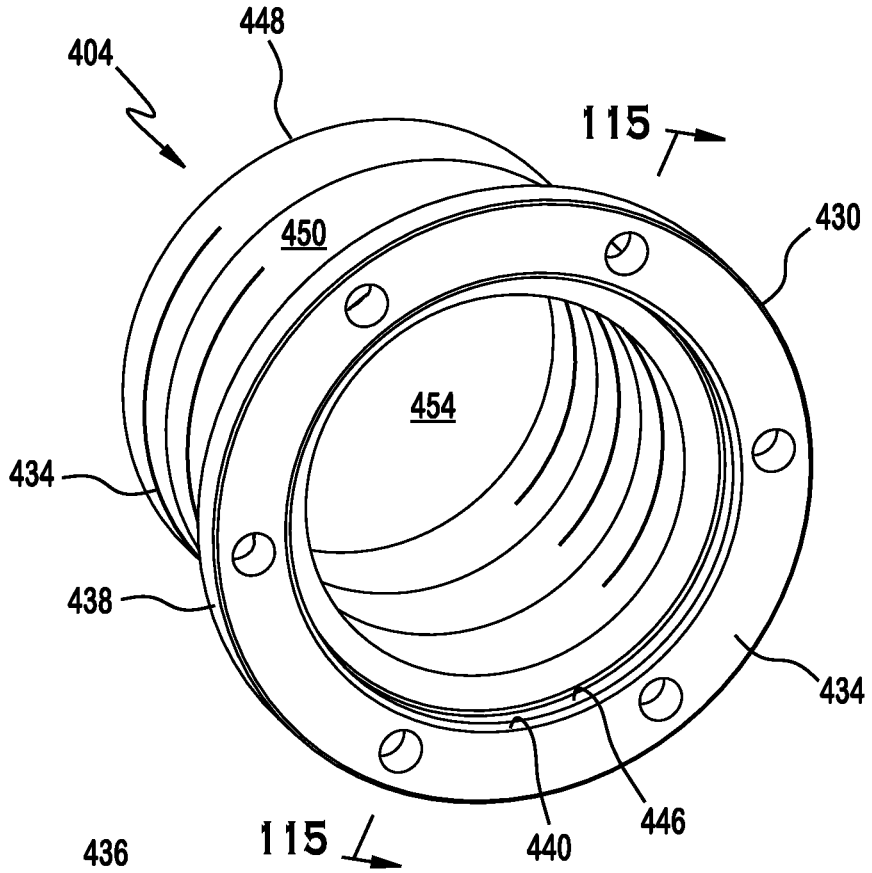
FIG. 112 is a perspective view of the retaining ring of FIG. 108.
Figure 113:
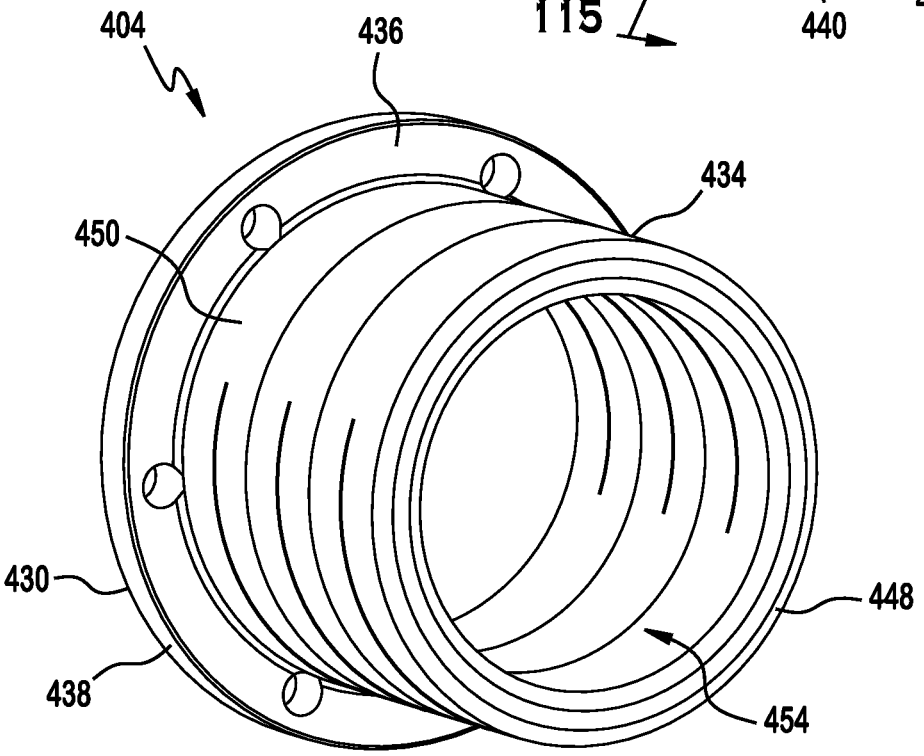
FIG. 113 is another perspective view of the retaining ring of FIG. 108.
Figure 114:
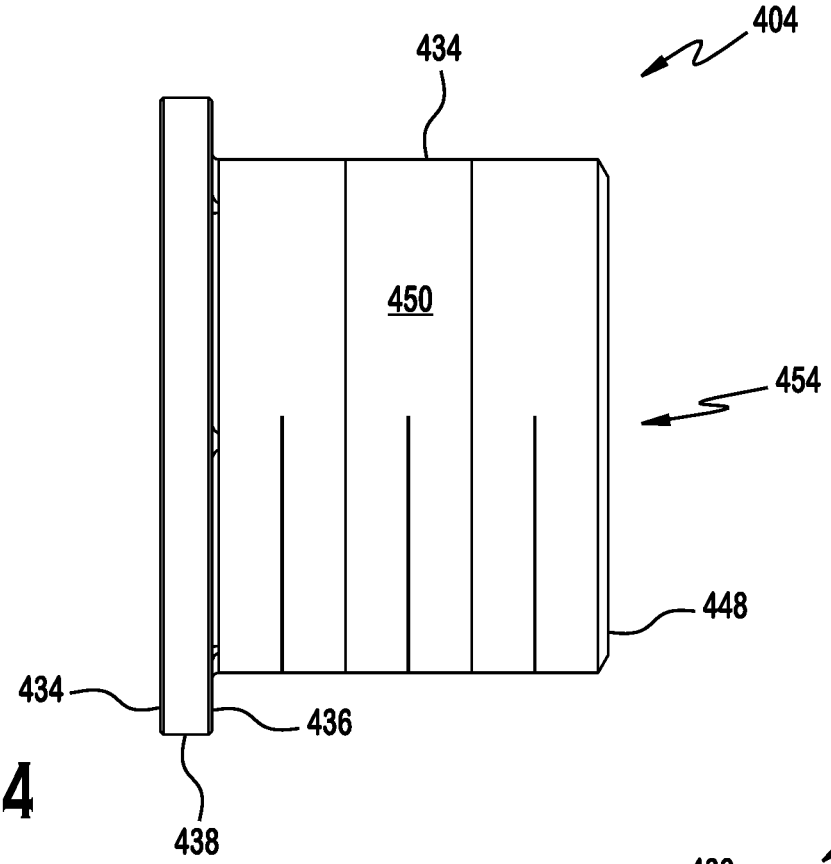
FIG. 114 is a side view of the retaining ring of FIG. 108.
Figure 115:
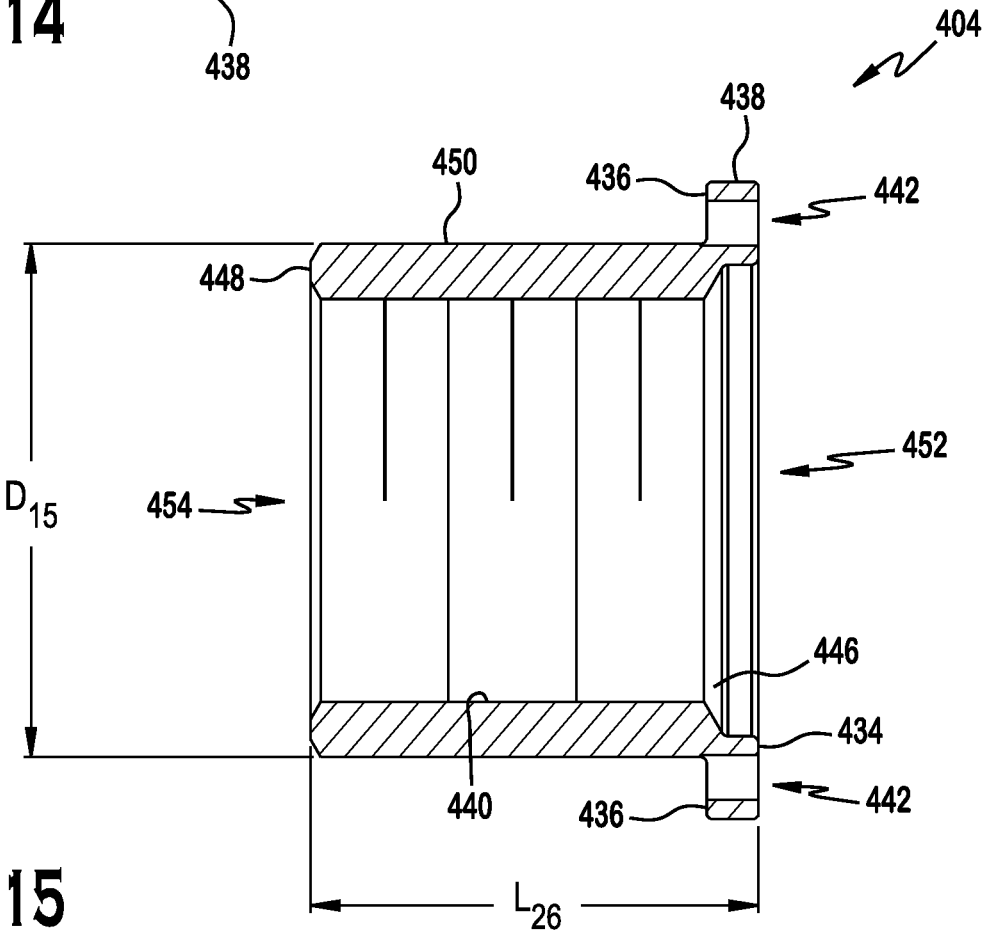
FIG. 115 is a cross-sectional view of the retaining ring of FIG. 114, along line 115-115.

Referring to FIGS. 112, 113, 114 and 115, generally the mounting ring 404 may include a flange 430 and a tubular segment 432. Referring to FIG. 112, the flange 430 may include a proximal face 434, a distal face 436, an exterior side wall 438 extending from the proximal face 434 to the distal face 436, and an interior sidewall 440. Additionally, the flange 430 may include a plurality of flange holes 442. The plurality of flange holes 442 may extend from the proximal face 434 of the flange to the distal face 436. The plurality of flange holes may form a pattern around the proximal face of the flange. The pattern may be configured and dimensioned to mate with a drive tool or wrench. Moreover, tubular segment 432 may include an annular ledge 446 adjacent to the interior sidewall 440 of the flange. The annular ledge 446 may define a proximal opening 452 of the tubular segment. An inner sidewall of the tubular segment may extend from the annular ledge 446 to the distal end of the tubular segment 448. The tubular segment further may include an exterior sidewall 450. The exterior side wall 450 may extend from the distal face 436 of the flange to the distal end 448 of the tubular segment. As shown in FIG. 113, the distal end 448 of the tubular segment may include a distal opening 454.

Figure 111:
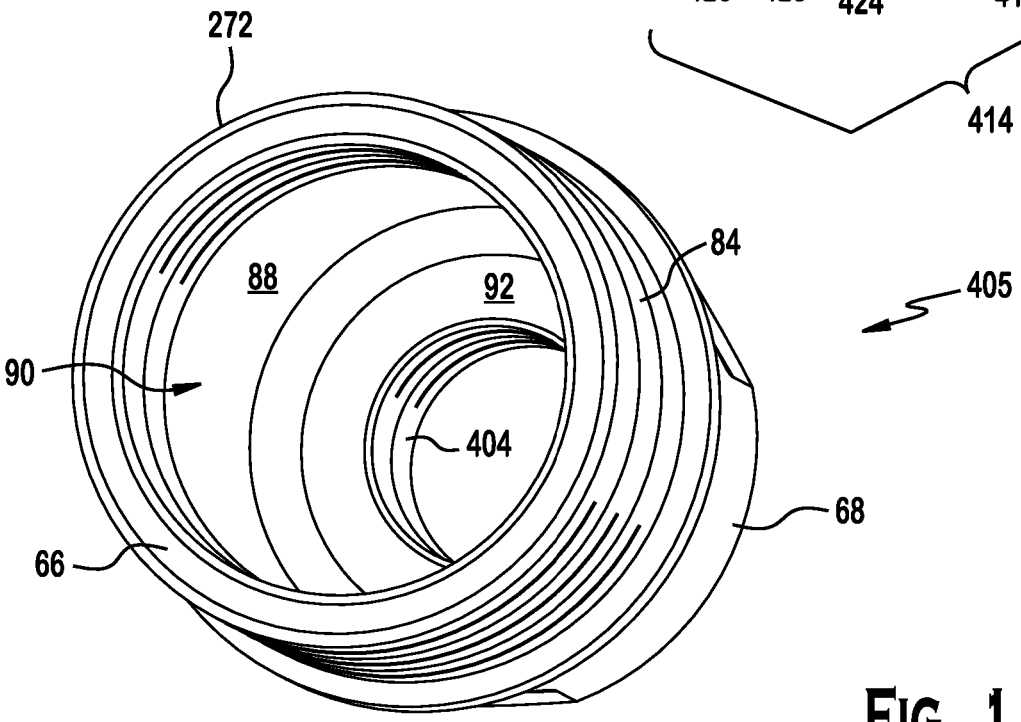
FIG. 111 is another perspective view of the mount body of FIG. 108.

Referring to FIGS. 110 and 111, the sidewall of the mounting ring receiving bore may include a screw thread, and the exterior sidewall 450 of the tubular segment may include a mating screw thread. See e.g., FIGS. 113 and 114. The mounting ring 404 may be secured to the mount body 402 by these mating screw threads. A thread locker may be applied to the mating screw thread interface to lock and seal the mounting ring 404 to the mount body 402.

Figure 107:
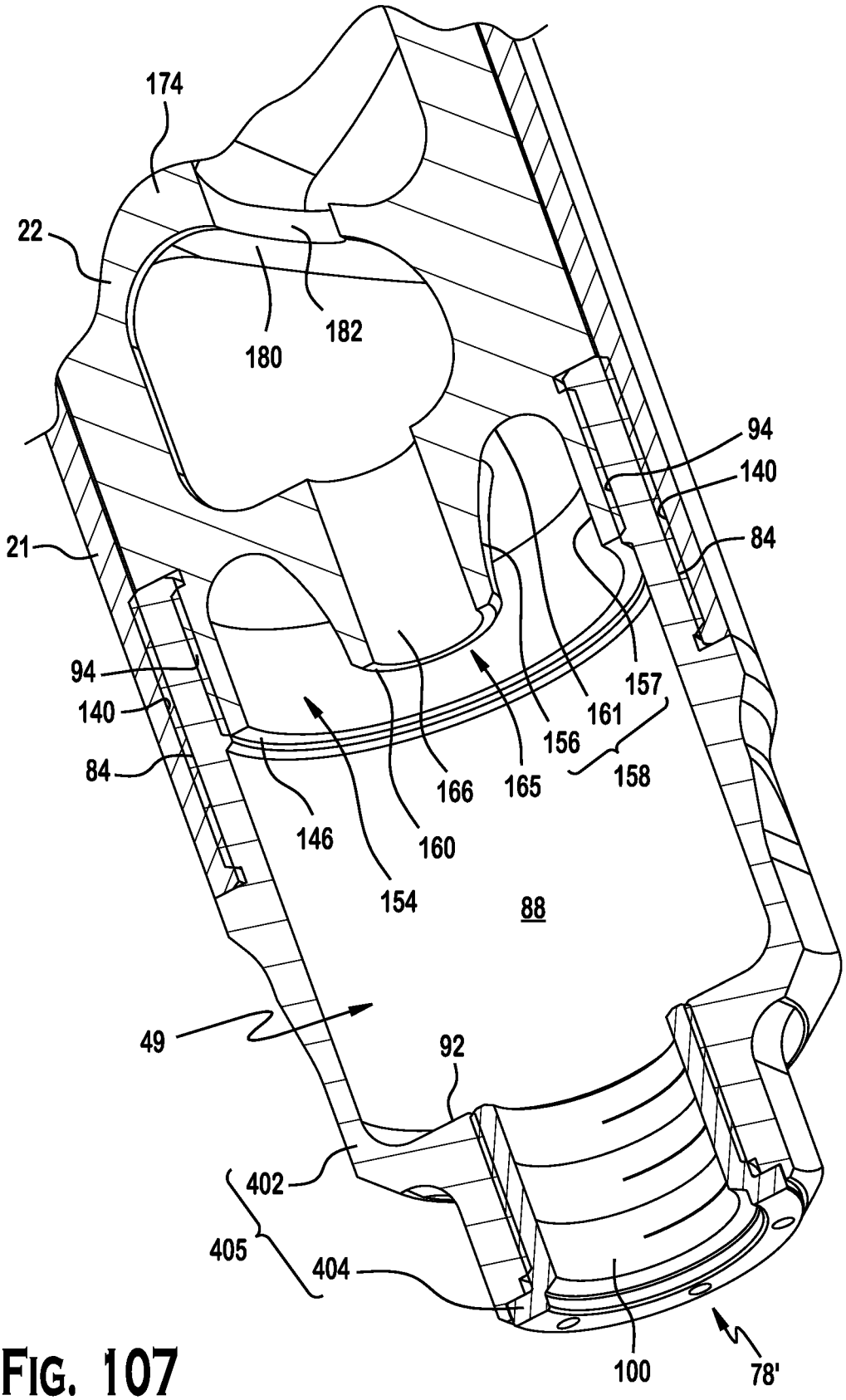
FIG. 107 is a partial sectional view of the suppressor of FIG. 106.
Figure 130:
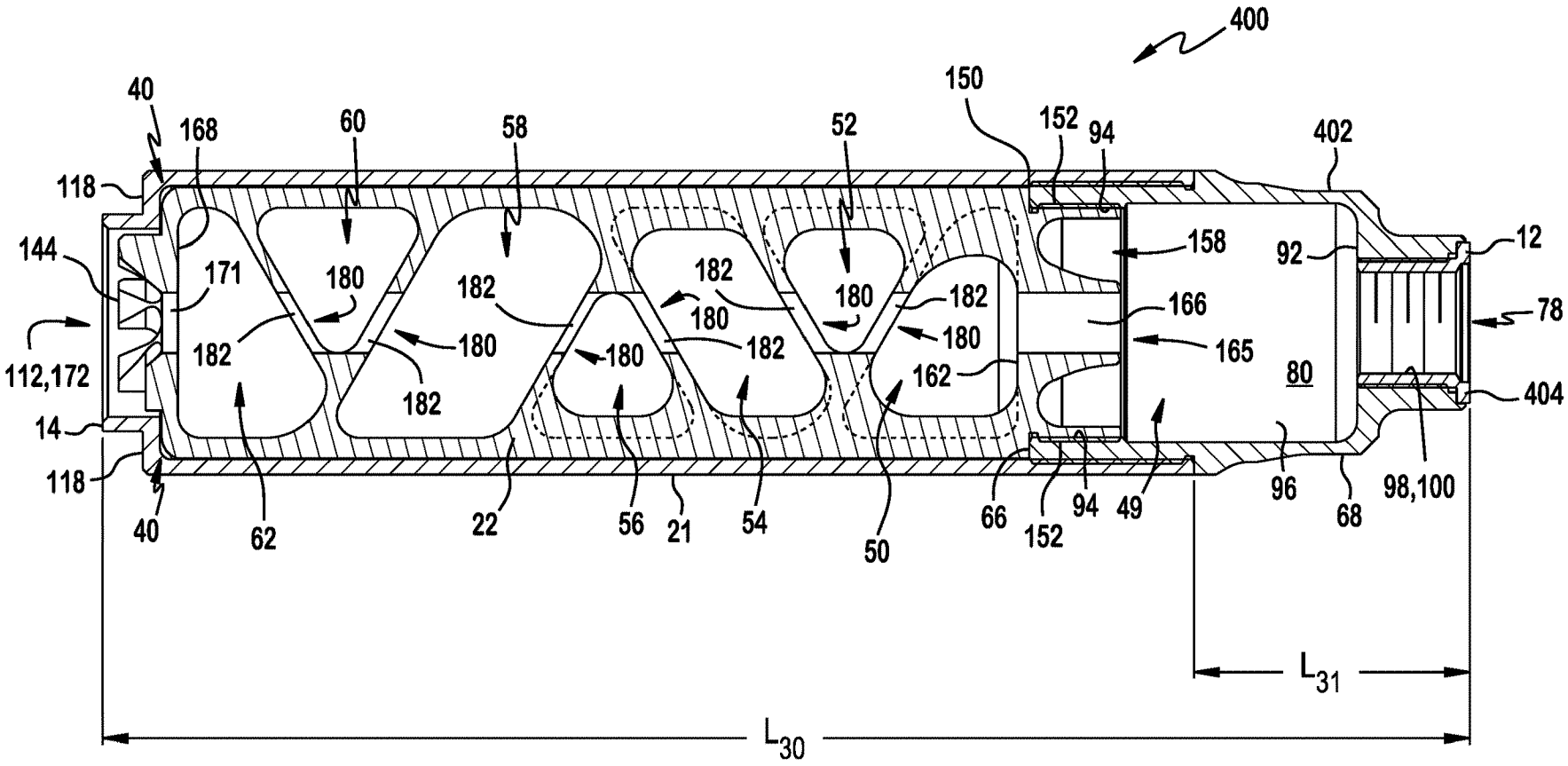

As shown in FIGS. 107, 130 and 131, the mount body assembly 405 and tube 21 may be connected by mating screw threads on the respective parts 84, 140. Also, other features of the mount body assembly 405 (e.g., proximal segment 96) may be configured and dimensioned to complement the proximal end 146 of core 22 to cooperatively form a blast or entrance chamber 49 of the suppressor. Generally, a blast chamber 49 may be disposed between proximal end wall 92 and inner side wall 88 (see e.g., FIGS. 130 and 131) of the mount body assembly 405 and the proximal end wall 150 (see e.g., FIGS. 118, 123 and 124) of the core 22. Referring to FIG. 132, a portion of the blast chamber 49 may include a blast baffle 154. Preferably, the blast baffle 154 may be an M-baffle.

Referring to FIG. 108, the mount body assembly 405 may include a proximal end 64, as well as a distal end 66 spaced from the proximal end 64 along the longitudinal axis 16. The mount body assembly 405 may include an intermediate body 68 disposed between the proximal end 64 and the distal end 66. Also, the mount body assembly 405 may include a collar 70 disposed between the intermediate body 68 and the proximal end 64. The collar 70 may be adjacent to the intermediate body 68 and the proximal end 64. The collar further may include a plurality of facets 76. Preferably, the collar may include six facets which are arranged to form a hexagonal shaped fitting. The intermediate body 68 also may include a plurality of facets 74. Preferably, the intermediate body 68 may include four facets which are arranged to form a fitting. For instance, the four facets may be arranged to form a generally square shaped fitting. Alternately, the four facets may be arranged to form another shape including four flat sides which may form a fitting of a proprietary configuration. Most preferably, however, the collar 70 and the intermediate body 68 may each include at least one pair of opposing facets such that an appropriately sized open end wrench may be used to hold or manipulate the mount body assembly.

Figure 109:
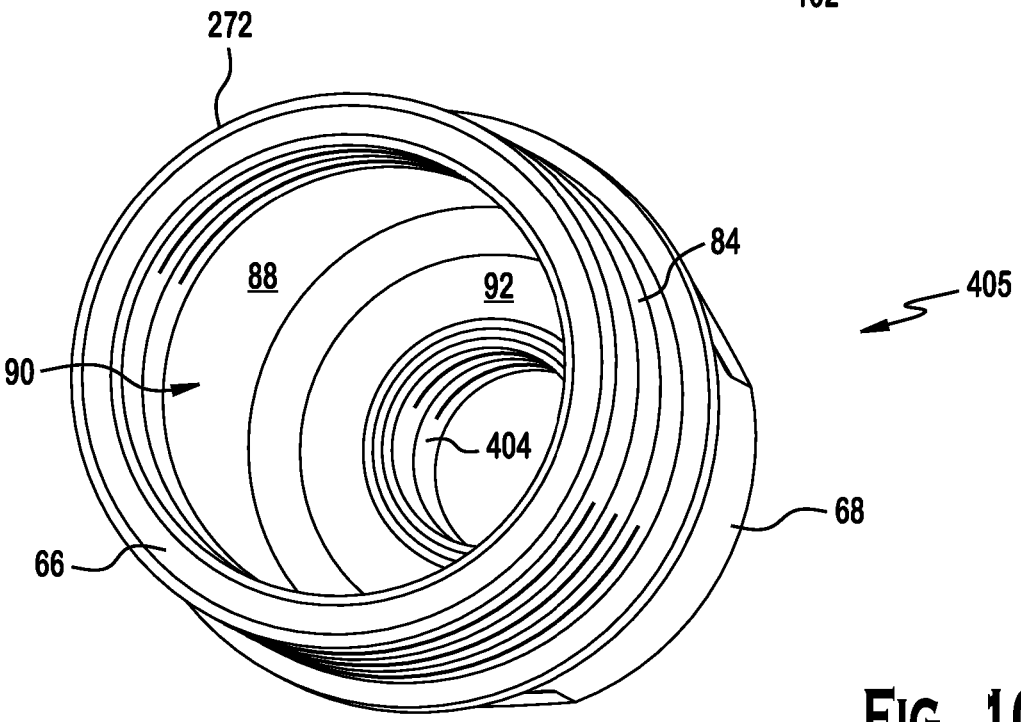
FIG. 109 is another perspective view of the mount body assembly of FIG. 105.
Figure 117:
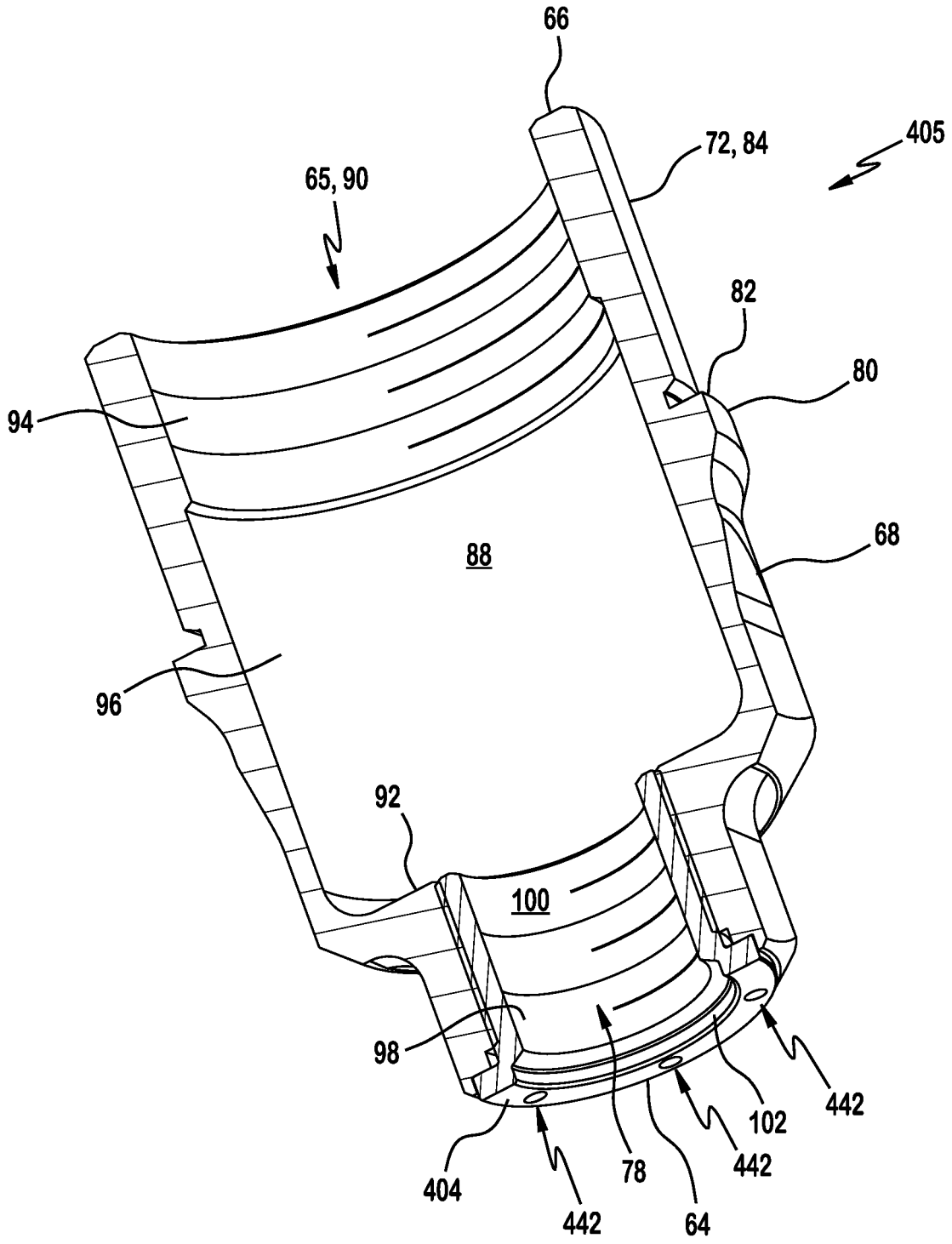
FIG. 117 is a cross-sectional view of the mount body of FIG. 108.

Referring to FIGS. 109 and 117, the mount body assembly 405 further may include an annular stem 72 disposed between the intermediate body 68 and the distal end 66. For example, the intermediate body 68 may include a flange 80. A thread relief (e.g., a circumferential groove) 86 may be disposed between the outer side wall 84 of the annular stem 72 and the flange 80. The outer sidewall of 84 of the annular stem 72 may include a screw thread (not shown in the drawings). The screw thread on the outer surface 84 of the annular stem 72 may be configured and dimensioned to mate with a screw thread disposed on the interior side wall 124 of the tube (see e.g., FIGS. 107, 130 and 131) adjacent to the proximal end 106 of the tube. For example, the screw thread on the outer sidewall 84 of the annular stem 72 may mate with a screw thread on the annular stem housing sidewall segment 140. In FIGS. 108 and 109, the outer dimension of the flange 80 may be greater than the outer dimension of the outer sidewall 84. Accordingly, the flange 80 may include a distal face 82 that may form a seat for the tube. See e.g., FIGS. 107, 130 and 131.

Referring to FIGS. 108 and 109, the annular stem 72 further may include an inner sidewall 88. As shown in FIG. 117, the inner sidewall 88 may extend from an opening 65 on the distal end 66 of the mount body assembly 405 to the proximal end wall 92 of the intermediate body 68. The inner side wall 88 may include a distal segment 94 and a proximal segment 96. Referring to, the distal segment 94 may include a screw thread that is configured and dimensioned to mate with a screw thread on a proximal side wall 152 of core 22. Accordingly, the opening 65 on the distal end 66 of the mount body assembly 405 and the distal segment 94 of the inner sidewall 88 may form a core mounting receptacle 90. See e.g., FIG. 109.

As shown in FIGS. 106, 107, 108, 109, 130 and 131, the proximal end 64 of the mount body assembly 405 further may include a barrel receiving bore 78. The barrel receiving bore may include a sidewall 98 that extends from the proximal end 64 of the mount body assembly 405 to the proximal end wall 92 of the intermediate body 68. The sidewall 98 of the barrel receiving bore 78 may include a threaded segment 100 and a recessed thread relief segment 102. The barrel receiving bore 78 may be configured and dimensioned to receive the muzzle end of a threaded barrel. Accordingly, screw threads on the threaded segment 100 may be configured and dimensioned to mate with screw threads on a host firearm barrel. Accordingly, the barrel receiving bore 78 and associated screw threads may be configured and dimensioned to mate with a barrel chambered in a variety of calibers and ammunition cartridges including, without limitation, 7.62×51 mm, .308 WIN, 6.5 CM, and others.

Referring to FIG. 130, the tube 21 generally may include a proximal end 106 and a distal end 108. The tube 21 further may include a distal end wall 118. See e.g., FIGS. 105, 106, 130, 131 and 132. The distal end wall 118 may be proximate to the distal end 108. See e.g., FIG. 105. The distal end wall 118 may include a tool fitting 120. The tool fitting 118 may include a plurality of facets 122. Preferably, the tool fitting 120 may include six facets 122 which are arranged to form a hexagonal shaped fitting. Generally, the tool fitting 120 may include at least one pair of opposing facets such that an appropriately sized open end wrench may be used to hold or manipulate the tube. The distal end 108 of the tube 21 may include a distal opening 112.

Referring to FIGS. 37 and 130, the proximal end of the tube further may include a proximal opening 114. A passage 126 may extend from the proximal opening 114 to the distal opening 112. The passage may be bounded by an interior side wall 124. For instance, the interior side wall 124 may include a discharge port sidewall segment 132, a baffle array sidewall segment 136, and an annular stem side wall segment 140. The discharge port sidewall segment 132 may extend from the distal end 108 to the distal interior end wall 128. The annular stem side wall segment 136 may extend from the proximal end 106 to a proximal interior end wall of the tube 130. As described above the annular stem side wall segment 140 may include a screw thread and be configured and dimensioned to mate with the outer side wall 84 of the mount body assembly 20. In view of the above, the passage 126 may include a discharge port housing segment 134, a baffle array housing segment 136, and annular stem housing segment 142.

Referring to FIGS. 118, 119, 120, 121 and 122, core 22 may include a distal end 144 and a proximal end 146, as well as a distal end wall 148 and a proximal end wall 150. A proximal side wall 152 may extend from the proximal end wall 150 to the proximal end 146 of the core. The exterior side of the proximal side wall 152 may include an external screw thread 153. As previously described, the exterior side wall 152 and the screw thread thereon may be configured and dimensioned to mate with the core mounting receptacle 90 of the mount body assembly 405. Moreover, referring to FIGS. 123 and 124, the interior space circumscribed by the proximal end wall 152 may house or include a baffle (e.g., blast baffle 154). For instance, the interior side 157 of the proximal end wall 152 may cooperate with a distal end wall 161 and an adjacent baffle cone 156 to form a baffle control surface 158 of lead baffle 154. The lead baffle may be referred to as a blast baffle 154. Referring to FIGS. 121, 122, 123 and 124, the baffle cone 156 further may include a proximal end 160 and a baffle bore 165 extending from the proximal end 160 to a proximal interior end wall 162 of the core.

Figure 121:
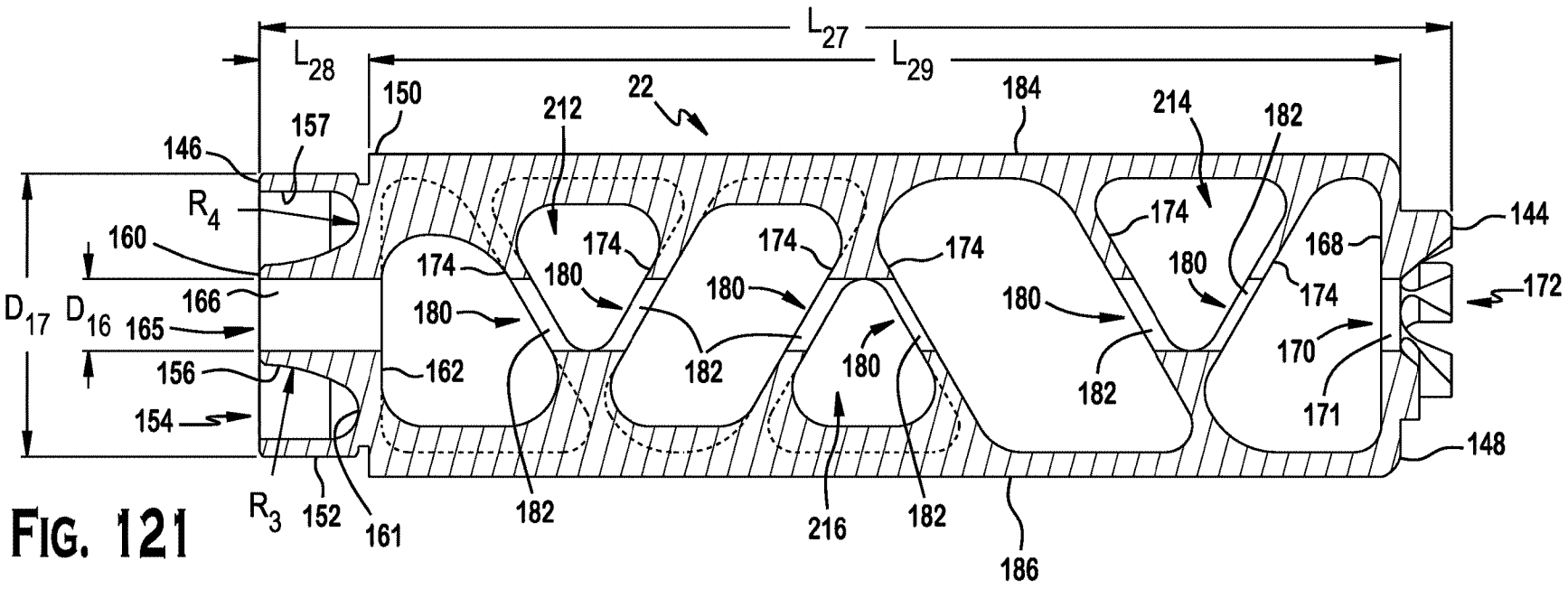
Figure 122:
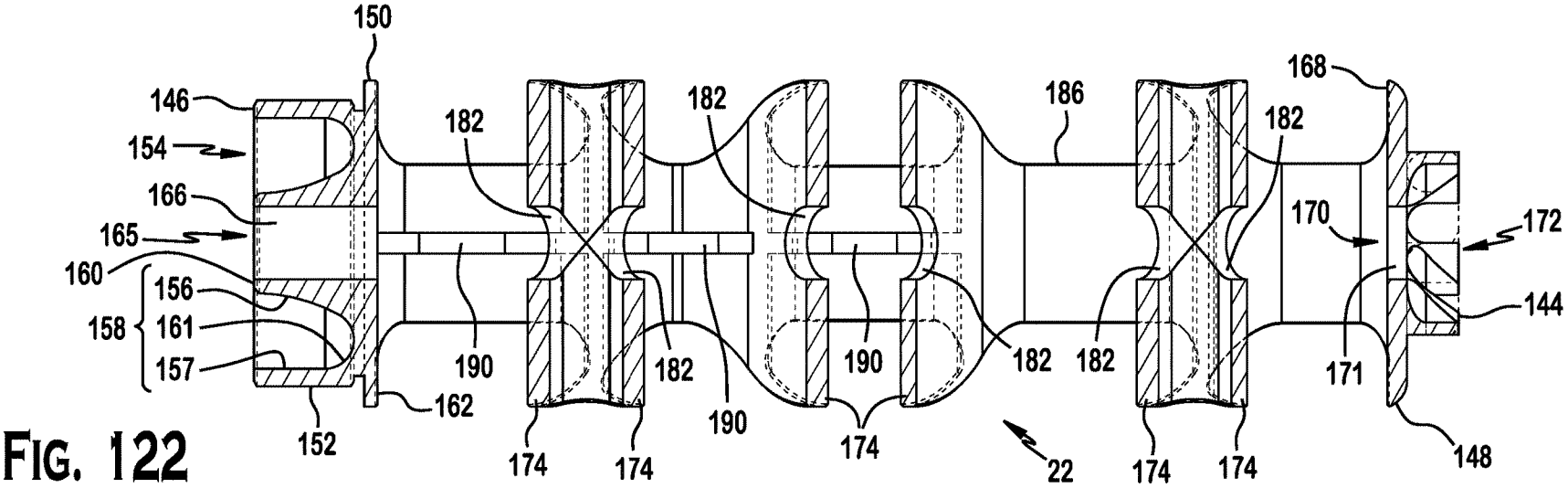
Figure 123:
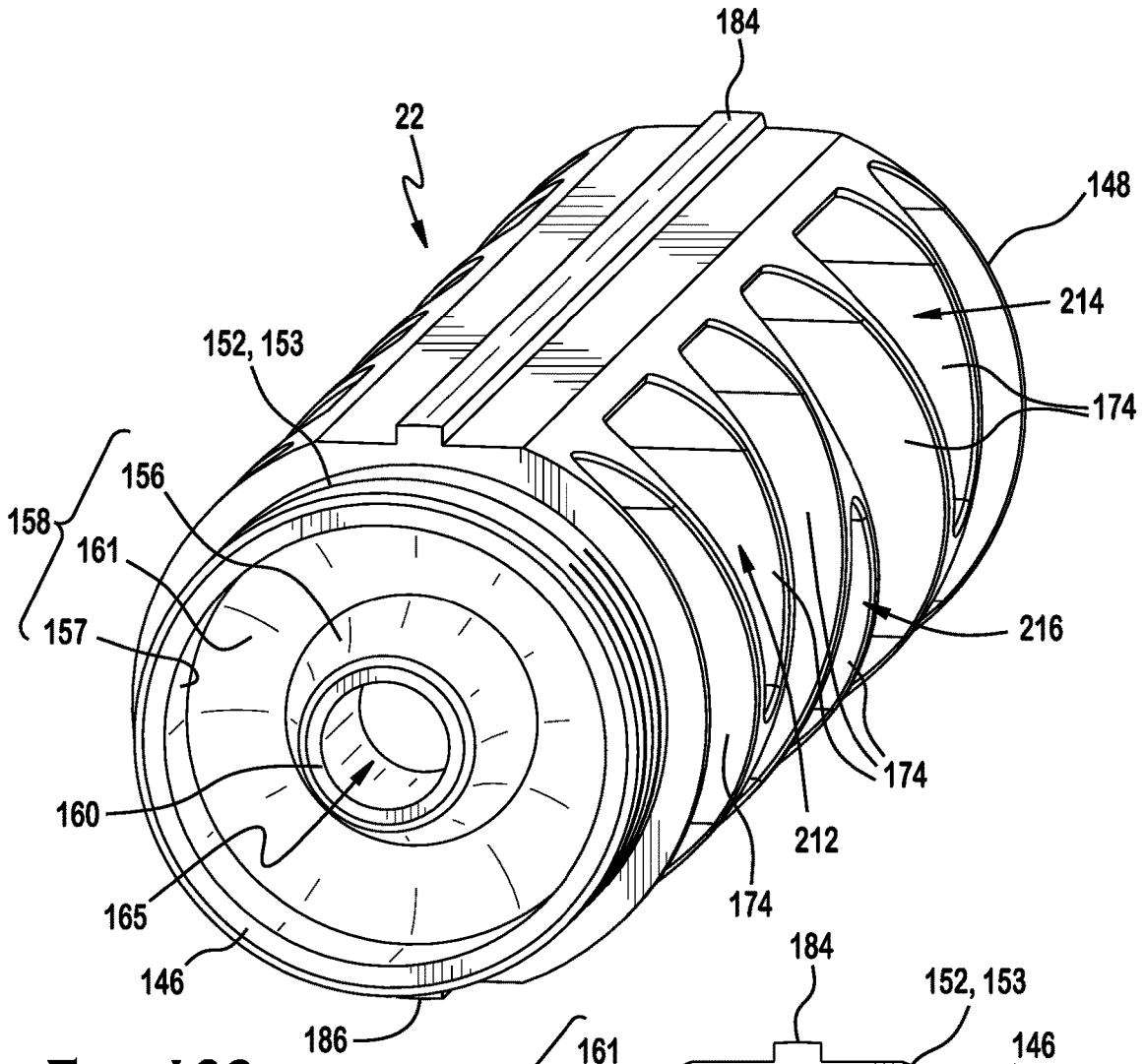
Figure 124:
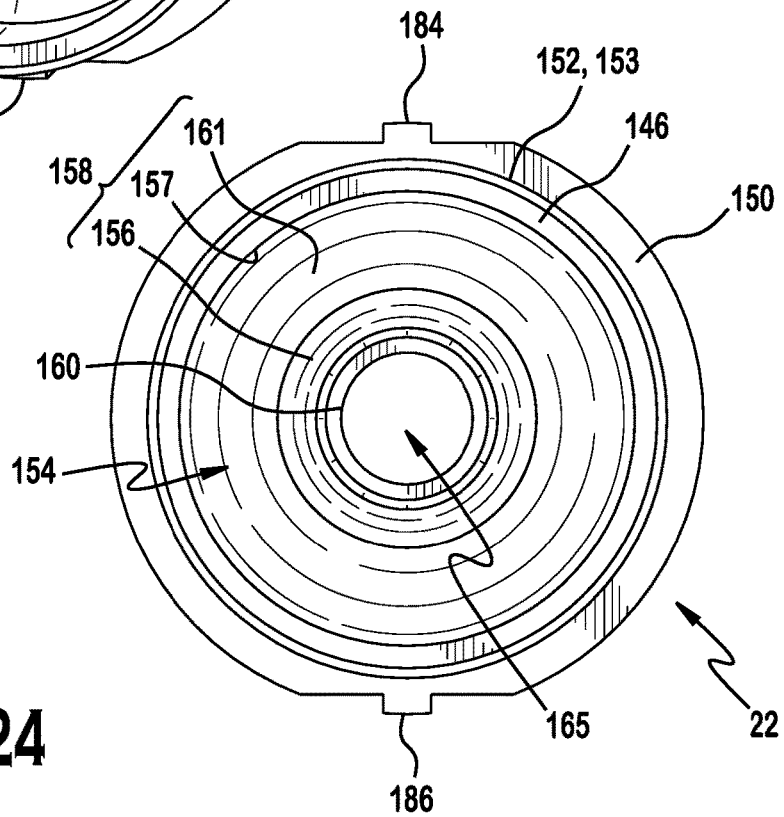
Figure 125:
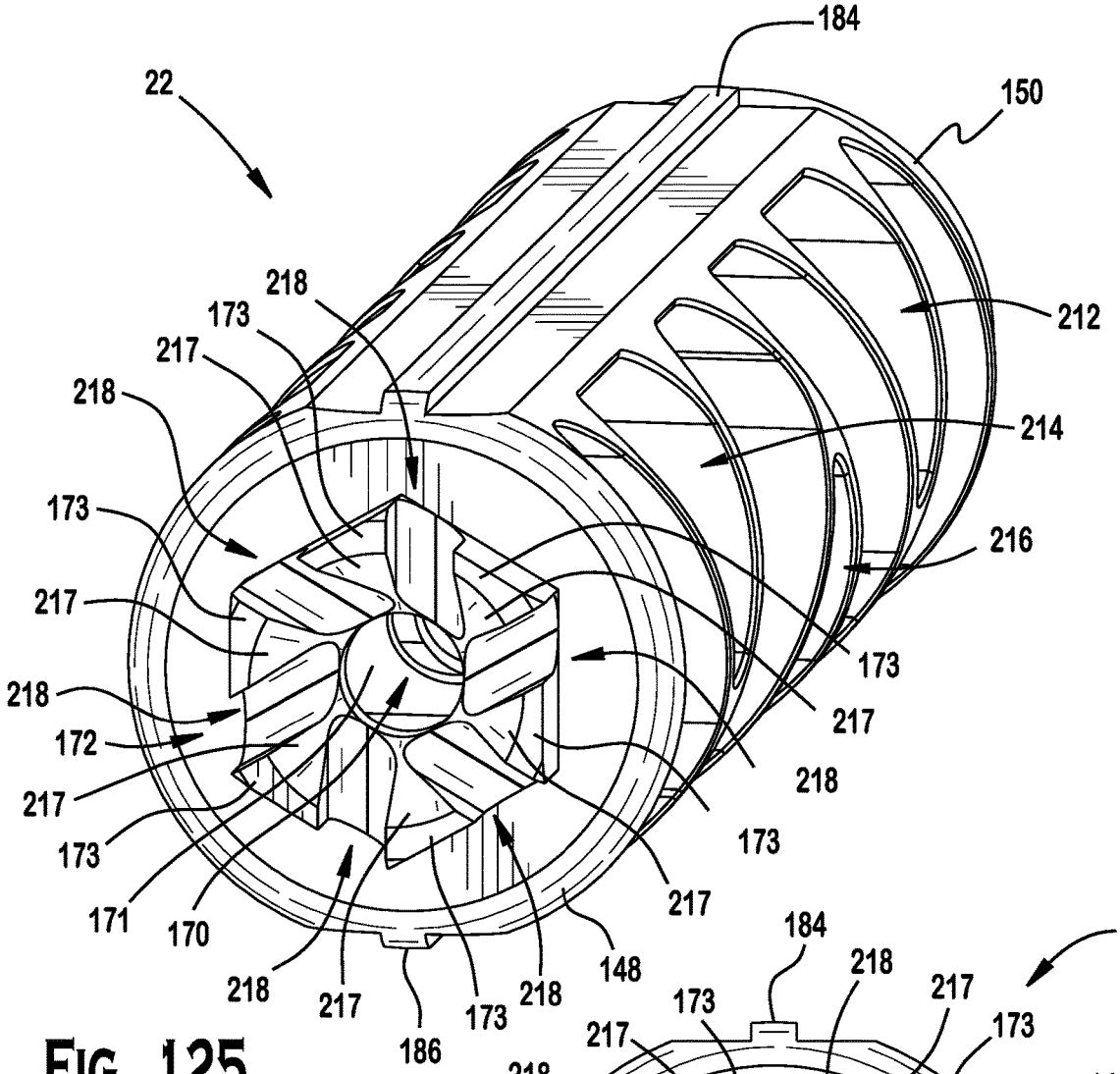

Referring to FIG. 123 the control surface 158 may include a concave curve. The concave curve may be a compound curve. Referring to FIG. 121, a first segment of the concave curve may possess a first radius R3. A second segment of the concave curve may possess a second radius R4. Preferably, the first radius R3 and the second radius R4 may be substantially equal to 0.853 inches and 0.138 inches, respectively. In this context, the compound curve portion may exhibit a first curve ratio (FCR). More particularly, the second curve ratio may be defined as the second radius R4 divided by the first radius R of the concave curve. Accordingly, the first curve ratio (FCR) of the compound curve portion of the control surface 158 may be approximately 0.16 (R2/R1).

Figure 118:
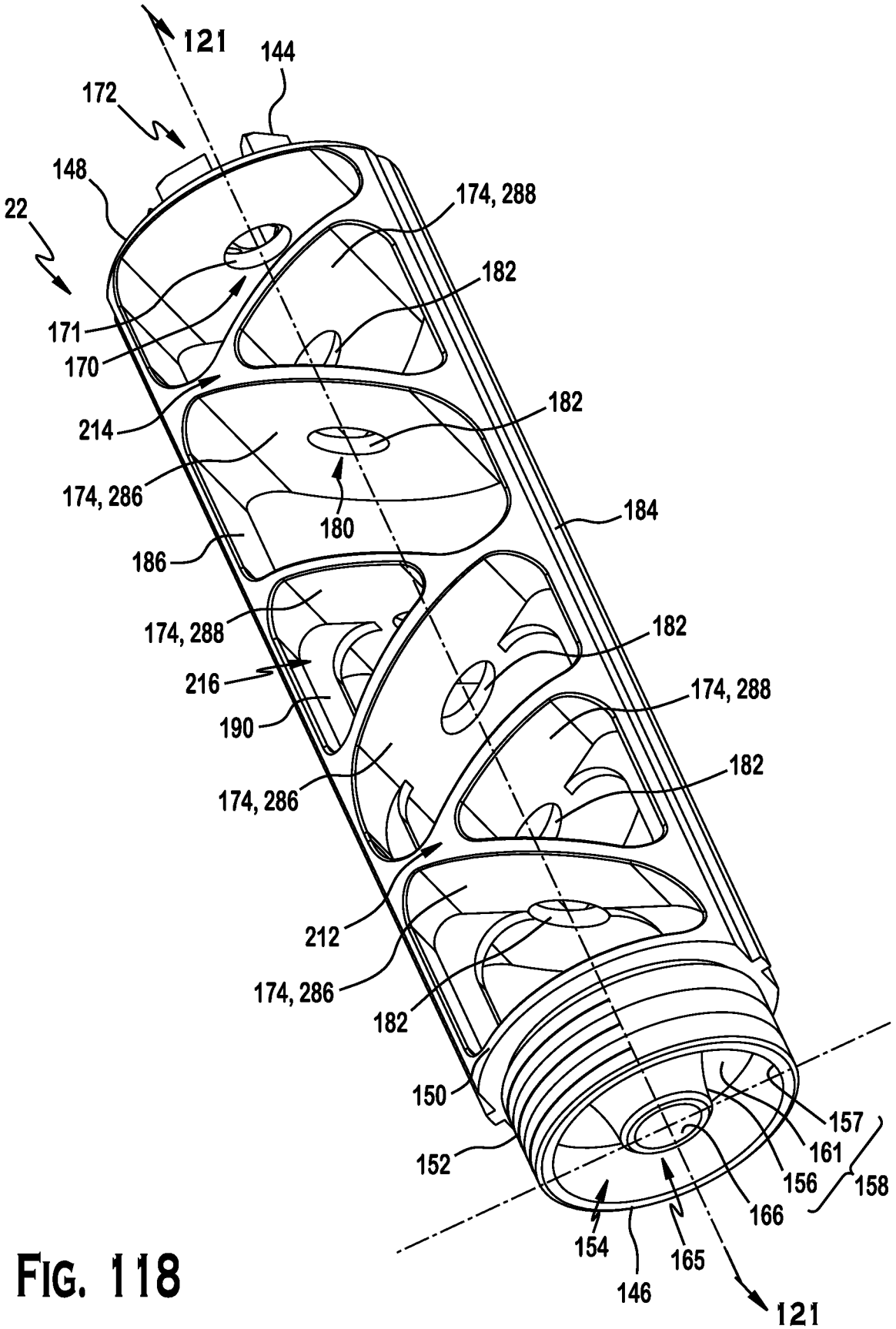
FIG. 118 is a perspective view of the core of FIG. 107.
Figure 119:
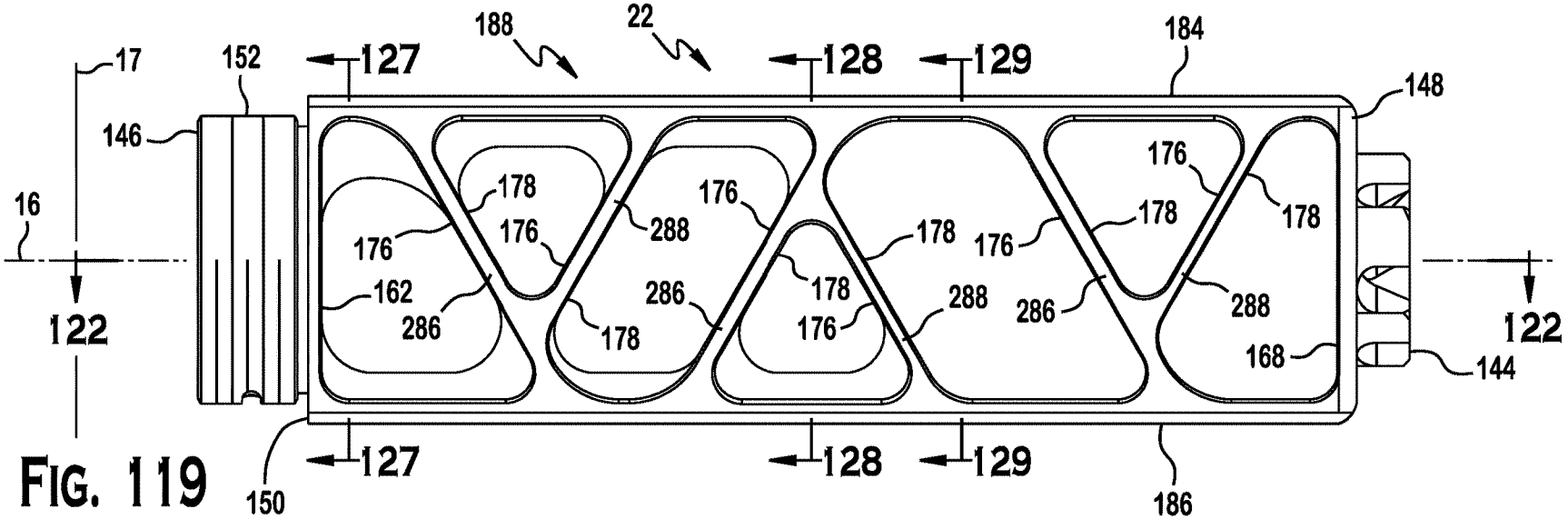
Figure 120:
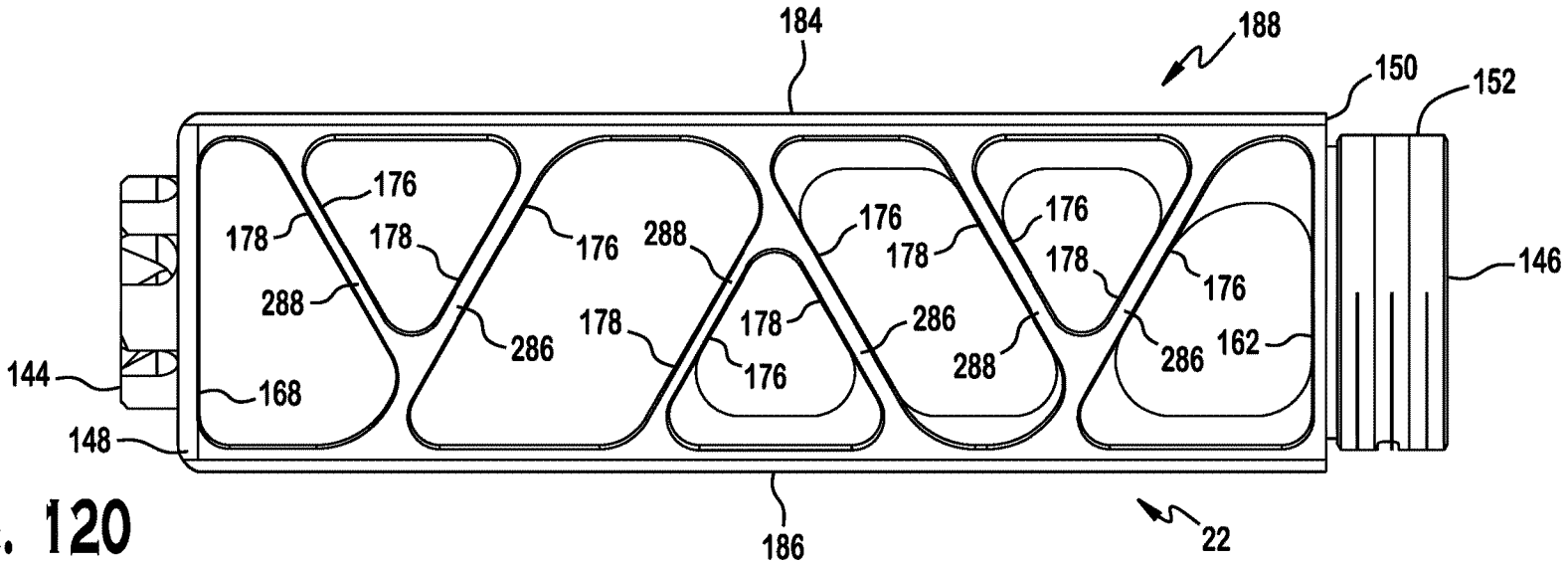

The core further may include a distal end wall 148 spaced from the proximal end wall 150 along a longitudinal axis 16. Referring to FIGS. 119, 120, 123 and 125, a superior longitudinal member 184 may extend from the proximal end wall 150 to the distal end wall 148. Also, an inferior longitudinal member 186 may extend from the proximal end wall 150 to the distal end wall 148. The superior longitudinal member 184 may be disposed opposite to the inferior longitudinal member 186. For example, the inferior longitudinal member 186 may be spaced from the superior longitudinal member 184 along a vertical axis 17. As shown in FIGS. 118, 119 and 120, the distal end wall 148, proximal end wall 150, superior longitudinal member 184, and inferior longitudinal member 146 may define a frame 188. The frame further may include a plurality of transverse plates 286 which extend between the superior longitudinal member 184 and the inferior longitudinal member 186. Each of the plurality of transverse plates 286 further may include a leading surface 176 and a trailing surface 178, along with an aperture 180 extending from the leading surface to the trailing surface. The aperture 180 may include a sidewall 182. See e.g., FIGS. 127, 128 and 129.

The frame 188 further may include a plurality of partial transverse plates 288 which extend from either the superior longitudinal member or the inferior longitudinal member to a transverse plate 286. Each partial transverse plate 288 may also include a leading surface and a trailing surface, along with an aperture 180 extending from the leading surface 176 to the trailing surface 178. Although each transverse plate 286 or partial transverse plate 288 may form a baffle 174, other baffle structures may be used.

Further, the proximal interior end wall 162, the distal interior end wall 168, the superior longitudinal member 184, the inferior longitudinal member 186, the transverse plates 286, and the partial transverse plates 288 may form a plurality of partition configurations within the frame. Each of the plurality of partition configurations may define a cell which in combination with the interior side wall of the tube 124 may form a chamber inside the suppressor. For instance, referring to FIGS. 130 and 132, the core and tube may cooperate to form seven chambers 50, 52, 54, 56, 58, 60 and 62. Moreover, chamber 49 which may be formed by the core and the mount body may be referred to as a blast or entrance chamber. Also, the chamber 62 formed, in part, by the distal interior end wall 168 may be referred to as an exit chamber. The other chambers 50, 52, 54, 56, 58, and 60 located between the entrance chamber 50 and the exit chamber may be referred to individually as an ordinally numbered chamber and collectively as intermediate chambers or pressure modulation chambers.

Each chamber may enclose a fraction of the total internal volume of the suppressor. Table 1 (above) presents illustrative chamber volume values for the exemplary suppressor 400 of FIG. 105.

Referring to FIGS. 119-121, the frame may include one (or more) triangularly shaped partition(s) formed by one of the superior longitudinal member 184 or the inferior longitudinal member 186, a transverse plate 286, and a partial transverse plate 288. The triangularly shaped partition may resemble an equilateral triangle. For instance, in this embodiment the frame 188 may include three partitions which form or resemble an equilateral triangle 212, 214, 216. The configuration of the core 21, including three partitions resembling an equilateral triangle may provide enhanced structural properties to the suppressor 400. Moreover, referring to FIGS. 159, 127, 128, the superior longitudinal member 184 and the inferior longitudinal member may each include a cross-section 192, 200 perpendicular to the longitudinal axis of the core. The cross-section may include: an exterior rib portion 198, 206; a beam portion 194, 206; and a flanged portion 196, 204. Accordingly, the frame 188 may include one or more ribs 190 that may provide structural reinforcement.

Figure 126:
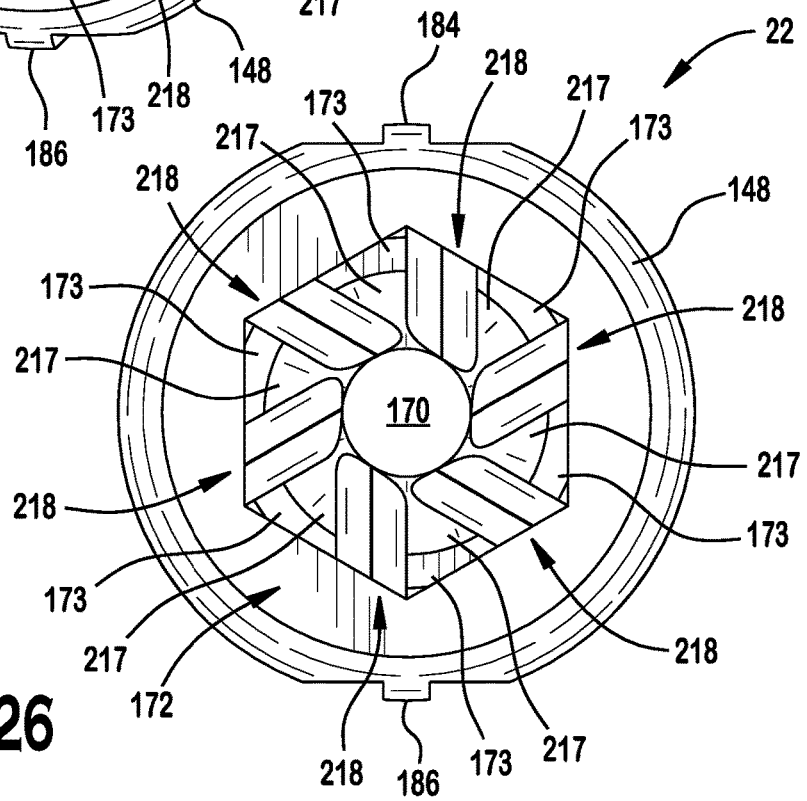
Figure 127:
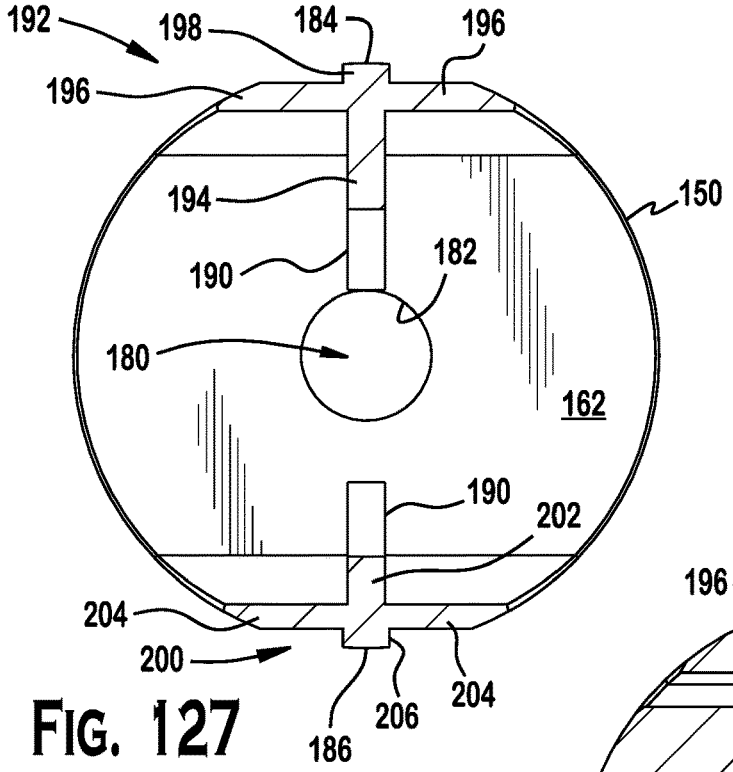
Figure 128:
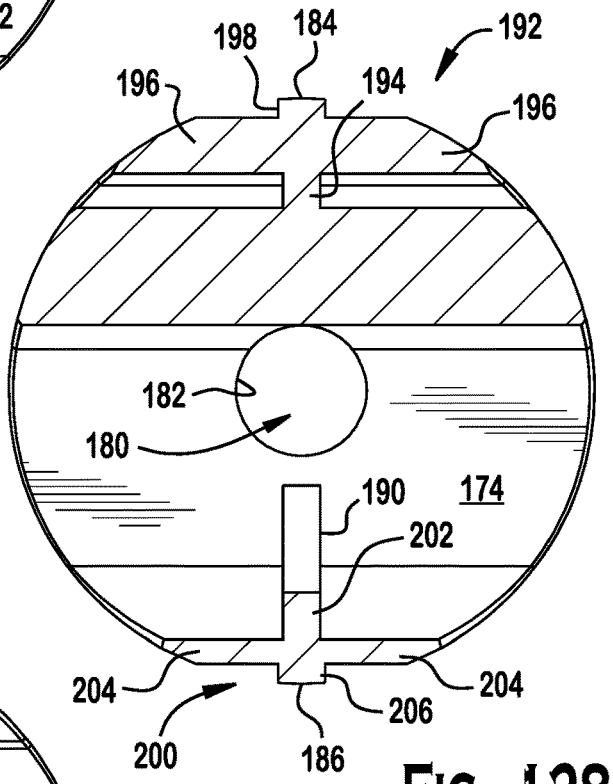
Figure 129:
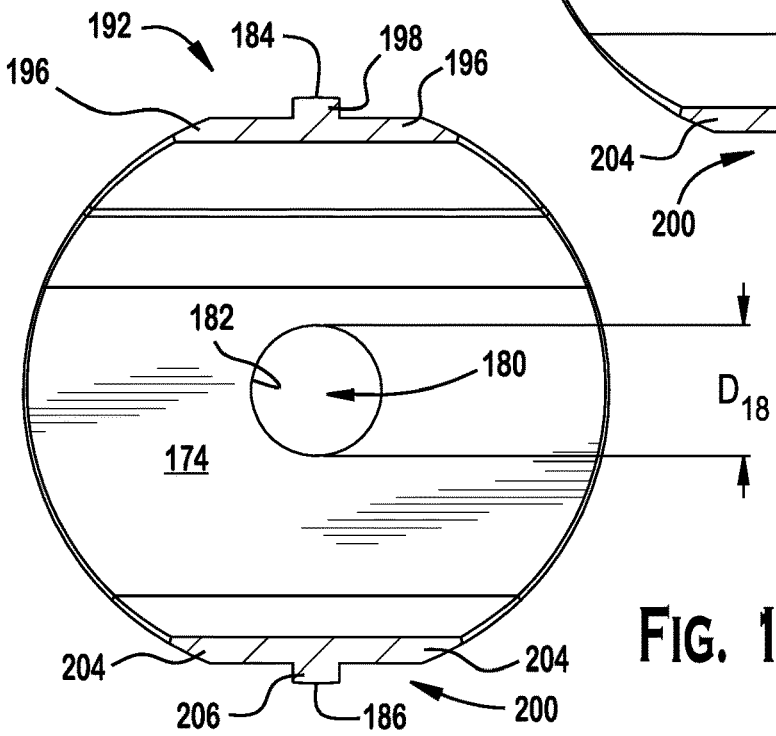

Referring to FIGS. 130 and 131, the tube 21 may include a distal opening 112. The distal opening of the tube may be configured and dimensioned to house the distal end 144 of the core. More particularly, the distal end 144 of the core may include an exterior vent 172. Referring to FIGS. 20, 21 and 126, the vent 172 may include a plurality of facets 173. The facets 173 may project into the distal opening 112. The facets 173 may surround the discharge port 170 of the core and may be shaped to direct ammunition discharge gases away from the suppressor. For example, each facet 173 may include a curved surface 217 which may direct exiting discharge gases forward and radially outward. Collectively, the curved surfaces of the facets 173 may define a set of outwardly facing concave surfaces. The set of concave surfaces may define semi-hemispherical shape 217. Additionally, the exterior vent 172 may include a plurality of troughs 218. Generally, the plurality of troughs may direct discharge gases radially.

Referring to FIGS. 20, 21, 126, 130 and 131, preferably a longitudinal gap 40 may exist between the distal end wall 148 of the core and the distal interior end wall 128 of the tube. The longitudinal gap 40 may have a length L6. For example, the length L6 of the longitudinal gap 40 may range from approximately 0.005 inches to approximately 0.015 inches. Similarly, a radial gap 42 may exist between the distal tool fitting 120 at the distal end of the tube 108 and the exterior vent 172 near the distal end 144 of the core. The radial gap 42 may have a length L7. For example, the length L7 of the radial gap 42 may range from approximately 0.03 inches to approximately 0.05 inches. Additionally, the radial gap between the core and the tube may be approximately 0.0075 inches. Illustrative dimensions for the exemplary suppressor of FIG. 105 are presented in Table 7 and Table 8 (below).

The longitudinal gap 40 and the radial gap 42 may be reduced or eliminated during use of the suppressor due to thermal expansion of the suppressor components (e.g., mount body assembly, core, and tube). Thermal expansion of suppressor components may result in the distal end of the core being compressed between the mount body and the tube. Accordingly, the suppressor may be post-tensioned by compressive forces acting on the core and by tensile forces acting on the tube. The suppressor, therefore, may form a post-stressed assembly that enhances structural properties or operational performance of the suppressor. For example, the post-tensioned assembly may deflect less under dynamic loads or allow for a reduction in the material requirements for the tube or core, resulting in a lighter suppressor.

The proximal side wall 152 of the core may be advanced into the inner side wall 88 of the mount body assembly 405, until the proximal end 106 of the tube is seated on the distal face 82 of the flange 80. Generally, the mount body assembly 405, core 22 and tube 21 may be formed from a lightweight alloy (e.g., 7075-T6 Aluminum), which further may include a Type III hardcoat anodizing finish.

Generally, the suppressor 400 may be configured for rifle caliber ammunition including—without limitation—7.62 mm and 6.5 mm caliber ammunition, as well as larger magnum cartridges. Accordingly, the suppressor 400 may be hosted on barrels chambered for rifle caliber ammunition, including barrels of bolt action rifles. The suppressor 400 may weigh approximately 10.8 ounces, may include an outer diameter of approximately 1.75 inches, and may have an overall length of approximately 7.9 inches. The suppressor may add approximately 7.25 inches of length to the muzzle of the hosted gun or firearm. As described above, the barrel receiving bore of the suppressor may include a direct thread mount. For example, the barrel receiving bore for a barrel chambered in 7.62 mm or 6.5 mm caliber ammunition may include a ⅝-24 thread mount. As described above, the suppressor components may include a Cerkote finish.

Generally, the suppressor 400 may be hosted on a barrel having a barrel length of approximately 16 inches or greater. During use the suppressor 400 may provide a reduction of sound signature and recoil, as well as decreasing the flash signature of the hosted weapon. For example, the suppressor 400 may achieve a peak sound level measurement of 131.9 dB—measured at the shooter's left ear—for an 18" bolt action rifle in accordance with MIL-STD-1474D (12 Feb. 1997). Operational data for the suppressor 400 of FIG. 105 are presented in Table 4 (below).

TABLE 4

Suppressor 400: Measured Peak Sound Levels

| Caliber | Rating | Reduction |
|---|---|---|
| 308 WIN | 16" .308 CROF | 136.2 dB |
| 6.5 CM | 16" 6.5 CM CROF | 134.7 dB |

Notes:
(a) All sound measurements performed in accordance with MIL-STD 1474-D.
(b) Reduction measurements taken from the Shooter's Left Ear measurement location.
(c) Sound reduction measurements were performed with a Larson and Davis LXT sound meter that was within its certification and that was calibrated before every use, in C weighting.
(e) .308 and 6.5 suppressors are measured with 18" barrel weapon systems and M80 ball and Hornady 140 gr ELD Match respectively.
(f) CROF (Controlled rate of fire): 1 round per second for 20 rounds, let cool to ambient temperature.

Accordingly, the suppressor may achieve a measured peak sound level measurement less than 136.62 dB at the shooter's left ear with a C-weighting on the meter. The measurement of the peak sound level being conducted in accordance with MIL-STD-1474D (12 Feb. 1997).

FIGS. 133 and 134 show another exemplary embodiment of a suppressor 500. The suppressor 500 may include a proximal end 12 and a distal end 14, as well as a longitudinal axis 16 extending from the proximal end to the distal end. Further, a lateral axis 18 may be disposed perpendicular to the longitudinal axis, and a vertical axis 17 may be disposed perpendicular to the longitudinal axis and the vertical axis. The suppressor 500 further may include a core 506 arranged in the tube 504. At the proximal end of the suppressor 500 the mount body 502 may include a barrel receiving bore 508, and at the distal end of the suppressor 500 the core may include a discharge port 510.

Referring to FIGS. 135, 162, 163, 164 and 165, the mount body 502 and the tube 504 may cooperate to form a housing for internal baffles 570, 174 that may be configured and dimensioned to dissipate kinetic energy and reduce blast intensity of firearm discharge gases. Preferably, a plurality of the baffles may be formed as a unitary structure or core 506. For instance, a core 506 may be telescopically received within the tube 504 and arranged next to the mount body 502. Although, the core 506 may be a unitary structure, the core may be formed from multiple parts or combined with other parts, including M-baffles, K-baffles, or other baffle types.

Referring to FIGS. 136, 137, 138, 139, 140, 141 and 142, the mount body 502 may include an intermediate body 512 and a collar 514 disposed between the intermediate body 512 and the proximal end 518. The collar 514 may include a plurality of facets 516. The proximal end 518 of the mount body 502 further may include a proximal opening 530. The mount body 502 further may include a tubular stem 526 between the intermediate body 512 and the distal end 520. Referring to FIGS. 141 and 142, the intermediate body 512 also may include a circumferential ledge (or seat) 522. The tubular stem 526 may extend from the distal end 520 to the circumferential ledge 522. The tubular stem 526 further may include an exterior side wall 528, as well as a circumferential groove 524 adjacent to the circumferential ledge 522. The exterior side wall 528 may include a screw thread. Accordingly, the circumferential groove 524 may be a thread relief for the screw thread on the exterior side wall 528.

Referring to FIG. 142, the mount body 502 may include an interior sidewall 534 extending from the proximal opening 530 to the distal opening 532. The interior sidewall 534 may include a proximal linear segment 536 adjacent to the proximal end 518 and a complex curve portion extending from the distal end 520 to the proximal linear segment 536. The complex curve portion may include a tail segment 540 adjacent the distal end 520, a concave segment 536 adjacent to the proximal linear segment 536, and convex segment 538 between the tail segment 540 and the concave segment 536. The proximal linear segment 536 may be configured and dimensioned to receive the muzzle of a threaded barrel, and thus the proximal linear segment may include a screw thread. A circumferential recess 544 may be disposed between the proximal linear segment 536 and the proximal end 518 of the mount body 502. The circumferential recess 544 may be a thread relief for the screw thread on the proximal linear segment 536.

Preferably, the compound curve portion of the interior sidewall 534 may include a concave segment 536 having a first radius R5. The concave segment 536 may be concave with respect to the longitudinal axis 16 of the mount body. Also, the complex curve portion may include a convex segment 538 next to the concave segment 536. The convex segment 538 may be convex with respect to the longitudinal axis 16 of the mount body. The convex segment may have a radius R6. Additionally, the interior sidewall 534 may include a first inflection point 541 between the proximal linear segment 535 and the concave segment 536. The first inflection point 541 may be spaced a first inflection point distance L1 from the distal end 520. Also, the interior sidewall 534 may include a second inflection point 543 between the concave segment 536 and the convex segment 538. The second inflection point 543 may be spaced a second inflection point distance L2 from the distal end 520.

For example, the first radius R5, the second radius R6, the first inflection point distance L1, and the second inflection point distance L2 may be substantially equal to 0.500 inches, 0.400 inches, 0.572 inches, and 0.310 inches, respectively. In this context, the compound curve portion may exhibit a curve ratio (CR). More particularly, the curve ratio may be defined as the radius of the trailing curve divided by the radius of the leading curve. In FIG. 142, the leading curve may be the concave segment 536 having a first radius R5 and the trailing curve may be the convex segment 538 having a radius R6. Accordingly, the curve ratio of the compound curve portion of the interior sidewall 534 may be approximately 0.80 (R6/R5).

Referring to FIGS. 143, 144 and 146, the tube 504 may include a proximal end 546 and a distal end 548. The tube 504 further may include an outer side wall 560 that extends from the proximal end 546 to the distal end 548. Referring to FIGS. 145 and 146, the tube 504 further may include an interior sidewall 561. The interior sidewall 561 may include a proximal segment 562, a distal segment 566, and an intermediate segment 564.

Referring to FIGS. 147, 148, 149, 150, 151, 152, 153, 154, 157 and 158, the core 506 may include a distal end 578 and a proximal end 574, as well as a distal end cap 574 and a proximal end wall 569. An exterior side wall 573 may extend from the distal end of the distal end cap 574 to a proximal end wall 584 of the distal end cap 574. The core 504 further may include a circumferential side wall 576 adjacent to the proximal end wall 584. The circumferential side wall 576 may include a screw thread. The circumferential side wall 576 and the screw thread thereon may be configured and dimensioned to mate with a screw thread on the distal segment 566 of the interior sidewall 561 of the tube 504. The distal end cap 574 further may include a discharge port 170 extending from the proximal side 168 of the distal end cap 574 to the distal side 580 of the distal end cap 574. The distal side 580 of the distal end cap 574 further may include a fitting for a tool. For example, the fitting may be hexagonal in shape. See FIGS. 157 and 158.

Referring to FIGS. 149, 150, 151, 152, 153, 155 and 156, the core 506 further may include a proximal end wall 584 spaced from the proximal side 168 of the distal end cap 574 along a longitudinal axis 16. A superior longitudinal member 184 may extend from the proximal end wall 584 of the distal cap 574 to the proximal side 571 of the proximal end wall 569. Also, an inferior longitudinal member 186 may extend from the proximal end wall 584 of the distal cap 574 to the proximal side 571 of the proximal end wall 569. The superior longitudinal member 184 may be disposed opposite to the inferior longitudinal member 186. For example, the inferior longitudinal member 186 may be spaced from the superior longitudinal member 184 along a vertical axis 17. The proximal end wall 584 of the distal cap 574, the proximal side 571 of the proximal end wall 569, the superior longitudinal member 184, and inferior longitudinal member 186 may define a frame 188. The frame further may include a plurality of transverse plates 286 which extend between the superior longitudinal member 184 and the inferior longitudinal member 186. Each of the plurality of transverse plates 286 further may include a leading surface 176 and a trailing surface 178, along with an aperture 180 extending from the leading surface to the trailing surface. The aperture 180 may include a sidewall 182. See e.g., FIGS. 159, 160 and 161.

The frame 188 further may include a plurality of partial transverse plates 288 which extend from one of the superior longitudinal member or the inferior longitudinal member to a transverse plate 286. Each partial transverse plate 288 may also include a leading surface and a trailing surface, along with an aperture 180 extending from the leading surface 176 to the trailing surface 178. Although each transverse plate 286 or partial transverse plate 288 may form a baffle 174, other baffle structures may be used.

Further, the proximal end wall 584 of the distal cap 574, the proximal side 571 of the proximal end wall 569, the superior longitudinal member 184, the inferior longitudinal member 186, the transverse plates 286, and the partial transverse plates 288 may form a plurality of partition configurations within the frame. Each of the plurality of partition configurations may define a cell which in combination with the interior side wall 561 of the tube 504 may form a chamber inside the suppressor. For instance, referring to FIGS. 162, 163, 164 and 165, the core 506 and the tube 504 may cooperate to form seven chambers 50, 52, 54, 56, 58, 60 and 62. Moreover, another chamber 49 may be formed by the proximal side 570 of the proximal end wall 569 of the core and the compound curve portion of the interior sidewall 534 of the mount body. This chamber 49 may be referred to as a blast or entrance chamber. Also, the chamber 62 formed, in part, by the proximal side 571 of the proximal end wall 569, may be referred to as an exit chamber. The other chambers 50, 52, 54, 56, 58, and 60 located between the entrance chamber 50 and the exit chamber may be referred to individually as an ordinally numbered chamber and collectively as intermediate chambers or pressure modulation chambers.

Each chamber may enclose a fraction of the total internal volume of the suppressor. Table 5 (below) presents illustrative chamber volume values for the exemplary suppressor 500 of FIG. 133.

TABLE 5

Suppressor 500: Chamber Volumes

| Chamber (Reference Element No.) | Volume (Cubic inches) | Fraction |
|---|---|---|
| Blast chamber (49) | 0.177 | 0.08 |
| First chamber (50) | 0.267 | 0.12 |
| Second chamber (52) | 0.131 | 0.06 |
| Third chamber (54) | 0.411 | 0.18 |
| Fourth chamber (56) | 0.135 | 0.06 |
| Fifth chamber (58) | 0.454 | 0.20 |
| Sixth chamber (60) | 0.135 | 0.06 |
| Seventh chamber (586) | 0.477 | 0.21 |
| Exit chamber (62) | 0.101 | 0.04 |
| All (49-62) | 2.288 | 1.00 |

Referring to FIGS. 162, 163, 164 and 165, the frame may include one (or more) triangularly shaped partition(s) formed by one of the superior longitudinal member 184 or the inferior longitudinal member 186, a transverse plate 286, and a partial transverse plate 288. The triangularly shaped partition may resemble an equilateral triangle. For instance, in this embodiment the frame 188 may include three partitions which form or resemble an equilateral triangle 212, 214, 216. The configuration of the core 21, including three partitions resembling an equilateral triangle may provide enhanced structural properties to the suppressor 500. Moreover, referring to FIGS. 159 and 160, the superior longitudinal member 184 and the inferior longitudinal member 186 may each include a cross-section 192, 200 perpendicular to the longitudinal axis of the core. The cross-section may include: an exterior rib portion 198, 206 and a flanged portion 196, 204, as well as one or more ribs 190 which may provide structural reinforcement.

Referring to FIGS. 162, 163 and 164, the proximal end cap 568 of the core may be telescopically received in the distal end 548 of the tube 504. The core may be advanced along the distal segment 566 of the inner surface 561 of the tube, until the proximal end wall 584 of the distal end cap 574 is seated on the distal end of the tube 548.

Illustrative dimensions for the exemplary suppressor of FIG. 133 are presented in Table 7 and Table 8 (below). Also, the volume of the suppressor 500 V (as calculated between the proximal end and the distal end), and the volume of solid parts of the suppressor 500 Vs (as calculated from the solid parts of the tube, core and mount body) may be approximately 4.5 cubic inches and approximately 1.9 cubic inches, respectively. Generally, the void ratio VR for a suppressor may be equal to the volume of the void space divided by the total volume [VR=((V−Vs)/V)]. In this embodiment, the void ratio VR of the suppressor 500 may be approximately 0.58.

Generally, the mount body 502, core 506 and tube 504 may be formed from a lightweight alloy (e.g., Grade 5 6Al-4V Titanium or 7075-T6 Aluminum), and further may include a high temperature heat resistant coating, including without limitation diffusional coatings, overlay coatings, or thermal barrier coatings (TBC). For instance, the mount body 502, core 506, and tube 504 may be formed from one material composition (e.g., 7075-T6 Aluminum). The mount body 502 and tube 504 further may receive a Type III hardcoat anodizing finish. Alternatively, the mount body 502 may be formed from Grade 5 Titanium and coated with DLC, and the tube 504 and core 506 may be formed from one material composition (e.g., 7075-T6 Aluminum) and receive a Type III hardcoat anodizing finish.

Generally, the suppressor 500 may be configured for .22LR, .22MAG, and .17HMR caliber ammunition. Accordingly, the suppressor 500 may be hosted on barrels chambered for .22LR caliber ammunition, including on barrels of rifles and pistols. The suppressor 500 may weigh approximately 3.5 ounces, may include an outer diameter of approximately 1.0 inch, and may have an overall length of approximately 5.9 inches. The suppressor may add approximately 5.4 inches of length to the muzzle of the hosted firearm. As described above, the barrel receiving bore of the suppressor may include a direct thread mount. For example, the barrel receiving bore may include a ½-28 thread mount. Additionally, the suppressor components may have a Cerkote finish.

Generally, the suppressor 500 may be hosted on a rifle or pistol barrel. During use the suppressor 500 may provide a reduction of sound signature and recoil, as well as decreasing the flash signature of the hosted weapon. For example, the suppressor 500 may achieve a peak sound level measurement of 114 dB—measured at the shooter's left ear—for a Ruger Mark IV pistol with a Gemtech subsonic ammunition or CCI Minimag ammunition in accordance with MIL-STD-1474D (12 Feb. 1997). Operational data for the suppressor 500 of FIG. 133 are presented in Table 6 (below).

TABLE 6

Suppressor 500: Measured Peak Sound Levels

| Caliber | Rating | Reduction |
|---|---|---|
| .22 LR | No restriction .22WMR | 116.2 dB |

Notes:

(a) All sound measurements performed in accordance with MIL-STD 1474-D.

(b) Reduction measurements taken from the Shooter's Left Ear measurement location.

(c) Sound reduction measurements were performed with a Larson and Davis LXT sound meter that was within its certification and that was calibrated before every use, in C weighting.

Accordingly, the suppressor may achieve a measured peak sound level measurement less than 136.62 dB at the shooter's left ear with a C-weighting on the meter. The measurement of the peak sound level being conducted in accordance with MIL-STD-1474D (12 Feb. 1997).

Referring to FIGS. 1, 62, 81, 89, 105, and 133, the cross-section of a barrel receiving opening of the exemplary embodiments of a suppressor disclosed herein may be adapted to receiving the muzzle of a firearm, and thus may have a circular shape. The circular shape may possess a diameter. For instance, the diameter may range from approximately 5/8 inches to approximately 25/32 inches. Moreover, the bore and baffle apertures of the exemplary embodiments of a suppressor disclosed herein may be configured and dimensioned to allow passage of a bullet from a specific ammunition cartridge, including, without limitation, a .22LR, 7.62×39 mm, 5.56 NATO, 300 BLK, .308 WIN, or 6.5 CM ammunition cartridge. For instance, the inner diameter presented by the bore or baffle apertures may have a diameter ranging from approximately 0.02 inches to approximately 0.172 inches greater than the caliber of the bullet. Additionally, the outer dimension of the baffles may be less than the inner diameter of the respective tubes.

Table 7 (below) presents length dimensions for the exemplary embodiments of the suppressors described herein. These values are for provided for illustrative purposes.

TABLE 7

Illustrative Length Dimensions

| Dimension | Description | Length (inches) | FIG. |
|---|---|---|---|
| L1 | Suppressor (10), overall length | 7.8 | 5 |
| L2 | Tube A (21), overall length | 6.29 | 5 |
| L3 | Mount Body (20) - prox. end (12) to distal face of flange (82) | 1.56 | 5 |
| L4 | Notch (37) | 0.070 | 14 |
| L5 | Recess (28) | 0.070 | 15 |
| L6 | Longitudinal Gap (40) | 0.010 | 20 |
| L7 | Radial Gap (42) | 0.04 | 21 |
| L8 | Mount Body (20), overall length | 2.51 | 30 |
| L9 | Tube A (21), prox. end (106) to distal end wall (118) | 6.061 | 37 |
| L10 | Tube A (21), distal end wall (118) to distal end (108) | 0.233 | 37 |
| L11 | Tube A (21), prox. end (106) to distal interior end wall (128) | 5.961 | 37 |
| L12 | Core A (22), overall length | 5.778 | 44 |
| L13 | Core A (22), proximal end (146) to proximal end wall (150) | 0.528 | 44 |
| L14 | Core A (22), proximal end wall (150) to distal end wall (148) | 5.001 | 44 |
| L15 | Mount Body Base (254), overall length | 1.91 | 70 |
| L16 | Modular Mount (256), overall length | 1.22 | 76 |
| L17 | Suppressor (250), overall length | 7.8 | 79 |
| L18 | Mount Body Assembly (252) - prox. end (12) to distal face of flange (82) | 1.565 | 79 |
| L19 | Modular Mount (304), overall length | 1.225 | 86 |
| L20 | Suppressor (300), overall length | 7.858 | 87 |
| L21 | Mount Body Assembly (302) - prox. end (12) to distal face of flange (82) | 1.565 | 87 |
| L22 | Modular Mount (314), overall length | 2.33 | 102 |
| L23 | Closure (324), overall length | 1.414 | 102 |
| L24 | Suppressor (310), overall length | 8.9 | 93 |
| L25 | Mount Body Assembly (312) - prox. end (12) to distal face of flange (82) | 2.615 | 93 |
| L26 | Mounting Ring (404), overall length | 0.650 | 115 |
| L27 | Core B (22), overall length | 5.778 | 121 |
| L28 | Core B (22), proximal end (146) to proximal end wall (150) | 0.528 | 121 |
| L29 | Core B (22), proximal end wall (150) to distal end wall (148) | 5.001 | 121 |
| L30 | Suppressor (400), overall length | 7.8 | 130 |
| L31 | Mount Body Assembly (405) - prox. end (12) to distal face of flange (82) | 1.590 | 130 |
| L32 | Mount Body (502), overall length | 1.172 | 142 |
| L33 | Mount Body (502), distal end (520) to 1st inflection pt. (541) | 0.572 | 142 |
| L34 | Mount Body (502), distal end (520) to 2d inflection pt. (541) | 0.310 | 142 |
| L35 | Tube B (504), overall length | 4.900 | 146 |
| L36 | Core C (505), overall length | 4.725 | 153 |
| L37 | Core C (506), distal end (578) to proximal wall (584) of distal end cap (574) | 0.250 | 153 |
| L38 | Suppressor (500), overall length | 5.9 | 162 |
| L39 | Mount Body (502) - prox. end (12) to distal face of flange (522) | 0.772 | 162 |

Table 8 presents diameter dimensions for the exemplary embodiments of the suppressors described herein. These values are provided illustrative purposes.

TABLE 8

Illustrative Diameter Dimensions

| Dimension | Description | Diameter (inches) | FIG. |
|---|---|---|---|
| D1 | Outer diameter of coil spring, (24) | 0.047 | 16 |
| D2 | Mount Body (20), outer diameter of annular stem (72) | 1.625 | 30 |
| D3 | Mount Body (20), inner diameter of core mounting receptacle (90) | 1.321 | 30 |
| D4 | Mount Body (20), outer diameter of flange (80) | 1.810 | 30 |
| D5 | Tube A (21), outer diameter | 1.750 | 37 |
| D6 | Tube A (21), inner diameter | 1.576 | 37 |
| D7 | Tube A (21), distal opening of tube (112) | 1.084 | 37 |
| D8 | Core A (22), inner diameter of blast baffle bore (164) | 0.264 | 44 |
| D9 | Core A (22), outer diameter of proximal sidewall of core (152) | 1.370 | 44 |
| D10 | Core A (22), inner diameter of baffle aperture (180) | 0.264 | 52 |
| D11 | Mount Body Base (254), inner diameter of proximal opening (262) | 1.330 | 70 |
| D12 | Modular Mount A (256), outer diameter of annular plug (272) | 1.370 | 76 |
| D13 | Modular Mount B (304), outer diameter of annular plug (272) | 1.370 | 86 |
| D14 | Modular Mount C (314), outer diameter of annular plug (272) | 1.370 | 102 |
| D15 | Mounting Ring (404), outer diameter of tubular segment (432) | 0.745 | 115 |
| D16 | Core B (22), inner diameter of blast baffle bore (165) | 0.348 | 121 |
| D17 | Core B (22), outer diameter of proximal sidewall of core (152) | 1.370 | 121 |
| D18 | Core B (22), inner diameter of baffle aperture (180) | 0.348 | 129 |
| D19 | Mount Body (502), outer diameter of tubular stem (526) | 0.933 | 142 |
| D20 | Mount Body (502), inner diameter of distal opening (532) | 0.733 | 142 |
| D21 | Tube C (504), outer diameter | 1.000 | 146 |
| D22 | Tube C (504), inner diameter | 0.902 | 146 |
| D23 | Core C (506), outer diameter of distal end cap (574) | 1.000 | 153 |
| D24 | Core C (506), inner diameter of discharge port (170) | 0.257 | 153 |
| D25 | Core C (506), inner diameter of baffle aperture (180) | 0.257 | 160 |

Notes:

(a) Dimensions of features with screw threads are simplified representations where outer diameters are major diameters and inner diameters are minor diameters.

In use, a suppressor may be secured to the barrel of a firearm. During operation of the firearm, an ammunition cartridge may be fired. The discharge gases from the ammunition cartridge may propel the bullet (or projectile) through the bore and out the muzzle of the firearm. The bullet, traveling in a ballistic trajectory, may pass through the suppressor (e.g., the bore, the apertures in the pressure modulation baffles, and the discharge port) before exiting the suppressor, traveling down range, and striking a target. The discharge gases also may enter the suppressor. The expanding discharge gases may enter the blast chamber adjacent to the proximal end wall of the core. The discharge gasses may be directed sequentially through the baffle array and the respective chambers between them. Discharge gases may then exit the suppressor through the discharge port and any other vents which may be in fluid communication with the boreway.

While it has been illustrated and described what at present are considered to be preferred embodiments, it will be understood by those skilled in the art that various changes and modifications may be made, and equivalents may be substituted for elements thereof without departing from the true scope of the present invention, as defined in the appended claims. For instance, a suppressor with a direct thread mount body and core may be modified for use with a barrel that is chambered in a specific ammunition cartridge. Moreover, features and or elements from any disclosed embodiment may be used singly or in combination with other embodiments. Therefore, it is intended that the present invention not be limited to the described embodiments, but that it have the full scope defined by the language of the following claims, and equivalents thereof.

What is claimed is:

1. A suppressor for a firearm, the suppressor including a first longitudinal axis and comprising:

a mount body for receiving a muzzle of a firearm barrel, the mount body comprising a first proximal end, a first distal end spaced from the first proximal end along the first longitudinal axis, a collar adjacent to the first proximal end, an annular stem adjacent to the first distal end, the annular stem comprising a first outer side wall surface, which comprises a first screw thread, and a first interior side wall surface, which comprises a second screw thread;

a core connected to the mount body, the core including a second longitudinal axis and comprising a second proximal end, a frame adjacent the second proximal end, the frame comprising a distal end wall, a proximal end wall spaced from the distal end wall along the second longitudinal axis, and an array of baffles arranged between the proximal end wall and the distal end wall, a proximal side wall disposed between the proximal end wall and the second proximal end, the proximal side wall comprising an exterior surface which comprises a third screw thread, the third screw thread being configured and dimensioned to mate with the second screw thread to secure the core to the mount body; and a M-baffle within the proximal side wall; and a tube disposed over the core and the annular stem, the tube comprising a third proximal end, a third distal end spaced from the third proximal end along the first longitudinal axis, and an interior sidewall extending from the third proximal end to the third distal end, the interior sidewall comprising a fourth screw thread, the fourth screw thread being configured and dimensioned to mate with the first screw thread to secure the tube to the mount body.

2. The suppressor of claim 1, wherein the array of baffles comprises a plurality of triangular partitions.

3. The suppressor of claim 2, wherein three triangular partitions each form an equilateral triangle.

4. The suppressor of claim 1, wherein the M-baffle comprises a compound curve, the compound curve comprising a first curve having a first radius substantially equal to 0.853 inches.

5. The suppressor of claim 4, wherein the compound curve further comprises a second curve having a second radius, the second radius being substantially equal to 0.138 inches.

6. The suppressor of claim 1, wherein the M-baffle comprises a compound curve, the compound curve comprising a first curve and a second curve, the first curve having a first radius and the second curve having a second radius, the ratio of the second radius divided by the first radius being approximately 0.16.

7. The suppressor of claim 1, wherein the M-baffle further comprises a bore, and the bore possesses an internal diameter, the internal diameter being approximately 0.264 inches.

8. The suppressor of claim 1, wherein the first screw thread and the fourth screw thread are right-hand screw threads.

9. The suppressor of claim 8, wherein the second screw thread and the third screw thread are left-hand screw threads.

10. The suppressor of claim 1, wherein the mount body further comprises a first proximal end wall adjacent to the first interior side wall surface, and a barrel receiving bore which comprises a sidewall, the sidewall extending from the first proximal end to the first proximal end wall.

11. The suppressor of claim 10, wherein the sidewall comprises a fifth screw thread, and the fifth screw thread is configured and dimensioned to mate with a muzzle portion of a firearm barrel.

12. The suppressor of claim 11, wherein the barrel receiving bore and the fifth screw thread are configured and dimensioned to mate with a firearm barrel that is chambered in 7.62×39 mm, 5.56 NATO, 300 BLK, .308 WIN, or 6.5 CM ammunition cartridges.

13. The suppressor of claim 1, wherein the mount body further comprises a flange and a circumferential groove adjacent the flange, and the tube further comprises a recess, and the suppressor further comprises a coil of wire, wherein the coil of wire is arranged in the circumferential groove and across the flange, the coil of wire being positioned in the recess to block relative rotation of the mount body and the tube.

14. The suppressor of claim 13, wherein the recess is one of a plurality of recesses.

15. The suppressor of claim 14, wherein the plurality of recesses form an array of circumferential recesses.

16. The suppressor of claim 1, wherein the mount body, core, and tube form a plurality of chambers for sound signature reduction of a host firearm, the suppressor achieving a measured peak sound level measurement of less than 136.62 dB, the peak sound level measurement being conducted in accordance with MIL-STD-1474D.

17. The suppressor of claim 1, wherein the mount body, core and tube define a blast chamber and an exit chamber, the blast chamber including a blast chamber volume and the exit chamber including an exit chamber volume, the ratio of the exit chamber volume divided by the blast chamber volume being approximately 0.48.

18. The suppressor of claim 17, wherein the blast chamber volume is approximately 2.387 cubic inches.

19. The suppressor of claim 1, wherein the composition of the core comprises a high temperature heat resistant alloy.

20. The suppressor of claim 19, wherein the high temperature heat resistant alloy is formed from 17-4 stainless steel.

21. The suppressor of claim 20, wherein the 17-4 stainless steel is heat treated.

22. The suppressor of claim 1, wherein the composition of the tube comprises a high temperature heat resistant alloy.

23. The suppressor of claim 22, wherein the high temperature heat resistant alloy is selected from a group consisting of 17-4 Stainless Steel or Grade 9 6AL-4V Titanium.

24. The suppressor of claim 23, wherein the high temperature heat resistant alloy is coated with Diamond Like Coating (DLC).

25. The suppressor of claim 24, wherein the high temperature heat resistant alloy is 17-4 stainless steel.

26. A firearm apparatus comprising:

a suppressor of claim 1; and a firearm comprising a barrel, the barrel being connected to the suppressor.

27. A suppressor for a firearm, the suppressor including a first longitudinal axis and comprising:

a mount body for receiving a muzzle of a firearm barrel, the mount body comprising a first proximal end, a first distal end spaced from the first proximal end along the first longitudinal axis, a collar adjacent to the first proximal end, an annular stem adjacent to the first distal end, the annular stem comprising a first outer side wall surface, which comprises a first screw thread, and a first interior side wall surface, which comprises a second screw thread;

a core connected to the mount body, the core including a second longitudinal axis and comprising a second proximal end, a frame adjacent the second proximal end, the frame comprising a distal end wall, a proximal end wall spaced from the distal end wall along the second longitudinal axis, and an array of baffles arranged between the proximal end wall and the distal end wall, a proximal side wall disposed between the proximal end wall and the second proximal end, the proximal side wall comprising an exterior surface which comprises a third screw thread, the third screw thread being configured and dimensioned to mate with the second screw thread to secure the core to the mount body, and a M-baffle adjacent the frame, the M-baffle comprising a compound curve, the compound curve comprising a first curve having a first radius substantially equal to 0.853 inches, and a second curve having a second radius, the second radius being substantially equal to 0.138 inches; and a tube disposed over the core and the annular stem, the tube comprising a third proximal end, a third distal end spaced from the third proximal end along the first longitudinal axis, and an interior sidewall extending from the third proximal end to the third distal end, the interior sidewall comprising a fourth screw thread, the fourth screw thread being configured and dimensioned to mate with the first screw thread to secure the tube to the mount body.

28. A suppressor for a firearm, the suppressor including a first longitudinal axis and comprising:

a mount body for receiving a muzzle of a firearm barrel, the mount body comprising a first proximal end, a first distal end spaced from the first proximal end along the first longitudinal axis, a collar adjacent to the first proximal end, an annular stem adjacent to the first distal end, the annular stem comprising a first outer side wall surface, which comprises a first screw thread, and a first interior side wall surface, which comprises a second screw thread;

a core connected to the mount body, the core including a second longitudinal axis and comprising a second proximal end, a frame adjacent the second proximal end, the frame comprising a distal end wall, a proximal end wall spaced from the distal end wall along the second longitudinal axis, and an array of baffles arranged between the proximal end wall and the distal end wall, a proximal side wall disposed between the proximal end wall and the second proximal end, the proximal side wall comprising an exterior surface which comprises a third screw thread, the third screw thread being configured and dimensioned to mate with the second screw thread to secure the core to the mount body, and a M-baffle adjacent the frame, the M-baffle comprising a compound curve, the compound curve comprising a first curve and a second curve, the first curve having a first radius and the second curve having a second radius, the ratio of the second radius divided by the first radius being approximately 0.16; and a tube disposed over the core and the annular stem, the tube comprising a third proximal end, a third distal end spaced from the third proximal end along the first longitudinal axis, and an interior sidewall extending from the third proximal end to the third distal end, the interior sidewall comprising a fourth screw thread, the fourth screw thread being configured and dimensioned to mate with the first screw thread to secure the tube to the mount body.

29. The suppressor of claim 28, wherein the M-baffle further comprises a bore, and the bore possesses an internal diameter, the internal diameter being approximately 0.264 inches.

* * * * *